US007714882B2

(12) United States Patent
Inaba et al.

(10) Patent No.: US 7,714,882 B2
(45) Date of Patent: May 11, 2010

(54) IMAGE FORMING APPARATUS AND IMAGE FORMING PROCESS

(75) Inventors: Yoshinori Inaba, Numazu (JP); Tatsuya Niimi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 376 days.

(21) Appl. No.: 11/855,553

(22) Filed: Sep. 14, 2007

(65) Prior Publication Data

US 2008/0069588 A1 Mar. 20, 2008

(30) Foreign Application Priority Data

Sep. 15, 2006 (JP) ..... 2006-250503
Sep. 15, 2006 (JP) ..... 2006-250648
Jul. 10, 2007 (JP) ..... 2007-181536
Jul. 10, 2007 (JP) ..... 2007-181538

(51) Int. Cl.
*B41J 2/45* (2006.01)
*G03G 5/05* (2006.01)
*G03G 5/07* (2006.01)

(52) U.S. Cl. ..... 347/129; 347/233

(58) Field of Classification Search ..... 347/129, 347/130, 233

See application file for complete search history.

(56) References Cited

U.S. PATENT DOCUMENTS 4,890,138 A * 12/1989 Miyamoto et al. ..... 399/171
2004/0120730 A1 6/2004 Niimi et al.
2004/0183883 A1 9/2004 Suzuki et al.
2004/0185358 A1 9/2004 Kami
2005/0069797 A1 3/2005 Niimi et al.
2005/0175911 A1 8/2005 Tamoto et al.
2005/0232657 A1* 10/2005 Fujii et al. ..... 399/159
2006/0008719 A1 1/2006 Niimi
2006/0057479 A1 3/2006 Niimi et al.

(Continued)

FOREIGN PATENT DOCUMENTS

JP 3-192282 8/1991

(Continued)

OTHER PUBLICATIONS

U.S. Appl. No. 11/669,957, filed Feb. 1, 2007, Tatsuya Niimi.

(Continued)

*Primary Examiner*—Huan H Tran
(74) *Attorney, Agent, or Firm*—Oblon, Spivak, McClelland, Maier & Neustadt, L.L.P.

(57) ABSTRACT

The present invention provides an image forming apparatus including a photoconductor, a charging unit configured to charge the photoconductor, a writing unit configured to form a latent electrostatic image, a toner image forming unit configured to form a toner image by developing the latent electrostatic image, the toner image forming unit having a plurality of developing devices housing a plurality of color developers for each color, a transfer unit configured to transfer the toner image formed on the photoconductor onto a transfer material, and a fixing unit configured to fix the transferred toner image on the transfer material, wherein the time spent by an arbitrary point on the photoconductor in moving from a position in which to face the writing unit to a position in which to face the developing unit is shorter than 50 ms and longer than the transit time of the photoconductor.

13 Claims, 10 Drawing Sheets

U.S. PATENT DOCUMENTS

| | | | |
|---|---|---|---|
| 2006/0134540 | A1 | 6/2006 | Kondo et al. |
| 2006/0177749 | A1 | 8/2006 | Tamoto et al. |
| 2006/0197823 | A1 | 9/2006 | Ohta et al. |
| 2006/0198659 | A1 | 9/2006 | Niimi |
| 2006/0292480 | A1 | 12/2006 | Niimi |
| 2007/0172752 | A1 | 7/2007 | Niimi |
| 2007/0196749 | A1 | 8/2007 | Inaba et al. |
| 2007/0196750 | A1 | 8/2007 | Fujiwara et al. |

FOREIGN PATENT DOCUMENTS

| | | |
|---|---|---|
| JP | 4-204871 | 7/1992 |
| JP | 7-244414 | 9/1995 |
| JP | 10-115944 | 5/1998 |
| JP | 2000-275872 | 10/2000 |
| JP | 2001-312077 | 11/2001 |
| JP | 3874328 | 11/2006 |

OTHER PUBLICATIONS

U.S. Appl. No. 11/749,292, May 16, 2007, Yoshinori Inaba, et al.

* cited by examiner

IMAGE FORMING APPARATUS AND IMAGE FORMING PROCESS

BACKGROUND OF THE INVENTION

1. Field of the Invention

The present invention relates to an image forming apparatus which is compact and operates at high speed, and an image forming process.

2. Description of the Related Art

In recent years, image forming apparatuses allowing for achievement of high image quality of 1,200 dpi or more have had two major problems to solve. One is a demand for achievement of high-speed performance, and the other is a demand for achievement of compactness.

For the former, in order to improve productivity in image forming apparatuses, improvement in printing speed is vital. As for a monochrome machine, measures are generally taken by increasing the linear velocity of a photoconductor (hereinafter possibly referred to as "electrophotographic photoconductor", "latent electrostatic image-bearing member", "image-bearing member" or "photoconductive insulator") and enlarging the diameter of the photoconductor. As for a full-color machine, there are two directions, one is achievement of tandem technologies (a plurality of image forming elements are used), and the other is the direction in which measures are taken by increasing the linear velocity and enlarging the diameter of a photoconductor, as in the case of a monochrome machine. Here, the image forming elements denote a minimum unit structure for image forming, including at least a photoconductor, a charging member, a writing member and a developing member. In addition, a transfer member and a fixing member, a cleaning member, a charge-eliminating member, etc. may be provided; however, when a plurality of image forming elements are used at the same time, what is necessary is not a plurality of these image forming units but one unit formed in a combined manner.

Meanwhile, methods for forming multicolor images and full-color images are, in general, broadly divided into two methods using an image forming apparatus based upon an electrophotographic system. Specifically, they are image forming apparatuses based upon a "tandem system" in which image forming units are provided for each color, and based upon a "one-drum system". An image forming apparatus based upon a "tandem system", which is the former, produces a large number of printed sheets per unit time but has problems with a large size of the apparatus and its high costs because image-forming processors such as a charger and a laser scanner unit are necessary for each image forming unit; whereas, an image forming apparatus based upon a "one-drum system", which is the latter, makes it not necessary to improve positional accuracy as high as that of the "tandem system" because displacement of an output image caused by using a plurality of photoconductor drums is vanishingly small in comparison with the "tandem system", thereby making it possible to reduce costs caused by using four photoconductor drums. Also, the "one-drum system" is advantageous in that it is possible to make an image forming apparatus compact at the same time; therefore, note has been taken of it in recent years.

Additionally, as to a full-color image forming apparatus of the "one-drum system", as shown in FIG. 9 (although FIG. 9 is basically for explaining an image forming apparatus of the present invention, a full-color image forming technique of a conventional "one-drum system" will be explained here for the sake of convenience, with reference to this figure), the following method is also described, for example in Japanese Patent Application Laid-Open (JP-A) No. 3-192282: toner images of each color formed by developing devices of each color (4Y), (4M), (4C) and (4K) in a developing unit (4) on a photoconductor drum (1) charged by a charger (2) and selectively exposed by an exposer (3) are not sequentially transferred onto a recording material (11) but once primarily transferred onto an intermediate transfer belt (5) by means of the electric field of a transfer roller (transfer member) (10); the toner images of four colors transferred onto this intermediate transfer belt (5) are transferred onto the recording material (11) at one time by means of the electric field of a secondary transfer roller (6); and then the unfixed toner image is fixed. Note that in the figure, the reference numeral (40) denotes a rotor which rotates with the developing devices mounted thereupon, (6) denotes a secondary transfer roller, (8) denotes a cleaning device which cleans the surface of the photoconductor drum (1), and (9) denotes an intermediate transfer cleaning device which cleans the surface of the intermediate transfer belt (5).

Giving greater freedom with respect to the placement of each device in an image forming apparatus than the case of the use of a transfer drum in the "one-drum system" and a method of holding and conveying a recording material on a conveyance belt to conduct transfers in the "tandem system", the foregoing method using the intermediate transfer belt (5) has been suitably used in recent years in terms of the ability of making image forming apparatuses compact and suitability for a wide variety of recording materials, and has become the mainstream of color image forming apparatuses.

Incidentally, in the case of the "one-drum system", toner images of four colors are formed using one photoconductor drum, so that even if there is an alteration in the rotation of the photoconductor drum, bringing the formation positions of the images of each color in line on the photoconductor drum makes the effect of the rotational alteration of the photoconductor drum appear in a similar manner in the toner images of each color; accordingly, the "one-drum system" is characterized in that by bringing the image forming positions of each color in line on the photoconductor drum, changes in hue rarely occur even when nonuniformity of image density attributable to rotational alteration of the photoconductor drum arises. Also, amongst processors disposed in the vicinity of one photoconductor drum, anything except a developing unit allows the same thing to be used for each color; therefore, there is even such a characteristic that it is possible to simplify the structure of the apparatus and it is possible to make the apparatus compact and to lower costs. However, in the "one-drum method", there is a problem that it takes approximately four times longer for the "one-drum system" to form a full-color image by means of four colors of yellow, magenta, cyan and black than to obtain a monochrome image of black color, and thus the productivity in producing full-color images per unit time (printing speed) is low.

Since it has the merits and demerits, the image forming system according to the "one-drum system" is employed in full-color machines aimed at serving also to produce black-and-white images, as things stand at present.

However, in conventional image forming apparatuses, since members constituting image forming elements such as for a charging step and a writing step are slow in ability, it has been difficult to plan compactness, high-speed performance (50 sheets/min or more) and high resolution (1,200 dpi or more).

In a charging step, it is necessary to improve charging ability for achievement of high-speed performance. When the diameter of a photoconductor is lessened, the width by which a charging member and the photoconductor can be disposed so as to face each other (referred to as charging nip) becomes very small. It is not impossible for a wire-type charging member used thus far, which is typified by a scorotron charger, to increase the amount of a corona falling onto the surface of the photoconductor by increasing the number of wires, but there is a problem that when wires are too close to one another in distance, they interfere with one another and power consumption becomes greater. Additionally, a grid is necessary for stabilizing charging, and the size thereof determines the charging nip width. A grid is generally made of a conductive metal plate and placed in the tangential direction of a photoconductor. For this reason, when the diameter of a photoconductor is lessened, a grid-photoconductor surface distance significantly differs between the center and both ends of a grid, and the net nip width becomes very small (charging becomes unstable at both ends that are front and rear ends corresponding to the moving direction of the photoconductor). In order to solve this problem, it is possible to use a grid which is not flat to fit the curvature of a photoconductor. However, an apparatus has to be a little complex to place such a photoconductor in, and the space in which a charging member can be placed is inevitably small due to the reduction in diameter; thus, this method is not realistic.

In contrast to the method, there is a method in which a roller-shaped charging member is used. A roller-shaped charging member is used in such a manner as to make contact with a photoconductor surface, or in such a manner that both surfaces thereof are placed close to each other with a gap of 50 μm or so in between. In most situations, by rotating both surfaces (making both surfaces rotate together) at equal speed, and applying a bias voltage to the roller, a discharge takes place from the roller to the photoconductor, and the photoconductor surface is charged. In this case, the charging member can successfully be made compact by lessening the diameter of the roller to a possible extent. When the roller diameter is lessened, the chargeable range (such a range that the photoconductor is apart from the roller surface by roughly 50-100 μm; referred to as charging nip) becomes narrow, and thus charging ability is lowered. However, it is not lowered as much as that of the scorotron charging does; further, charging ability improves dramatically, as a bias voltage applied to a roller member includes not only a DC component but also an AC component in a superimposed manner. By using such a technique, a charging step is no longer a rate-limiting factor in an image forming process at present. However, owing to the AC superimposition to obtain greater charging ability, there is a greater hazard to the photoconductor surface, and so the impact on the durability (lifetime) of the photoconductor will be great.

Meanwhile, in a writing step, light-emitting diodes (LEDs) and laser diodes (LDs) have been used as writing light sources until these days. LEDs are used as a writing light source, as they are placed in the form of an array in the lengthwise direction of a photoconductor (in the case of a drum-shaped small-diameter photoconductor, not in the MD (machine direction) but in the TD (traverse direction), in other words the axial direction), in the vicinity of the photoconductor. However, its resolution is determined by the size of one element, and also depends upon the distance between elements. Therefore, at this point in time, an LED is hardly deemed to be most suitable as a light source of 1200 dpi or more. Meanwhile, when an LD is used, writing is carried out by drawing and sending a light beam in the lengthwise direction of a photoconductor by means of a polygon mirror. When the diameter of a photoconductor is lessened, photoconductor linear velocity increases in relation to printing speed, and thus there is a need to increase the number of rotations of the polygon mirror. However, at present the number of rotations of a polygon mirror is 40,000 rpm or so at the most, and a single beam causes a limit on writing speed.

In contrast to the foregoing, a system in which a plurality of light beams are used has come into use. The following are used: a system of irradiating one polygon mirror with beams from a plurality of LD light sources; and a multi-beam exposing unit such as a construction in which a plurality of LDs are disposed as one array. Also these days, as multi-beam units, a surface-emitting laser with three light sources or more is used, and further, a surface-emitting laser with its light source placed in a two-dimensional manner is used. These techniques have been making it possible to carry out writing on photoconductors with a resolution of 1200 dpi or more.

As just described, amelioration of members constituting image forming elements or a novel technique has been making compactness, high-speed performance (50 sheets/min or more) and high resolution (1200 dpi or more) of photoconductors ready to achieve.

Meanwhile, in actual fact, as to related art such as the one described above, when compactness and high-speed performance are to be realized at the same time, it is not much clear where a rate-limiting factor is, in process designing, owing to the relationships between the linear velocity of a photoconductor, the size of members disposed in the vicinity of the photoconductor, and their respective abilities; furthermore, photoconductor techniques to respond to demands for compactness and high-speed performance have yet to become clear.

Therefore, the present invention is aimed at solving the problems in related art, and achieving the following objects.

An object of the present invention is to provide a compact image forming apparatus capable of forming high-quality images at high speed, and an image forming process using the image forming apparatus. Also, an object is to provide an image forming apparatus which is high in durability and capable of stable image output with few abnormal images, even when repeatedly used, and an image forming process using the image forming apparatus.

BRIEF SUMMARY OF THE INVENTION

By means of a variety of simulations, the present inventors have worked out a rate-limiting process in an image forming process allowing for obtaining the compactness, high-speed performance (A4 size 50 sheets/min or more) and high resolution (1,200 dpi or more), in other words a combination of a "specific photoconductor" and a "specific process" that are needed. As a result of it, some facts are revealed. To achieve high-speed performance, with maintaining a small diameter of a photoconductor, it is necessary to increase the linear velocity of the photoconductor, but the required linear velocity varies according to the set printing speed and the paper gap. Here, the "paper gap" is defined as follows. Assuming that the size and direction of fed paper corresponds with lateral A4 (210 mm×297 mm), the length in the paper feeding direction between the rear end of an (X)th sheet of fed paper and the front end of an (X+1)th sheet of fed paper as viewed from the paper feeding direction to 210 mm, is denoted by the "paper gap" (possibly expressed as a ratio). When a target printing speed is constant, the smaller the paper gap is, the smaller the photoconductor linear velocity can be set; however, the paper gap has a lower limit, and the photoconductor linear velocity is naturally set with its lower limit.

The linear velocity of a photoconductor has an effect on the ability and size of image forming elements (members) arranged in the vicinity of the photoconductor. As in the earlier explanation, if a charging member has a margin of charging ability, for example, the charging member can be made small, thereby giving a margin to the layout (arrangement) in the vicinity of the photoconductor. As a result of it, in steps before and after a charging step, for example an arrangement of a charge-eliminating member and a writing member, can be shifted in a direction which is advantageous in an image forming process. For example, if a margin of photoconductor potential decay is small because of charge elimination, it is possible to enlarge the charge elimination—charging space by the reduced size of the photoconductor. Alternatively, if a margin of photoconductor potential decay is small after writing, the writing-developing space can be enlarged by placing a writing light source alongside the charging member, for example.

Here, the meanings of "if a margin of photoconductor potential decay is small because of charge elimination, it is possible to enlarge the charge elimination—charging space by the reduced size of the photoconductor" and "if a margin of photoconductor potential decay is small after writing, the writing-developing space can be enlarged by placing a writing light source alongside the charging member" are explained.

As to the former, by irradiating a photoconductor with light, a charge-eliminating unit functions to decay a residual potential on the photoconductor, reduce a potential difference between an exposed portion using a writing light and an unexposed portion and uniform a photoconductor surface potential for the next time the photoconductor surface is charged.

When the linear velocity of a photoconductor is constant, and a margin of photoconductor potential decay is small because of charge elimination (for example, light intensity is small, the responsiveness of a photoconductor is poor, and sensitivity is small), it is necessary to shift an arrangement of a charge-eliminating member in a direction which is advantageous in an image forming process. Assuming that there is a margin in charging ability, it is possible to reduce a charging member in size and to enlarge the space between a charge-eliminating unit and a charging unit. Thus, it is possible to lengthen a charge-eliminating light irradiation time and to lengthen a time after charge-eliminating light irradiation. Specifically, it becomes possible to provide a time space for decaying a residual potential on a photoconductor and uniforming the surface potential of the photoconductor.

Next, the meaning of "if a margin of photoconductor potential decay is small after writing, the writing-developing space can be enlarged by placing a writing light source alongside the charging member" will be described. It is desirable that a photoconductor surface be positioned so as to face an exposer and irradiated with light with such an exposed amount (ultimate energy) of which sufficient potential decay can be obtained before the light reaches a developing unit. However, when the surface potential decay rate after irradiation of a photoconductor is insufficient, the time required for photocarriers to move as far as the photoconductor surface has to be gained by a certain means. One method to respond to the requirement is that the distance between an exposer and a developing unit disposed in the vicinity of a photoconductor is lengthened.

By repeating such a simulation as described above, required properties for a photoconductor used in the high-speed (A4 size 50 sheets/min or more) and high-resolution (1,200 dpi or more) process and a step in which the required properties are a rate-limiting factor that are largely different from those of a conventional apparatus, in image formation, have been worked out. A point which is largely different in process from conventional image forming apparatuses is that the process needs a photoconductor which is highly sensitive, has little light fatigue and is highly durable; as for a quick dark-decay property required for its high sensitivity, in order to compensate for this in a process, the time between exposure and developing (hereinafter referred to as exposing-to-developing time length) by means of a writing light shortens to a great extent. Specifically, in an existing image forming apparatus, the exposing-to-developing time length is 70 ms or so at the least. However, according to our simulation, with follow-through on the condition, it was found that the exposing-to-developing time length can attain such a condition as can be shorter than 50 ms.

Meanwhile, photoconductors have not yet been used in such a short exposing-to-developing time length so far; accordingly, the present inventors decided to evaluate time responsiveness of surface potential light decay, in order to work out the properties of a photoconductor conforming to this.

As to a method of evaluating the time responsiveness of surface potential light decay of an electrophotographic photoconductor, a charge transporting material or a resin film formed of this and a binder resin is often estimated in accordance with the Time of Flight (TOF) method, as seen for example in Japanese Patent Application Laid-Open (JP-A) No. 10-115944 and Japanese Patent Application Laid-Open (JP-A) No. 2001-312077. This is a useful method in designing the component formulation of a photoconductor. However, there is a difference pointed out: as to the conditions of charge transport of a photoconductor used in an apparatus, electric field intensity in a film changes every moment after exposing the photoconductor surface; as to the conditions of charge transport of a photoconductor determined by means of the TOF method, electric field intensity is constant. Also, to a laminate type photoconductor, the effects brought about on charge transport by charge generation from a charge generating layer due to exposure, and injection behavior from the charge generating layer to a charge transporting layer are not reflected in a measurement value according to the TOF method.

Also, as a method for directly evaluating the responsiveness of a photoconductor, a method in which a surface potential change of a photoconductor after pulse light irradiation is recorded at high speed using a high-speed surface electrometer, and the response time spent in attaining a predetermined potential is measured has been proposed, as seen for example in Japanese Patent Application Laid-Open (JP-A) No. 2000-305289. This method is generally referred to as "Xerographic Time of Flight (XTOF) method". This method is useful as an evaluating means of removing shortcomings in the TOF method. However, according to this method, a light source used in measurement is often different from an exposing unit used in an electrophotographic apparatus, and so this method has such an aspect that it is not necessarily a direct measuring method.

In contrast to the above-noted method, by using the photoconductor property evaluating method and evaluating apparatus described in Japanese Patent Application Laid-Open (JP-A) No. 2000-275872, it is possible to set a predetermined time spent by an exposed site (portion irradiated with writing light) of a photoconductor in reaching a developing unit (hereinafter, for simplicity, referred to as exposing-to-developing time length (Ted)) and to grasp the relation (light decay curve) of an exposed portion potential (surface potential of an exposed portion) to an exposed amount (energy) of the photoconductor that is output from an LD.

This technique described in Japanese Patent Application Laid-Open (JP-A) No. 2000-275872 is applied correspondingly to the present invention as well, and also deemed to be very suggestive on how an evaluation method of properties of a photoconductor suitable for a high-speed image forming apparatus using a practical light source should exist; accordingly, the outline thereof will be described below.

The following technical content is described in Japanese Patent Application Laid-Open (JP-A) No. 2000-275872. "Various methods are employed for methods of evaluating properties of a photoconductor used in a copier or the like for an electrophotographic system, especially measurement of a sensitivity property; for example, in a first measuring method, which is a dynamic measuring method, the surface of a photoconductor is charged for a predetermined period of time or until attaining a predetermined surface potential, while the photoconductor is rotated at a high rotation speed of 1,000 rpm, then the surface of the photoconductor is irradiated with light and exposed for a predetermined period of time or until attaining a predetermined surface potential, the product of the time spent by the photoconductor on predetermined surface potential decay according to this exposure and the illuminance, namely the exposed amount, is calculated, and the required exposed amount is the sensitivity of the photoconductor; in a second measuring method, as shown by the dynamic measuring method standardized according to the white-light sensitivity measuring method in the standards of Society of Electrophotography of Japan established on Mar. 31, 1992, a change in surface potential is measured when continuous exposure is conducted with a white light of constant light intensity, while a photoconductor is rotated at a low rotation speed of 100 rpm, the surface of the photoconductor is charged in a charge condition previously adjusted such that it attains a predetermined surface potential, a slit light of a predetermined illuminance is applied as the charged part of the photoconductor surface passes an exposing unit, the surface potential of the photoconductor is measured in a predetermined position or at a predetermined point in time after the charged part has passed the exposing unit, and the surface potential value measured is the sensitivity of the photoconductor; in a third measuring method, as shown by the static measuring method standardized according to the white-light sensitivity measuring method in the standards of Society of Electrophotography of Japan established on Mar. 31, 1992, while a photoconductor is rotated at a low rotation speed of 100 rpm, the surface of the photoconductor is charged in a charge condition previously adjusted such that it attains a predetermined surface potential, the rotation of the photoconductor is stopped when the charged part of the photoconductor surface comes to an exposing unit, a light of a predetermined illuminance is applied for a predetermined period of time, a change in surface potential is measured with a light-transmissive surface electrometer, and the exposed amount required for predetermined surface potential decay is the sensitivity of the photoconductor. These sensitivity evaluating methods have common problems that due to restrictions of the use of a tungsten lamp or halogen lamp as a light source for light irradiation, the use of a mechanical shutter or electromagnetic shutter to control the irradiation time, and a measuring system such as response of a surface electrometer, etc., the exposure time in the first measuring method, the exposure time in the second measuring method and the exposure time in the third measuring method stand at 0.1 sec or more, 0.01 sec or more and 0.001 sec or more respectively, thereby preventing the time for which one point of a photoconductor is exposed from being short. The light intensity is in the range of 0.1 $\mu W/cm^2$ to 10 $\mu W/cm^2$; however, copiers and printers using present-day electrophotographic processes are dominated by so-called digital machines by means of laser scanning, in which the time for which one point on a photoconductor is exposed is normally in the range of several tens ns to 100 ns or so, and the light intensity is often several tens $W/cm^2$; hence the measurement conditions are unable to be realized with a conventional measuring method. And again, in order to surmise and evaluate properties of a photoconductor in an actual copier, etc., it is necessary to make an evaluation in accordance with the same scale as the scale of conditions used for a photoconductor in an actual copier, etc.; ideally, it is better to measure the sensitivity of a photoconductor in a copier in which the photoconductor is actually used, but normally a photoconductor and a copier on which this photoconductor is mounted are developed concurrently, which makes it impossible in the midst of the developing of the photoconductor to prepare a copier that can be stably used as a measurer, and thus it is often difficult to evaluate a photoconductor by a copier on which the photoconductor is actually mounted. Further, when an attempt is made to evaluate the sensitivity of a photoconductor with a copier in which the photoconductor is actually used, operational conditions such as the photoconductor size, the placement of a processing device, the linear velocity and the process timing are unambiguously determined and unable to be altered with respect to the copier, etc., hence a problem that every time the drum diameter and drum length of a photoconductor are changed in size, it is necessary to prepare a copier, etc. corresponding to the photoconductor. Accordingly, an object of the invention described in Japanese Patent Application Laid-Open (JP-A) No. 2000-275872 is to provide a digital-photoconductor property evaluating apparatus wherein the problems are removed, sensitivity properties of a photoconductor can be evaluated in accordance with the same scale in time as that of a digital machine having a laser scanning optical system, and also it is possible to carry out an evaluation with great freedom and high reliability, without dependence upon a particular digital machine. Specifically, what is provided is a photoconductor property evaluating apparatus including a charger, an exposer and a charge eliminator disposed in the vicinity of a photoconductor as a tested object; wherein a first surface electrometer is placed between the charger and the exposer; a second surface electrometer is placed between the exposer and the charge eliminator; the photoconductor is held in a freely rotatable manner; the charger, the charge eliminator and the first and second surface electrometers are attached to a common mount so as to be able to move in the circumferential direction, the diametral direction and the lengthwise direction of the photoconductor; the exposer is formed of a laser writing device and provided in a freely movable manner in the diametral direction and the lengthwise direction of the photoconductor; the photoconductor is scanned and exposed by continuously lighting a laser emitting device; the second surface electrometer is given maximum freedom with respect to its movable range in the circumferential direction; devices disposed in the vicinity of the photoconductor are given maximum freedom; on/off control is taken based upon the external diameter of the photoconductor, the linear velocity of the photoconductor, the resolution in a laser scanning sub-scanning direction, the charging time, the exposure time, and information on the placement positions of the devices disposed in the vicinity of the photoconductor; and properties of the photoconductor are evaluated and analyzed according to the surface potential of the photoconductor before and after exposure, measured by the first and second surface electrometers, and information on the placement positions of the devices. For example, a light decay filter is provided between the laser emitting device and a polygon mirror in the exposer; when the maximum exposure power is Pmax and the minimum exposure power is Pmin in a drive current adjusting range of the exposure power of the laser emitting device, it is desirable that the transmittance T(%) of the light decay filter to the wavelength of a laser light be $T \geqq \{(Pmin/Pmax)^n\} \times 100$ (%) with n serving as a positive integer; it is advisable to use a piece of colored glass as a board of this light decay filter; and again, it is advisable to provide a plurality of light decay filters of the transmittance T when n=1; also, after repetitively measuring the surface potential before and after exposure, in varying the exposure power of the exposer, it is advisable to repeat a similar measurement with the light decay filter replaced by a new one; further, in varying the exposure power of the exposer, it is also advisable to measure the surface potential of the photoconductor a plurality of times, with the number of light decay filters altered according to the exposure power. Specifically, a photoconductor property evaluating apparatus according to this invention is a photoconductor property evaluating apparatus including a charger, an exposer and a charge eliminator disposed in the vicinity of a photoconductor as a tested object; wherein a first surface electrometer is placed between the charger and the exposer; a second surface electrometer is placed between the exposer and the charge eliminator; the photoconductor is held in a freely rotatable manner; the charger, the charge eliminator and the first and second surface electrometers are attached to a common mount so as to be able to move in the circumferential direction, the diametral direction and the lengthwise direction of the photoconductor; the exposer is formed of a laser writing device, is able to move in the diametral direction and the lengthwise direction of the photoconductor, and is positioned in the diametral direction of the photoconductor in such a manner as to be apart from the photoconductor surface by the focal length of a fθ lens of a laser writing system; in this state, an evaluation of the photoconductor is carried out in such a manner that, while the polygon mirror in the exposer is being rotated and the photoconductor is being rotated at a constant rotation speed, the surface of the photoconductor is made to undergo charge elimination with the charge eliminator, the surface of the photoconductor is charged by the charger to become a predetermined surface potential, the charged photoconductor is irradiated with laser light by the exposer, the surface potential of the photoconductor in this charged state is measured by the first surface electrometer, the surface potential of the photoconductor after the exposure is measured with the second surface electrometer, the exposed amount (arrival energy) spent on potential decay is calculated from the external diameter and linear velocity of the photoconductor, the resolution in a laser scanning sub-scanning direction, the charging time, the exposure time, the placement position of the charger with respect to a circumferential direction, and the surface potential of the photoconductor measured, the sensitivity of the photoconductor is determined according to the relationship between the exposed amount calculated and the potential after the exposure or potential variation before and after the exposure measured, and this process is repeated a predetermined number of times in changing the exposure power applied to the photoconductor".

One example of a measurement result of a photoconductor using the technique described in Japanese Patent Application Laid-Open (JP-A) No. 2000-275872 is represented in FIG. 2. According to FIG. 2, judging from the curve of surface potential to exposure energy, there are a light intensity region in which the potential decay amount becomes greater (the surface potential becomes lower) as exposure energy increases, and a light intensity region in which the surface potential does not become lower. With the boundary between those two light intensity regions as a boundary point (transit point), the following measurement will be carried out using a lower light intensity than this boundary point.

As shown in FIG. 3, in the apparatus described in Japanese Patent Application Laid-Open (JP-A) No. 2000-275872, a change in exposed portion potential when the exposing-to-developing time length has been changed is measured. Subsequently, as shown in FIG. 4, plotting a relation of the exposed portion potential to the exposing-to-developing time length makes it possible to find a bent point. The exposing-to-developing time length at this bent point is defined in the present invention as "transit time". According to the foregoing, the relationships between the exposing-to-developing time length, the exposed portion potential and the transit time, namely the time responsiveness of surface potential light decay of an electrophotographic photoconductor, can be accurately grasped. Note that the transit time depends upon the photoconductor surface potential and the photoconductor film thickness before irradiation with writing light (in other words, it depends upon the electric field intensity applied to the photoconductor). Therefore, when the transit time is measured, a photoconductor with the same composition and film thickness as those of a photoconductor actually used is used, and the photoconductor surface potential before irradiation with writing light is made the same as the unexposed portion surface potential of an image forming apparatus in which the photoconductor is used; an evaluation has to be thus made.

The "transit time" in the present invention will be further explained for sureness.

By using the photoconductor property evaluating apparatus shown in Japanese Patent Application Laid-Open (JP-A) No. 2000-275872 or FIG. 14, it is possible to grasp the relation (light decay curve) of the exposed portion potential to the exposed amount of a photoconductor output from an LD (exposed portion) (see FIG. 2). As to the apparatus in FIG. 14, when a position directly opposite a writing unit is (A) and a position directly opposite a developing unit is (B), the exposure time—developing time (Ted) is represented as follows.

Ted=(circumferential length of photoconductor drum)×(angle between *OA* and *OBn*)/360÷(linear velocity of photoconductor)

In this manner of measurement, as shown in FIG. 14, by moving a surface electrometer, situated at a developing site, in the circumferential direction of a photoconductor, a predetermined time spent by an exposed site of the photoconductor irradiated with LD light in the figure in reaching a position in which to face a developing unit (hereinafter, for simplicity, referred to as exposing-to-developing time length) can be set relatively freely in a certain range. In this apparatus, when a change in exposed portion potential with an alteration in exposing-to-developing time length is measured, with the exposed amount fixed, it is possible to find a bent point in the relation of the exposed portion potential to the exposing-to-developing time length (see FIG. 4). In the present invention, for the sake of convenience, the exposing-to-developing time length at this bent point is defined as the transit time. A specific example concerning the relation is shown in FIG. 15. In the figure, exposing-to-developing time length is written as process time.

As a further explanation of the two requirements in the present invention, i.e. "the surface of a photoconductor is exposed with a resolution of 1,200 dpi or more" and "the time spent by an exposed area in moving from a position in which to face a writing unit to a position in which to face a developing unit is shorter than 50 ms and longer than the transit time of the photoconductor", those two requirements are a measurement mode in which the description in Japanese Patent Application Laid-Open (JP-A) No. 2000-275872 relating in some way to "the time spent by an exposed area in moving from a position in which to face a writing unit (exposing unit) to a position in which to face a developing unit is shorter than 50 ms" is applicable (convertible) to an actual machine.

Here, for reference, the "exposing-to-developing time length" on each condition described in the publication is calculated according to the explanation. As to the "condition in which the surface of a photoconductor is exposed with a resolution of 1,200 dpi or more", according to the description in the publication, "the time required for rotation as far as a second surface electrometer after beam exposure is 303 ms {(24 mm in drum diameter)×(3.14 in circular constant)×(55°/360°)/(38 mm/s in linear velocity)}; as to the [aspect 2-1], " the time required for rotation as far as a second surface electrometer after beam exposure is 58 ms {(60 mm in drum diameter)×(3.14 in circular constant)×(20°/360°)/(180 mm/s in linear velocity)}; as to the [aspect 2-2], "the time required for rotation as far as a second surface electrometer after beam exposure is 116 ms {(60 mm in drum diameter)×(3.14 in circular constant)×(40°/360°)/(180 mm/s in linear velocity)}; and as to the [specific example 3], "the time required for rotation as far as a second surface electrometer after beam exposure is 366 ms {(80 mm in drum diameter)×(3.14 in circular constant)×(55°/360°)/(105 mm/s in linear velocity)}. In other words, this conventional material makes no mention of "the time required for rotation as far as a developing site after beam exposure is shorter than 50 ms".

Note that a method of controlling the transit time of a photoconductor will be explained in detail when a photoconductor is explained; here, the present inventors have carried out an analysis of the transit time of a typical type of negatively-charged laminate photoconductor in which an intermediate layer, a charge generating layer and a charge transporting layer are provided on a support. As a result of it, transport property of photocarriers generated in the charge generating layer is reflected in the transit time, but consequently it was found that hole transport property in the charge transporting layer is generally reflected in the transit time. Accordingly, it was found that in order to control the transit time greatly, it is reasonable to consider how to design the charge transporting layer.

The exposing-to-developing time length mentioned here is defined as the time required when an arbitrary point on a photoconductor moves from a position in which to face a writing unit to a position in which to face a developing unit. More specifically, as shown in FIG. 1, it is the time during which one arbitrary point on a photoconductor moves from a position (A) in which to face a writing member to a position (B) in which to face a developing member, while the photoconductor is rotating in the dotted arrow direction in the figure. Here, the position (A) is the center of a writing light (beam), and is the point where the center of a writing light applied from a writing light source toward the photoconductor center intersects the photoconductor surface. It can be said that the position (B) is the center of a developing nip, and that when a rod-like developing sleeve is used as in the figure, the position (B) is the position where the developing sleeve and the photoconductor surface become closest to each other. Therefore, the exposing-to-developing time length is the length of time (sec) calculated by dividing the length (mm) of the circumference (arc) between the position (A) and the position (B) by the photoconductor linear velocity (mm/sec).

The present invention has been completed by making clear the relationship between the transit time of a photoconductor and the exposing-to-developing time length accurately calculated, in accordance with the foregoing method.

When the status of use under the conditions is considered in terms of the photoconductor side, light decay of a photoconductor needs to be finished within the exposing-to-developing time length. As to the finishing of light decay mentioned here, when writing light is applied within a short period of time as in the case of laser light after the photoconductor has been charged, the surface potential of the photoconductor gradually decays as time passes, and on this occasion the potential decrease amount (speed) is great until a certain point in time, but the potential speed becomes very small after the certain point in time. The surface potential at this stage stands at a rather small value, and also potential decay is hardly generated even when more time than this is allowed. It is possible to deem this time to be a time (transit time) when a great majority of photocarriers generated in the photoconductor cross a photosensitive layer.

It is inferred that this time is a property dependent upon the carrier generation and carrier-transport time of the photoconductor, but in the case of use in a tandem-type full-color image forming apparatus, the relationship between process conditions and a photoconductor satisfying this transit time has not been clarified.

When a writing unit cannot conform to the attribute of a photoconductor, the amount of light irradiation to the photoconductor decreases, which causes such a trouble that the image density decreases in negative-positive developing, and which leads to a decrease in color balance in a tandem-type full-color machine. For this reason, measures are taken by lowering the writing resolution.

Also, when the transit time of a photoconductor becomes greater than the exposing-to-developing time length, an exposed site of the photoconductor reaches a developing site while photocarriers generated inside a photosensitive layer are still being transported.

Thus, (1) since the photoconductor surface potential does not lower sufficiently, it is impossible to obtain developing potential sufficiently, which causes such a trouble that the image density decreases in negative-positive developing; (2) even if developing potential can be gained, the surface potential decrease still continues when the exposed site is past the developing site, and toner is developed at an exposed portion in negative-positive developing (attachment of toner is conducted electrostatically); thus, the adhesion between the exposed portion and the toner lowers, and an increase in the resolution of dots or dust at the time of transfer is liable to arise; (3) further, when the photoconductor has rotated once passing image forming elements and then enters a next step, carriers later generated inside at a next time of charging cause the potential of a former image exposed portion to decrease slightly. Accordingly, there is a difference in halftone potential, which causes abnormal images like ghosts (afterimages) to arise in monochrome machines, and which causes color reproducibility to lower in the case of full-color machines which produce a lot of halftone images.

The present invention is based upon the knowledge of the present inventor, and a means of solving the problems is as follows.

(1) An image forming apparatus, including a photoconductor, a charging unit configured to charge the photoconductor to a desired potential, a writing unit configured to form a latent electrostatic image by exposing the surface of the photoconductor with a resolution of 1,200 dpi or more, a toner image forming unit configured to form a toner image by developing the latent electrostatic image using a toner, the toner image forming unit having a plurality of developing devices being placed so as to face the photoconductor and housing a plurality of color developers for each color, a transfer unit configured to transfer the toner image formed on the photoconductor onto a transfer material, and a fixing unit configured to fix the transferred toner image on the transfer material, wherein the time spent by an arbitrary point on the photoconductor in moving from a position in which to face the writing unit to a position in which to face the developing unit is shorter than 50 ms and longer than the transit time of the photoconductor.

(2) An image forming apparatus, including a photoconductor, a plurality of charging units configured to charge the photoconductor to a desired potential, a plurality of writing units configured to form a latent electrostatic image by exposing the surface of the photoconductor with a resolution of 1,200 dpi or more, a toner image forming unit configured to form a toner image by developing the latent electrostatic image using a toner, the toner image forming unit including a plurality of developing devices being placed so as to face the photoconductor and housing a plurality of color developers for each color, a transfer unit configured to transfer the toner image formed on the photoconductor onto a transfer material, and a fixing unit configured to fix the transferred toner image on the transfer material, wherein the time spent by arbitrary points on the photoconductor in moving from respective positions in which to face the plurality of writing units to respective positions in which to face the corresponding plurality of developing units is shorter than 50 ms and longer than the transit time of the photoconductor.

(3) The image forming apparatus according to any one of (1) and (2), wherein a multi-beam exposing system is employed in which the writing unit is configured to form the latent electrostatic image by simultaneously exposing a plurality of exposed regions using a plurality of beam bundles.

(4) The image forming apparatus according to (3), wherein a light source employed in the multi-beam exposing system is composed of three or more surface-emitting laser arrays.

(5) The image forming apparatus according to (4), wherein the light source employed in the multi-beam exposing system is composed of three or more surface-emitting laser arrays, and surface-emitting lasers are disposed in a two-dimensional manner.

(6) The image forming apparatus according to claim 1, wherein the photoconductor has a photosensitive layer containing an azo pigment represented by the following Structural Formula (1), Structural Formula (1)

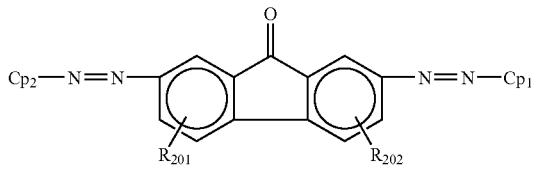

(where $Cp_1$ and $Cp_2$ respectively denote a coupler residue; $R_{201}$ and $R_{202}$ respectively denote any one of a hydrogen atom, a halogen atom, an alkyl group, an alkoxy group and a cyano group, and $R_{201}$ and $R_{202}$ may be the same or different from each other; $Cp_1$ and $Cp_2$ are respectively represented by the following Structural Formula (2), Structural Formula (2)

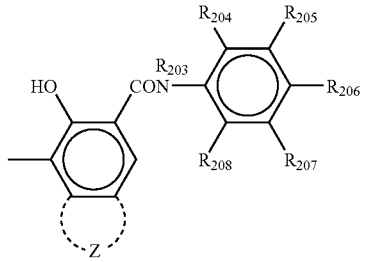

where $R_{203}$ denotes any one of a hydrogen atom, an alkyl group and an aryl group; $R_{204}$, $R_{205}$, $R_{206}$, $R_{207}$ and $R_{208}$ respectively denote any one of a hydrogen atom, a nitro group, a cyano group, a halogen atom, an alkyl halide group, an alkyl group, an alkoxy group, a dialkylamino group and a hydroxyl group; and Z denotes an atom group necessary to form a carbocyclic aromatic group that may have a substituent group or a heterocyclic aromatic group that may have a substituent group.

(7) The image forming apparatus according to (6), wherein $Cp_1$ and $Cp_2$ in the azo pigment are different from each other.

(8) The image forming apparatus according to any one of (1) to (5), wherein the photoconductor has a photosensitive layer containing a titanylphthalocyanine crystal that has a maximum diffraction peak of at least 27.2° of Bragg angle (2θ±0.2°), has major peaks at 9.4°, 9.6° and 24.0°, has a minimum-angle diffraction peak at 7.3°, does not have a diffraction peak between the peaks at 7.3° and 9.4°, and does not have a diffraction peak at 26.3°, in an X-ray diffraction spectrum using a CuKα X-ray (1.542 Å).

(9) The image forming apparatus according to any one of (1) to (8), wherein the photoconductor has a protective layer on the photosensitive layer.

(10) The image forming apparatus according to (9), wherein the protective layer includes at least any one of an inorganic pigment and a metal oxide having a specific resistance of $10^{10}$Ω-cm or more.

(11) The image forming apparatus according to (9), wherein the protective layer is formed by hardening at least a trifunctional or more radical polymerizable monomer having no charge transporting structure and a monofunctional radical polymerizable compound having a charge transporting structure.

(12) The image forming apparatus according to any one of (1) to (11), provided with a process cartridge which is detachably mountable to the image forming apparatus main body, wherein the process cartridge includes the photoconductor and one or more units selected from the charging unit, the writing unit, the developing unit, the transfer unit, a cleaning unit and a charge-eliminating unit, and the photoconductor and the one or more units are integrated into one unit.

(13) An image forming process, including a charging step configured to charge a photoconductor to a desired potential, a writing step configured to form a latent electrostatic image by exposing the surface of the photoconductor with a resolution of 1,200 dpi or more, a toner image forming step configured to form a toner image by developing the latent electrostatic image using a toner, the toner image forming step having a plurality of developing devices being placed so as to face the photoconductor and housing a plurality of color developers for each color, a transfer step configured to transfer the toner image formed on the photoconductor onto a transfer material, and a fixing step configured to fix the transferred toner image on the transfer material, wherein the time spent by an arbitrary point on the photoconductor in moving from a position in which to face a writing unit to a position in which to face a developing unit is shorter than 50 ms and longer than the transit time of the photoconductor.

(14) An image forming process, including charging a photoconductor to a desired potential a plurality of times, writing images to form a plurality of latent electrostatic images on the photoconductor by exposing the surface of the photoconductor with a resolution of 1,200 dpi or more, forming toner images by developing the latent electrostatic images using toners, transferring toner images on the photoconductor onto a transfer material, fixing the transferred toner images on the transfer material, wherein the time spent by arbitrary points on the photoconductor in moving from respective positions in which to face a plurality of writing units to respective positions in which to face a corresponding plurality of developing units is shorter than 50 ms and longer than the transit time of the photoconductor.

(15) The image forming process according to any one of (13) and (14), wherein a multi-beam exposing system is employed in which the writing step is configured to form the latent electrostatic image by simultaneously exposing a plurality of exposed regions using a plurality of beam bundles.

(16) The image forming process according to (15), wherein a light source employed in the multi-beam exposing system is composed of three or more surface-emitting laser arrays.

And (17) the image forming process according to (16), wherein the light source employed in the multi-beam exposing system is composed of three or more surface-emitting laser arrays, and surface-emitting lasers are disposed in a two-dimensional manner.

As is evident from the detailed and specific explanations below, the present invention makes it possible to provide a compact image forming apparatus capable of solving various problems in related art and forming high-quality images at high speed, and an image forming process using the image forming apparatus; also, the present invention makes it possible to provide an image forming apparatus which is high in durability and capable of stable image output with few abnormal images, even when repeatedly used, and an image forming process using the image forming apparatus, hence a very superior effect.

The present inventors have worked out a rate-limiting process in an image forming process allowing for obtaining the compactness, high-speed performance (50 sheets/min or more) and high resolution (1,200 dpi or more). As a result of it, some facts are revealed. To achieve high-speed performance with maintaining a small diameter of a photoconductor, it is necessary to increase the linear velocity of the photoconductor, but the required linear velocity varies according to the set printing speed and the paper gap. When a target printing speed is constant, the smaller the paper gap is, the smaller the photoconductor linear velocity can be set; however, the paper gap has a lower limit, and the photoconductor linear velocity is naturally set with its lower limit.

The linear velocity of a photoconductor has an impact on the ability and size of image forming elements (members) arranged in the vicinity of the photoconductor. As in the earlier explanation, if a charging member has a margin of charging ability, for example, the charging member can be made small, thereby giving a margin to the layout (arrangement) in the vicinity of the photoconductor. As a result of it, in steps before and after a charging step, for example an arrangement of a charge-eliminating member and a writing member, can be shifted in a direction which is advantageous in an image forming process. For example, if a margin of photoconductor potential decay is small because of charge elimination, it is possible to enlarge the charge elimination—charging space by the reduced size of the photoconductor. Alternatively, if a margin of photoconductor potential decay is small after writing, the writing-developing space can be enlarged by placing a writing light source alongside the charging member, for example.

By repeating such a simulation as described above, a step was sought after in which photoconductor properties are a rate-limiting factor that is largely different from that of a conventional apparatus in image formation. A point which is largely different in process from conventional image forming apparatuses is that the time spent between exposure and developing (hereinafter referred to as exposing-to-developing time length) by means of writing light can be shortened to a great extent. Specifically, in an existing image forming apparatus, the exposing-to-developing time length is 70 ms or so at the least. However, according to our simulation, with follow-through on the conditions, it was found that the exposing-to-developing time length can attain such a condition as can be shorter than 50 ms.

Meanwhile, photoconductors have not yet been used in such a short exposing-to-developing time length so far; accordingly, the present inventors decided to evaluate time responsiveness of surface potential light decay, in order to grasp the properties of a photoconductor conforming to this.

As to a method of evaluating the time responsiveness of surface potential light decay of an electrophotographic photoconductor, a charge transporting material or a resin film formed of this and a binder resin is often estimated in accordance with the Time of Flight (TOF) method, as can be seen for example in Japanese Patent Application Laid-Open (JP-A) No. 10-115944 and Japanese Patent Application Laid-Open (JP-A) No. 2001-312077. This is a useful method in designing the component formulation of a photoconductor. However, there is a difference pointed out: as to the conditions of charge transport of a photoconductor used in an apparatus, electric field intensity in a film changes every moment after exposing the photoconductor surface; as to the conditions of charge transport of a photoconductor determined by means of the TOF method, electric field intensity is constant. Also, to a laminate type photoconductor, the effects brought about on charge transport by charge generation from a charge generating layer due to exposure, and injection behavior from the charge generating layer to a charge transporting layer are not reflected in a measurement value according to the TOF method.

Also, as a method for directly evaluating the responsiveness of a photoconductor, a method in which a surface potential change of a photoconductor after pulsed light irradiation is recorded at high speed using a high-speed surface electrometer, and the response time spent in attaining a predetermined potential is measured has been proposed, as can be seen for example in Japanese Patent Application Laid-Open (JP-A) No. 2000-305289. This method is generally referred to as "Xerographic Time of Flight (XTOF) method". This method is useful as an evaluating means of removing shortcomings in the TOF method. However, according to this method, a light source used in measurement is often different from an exposing unit used in an electrophotographic apparatus, and so this method has such an aspect that it is not necessarily a direct measuring method.

In contrast to the above-noted method, by using the photoconductor property evaluating method described in Japanese Patent Application Laid-Open (JP-A) No. 2000-275872, it is possible to set a predetermined time spent by an exposed site (portion irradiated with writing light) of a photoconductor in reaching a developing unit (hereinafter, for simplicity, referred to as exposing-to-developing time length (Ted)), and to grasp the relation (light decay curve) of an exposed portion potential (surface potential of an exposed portion) to an exposed amount (energy) of the photoconductor that is output from an LD. One example of a measurement result of the foregoing is represented in FIG. 2. According to FIG. 2, judging from the curve of surface potential to exposure energy, there are a region in which the potential decay amount becomes greater (the surface potential becomes lower) as exposure energy increases, and a region in which the surface potential does not become lower. With the boundary between those two regions serving as a boundary point, the following measurement will be carried out using a smaller light intensity than this boundary point.

As shown in FIG. 3, in the apparatus described in Japanese Patent Application Laid-Open (JP-A) No. 2000-275872, a change in exposed portion potential when the exposing-to-developing time length has been changed is measured. Subsequently, as shown in FIG. 4, plotting a relation of the exposed portion potential to the exposing-to-developing time length makes it possible to find a bent point. The exposing-to-developing time length at this bent point is defined in the present invention as the transit time. According to the foregoing, the relationships between the exposing-to-developing time length, the exposed portion potential and the transit time, namely the time responsiveness of surface potential light decay of an electrophotographic photoconductor, can be accurately grasped. Note that the transit time depends upon the photoconductor surface potential and the photoconductor thickness before writing light irradiation (in other words, it depends upon the electric field intensity applied to the photoconductor). Therefore, when the transit time is measured, a photoconductor with the same composition and film thickness as those of a photoconductor actually used is used, and the photoconductor surface potential before writing light irradiation is made the same as the unexposed portion surface potential of an image forming apparatus in which the photoconductor is used; an evaluation has to be thus made.

Note that a method of controlling the transit time of a photoconductor will be explained in detail when a photoconductor is explained; here, the present inventors have carried out an analysis of the transit time of a typical negatively-charged laminate type photoconductor in which an intermediate layer, a charge generating layer and a charge transporting layer are provided in this order on a support. As a result of it, it was found that transport property of photocarriers generated in the charge generating layer is to be reflected in the transit time, but consequently a hole transport property in the charge transporting layer is generally reflected in the transit time. Accordingly, it was found that in order to control the transit time greatly, it is reasonable to consider how to design the charge transporting layer.

The exposing-to-developing time length mentioned here is defined as the time when an arbitrary point on a photoconductor moves from a position in which to face a writing unit to a position in which to face a developing unit. More specifically, as shown in FIG. 1, it is the time during which one arbitrary point on a photoconductor moves from a position (A) in which to face a writing member to a position (B) in which to face a developing member, while the photoconductor is rotating in the dotted arrow direction in the figure. Here, the position (A) is the center of a writing light (beam), and is the point where the center of a writing light applied from a writing light source toward the photoconductor center intersects the photoconductor surface. It can be said that the position (B) is the center of a developing nip, and that when a rod-like developing sleeve is used as in the figure, the position (B) is the position where the developing sleeve and the photoconductor surface become closest to each other. Therefore, the exposing-to-developing time length is the length of time (sec) calculated by dividing the length (mm) of the circumference (arc) between the position (A) and the position (B) by the photoconductor linear velocity (mm/sec).

The present invention has been completed by making clear the relation between the transit time of a photoconductor and the exposing-to-developing time length accurately calculated, in accordance with the foregoing method.

When the status of use under the conditions is considered in terms of the photoconductor side, light decay of a photoconductor needs to be finished within the exposing-to-developing time length. As to the finishing of light decay mentioned here, when writing light is applied within a short period of time as in the case of laser light after the photoconductor has been charged, the surface potential of the photoconductor gradually decays as time passes. On this occasion, the potential decrease amount (speed) is great until a certain point in time, but the potential speed becomes very small after the certain point in time. The surface potential at this stage stands at a rather small value, and also potential decay is hardly generated even when more time than this is allowed. It is possible to deem this time to be a time (transit time) when a great majority of photocarriers generated in the photoconductor cross a photosensitive layer.

It is inferred that this time is a property dependent upon the carrier generation and carrier-transport time of the photoconductor, but in the case of use in a two-drum-type full-color image forming apparatus, the relation between process conditions and this transit time has not yet been clarified.

When the performance of a writing unit cannot follow the processing speed, the amount of light irradiation to a photoconductor decreases, which causes such a trouble that the image density decreases in negative-positive developing, and which leads to a decrease in color balance in a two-drum-type full-color machine. For this reason, the problem will be solved by lowering the writing resolution.

Also, when the transit time of a photoconductor becomes longer than the exposing-to-developing time length, an exposed site of the photoconductor reaches a developing site while photocarriers generated inside a photosensitive layer are still being transported. Thus, (i) since the photoconductor surface potential does not lower sufficiently, it is impossible to obtain developing potential sufficiently, which causes such a trouble that the image density decreases in negative-positive developing; (ii) even if developing potential can be gained, the surface potential still decreases when the exposed site is past the developing site, and toner is developed at an exposed portion in negative-positive developing (adhesion of toner is conducted electrostatically); thus, the adhesive force between the exposed portion and the toner lowers, and an increase in the resolution of dots or dust at the time of transfer is liable to arise; (iii) further, when the photoconductor has rotated once passing image forming elements and then enters a next step, carriers later generated inside at a next time of charging cause the potential of a former image exposed portion to decrease slightly. Accordingly, there is a difference in halftone potential, which causes abnormal images like ghosts (afterimages) to arise in monochrome machines, and which causes color reproducibility to lower in the case of full-color machines which produce a lot of halftone images.

The present invention is based upon the knowledge of the present inventor, and a means of solving the problems is as follows.

(1) An image forming apparatus including a color image forming unit having a first photoconductor, a first writing unit with a resolution of 1,200 dpi or more, and a plurality of color developing units, in which a color toner image formed on the first photoconductor is transferred onto a recording material at a first transfer portion by the plurality of color developing units; a black image forming unit having a second photoconductor, a second writing unit with a resolution of 1,200 dpi or more, and a black developing unit, in which a black toner image formed on the second photoconductor is transferred onto a recording material at a second transfer portion by the black developing unit; and a fixing unit which fixes a color toner image and a black toner image transferred onto a recording material, wherein the time spent by arbitrary points on the first and second photoconductors in moving from positions in which to face the writing units to positions in which to face the developing units is shorter than 50 ms and longer than the transit time of the first and second photoconductors respectively.

(2) An image forming apparatus including a first toner image forming unit having a first photoconductor, a first writing unit with a resolution of 1,200 dpi or more, and a first plurality of developing units; a second toner image forming unit having a second photoconductor, a second writing unit with a resolution of 1,200 dpi or more, and a second plurality of developing units; a transfer unit which transfers toner images formed on the first and second photoconductors to a transfer medium at a transfer portion; and a fixing unit which fixes toner images transferred onto a recording material, wherein the time spent by arbitrary points on the first and second photoconductors in moving from positions in which to face the writing units to positions in which to face the developing units is shorter than 50 ms and longer than the transit time of the first and second photoconductors respectively.

(3) An image forming apparatus according to (1) or (2), wherein a multi-beam exposing system in which a plurality of exposed regions are simultaneously exposed as the first and/or second writing units/unit use/uses a plurality of beam bundles is employed.

(4) An image forming apparatus according to (3), wherein a light source employed in the multi-beam exposing system is composed of three surface-emitting laser arrays or more.

(5) An image forming apparatus according to (4), wherein a light source employed in the multi-beam exposing system is composed of three surface-emitting laser arrays or more, and also surface-emitting lasers are disposed in a two-dimensional manner.

(6) An image forming apparatus according to any one of (1) to (5), wherein a photosensitive layer of the photoconductor contains the azo pigment represented by Structural Formula (1) below.

Structural Formula (1)

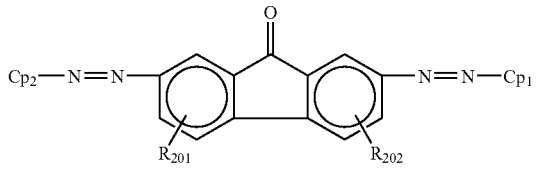

(in the structural formula, both $Cp_1$ and $Cp_2$ denote coupler residues; $R_{201}$ and $R_{202}$ each denote a hydrogen atom, a halogen atom, an alkyl group, an alkoxy group or a cyano group, and whether $R_{201}$ and $R_{202}$ are the same or different does not matter. $Cp_1$ and $Cp_2$ are represented by Structural Formula (2) below, Structural Formula (2)

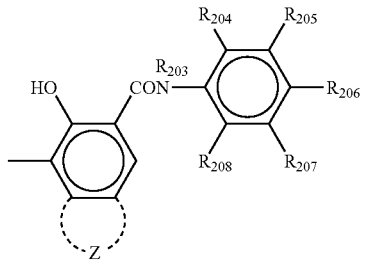

in the structural formula, $R_{203}$ denotes a hydrogen atom, an alkyl group or an aryl group; $R_{204}$, $R_{205}$, $R_{206}$, $R_{207}$ and $R_{208}$ each denote a hydrogen atom, a nitro group, a cyano group, a halogen atom, an alkyl halide group, an alkyl group, an alkoxy group, a dialkylamino group or a hydroxyl group; and Z denotes an atom group necessary to form a carbocyclic aromatic group that may have a substituent group or a heterocyclic aromatic group that may have a substituent group.)

(7) An image forming apparatus according to (6), wherein $Cp_1$ and $Cp_2$ in the azo pigment are different from each other.

(8) An image forming apparatus according to any one of (1) to (5), wherein a photosensitive layer of the photoconductor contains a titanyl phthalocyanine crystal having a diffraction peak of maximum intensity at least at 27.2°, having major peaks at 9.4°, 9.6° and 24.0°, having a minimum-angle diffraction peak at 7.3°, not having a diffraction peak between the peaks at 7.3° and 9.4°, and not having a diffraction peak at 26.3° within the bragg angle (2θ±0.2°), in an X-ray diffraction spectrum using CuKα character X-rays (1.542 Å).

(9) An image forming apparatus according to any one of (1) to (8), wherein the photoconductor has a protective layer on a photosensitive layer.

(10) An image forming apparatus according to (9), wherein the protective layer contains at least either an inorganic pigment or metal oxide having a resistance ratio of $10^{10}\Omega\cdot$cm or more.

(11) An image forming apparatus according to (9), wherein the protective layer is formed by hardening at least a trifunctional or more radical polymerizable monomer having no charge transporting structure and a monofunctional radical polymerizable compound having a charge transporting structure.

(12) An image forming apparatus according to any one of (1) to (11), wherein a photoconductor is integrated with one or more units selected from a charging unit, a writing unit, a developing unit, a transfer unit, a cleaning unit and a charge-eliminating unit, and a process cartridge detachable from an apparatus body is installed.

(13) An image forming process including a color image forming step having a first photoconductor, a first writing step with a resolution of 1,200 dpi or more, a plurality of color developing steps, and an intermediate transfer step, in which a color toner image formed on the first photoconductor is transferred onto a recording material in a first transfer step via the intermediate transfer step; a black image forming step having a second photoconductor, a second writing step with a resolution of 1,200 dpi or more, and a black developing step, in which a black toner image formed on the second photoconductor is transferred onto a recording material in a second transfer step by the black developing step; and a fixing step which fixes a color toner image and a black toner image transferred onto a recording material; wherein the time spent by arbitrary points on the first and second photoconductors in moving from positions in which to face the writing steps to positions in which to face the developing steps is shorter than 50 ms and longer than the transit time of the first and second photoconductors respectively.

(14) An image forming process including at least: a first toner image forming step having a first photoconductor, a first writing step with a resolution of 1,200 dpi or more, and a first plurality of developing steps; a second toner image forming step having a second photoconductor, a second writing step with a resolution of 1,200 dpi or more, and a second plurality of developing steps; a transfer step which transfers toner images formed on the first and second photoconductors to a transfer medium in a transfer step; and a fixing step which fixes toner images transferred onto a recording material; wherein the time spent by arbitrary points on the first and second photoconductors in moving from positions in which to face the writing steps to positions in which to face the developing steps is shorter than 50 ms and longer than the transit time of the first and second photoconductors respectively.

(15) An image forming process according to any one of (13) and (14), wherein a multi-beam exposing system in which a plurality of exposed regions are simultaneously exposed as the first and/or second writing steps/step use/uses a plurality of beam bundles is employed.

(16) An image forming process according to (15), wherein a light source employed in the multi-beam exposing system is composed of three surface-emitting laser arrays or more.

(17) An image forming process according to (16), wherein a light source employed in the multi-beam exposing system is composed of three surface-emitting laser arrays or more, and also surface-emitting lasers are disposed in a two-dimensional manner.

According to the present invention, it is possible to provide a compact image forming apparatus capable of solving various problems in related art and forming high-quality images at high speed, and an image forming process using the image forming apparatus. Also, it is possible to provide an image forming apparatus which is high in durability and capable of stable image output with few abnormal images, even when repeatedly used, and an image forming process using the image forming apparatus.

Figure 1:
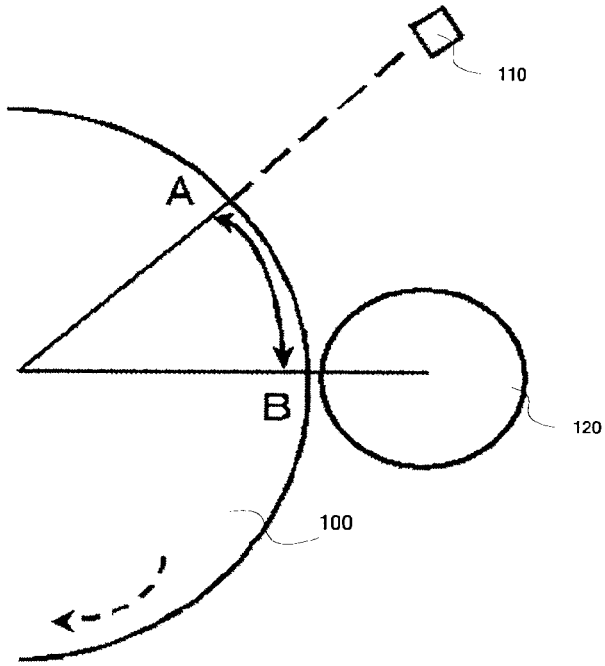
FIG. 1 is a diagram for explaining the exposing-to-developing time length in an image forming apparatus.
Figure 2:
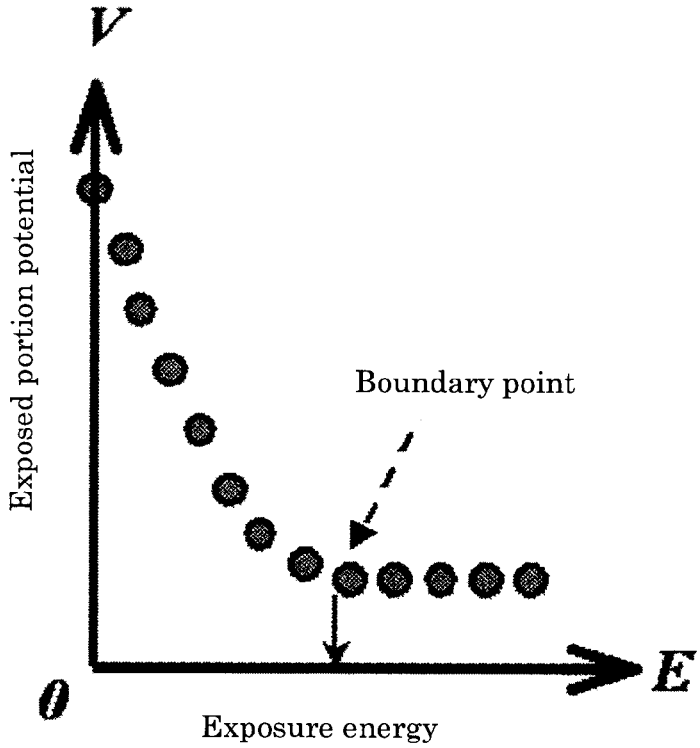
FIG. 2 is an example diagram showing a light decay property of a photoconductor.

DETAILED DESCRIPTION OF THE INVENTION (Image Forming Apparatus and Image Forming Process)

An image forming apparatus of the present invention includes a latent electrostatic image-bearing member (possibly referred to as photoconductor), a charging unit, a writing unit, a developing unit, a transfer unit and a fixing unit, wherein the time spent by an arbitrary point on the latent electrostatic image-bearing member in moving from a position in which to face the writing unit to a position in which to face the developing unit (referred to as exposing-to-developing time length) is shorter than 50 ms and longer than the transit time of a photoconductor; further, it includes other units suitably selected according to need, such as a cleaning unit, a charge-eliminating unit, a developer recycling unit and a control unit.

An image forming process of the present invention includes a charging step, a writing step, a developing step, a transfer step and a fixing step, wherein the time spent by an arbitrary point on a latent electrostatic image-bearing member in moving from a position in which to face a writing unit to a position in which to face a developing unit (referred to as exposing-to-developing time length) is shorter than 50 ms and longer than the transit time of a photoconductor; further, it includes other steps suitably selected according to necessity, such as a cleaning step, a charge-eliminating step, a recycling step and a control step.

The image forming process of the present invention can be suitably carried out by an image forming apparatus of the present invention; the charging step can be conducted by the charging unit, the writing step can be conducted by the writing unit, the developing step can be conducted by the developing unit, the transfer step can be conducted by the transfer unit, the charge-eliminating step can be conducted by the charge-eliminating unit, the fixing step can be conducted by the fixing unit, and the other steps can be conducted by the other units.

—Formation of Latent Electrostatic Image—

A latent electrostatic image can be formed, for example, by uniformly charging the surface of a latent electrostatic image-bearing member and then imagewisely exposing the latent electrostatic image-bearing member by means of a latent electrostatic image forming unit.

The latent electrostatic image forming unit includes at least a charger which uniformly charges the surface of a latent electrostatic image-bearing member, and an exposer which exposes the surface of the latent electrostatic image-bearing member imagewisely, for example.

—Charging Unit—

The charger is not particularly limited and may be suitably selected according to the purpose. Examples thereof include a contact charger known in the art which is provided with a conductive/semiconductive roller, a brush, a film, a rubber blade and the like; a noncontact charger utilizing corona discharge such as a corotron or scorotron; and a roller-shaped closely-placed charger (including a close-type noncontact charger in which there is a gap of 100 μm or less between a photoconductor surface and the charger, as described in Japanese Patent Application Laid-Open (JP-A) No. 2002-148904 or Japanese Patent Application Laid-Open (JP-A) No. 2002-148905, for example).

A photoconductor of the present invention is charged normally to the range of −300V to −150V, preferably to the range of −500V to −1,000V, by the charging unit. This is what charging a photoconductor to a desired potential in the present invention means.

It is desirable that the electric field intensity applied to a latent electrostatic image-bearing member by the charger be in the range of 20 to 60V/μm, more desirably in the range of 30 to 50V/μm. The higher the electric field intensity applied to a photoconductor is, the better dot reproducibility is; however, when the electric field intensity is too high, there could be breakdown of the photoconductor, carrier attachment at the time of developing and the like, which are problematic.

Note that the electric field intensity is represented by Equation (A) below.

$$\text{Electric field intensity } (V/\mu m) = SV/G \quad \text{(A)}$$

It should be noted that in Equation (A), SV denotes the surface potential (V) at an unexposed portion of a latent electrostatic image-bearing member in a developing position. G denotes the film thickness (μm) of a photosensitive layer including at least a photosensitive layer (charge generating layer and charge transporting layer).

—Writing Unit—

The writing can be carried out, for example, by imagewisely exposing the surface of the latent electrostatic image-bearing member, with the use of the exposer. For the exposer, a light source with a resolution of 1,200 dpi or more is used, and a suitable one can be selected according to the purpose; examples thereof include copying optical systems, rod lens array systems, laser optical systems and liquid crystal shutter optical systems. Additionally, in the present invention, a back-exposure system, in which exposure is imagewisely conducted from the back surface side of the latent electrostatic image-bearing member, may be employed.

As the light source, light sources capable of retaining high luminance, such as light-emitting diodes (LEDs), laser diodes (LDs) or electroluminescences (ELs) are used. Amongst them, one in which multi-beam exposure is conducted using a plurality of laser beams, one in which a light source used as a multi-beam light source is composed of three surface-emitting lasers or more, and one in which surface-emitting lasers are constructed in a two-dimensional manner are desirable; a multichannel laser diode array (LDA) in which an LD is placed in the form of an array described in Japanese Patent (JP-B) No. 3227226, and a surface-emitting laser in which an emitting point can be placed in a two-dimensional manner described in Japanese Patent Application Laid-Open (JP-A) No. 2004-287085 are very advantageous in carrying out high-density writing.

The resolution of the light source (writing light) used determines the resolution of a latent electrostatic image to be formed, and further, of a toner image to be formed, and a clearer image can be obtained as the resolution increases. However, when writing is carried out with the resolution high, greater time is thereby spent on the writing; thus, when there is only one writing light source, writing becomes a rate-limiting factor in a drum linear velocity (process speed). Therefore, when there is only one writing light source, a resolution of 2,400 dpi or so is the maximum. When there is a plurality of writing light sources, "2,400 dpi×number of writing light sources" is, in effect, the maximum because a writing region can be shared by the writing light sources. Amongst these light sources, a light-emitting diode and a laser diode are favorably used because of their high irradiation energy.

In the present invention, although dependent upon an initial charge potential, the surface potential when a photoconductor has moved to a developing site after being exposed is normally in the range of −0V to −200V, preferably in the range of −0V to −100V, and more preferably in the range of −0V to −50V.

—Developing Unit—

The developing can be carried out by developing the latent electrostatic image with the use of a toner, and so forming a toner image (visible image). For the toner, a toner having the same polarity as the charge polarity of a photoconductor is used, and a latent electrostatic image is developed by means of reversal developing (negative-positive developing). There are the following two developing methods: a one-component process in which an image is developed using only toner, and a two-component process in which a two-component developer composed of a toner and a carrier is used.

Also, when a plurality of color toner images are sequentially superimposed on a photoconductor, the use of a contact developing unit may disturb toner images previously developed. Therefore, when a plurality of color toner images are formed, it is desirable to use a noncontact developing unit allowing for jumping developing.

As to an image forming process used in the present invention, there is such a required condition that the time spent by a point on a photoconductor surface in passing between the writing unit and developing unit (exposing-to-developing time length) is 50 ms or less.

—Transfer Unit—

The transfer unit is a unit for transferring the visible image to a transfer material (recording medium such as paper; hereinafter possibly referred to as "transfer paper"), which can be divided into a method of directly transferring a visible image from a conductor surface to a recording medium, and a method in which an intermediate transfer member is used, and a visible image is primarily transferred onto the intermediate transfer member, then the visible image is secondarily transferred onto the recording medium. The transfer unit can be favorably used in both aspects, but when there is a great negative effect as high image quality is achieved, the former (direct transfer) method that is smaller in the number of transfers is more favorable.

The transfer can be carried out, for example, by transferring the visible image in such a manner that the latent electrostatic image-bearing member (photoconductor) is charged using a transfer charger, and it can be carried out by the transfer unit. The transfer unit is not particularly limited and may be suitably selected from those known in the art according to the purpose; preferred examples thereof include a transfer conveyance belt capable of conveying a recording medium as well at the same time.

It is desirable that each of the transfer units (primary and secondary transfer units) have at least a transfer charger which peels off and charges the visible image formed on the latent electrostatic image-bearing member, toward the side of the recording medium. As to the transfer unit, whether there is one, two or more than two does not matter. Examples of the transfer charger include corona transfer devices by means of corona discharge, transfer belts, transfer rollers, pressure transfer rollers and adhesive transfer devices. Note that for the recording medium, a suitable one can be selected from conventional recording media (recording papers), without any restrictions in particular.

It is possible to use a transfer belt or transfer roller for a transfer charger, in which case it is desirable that a contact type of a transfer belt, transfer roller, etc. generating less ozone be used. Note that although both a constant-voltage system and a constant-current system are applicable to a voltage/current applying system at the time of transfer, a constant-current system that is able to keep the transfer charge amount constant and that is superior in stability is more desirable. For the transfer member, any conventional transfer member can be used as long as it can satisfy the structure of the present invention.

The photoconductor passage charge amount per cycle of image formation greatly varies according to the photoconductor surface potential after transfer (surface potential on the occasion of entry into a charge-eliminating portion). The larger this is, the greater impact there will be on electrostatic fatigue of a photoconductor when repeatedly used.

This passage charge amount is equivalent to a charge amount flowing in the film thickness direction of a photoconductor. As operations in an image forming apparatus of a photoconductor, the apparatus is charged (negatively charged in most cases) to a desired charge potential by a main charger, and light writing is carried out based upon an input signal corresponding to a manuscript. On this occasion, photocarriers are generated at the part where writing has been conducted, thereby neutralizing surface charge (decaying in potential). At this time, a charge amount dependent upon a photocarrier generation amount flows in the photoconductor film thickness direction. Meanwhile, after passing a developing step and a transfer step, the region where light writing is not conducted (unwritten portion) moves to a charge-eliminating step (if necessary, a cleaning step is carried out before the charge-eliminating step). Here, when the surface potential of the photoconductor is close to a potential given by main charging (except for dark-decay elements), a charge amount which is approximately the same as that at the region where light writing has been conducted is to flow in the photoconductor film thickness direction. Typically, since present-day manuscripts are low in writing percentage, in this system a current which flows in the charge-eliminating step occupies most of the passage charge amount of the photoconductor when repeatedly used (assuming that the writing percentage is 10%, a current which flows in the charge-eliminating step occupies 90% of the total).

This passage charge has a great impact on photoconductor electrostatic properties, for example causing deterioration of a material forming a photoconductor. As a result of it, depending upon the passage charge amount, the residual potential of a photoconductor, in particular, is made to increase. If the residual potential of a photoconductor increases, the image density decreases in negative-positive developing used in the present invention, hence a great problem. Therefore, in order to aim for achievement of a long lifetime (high durability) of a photoconductor in an image forming apparatus, there is a problem in working out how to reduce the passage charge amount of the photoconductor.

In contrast to the foregoing, it may be thought reasonable to exclude a light elimination process; however, unless the charger ability of a main charger is great, charging cannot be stabilized, thus possibly leading to a problem with afterimages. Passage charge of a photoconductor is generated, as light irradiation is conducted according to the potential with respect to the charging of the photoconductor surface (electric field produced thereby) and thus photocarriers which have been generated move. Therefore, if the photoconductor surface potential can be decayed by a means other than light, it is possible to lower the passage charge amount per rotation of a photoconductor (cycle of image formation).

To achieve the foregoing, adjustment of the photoconductor passage charge amount by adjusting a transfer bias in a transfer step is effective. Specifically, an unwritten portion, which is charged by main charging and in which writing is not conducted, enters a transfer step, with its potential close to the potential thereof when charged, except for an dark-decay amount. On this occasion, by lowering the absolute value on the polarity side charged by a main charging deice to 100V or less, photocarriers are hardly generated and passage charge is not generated, when the unwritten portion enters a charge-eliminating step subsequent to the transfer step. It is desirable that this value be close to 0V as much as possible.

Further, with adjustment of a transfer bias, by applying a transfer bias such that a photoconductor is charged to have the opposite polarity in photoconductor surface potential to a charge polarity given by main charging, photocarriers will never arise, which makes this idea even more desirable. However, in a transfer condition in which a photoconductor is charged to an opposite polarity, in some cases a great deal of transfer dust could be generated, or main charging for a next image forming process (cycle) could be delayed. In that case, since a trouble such as afterimages could be caused, it is desirable that the absolute value of an opposite polarity be 100V or less.

Addition of the controls makes it possible to utilize the effect in the present invention conspicuously and usefully.

—Fixing Unit—

In the fixing, a visible image transferred onto a recording medium is fixed using a fixing device, and the image may be fixed for each of color toners every time each color toner is transferred onto the recording medium, or images for each of color toners may be fixed at one time with the images superimposed on the recording medium.

The fixing device is not particularly limited and may be suitably selected according to the purpose, but a heating/pressurizing unit is suitably used. Examples of the heating/pressurizing unit include a combination of a heating roller and a pressuring roller and a combination of a heating roller, a pressurizing roller and an endless belt. Typically, it is desirable that heating in the heating/pressurizing unit take place in the temperature range of 80° C. to 200° C. It should be noted that in the present invention, an optical fixing device in the art, for example, may be used along with or in place of the fixing unit in the fixing step, according to the purpose.

—Others—

The charge-eliminating unit is not particularly limited and may be suitably selected from charge eliminators known in the art. Examples thereof include laser diodes (LDs), light-emitting diodes (LEDs) and electroluminescences (ELs).

In addition, a combination of a fluorescent lamp, tungsten lamp, halogen lamp, mercury-vapor lamp, sodium-vapor lamp, xenon lamp, etc. and a certain optical filter, or the like can be used. Filters such as a sharp-cut filter, a band-pass filter, a near-infrared cut filter, a dichroic filter, an interference filter and a color temperature conversion filter can also be used.

The cleaning unit is not particularly limited and may be suitably selected from cleaning units known in the art as long as it can remove the electrophotographic toner remaining on the latent electrostatic image-bearing member; examples thereof include magnetic brush cleaners, electrostatic brush cleaners, magnetic roller cleaners, blade cleaners, brush cleaners and web cleaners.

The recycling unit is used for recycling and conveying the electrophotographic color toner removed by the cleaning unit to the developing unit; conventional conveying units are exemplified.

The control unit is used for controlling the above-mentioned steps, and this can be suitably conducted by a control unit.

The control unit is not particularly limited and may be suitably selected from control units known in the art as long as it can control the movements of the units; examples thereof include an apparatus such as a sequencer or computer.

Here, one aspect of an image forming apparatus of the present invention is explained with reference to FIG. 9.

Figure 9:
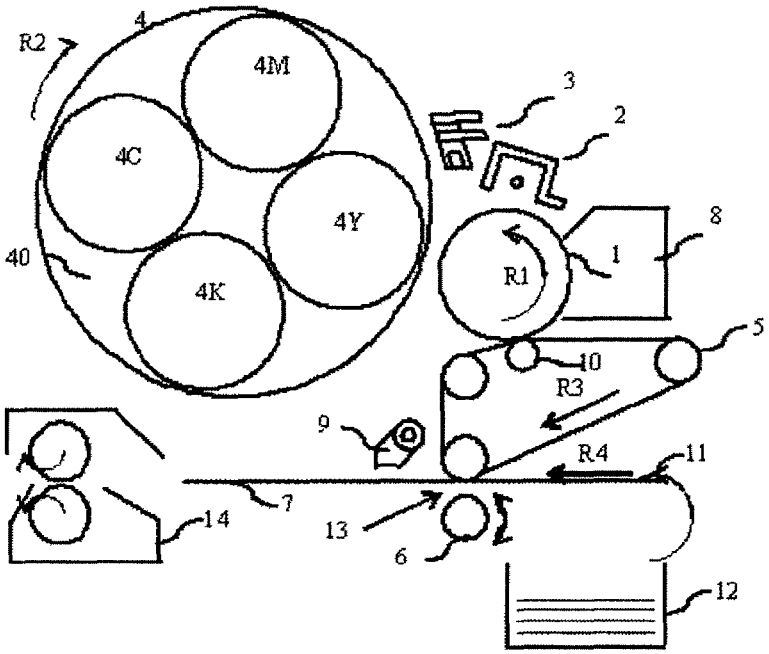
FIG. 9 is a schematic diagram for explaining a one-drum system electrophotographic process and an image forming apparatus of the present invention.

FIG. 9 is a schematic diagram for explaining an image forming apparatus of the present invention, and modified examples to be later shown are also within the scope of the present invention.

The image forming apparatus shown in the figure is provided with a full-color image forming unit which forms full-color images, including a drum-shaped image-bearing member (hereinafter referred to as "image-bearing member").

Note that hereinafter "color" will denote colors except black, and "full-color" will denote colors including black. In compliance with this, "color toner" will denote toners of colors except black.

In the vicinity of an image-bearing member (1) for full-color image formation, a charger (2), an exposer (3), a developing unit (full-color developing unit) (4), an intermediate transfer bearing member (5), a primary transfer roller (10), a secondary transfer roller (6), a cleaning device (8), an intermediate transfer bearing member cleaning device (9) and the like are disposed roughly in this order with respect to the rotational direction (direction of the arrow (R1)) of the image-bearing member (1).

In FIG. 9, the image-bearing member (1) includes at least a photosensitive layer on a support, and is characterized in that the transit time thereof is smaller than the exposing-to-developing time length of an image forming apparatus used. Although the image-bearing member (1) is shaped like a drum, it may be formed in a sheet or an endless belt. Also, there is such a required condition that the time spent by the image-bearing member surface in moving from a position in which to face the exposer (3) to a position in which to face the developing unit (4) is 50 ms or less.

A wire charger, a roller charger or the like is used for the charger (2). When high-speed charging is required and the charging nip can be kept wide, a scorotron charger is favorably used, whereas in an attempt to achieve compactness and in an after-mentioned image forming apparatus, a roller charger that generates a smaller amount of acid gas (NOx, SOx, etc.) or ozone is effectively used. An image-bearing member is charged by this charger; the higher the electric field intensity applied to a photoconductor is, the more preferable dot reproducibility can be obtained; therefore, it is desirable that an electric field intensity of 20V/μm or more be applied. However, in light of a possibility of causing breakdown of the image-bearing member and carrier attachment at the time of developing, which are problematic, the maximum value is generally 60V/μm or less, more desirably 50V/μm or less.

A light source capable of retaining high luminance, such as a light-emitting diode (LED), laser diode (LD) or electroluminescence (EL), is used for the exposer (3). The resolution of the light source (writing light) determines the resolution of a latent electrostatic image to be formed, and further, of a toner image to be formed, and a clearer image can be obtained as the resolution increases. However, when writing is carried out with the resolution high, greater time is thereby spent on the writing; thus, when there is only one writing light source, writing becomes a rate-limiting factor in a drum linear velocity (process speed). Therefore, when there is only one writing light source, a resolution of 1,200 dpi or so is the maximum. When there is a plurality of writing light sources, "1,200 dpi×number of writing light sources" is, in effect, the maximum because a writing region can be shared by the writing light sources. Amongst these light sources, a light-emitting diode and a laser diode are favorably used because of their high irradiation energy.

Having a large number of emitting points and thus making it possible to increase the number of dots simultaneously written, a surface-emitting laser, in particular, is very advantageous in an apparatus utilizing high-density writing as in the present invention.

The developing unit (4), which is a developing unit, has four developing sleeves. The developing unit (4) is composed of a rotary (40) which rotates in the direction of the arrow (R2), and four full-color developing devices (4Y), (4M), (4C) and (4K) mounted thereupon.

As for the developing unit (4), a developing device for a color used in developing a latent electrostatic image formed on the image-bearing member (1) is to be placed in a developing position opposed to the image-bearing member (1) surface by the rotation of the rotary (40) in the direction of the arrow (R2). Latent electrostatic images for the colors of yellow, magenta, cyan and black formed on the image-bearing member (1) are given toners of each color and developed as toner images of each color, as developing biases are applied to the developing devices (4Y), (4M), (4C) and (4K) by a developing bias applying power supply (not shown in the figure).

In the developing unit (4), toners with the same polarity as the charge polarity of a photoconductor are used, and latent electrostatic images are developed by means of reversal developing (negative-positive developing). A digital light source is generally used for images that are low in image area ratio, and it is advantageous to consider the lifetime of the light source in a reversal developing system in which written parts are developed using toner. There are two methods, i.e. a one-component process in which an image is developed using only toner, and a two-component process in which a two-component developer composed of a toner and a carrier is used; the developing unit (4) can be favorably used in both cases.

For example, when a two-component developer is used, the developing device of yellow (4Y) includes a nonmagnetic yellow toner and a magnetic carrier. The developing device of magenta (4M) includes a nonmagnetic magenta toner and a magnetic carrier. The developing device of cyan (4C) includes a nonmagnetic cyan toner and a magnetic carrier. The developing device of black (4K) includes a nonmagnetic black toner and a magnetic carrier.

By being transferred to transfer paper, a toner image formed on an image-bearing member becomes an image on the transfer paper; on this occasion, there are two methods. One is a method of directly transferring a toner image developed on an image-bearing member surface onto transfer paper, and the other is a method of temporarily transferring a toner image from an image-bearing member onto an intermediate transfer member, and then transferring this onto transfer paper. Both cases are applicable to the present invention.

Here, an intermediate transfer bearing member temporarily bears the toner images of each color developed, and forms an image in which a plurality of colors are sequentially superimposed, by retransferring these toner images onto the transfer bearing member. It is possible to use a transfer belt or transfer roller for a transfer bearing member, but it is desirable that a contact type of a transfer belt, transfer roller, etc. generating less ozone be used. The intermediate transfer bearing member (5) is rotationally driven in the direction of the arrow (R3), set on a plurality of rollers. Provided on the inside of the intermediate transfer bearing member (5), the primary transfer roller (10) presses the intermediate transfer bearing member(5) against the image-bearing member (1) surface. A primary transfer bias is applied to the primary transfer roller (10) from a primary transfer bias applying power supply (not shown in the figure), and thus toner images of each color on the image-bearing member (1) are transferred onto the intermediate transfer bearing member (5) and sequentially superimposed.

The secondary transfer roller (6) is for transferring a full-color toner image on the intermediate transfer bearing member (5) to a transfer material (11) such as paper, and rotates in the direction of the arrow (R4). The transfer material (11) is stored in a paper feed cassette (12), and provided to a first transfer portion (transfer nip portion) (13) situated between the intermediate transfer bearing member (5) and the secondary transfer roller (6) at a predetermined timing by a feeding conveyance unit (not shown in the figure). On this occasion, a secondary transfer bias is applied to the secondary transfer roller (6) from a secondary transfer bias applying power supply (not shown in the figure), and thus a full-color toner image of the four colors on the intermediate transfer bearing member (5) is secondarily transferred onto the transfer material (11) at one time.

When toner images are directly transferred from an image-bearing member to a transfer material without using an intermediate transfer member like the one described above, toner images of a plurality of colors are formed on the image-bearing member, and the toner images are transferred to the transfer material at one time.

Note that although both a constant-voltage system and a constant-current system are applicable to a voltage/current applying system at the time of transfer, a constant-current system that is able to keep the transfer charge amount constant and that is superior in stability is more desirable. What is particularly suitable is a method of controlling a current value to an image-bearing member, by deducting currents which flow through parts relating to a transfer member and which do not flow into the image-bearing member, from currents which have been output from a power supply member (high-voltage power supply) supplying charge to the transfer member.

A transfer current is a current based upon a required charge amount given to peel off a toner electrostatically attached to a photoconductor and move it to a transfer receiving member (transfer paper, intermediate transfer member or the like). In order to avoid transfer defects such as a transfer residue, it is advisable to increase a transfer current; however, when negative-positive developing is used, charging with the opposite polarity to the charge polarity of an image-bearing member is given, and electrostatic fatigue of the image-bearing member will therefore be conspicuous. A large transfer current is advantageous in that it is possible to give a charge amount which is greater than the electrostatic adhesion between a photoconductor and a toner; however, a discharge phenomenon arises between a transfer member and an image-bearing member when the current value is greater than a certain threshold value, and toner images minutely developed are disturbed as a result. Thus, a maximum value is in such a range as can prevent this discharge phenomenon from arising. This threshold value varies depending upon the gap (distance) between a transfer member and an image-bearing member, upon the materials forming them, and upon the like; it is possible to avoid a discharge phenomenon when the current value is roughly 200 μA or less. Therefore, the maximum value of a transfer current is 200 μA or so.

A conventional transfer member can be used for the transfer member as long as it can satisfy the structure of the present invention.

Also, decreasing the image-bearing member surface potential (part not exposed with writing light) after transfer by controlling a transfer current as described above makes it possible to lower the image-bearing member passage charge amount per cycle of image formation, which is effective in the present invention.

The cleaning device (8) removes a toner (residual toner) which has not been transferred to the intermediate transfer bearing member (5) or the transfer material (11) but remains on the image-bearing member (1), when a full-color toner image on the image-bearing member (1) is transferred to the intermediate transfer bearing member (5) or the transfer material (11). When there is a toner remaining on the image-bearing member (1), it is removed from the image-bearing member (1) by a fur brush or blade. Cleaning is sometimes carried out only with a cleaning brush. For the cleaning brush, a conventional one typified by fur brush and magnetic fur brush can be used.

The intermediate transfer bearing member cleaning device (9) removes a toner (residual toner) which has not been transferred to the transfer material (11) but remains on the intermediate transfer bearing member (5), when a toner image on the intermediate transfer bearing member (5) is transferred to the transfer material (11).

The transfer material (11) to which a full-color toner image of the four colors has been thus transferred is conveyed by a transfer conveyance belt (7) to a fixing device (14), where the transfer material (11) is heated and pressurized and the full-color toner image of the four colors is fixed on the surface thereof. Accordingly, a full-color image of the four colors is formed on the transfer material (11).

Although not shown in the figure, a light source for a charge-eliminating lamp or the like may be suitably selected from conventional charge eliminators as long as it can remove a charge remaining on the image-bearing member (1); examples thereof include a laser diode (LD) and an electroluminescence (EL). Alternatively, a combination of a fluorescent lamp, tungsten lamp, halogen lamp, mercury-vapor lamp, sodium-vapor lamp, xenon lamp, etc. and a certain optical filter, or the like can be used. Filters such as a sharp-cut filter, a band-pass filter, a near-infrared cut filter, a dichroic filter, an interference filter and a color temperature conversion filter are applicable to the optical filter.

Figure 10:
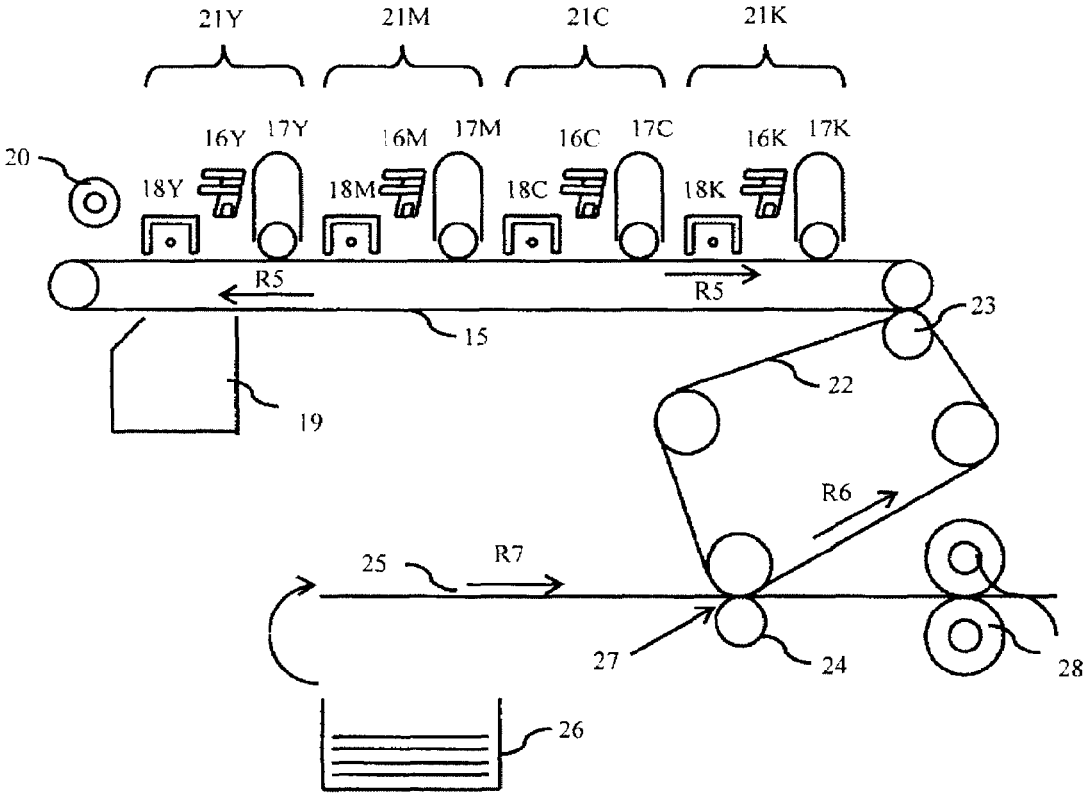
FIG. 10 is a schematic diagram for explaining a one-drum system full-color image forming apparatus of the present invention.

Next, FIG. 10 is a schematic diagram for explaining another full-color image forming apparatus of the present invention, and modified examples described below are also within the scope of the present invention.

In FIG. 10, the reference numeral (15) is a belt-like photoconductor including at least a photosensitive layer on a support, and is characterized in that the transit time thereof is smaller than the exposing-to-developing time length of an image forming apparatus used. Also, there is such a required condition that the time spent by the photoconductor surface in moving from a position in which to face exposers (16Y), (16M), (16C) and (16K) to a position in which to face developing units (17Y), (17M), (17C) and (17K) is 50 ms or less respectively.

This photoconductor (15) is able to rotate in the direction of the arrow (R5) in FIG. 10, and in the vicinity thereof at least chargers (18Y), (18M), (18C) and (18K), the developing units (17Y), (17M), (17C) and (17K) having one developing sleeve, a cleaning member (19) and a charge-eliminating unit (20) are disposed in rotational order. The chargers (18Y), (18M), (18C) and (18K) are chargers constituting a charging unit for evenly charging a photoconductor surface. As laser light is applied from the exposers (16Y), (16M), (16C) and (16K) between the chargers (18Y), (18M), (18C) and (18K) and the developing units (17Y), (17M), (17C) and (17K) on the photoconductor surface side, a latent electrostatic image is formed on the photoconductor (15). Four image forming elements (21Y), (21M), (21C) and (21K), with the photoconductor (15) at their center, are disposed along an intermediate transfer bearing member (22) that is a transfer material conveying unit. The intermediate transfer bearing member (22) is rotationally driven in the direction of the arrow (R6), set on a plurality of rollers. Provided on the inside of the intermediate transfer bearing member (22), a primary transfer roller (23) presses the intermediate transfer bearing member (22) against the image-bearing member (15) surface. A primary transfer bias is applied to the primary transfer roller (23) from a primary transfer bias applying power supply (not shown in the figure), and thus toner images of each color on the image-bearing member (15) are transferred onto the intermediate transfer bearing member (22) and sequentially superimposed.

A secondary transfer roller (24) is for transferring a full-color toner image on the intermediate transfer bearing member (22) onto a transfer material (25) such as paper, and conveys the transfer material (25) in the direction of the arrow (R7). The transfer material (25) is stored in a paper feed cassette (26), and provided to a first transfer portion (transfer nip portion) (27) situated between the intermediate transfer bearing member (22) and the secondary transfer roller (24) by a feeding conveyance unit (not shown in the figure) at a predetermined timing. On this occasion, a secondary transfer bias is applied to the secondary transfer roller (24) from a secondary transfer bias applying power supply (not shown in the figure), and thus a full-color toner image of the four colors on the intermediate transfer bearing member (22) is secondarily transferred onto the transfer material (25) at one time.

Also, toner images formed on a photoconductor are made to become images on transfer paper, by being transferred to the transfer paper; as well as a method in which an intermediate transfer member is used as described above, there is a method of directly transferring toner images to a transfer material without using an intermediate transfer member. Both cases are applicable to the present invention.

In the full-color image forming apparatus shown in FIG. 10, an image forming operation is carried out as follows. First of all, latent electrostatic images are formed on the photoconductor (15), at the image forming elements (21Y), (21M), (21C) and (21K). As the photoconductor (15) rotates, the photoconductor is charged by the chargers (18Y), (18M), (18C) and (18K). On this occasion, to form high-resolution latent images, charging is given such that the electric field intensity of the photoconductor is 20V/μm or more (60V/μm or less, preferably 50V/μm or less).

Next, writing is carried out with a resolution of 1,200 dpi or more (preferably 2,400 dpi or more), by means of laser light from the exposing members (16Y), (16M), (16C) and (16K) placed on the outside of a photoconductor, and latent electrostatic images corresponding to images of each color to be produced are formed. As the writing light sources, light sources suitable for an arbitrary photoconductor are used as described earlier. In this case also, with respect to the resolution of writing, 2,400 dpi is an approximate maximum value per writing light source.

Next, toner images are formed, as latent images are developed by the developing units (17Y), (17M), (17C) and (17K). The developing units (17Y), (17M), (17C) and (17K) are developing units which conduct developing with toners of Y (yellow), M (magenta), C (cyan) and K (black), and toner images of each color produced on the photoconductor (15) are sequentially superimposed on the intermediate transfer bearing member (22).

The transfer material (25) is conveyed from a tray by a paper feed roller (not shown in the figure), then made to stop once by a pair of resist rollers (not shown in the figure), and subsequently sent to the transfer conveyance belt (27) at a timing corresponding with an image formation on the intermediate transfer bearing member (22). As the transfer paper (25) held on the transfer conveyance belt (27) is conveyed, toner images of each color are transferred in the position (transfer position) (26) where the transfer paper (25) makes contact with the intermediate transfer bearing member (22).

Toner images on a photoconductor are transferred onto the transfer material (25) by means of an electric field created according to the potential difference between a transfer bias applied to the secondary transfer roller (24) and the intermediate transfer bearing member (22). The recording material (25) which has passed a transfer portion and on which toner images of the four colors are sequentially superimposed is conveyed to a fixing device (28), where the toners are fixed, and then sent to a paper ejecting portion not shown in the figure.

Also, a residual toner which has not been transferred by the first transfer roller (23) but remains on the photoconductor (15) is collected by the cleaner (19).

Subsequently, an unnecessary residual charge on the photoconductor is removed by the charge eliminating member (20). After that, charging is evenly given by a charger again, and a next image is formed.

It should be noted that although the image forming elements are disposed in the order of the colors Y (yellow), M (magenta), C (cyan) and K (black) as seen from the charge eliminator toward the primary transfer roller in the example of FIG. 10, the order of the colors can be arbitrarily set, not being confined to the foregoing order. Also, when a manuscript of only black is produced, provision of such a mechanism as stops the image forming elements excluding black ((25Y), (25M) and (25C)) is particularly effective in the present invention.

Also, as described earlier, it is desirable that a photoconductor surface after transfer be charged to 100V or less on the same polarity as the polarity of charging by a main charger, more desirably charged on the opposite polarity thereto, even more desirably charged to 100V or less on the opposite polarity thereto. This makes it possible to reduce the residual potential of a photoconductor when repeatedly used.

The image forming unit described above may be installed in a copier, facsimile or printer in a fixed manner, and also installed as a process cartridge in those apparatuses. A process cartridge is an apparatus (component) housing a photoconductor, and also including a latent electrostatic image forming unit, a developing unit, a transfer unit, a cleaning unit, a charge eliminating unit and the like.

The following explains embodiments in the present invention, with reference to the drawings.

Embodiments

Figure 16:
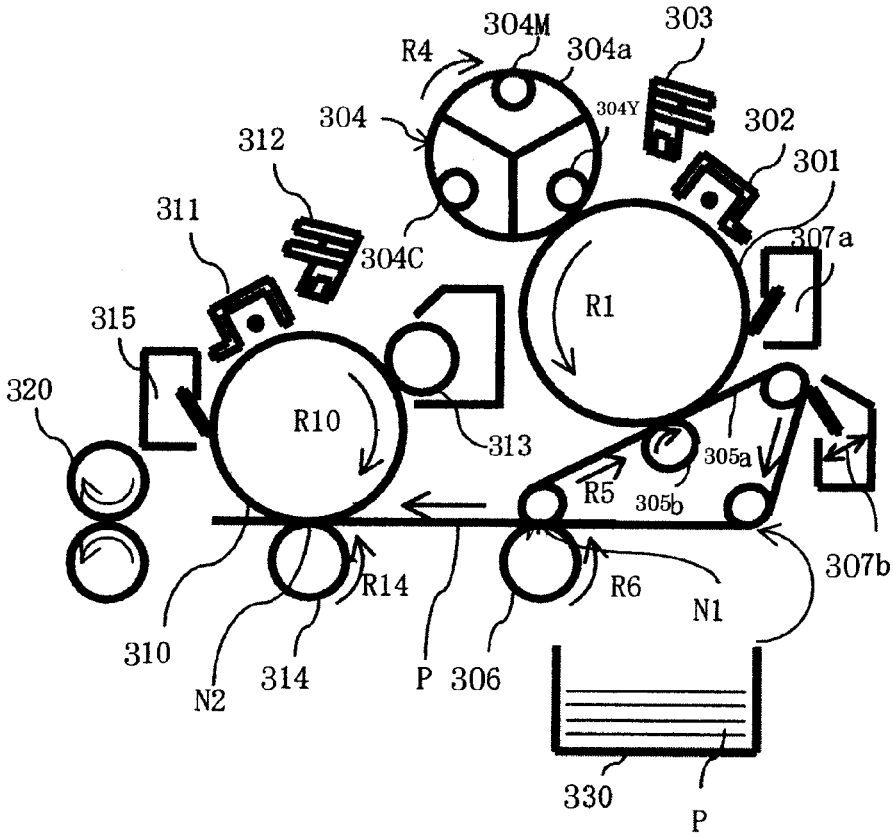
FIG. 16 is a schematic diagram for explaining a two-drum system electrophotographic process and an image forming apparatus of the present invention.

In FIG. 16, one example of an image forming apparatus of the present invention is shown as Embodiment B-1. The image forming apparatus in FIG. 16 is a full-color image forming apparatus (of four colors) according to an electrophotographic system, and the figure is a longitudinally cross-sectional view schematically showing the schematic structure thereof. Examples of the image forming apparatus include a printer, a copier and a facsimile.

The image forming apparatus in the figure is provided with a color image forming unit which forms color images (images of colors except black), and a black image forming unit which forms black images, including drum-shaped electrophotographic photoconductors (hereinafter referred to as "photoconductors") (301) and (310) respectively. Amongst these photoconductors, the photoconductor (301) (first photoconductor) is for forming color images, and the photoconductor (310) (second photoconductor) is for forming black images. Note that hereinafter "color" will denote colors except black, and "full-color" will denote colors including black. In compliance with this, "color toner" will denote toners of colors except black.

In the vicinity of the photoconductor (301) for color image formation, a charger (302), an exposer (303), a developing unit (color developing unit) (304), an intermediate transfer member (305*a*), a transfer roller (transfer device) (305*b*), a secondary transfer roller (306), a cleaning device (307*a*), an intermediate transfer member cleaning device (307*b*) and the like are disposed roughly in this order with respect to the rotational direction (direction of the arrow R1) of the photoconductor (301).

In FIG. 16, the photoconductor (301) includes at least a photosensitive layer on a support, and is characterized in that the transit time thereof is smaller than the exposing-to-developing time length of an image forming apparatus used. Although the photoconductor (301) is shaped like a drum, it may be shaped like a sheet or endless belt. Also, there is such a required condition that the time spent by the photoconductor surface in moving from a position in which to face the exposer (303) to a position in which to face the developing unit (304) is 50 ms or less.

A wire-system charger, a roller-shaped charger or the like is used for the charger (302). When high-speed charging is required and the charging nip can be kept wide, a charger of the scorotron system is favorably used, whereas in an attempt to achieve compactness and in an after-mentioned image forming apparatus, a roller-shaped charger that generates a smaller amount of acid gas (NOx, SOx, etc.) or ozone is effectively used. A photoconductor is charged by this charger; the higher the electric field intensity applied to a photoconductor is, the better dot reproducibility is; therefore, it is desirable that an electric field intensity of 20V/μm or more be applied. However, in light of a possibility of causing breakdown of the photoconductor and carrier attachment at the time of developing, which are problematic, the maximum value is generally 60V/μm or less, more desirably 50V/μm or less.

A light source capable of retaining high luminance, such as a light-emitting diode (LED), laser diode (LD) or electroluminescence (EL), is used for the exposer (303). The resolution of the light source (writing light) determines the resolution of a latent electrostatic image to be formed, and further, of a toner image to be formed, and a clearer image can be obtained as the resolution increases. However, when writing is carried out with the resolution high, greater time is thereby spent on the writing; thus, when there is only one writing light source, writing becomes a rate-limiting factor in a drum linear velocity (processing speed). Therefore, when there is only one writing light source, a resolution of 1,200 dpi or so is the maximum. When there is a plurality of writing light sources, "1,200 dpi×number of writing light sources" is, in effect, the maximum because a writing region can be shared by the writing light sources. Amongst these light sources, a light-emitting diode and a laser diode are favorably used because of their high irradiation energy. Having a large number of emitting points and thus making it possible to increase the number of dots simultaneously written, a surface-emitting laser, in particular, is very advantageous in an apparatus utilizing high-density writing as in the present invention.

The developing unit (304), which is a developing unit, has three developing sleeves. The developing unit (304) is composed of a rotary (304*a*) which rotates in the direction of the arrow (R4), and three color developing devices (304Y), (304M) and (304C) mounted thereupon.

As for the developing unit (304), a developing device for a color used in developing a latent electrostatic image formed on the photoconductor (301) is to be placed in a developing position opposed to the photoconductor (301) surface by the rotation of the rotary (304*a*) in the direction of the arrow (R4). Latent electrostatic images for the colors of yellow, magenta and cyan formed on the photoconductor (301) are given toners of each color and developed as toner images of each color, as developing biases are applied to the developing devices (304Y), (304M) and (304C) by a developing bias applying power supply (not shown in the figure).

In the developing unit (304), toners with the same polarity as the charge polarity of a photoconductor are used, and latent electrostatic images are developed by means of reversal developing (negative-positive developing). In the case of a digital light source today, although it varies according to the light source used in the exposer, the image area ratio is generally low; in response, it is advantageous if a reversal developing system, in which toner developing is carried out on a written part, allows for the lifetime of a light source or the like. There are two methods, i.e. a one-component system in which developing is only carried out by toner, and a two-component system in which a two-component developer composed of toner and carriers is used; the developing unit (304) can be favorably used in both cases. For example, when a two-component developer is used, the developing device of yellow (304Y) includes a nonmagnetic yellow toner and magnetic carriers. The developing device of magenta (304M) includes a nonmagnetic magenta toner and magnetic carriers.

The developing device of cyan (304C) includes a nonmagnetic cyan toner and magnetic carriers. Meanwhile, as to an after-mentioned developing unit (313) for black, a developing device of black (313K) includes a nonmagnetic black toner and magnetic carriers.

By being transferred to transfer paper, a toner image formed on a photoconductor becomes an image on the transfer paper; on this occasion, there are two methods. One is a method of directly transferring a toner image developed on a photoconductor surface to transfer paper, and the other is a method of temporarily transferring a toner image from a photoconductor to an intermediate transfer member, and then transferring this to transfer paper. Both cases are applicable to the present invention. Here, an intermediate transfer member temporarily supports the toner images of each color developed, and forms an image in which a plurality of colors are sequentially superimposed, by retransferring these toner images onto the transfer member. It is possible to use a transfer belt or transfer roller for a transfer bearing member, but it is desirable that a contact type of a transfer belt, transfer roller, etc. generating less ozone be used. The intermediate transfer member (305*a*) is rotationally driven in the direction of the arrow (R5), set on a plurality of rollers. Provided on the inside of the intermediate transfer member (305*a*), the primary transfer roller (305*b*) presses the intermediate transfer member (305*a*) against the photoconductor (301) surface. A primary transfer bias is applied to the primary transfer roller (5*b*) from a primary transfer bias applying power supply (not shown in the figure), and thus toner images of each color on the photoconductor (301) are transferred onto the intermediate transfer member (305*a*) and sequentially superimposed. 10 The secondary transfer roller (306) transfers a color toner image on the intermediate transfer member (305*a*) to a transfer material (P) such as paper, and rotates in the direction of the arrow (R6). The transfer material (P) is stored in a paper feed cassette (330), and provided to a first transfer portion (transfer nip portion) (N1) situated between the intermediate transfer member (305*a*) and the secondary transfer roller (306) at a predetermined timing by a feeding conveyance unit (not shown in the figure). On this occasion, a secondary transfer bias is applied to the secondary transfer roller (306) from a secondary transfer bias applying power supply (not shown in the figure), and thus a color toner image of the three colors on the intermediate transfer member (305*a*) is secondarily transferred onto the transfer material (P) at one time.

When toner images are directly transferred from a photoconductor to a transfer material without using an intermediate transfer member like the one described above, toner images of a plurality of colors are formed on a photoconductor, and the toner images are transferred onto the transfer material at one time.

Note that although both a constant-voltage system and a constant-current system are applicable to a voltage/current applying system at the time of transfer, a constant-current system that is able to keep the transfer charge amount constant and that is superior in stability is more desirable. What is particularly suitable is a method of controlling a current value to a photoconductor, by deducting currents which flow through parts relating to a transfer member and which do not flow into the photoconductor, from currents which have been output from a power supply member (high-voltage power supply) supplying charge to the transfer member.

A transfer current is a current based upon a required charge amount given to peel off a toner electrostatically attached to a photoconductor and move it to a transfer receiving member (transfer paper, intermediate transfer member or the like). In order to avoid transfer defects such as a transfer residue, it is advisable to increase a transfer current; however, when negative-positive developing is used, charging with the opposite polarity to the charge polarity of a photoconductor is given, and electrostatic fatigue of the photoconductor will therefore be conspicuous. A large transfer current is advantageous in that it is possible to give a charge amount which is greater than the electrostatic adhesion between a photoconductor and a toner; however, a discharge phenomenon arises between a transfer member and a photoconductor when the current value is greater than a certain threshold value, and toner images minutely developed are disturbed as a result. Thus, a maximum value is in such a range as can prevent this discharge phenomenon from arising. This threshold value varies depending upon the gap (distance) between a transfer member and a photoconductor, upon the materials forming them, and upon the like. A conventional transfer member can be used for the transfer member as long as it can satisfy the structure of the present invention.

Also, decreasing the photoconductor surface potential (part not exposed with writing light) after transfer by controlling a transfer current as described earlier makes it possible to lower the photoconductor passage charge amount per cycle of image formation, which is effective in the present invention.

The cleaning device (7*a*) removes a color toner (residual toner) which has not been transferred to the intermediate transfer member (5*a*) or the recording material (P) but remains on the photoconductor (1), when a color toner image on the photoconductor (1) is transferred to the intermediate transfer member (5*a*) or the recording material (P). When there is a toner remaining on the photoconductor (1), it is removed from the photoconductor (1) by a fur brush or blade. Cleaning is sometimes carried out only with a cleaning brush, and a conventional one, exemplified primarily by a fur brush or magnetic fur brush, is used for a cleaning brush.

The intermediate transfer member cleaning device (7*b*) removes a color toner (residual toner) which has not been transferred onto the recording material (P) but remains on the intermediate transfer member (5*a*), when a color toner image on the intermediate transfer member (5*a*) is transferred onto the recording material (P).

In the vicinity of the photoconductor (10) for black image formation, a charger (11), an exposer (12), a developing unit (black developing unit) (13), a transfer roller (transfer device) (14), a cleaning device (15) and the like are disposed roughly in this order with respect to the rotational direction (direction of the arrow R10) of the photoconductor (10).

The charger (11) evenly charges the photoconductor (10) surface to a predetermined polarity and potential. The exposer (12) forms a latent electrostatic image for black, by irradiating the photoconductor (10) surface with laser light after the photoconductor (10) has been charged, in accordance with image information. The developing unit (13) develops a latent electrostatic image as a black toner image, by attaching a black toner to the latent electrostatic image. The transfer roller (14) touches the photoconductor (10) surface to form a second transfer nip portion (N2) between itself and the photoconductor (10), and rotates in the arrow (R14) direction. In this second transfer portion (N2), a black toner image on the photoconductor (10) is transferred by the transfer roller (14) to the recording material (P), to whose surface color toner images of yellow, magenta and cyan have been transferred in the first transfer portion (N1).

The recording material (P) to which a full-color toner image of the four colors has been thus transferred is conveyed to a fixing device (20), where the recording material (P) is heated and pressurized and the full-color toner image of the four colors is fixed on the surface thereof. Accordingly, a full-color image of the four colors is formed on the recording material (P). Meanwhile, a black toner (residual toner) which has not been transferred onto the recording material (P) but remains on the photoconductor (10) is removed by the cleaning device (15).

Although not shown in the figure, a light source for a charge-eliminating lamp or the like may be suitably selected from conventional charge eliminators as long as it can remove a charge remaining on the photoconductors (1) and (10); examples thereof include a laser diode (LD) and an electroluminescence (EL). Alternatively, a combination of a fluorescent lamp, tungsten lamp, halogen lamp, mercury-vapor lamp, sodium-vapor lamp, xenon lamp, etc. and a certain optical filter, or the like can be used. Filters such as a sharp-cut filter, a band-pass filter, a near-infrared cut filter, a dichroic filter, an interference filter and a color temperature conversion filter are applicable to the optical filter.

Figure 17:
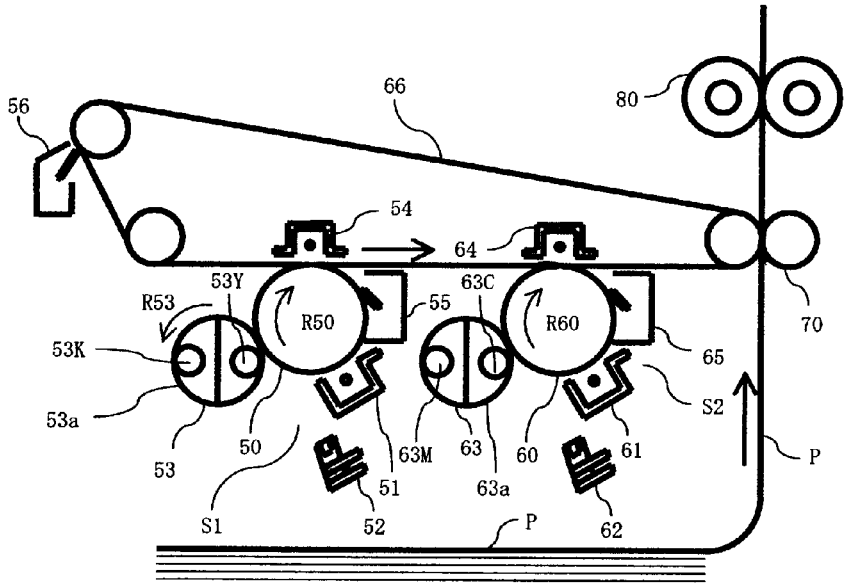
FIG. 17 is a schematic diagram for explaining a two-drum system electrophotographic process and an image forming apparatus of the present invention.

Next, another example of an image forming apparatus of the present invention is shown in FIG. 17 as Embodiment 2. The image forming apparatus in the figure is provided with two image forming units (S1) and (S2) having photoconductors (50) and (60) respectively.

The image forming apparatus in the figure is provided with an image forming section (first image forming section) which forms toner images for black and yellow, and an image forming section (second image forming section) which forms toner images for magenta and cyan. In the first image forming section, a yellow toner is mentioned as a color toner accompanying a black toner, but this is not always the case, and a color toner for magenta or cyan may be used in place of the yellow toner. For color toners supplied to the second image forming section, anything but color toners supplied to the first image forming section is acceptable, and there is no limitation in particular.

In the vicinity of the photoconductor (50), a charger (51), an exposer (52), a developing device (53), a transfer device (54), a cleaning device (55), an intermediate transfer member cleaning device (56) and the like are disposed roughly in this order with respect to the rotational direction (direction of the arrow R50) of the photoconductor (50).

The developing device (53), which is a developing unit, has two developing sleeves. The developing unit (53) is composed of a rotary (53a) which rotates in the direction of the arrow (R53), and two color developing devices (53Y) and (53K) mounted thereupon.

As for the developing device (53), a developing device for a color used in developing a latent electrostatic image formed on the photoconductor (50) is to be placed in a developing position opposed to the photoconductor (50) surface by the rotation of the rotary (53a) in the direction of the arrow (R53). Latent electrostatic images for the colors of yellow and black formed on the photoconductor (50) are given toners of each color and developed as toner images of each color, as developing biases are applied to the developing devices (53Y) and (53K) by a developing bias applying power supply (not shown in the figure).

Meanwhile, in the vicinity of the other photoconductor (60) for image formation, a charger (61), an exposer (62), a developing unit (63), a transfer device (64), a cleaning device (65) and the like are disposed roughly in this order with respect to the rotational direction (direction of the arrow R60) of the photoconductor (60).

The exposer (62) forms latent electrostatic images for magenta and cyan, by irradiating the photoconductor (60) surface with laser light after the photoconductor (60) has been charged, in accordance with image information. As for the developing unit (63), a developing device for a color used in developing a latent electrostatic image formed on the photoconductor (60) is to be placed in a developing position opposed to the photoconductor (60) surface by the rotation of a rotary (63*a*) in the direction of the arrow (R63). Latent electrostatic images for the colors of magenta and cyan formed on the photoconductor (60) are given toners of each color and developed as toner images of each color, as developing biases are applied to the developing devices (63M) and (63C) by a developing bias applying power supply (not shown in the figure).

In the transfer device (64), toner images of magenta and cyan formed on the photoconductor (60) are transferred to an intermediate transfer member (66), to whose surface toner images of black and yellow have been transferred in the transfer device (54). By being transferred onto transfer paper, a toner image formed on the photoconductor becomes an image on the transfer paper; on this occasion, there are two methods. One is a method of directly transferring a toner image developed on a photoconductor surface to transfer paper, and the other is a method of temporarily transferring a toner image from a photoconductor to an intermediate transfer member, and then transferring this to transfer paper. Both cases are applicable to the present invention.

Here, an intermediate transfer member temporarily bears each developed color image, and forms an image with a plurality of colors sequentially superimposed, by retransferring these toner images onto the transfer paper. It is possible to use a transfer belt or transfer roller for a transfer bearing member, but it is desirable that a contact type of a transfer belt, transfer roller, etc. generating less ozone be used. The intermediate transfer member (66) is rotationally driven in the direction of the arrow in the figure, set on a plurality of rollers. On the inside of the intermediate transfer member (66) are placed the corona transfer devices (54) and (64) by means of corona discharge. Primary transfer biases are applied to the corona transfer devices (54) and (64) from a primary transfer bias applying power supply (not shown in the figure), and thus toner images of each color on the photoconductors (50) and (60) are transferred onto the intermediate transfer member (66) and sequentially superimposed.

A secondary transfer bias is applied to a secondary transfer roller (70) from a secondary transfer bias applying power supply (not shown in the figure), and thus a full-color toner image on the intermediate transfer member (66) is secondarily transferred onto the recording material (P) at one time.

When toner images are directly transferred from a photoconductor to a recording material without using an intermediate transfer member like the one described above, a plurality of color toner images are formed on the photoconductor, and the toner images are transferred onto a transfer material at one time.

The recording material (P) to which a full-color toner image of the four colors has been thus transferred is conveyed to a fixing device (80), where the recording material (P) is heated and pressurized and the full-color toner image of the four colors is fixed on the surface thereof Meanwhile, a toner (residual toner) which has not been transferred onto the recording material (P) but remains on the intermediate transfer member (66) is removed by the intermediate transfer member cleaning device (56).

The image forming unit described above may be installed in a copier, facsimile or printer in a fixed manner, or may be incorporated in form of a process cartridge into those apparatuses. A process cartridge is a device (component) housing a photoconductor, and also including a latent electrostatic image forming unit, a developing unit, a transfer unit, a cleaning unit, a charge eliminating unit and the like.

—Latent Electrostatic Image-bearing Member—

The latent electrostatic image-bearing member preferably expresses a transit time shorter than the exposing-to-developing time length in an image forming apparatus used; it is desirable that the latent electrostatic image-bearing member have on a support a photosensitive layer which is formed of a charge generating layer and a charge transporting layer in a multi-layered structure; and the latent electrostatic image-bearing member may be suitably selected from latent electrostatic image-bearing members known in the art as long as it does not prevent generation of a sufficient amount photocarriers or hinder the mobility of a hole.

Next, an electrophotographic photoconductor used in the present invention will be explained in detail, with reference to drawings.

Figure 5:
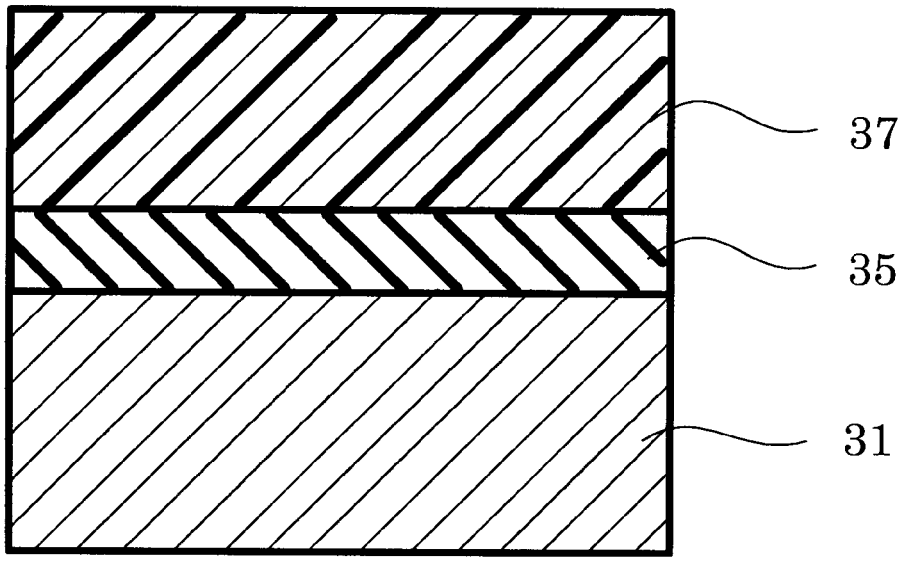
FIG. 5 is a diagram showing a layer structure of an electrophotographic photoconductor used in the present invention.

FIG. 5 is a cross-sectional view showing a structural example of an electrophotographic photoconductor used in the present invention, in which a charge generating layer (35) mainly containing an organic charge generating material as a charge generating material, and a charge transporting layer (37) mainly containing a charge transporting material are formed in a multi-layered structure on a support (31).

Figure 6:
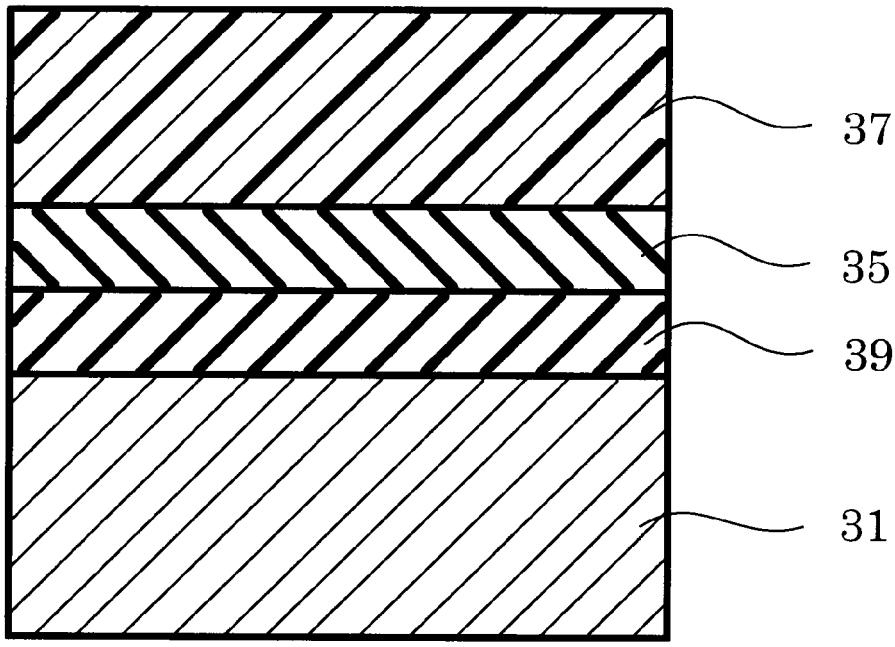
FIG. 6 is a diagram showing another layer structure of an electrophotographic photoconductor used in the present invention.

FIG. 6 is a cross-sectional view showing another structural example of an electrophotographic photoconductor used in the present invention, in which an intermediate layer (39), a charge generating layer (35) mainly containing an organic charge generating material as a charge generating material, and a charge transporting layer (37) mainly including a charge transporting material are formed in a multi-layered structure on a support (31).

Figure 7:
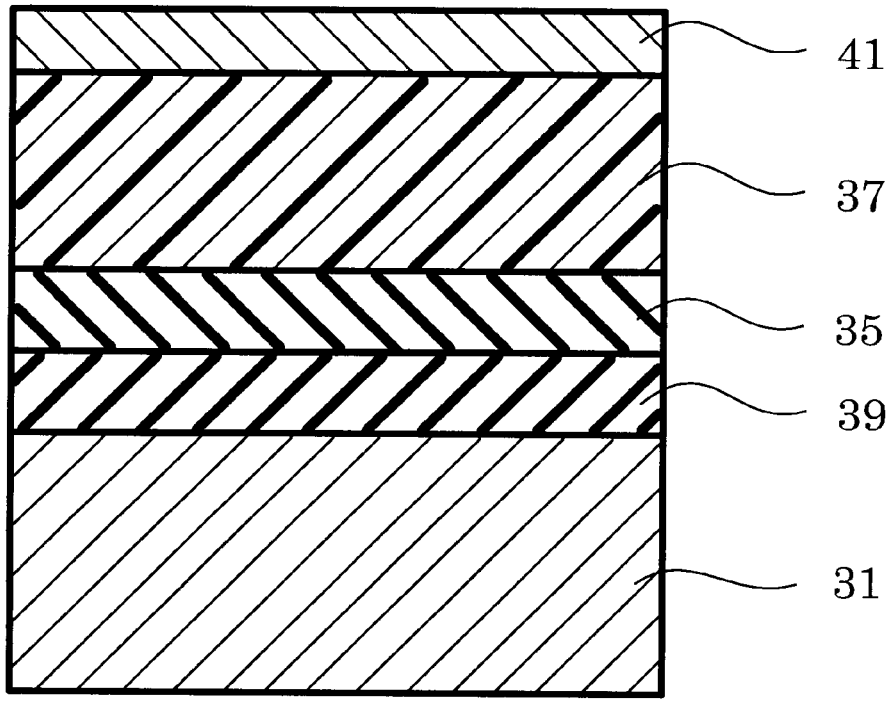
FIG. 7 is a diagram showing yet another layer structure of an electrophotographic photoconductor used in the present invention.

FIG. 7 is a cross-sectional view showing yet another structural example of an electrophotographic photoconductor used in the present invention, in which an intermediate layer (39), a charge generating layer (35) mainly containing an organic charge generating material as a charge generating material, and a charge transporting layer (37) mainly containing a charge transporting material are formed in a multi-layered structure on a support (31), and further, a protective layer (41) is provided on the charge transporting layer (photosensitive layer).

Figure 8:
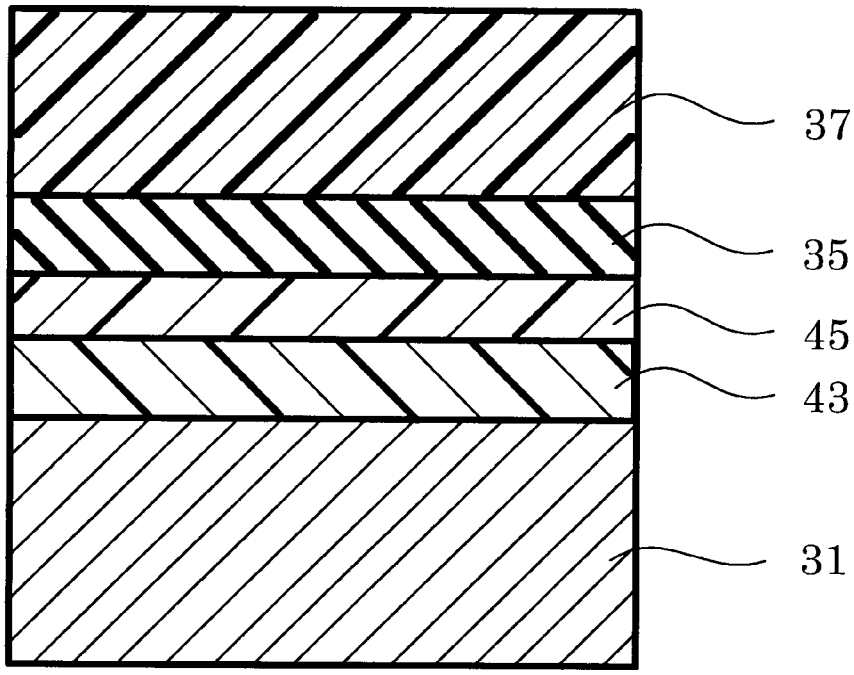
FIG. 8 is a diagram showing still yet another layer structure of an electrophotographic photoconductor used in the present invention.

FIG. 8 is a cross-sectional view showing still yet another structural example of an electrophotographic photoconductor used in the present invention, in which an intermediate layer (39) is formed by a charge blocking layer (43) and a moire prevention layer (45), and a charge generating layer (35) mainly including at least an organic charge generating material as a charge generating material, and a charge transporting layer (37) mainly including a charge transporting material are laid in a combined manner on the intermediate layer.

As the conductive support (31), what can be used is a conductive support showing such conductivity that the volume resistance is $10^{10}\Omega\cdot$cm or less; for example, a support formed by coating a film-like or cylindrical piece of plastic or paper with a metal such as aluminum, nickel, chrome, nichrome, copper, gold, silver or platinum or a metal oxide such as tin oxide or indium oxide by vapor deposition or sputtering; the support may be a plate of aluminum, aluminum alloy, nickel, stainless, etc., or a plate formed into a tube by extrusion or drawing and surface treating by cut, superfinishing and polishing can be used. Also, an endless nickel belt or an endless stainless belt can be used as a conductive support.

The support may be prepared by dispersing a conductive fine particle into a suitable binder resin and coating onto a support material. Examples of the conductive powder include carbon black, acethylene black, a metal powder of aluminum, nickel, iron, nichrome, copper, zinc, silver, etc., or a metal oxide powder of conductive tin oxide and ITO. Examples of the binder resin used together with the conductive powder include thermoplastic resins, thermosetting resins or photocurable resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethylcellulose resin, polyvinyl butyral, polyvinyl formal, polyvinyltoluene, poly-N-vinylcarbazole, acrylic resin, silicone resin, epoxy resin, melamine resin, urethane resin, phenol resin or alkyd resin. Such a conductive layer can be provided by dispersing the conductive powder and binder resin in a certain solvent, for example tetrahydrofuran, dichloromethane, methyl ethyl ketone or toluene, and then applying them.

Further, the support which is prepared by forming a conductive layer on the suitable cylindrical base with a thermal contraction inner tube made of a suitable material such as polyvinyl chloride, polypropylene, polyester, polystyrene, polyvinylidene chloride, polyethylene, chlorinated rubber or teflon (registered trademark) can also be favorably used as the conductive support in the present invention.

Of these, an aluminum cylindrical support easily capable of undergoing an anode oxide coating treatment can be most favorably used. The aluminum mentioned here includes both pure aluminum and aluminum alloy. Specifically, aluminums and aluminum alloys according to No. 1000 to No. 1999, No. 3000 to No. 3999 and No. 6000 to No. 6999 of JIS are most suitable. Anode oxide coat films are produced by subjecting various metals and alloys to an anodizing treatment in electrolyte solution; amongst those anode oxide coat films, a coat film called alumite, produced by subjecting aluminum or aluminum alloy to an anodizing treatment in electrolyte solution, is most suitable for a photoconductor used in the present invention. In particular, alumite is superior in preventing point defects (black spots and background smear) caused when used in reversal developing (negative-positive developing).

An anodizing treatment is carried out in an acid bath of chromic acid, sulfuric acid, oxalic acid, phosphoric acid, boric acid, sulfamic acid, etc. Of these, a treatment by means of a sulfate bath is most suitable. As one example, the treatment is carried out under the following conditions: 10% to 20% in sulfuric acid concentration, 5° C. to 25° C. in bath temperature, 1A/dm$^2$ to 4A/dm$^2$ in current density, 5V to 30V in electrolysis voltage, and 5 min to 60 min in treating time; however, note that the treatment is not necessarily carried out under these conditions. Since an anode oxide coat film thus produced is porous and highly insulative, its surface is very unstable. Accordingly, there is a temporal change after production, and property values of the anode oxide coat film are liable to change. In order to avoid this, it is desirable that the anode oxide coat film be also given a sealing treatment. For sealing treatments, there are some methods including a method of immersing an anode oxide coat film in a solution containing nickel fluoride or nickel acetate, a method of immersing an anode oxide coat film in boiling water, a method of treating an anode oxide coat film by means of pressurized steam, and the like. Amongst these methods, a method of immersing an anode oxide coat film in a solution containing nickel acetate is most favorable. Subsequent to the sealing treatment, a washing treatment is carried out on the anode oxide coat film. The main purpose of this treatment is to remove an excessive amount of materials, such as metallic salt, attached owing to the sealing treatment. When materials such as metallic salt remain excessively on the support (anode oxide coat film) surface, not only will the quality of a coat film formed thereupon be negatively affected, but also a low resistance component will generally remain, hence ironically a cause of occurrence of background smear. Washing may take place only once with the use of demineralized water, but normally washing takes place in many steps. On this occasion, it is desirable that a last washing liquid be as clean (deionized) as possible. Also, in one step of a multistep washing process, it is desirable that physical scrubbing be conducted by a contact member. It is desirable that the film thickness of an anode oxide coat film thusly formed be in the range of 5 μm to 15 μm or so. When the film thickness is far smaller than the foregoing, there will be an insufficient effect with respect to barrier properties as an anode oxide coat film, whereas when the film thickness is far greater than the foregoing, there will be a very great rise in time constant as an electrode, and so generation of a residual potential and a decrease in the response of a photoconductor are probable.

In light of the compactness of an image forming apparatus, it is desirable that a support be shaped like a cylinder (drum) whose external diameter is 40 mm or less.

Next, the intermediate layer (39) will be examined. An intermediate layer is, in general, formed mainly of resin; it is desirable that this resin be highly resistant to typical organic solvents, in consideration that it is coated with a solvent serving as a photosensitive layer. Examples of the resin include water-soluble resins such as polyvinyl alcohol, casein and sodium polyacrylate; alcohol-soluble resins such as copolymerized nylon and methoxymethylated nylon; and curable resins forming three-dimensional networks, such as polyurethane, melamine resin, phenol resin, alkyd-melamine resin and epoxy resin.

It is possible that an intermediate layer contains metal oxides for reduction of residual potential or the like, which simultaneously has such an effect as moire prevention. Examples of metal oxides include titanium oxide, silica, alumina, zirconium oxide, tin oxide and indium oxide. Amongst these, titanium oxide and tin oxide, in particular, are effectively used. Also, metal oxides used may be given surface treatment if necessary.

These intermediate layers can be formed by using a certain solvent and a certain coating method as in the case of the photosensitive layer. It is appropriate that the thickness of an intermediate layer be 0 μm to 5 μm.

The intermediate layer (39) has at least two functions, i.e. a function of preventing a charge of an opposite polarity, induced to the electrode side when a photoconductor is charged, from being injected into a photosensitive layer, and another function of preventing moire caused at the time of writing by coherent light similar to laser light. A functionally-divided intermediate layer, in which these functions are assigned to two layers or more in a divided manner, is an effective means for a photoconductor used in the present invention. The following explains a functionally-divided intermediate layer composed of a charge blocking layer (43) and a moire prevention layer (45).

The charge blocking layer (43) is a layer having the function of preventing a charge of an opposite polarity, induced to the electrode (conductive support (31)) when a photoconductor is charged, from being injected into a photosensitive layer from the support. It has the function of preventing hole injection in the case of negative charge, and the function of preventing electron injection in the case of positive charge. Examples of the charge blocking layer include an anode oxide coating typified by an aluminum oxide layer; an inorganic-type insulating layer typified by SiO; a layer formed by a glassy network of a metal oxide; a layer formed of polyphosphazene; a layer formed of an aminosilane reaction product; a layer formed of an insulative binder resin; and a layer formed of a curable binder resin. Amongst these layers, a layer formed of an insulative binder resin and a layer formed of a curable binder resin, able to be formed in accordance with a wet coating method, can be favorably used. A charge blocking layer is used with a moire prevention layer and a photosensitive layer formed thereupon in a multi-layered structure; therefore, when these layers are provided by a wet coating method, it is important that the charge blocking layer be formed of such a material or have such a structure as prevents the coat film from being corroded by coating solvents for the moire prevention layer and the photosensitive layer.

Examples of usable binder resins include thermoplastic resins and thermosetting resins such as polyamide, polyester and vinyl chloride-vinyl acetate copolymer; for example, it is also possible to use a thermosetting resin in which a compound containing a plurality of active hydrogen atoms (hydrogen atoms in —OH groups, —$NH_2$ groups, —NH groups, etc.) and a compound containing a plurality of isocyanate groups and/or a compound containing a plurality of epoxy groups are thermally polymerized. In this case, examples of a compound having a plurality of active hydrogen atoms include an acrylic-type resin containing active hydrogen, such as polyvinylbutyral, phenoxy resin, phenol resin, polyamide, polyester, polyethyleneglycol, polypropylene glycol, polybutylene glycol or hydroxyethyl methacrylate. Examples of a compound containing a plurality of isocyanate groups include tolylenediisocyanate, hexamethylene diisocyanate, diphenylmethane diisocyanate, etc. or a prepolymer thereof Examples of a compound containing a plurality of epoxy groups include bisphenol A type epoxy resin. In particular, polyamide can be most favorably used, in terms of film forming properties, environmental stability and solvent resistance. Amongst polyamides, N-methoxymethylated nylon is most suitable. N-methoxymethylated nylon can be obtained by modifying a polyamide which contains polyamide 6 as a component, for example in accordance with the method proposed by T. L. Cairns (J. Am. Chem. Soc. 71. P651 (1949)). N-methoxymethylated nylon is produced by substituting a methoxymethyl group for a hydrogen atom in an amide bond of an original polyamide. The substitution ratio can be selected in a wide range, depending upon a modifying condition; however, it is desirable in terms of environmental stability that the substitution ratio be in the range of 10 mol % to 85 mol %, because the hygroscopicity of an intermediate layer is curbed to some extent and N-methoxymethylated nylon is superior in alcohol affinity. It is more desirable that the substitution ratio be in the range of 20 mol % to 50 mol %. Also, it is desirable that the substitution ratio be 85 mol % or less; as the amide substitution degree (degree of N-N-methoxymethyl) increases, alcoholic solvent affinity increases; however, since a relaxation condition of main chains, a coordinated state between main chains, or the like possibly changes, strongly affected by bulk side chain groups around the main chains, hygroscopicity also increases and crystallizability decreases, which causes the melting point to decrease, and mechanical strength and elasticity decrease. It is more desirable that the substitution ratio be 70 mol % or less. Further, according to a result of study, as a nylon, nylon 6 is most favorable, and nylon 66 is second most favorable; conversely, a copolymerized nylon such as nylon 6/66/610 is not much favorable, as opposed to the disclosure in Japanese Patent Application Laid-Open (JP-A) No. 9-265202.

Thermosetting resins produced by thermally polymerizing oil-free alkyd resins and amino resins, such as butylated melamine resins, and further, photocurable resins produced for example by combining resins having unsaturated bonds, such as polyurethanes having unsaturated bonds and unsaturated polyesters, and photopolymerization initiators, such as thioxanthone-based compounds and methylbenzyl formate, can also be used as binder resins.

Additionally, a binder resin may have a rectifiable conductive polymer or have a function such as the controlling of charge injection from a base by adding a resin/compound with an acceptor (donor) property according to a charge polarity.

Also, it is desirable that the film thickness of a charge blocking layer be approximately in the range of 0.1 μm to 2.0 μm or so, more desirably in the range of 0.3 μm to 2.0 μm. As a charge blocking layer becomes thick, an increase in residual potential becomes conspicuous especially at low temperature and low humidity, due to the repetition of charging and exposure; whereas, as it becomes very thin, an effect with respect to blocking properties decreases. An agent, a solvent, an additive, a hardening accelerator and the like necessary for hardening (crosslinkage) are added to the charge blocking layer (43) if need be, and the charge blocking layer (43) is formed on a base by blade coating, an immersion coating method, spray coating, beat coating, a nozzle coating method, etc. according to an ordinary procedure. After applied, the charge blocking layer (43) is dried or hardened by drying, heating, or hardening with the use of light or the like.

The moire prevention layer (45) has the function of preventing a moire image caused by light interference inside a photosensitive layer, when writing is carried out by means of coherent light similar to laser light. When an intermediate layer is functionally divided, a metal oxide is contained in a moire prevention layer such that this moire prevention layer has a photocarrier generating function at the time of writing. Basically, the moire prevention layer has the function of dispersing the writing light. Having a material of a great refractive index is effective for a moire prevention layer to express such a function.

Since, in a photoconductor having a functionally-divided intermediate layer, charge injection from the support (31) is prevented by a charge blocking layer, it is desirable in terms of prevention of residual potential that at least a charge of the same polarity as a charge on the charged photoconductor surface be able to be moved in a moire prevention layer. Thus, in the case of a negatively-charged photoconductor, for example, it is desirable that a moire prevention layer be given electron conductivity, and so it is desirable that a moire prevention layer having a metal oxide with electron conductivity or a conductive moire prevention layer be used. Alternatively, the use of an electronically conductive material (for example accepter), etc. for a moire prevention layer makes the effect of the present invention even more remarkable.

For a binder resin, a material similar to that of a charge blocking layer can be used, but in light of the fact that a photosensitive layer (charge generating layer (35) and charge transporting layer (37)) is formed on a moire prevention layer, it is important that the material of the binder resin not be corroded by a coating solvent for the photosensitive layer (charge generating layer and charge transporting layer).

For a binder resin, a thermosetting resin is favorably used. In particular, a mixture of alkyd resin and melamine resin is most favorably used. On this occasion, the mixing ratio between an alkyd resin and a melamine resin is an important factor in determining the structure and properties of a moire prevention layer. When the ratio (weight ratio) of an alkyd resin to a melamine resin is in the range of 5:5 to 8:2, it can be said as a favorable mixing ratio. If more melamine resin is contained than in the case of 5:5, volume contraction becomes greater at the time of thermal hardening, easily causing coating defects, and the residual potential of a photoconductor is made greater, which is not favorable. Meanwhile, if more alkyd resin is contained than in the case of 8:2, the residual potential of a photoconductor can be effectively reduced, but the bulk resistance becomes very low, further causing background smear, which is not favorable either.

As to a moire prevention layer, the volume ratio between a metal oxide and a binder resin determines important properties thereof. Accordingly, it is important that the volume ratio of an metal oxide to a binder resin be in the range of 1:1 to 3:1. When the volume ratio of a metal oxide to a binder resin is less than 1:1, not only could moire preventing ability lower, but also the residual potential could rise greatly when repeatedly used. Meanwhile, when the volume ratio is in a greater range than 3:1, not only could adhesion of a binder resin be poor, but also surface properties of a coating could worsen and film forming properties of a photosensitive layer above could be negatively affected. This negative effect can become a serious problem, when a photosensitive layer is formed in a multi-layered structure, and a thin layer such as a charge generating layer is formed. And again, when the volume ratio is greater than 3:1, it is possible that a metal oxide surface cannot be covered with binder resin, and so the metal oxide surface directly makes contact with a charge generating material, thus making the incidence of photocarriers high, and negatively affecting background smear.

Further, by using two types of metal oxides of different average particle diameters for a moire prevention layer, it is possible to improve opacifying power over a conductive base and thus prevent moire; also, it is possible to remove a pinhole, which can be a cause of abnormal images. In order to do so, it is important that the ratio of the average particle diameter of the two types of metal oxides used be in a certain range ($0.2<D2/D1\leqq 0.5$). When the particle diameter ratio is outside a range prescribed by the present invention, in other words when the ratio of the average particle diameter of a metal oxide (T2) to the average particle diameter of a metal oxide (T1) that is larger in average particle diameter is very small ($0.2\geqq D2/D1$), activity on metal oxide surfaces increases, and electrostatic stability in an electrophotographic photoconductor is greatly impaired. Also, when the ratio of the average particle diameter of the other metal oxide (T2) to the average particle diameter of one metal oxide (T1) is very large ($D2/D1>0.5$), opacifying power over a conductive base lowers, and preventing power over moire and abnormal images lowers. The average particle diameter mentioned here is calculated from a particle size distribution measurement obtained when strong dispersion is conducted in an aqueous system.

Also, how large is the average particle diameter (D2) of the metal oxide (T2) that is smaller in particle diameter is an important factor, and $0.05\ \mu m<D2<0.20\ \mu m$ is important. When the average particle diameter (D2) is 0.05 μm or less, opacifying power lowers, and moire could be generated. Meanwhile, when the average particle diameter (D2) is 0.20 μm or more, the filling percentage of metal oxides on a moire prevention layer is lowered, and thus effect of preventing background smear cannot be sufficiently exerted.

Also, the mixing ratio (weight ratio) between the two types of metal oxides is also an important factor. When $T2/(T1+T2)$ is less than 0.2, the filling percentage of the metal oxides is not much great, and thus effect of preventing background smear cannot be sufficiently exerted. Meanwhile, when $T2/(T1+T2)$ is greater than 0.8, opacifying power lowers, and moire could be caused. Therefore, $0.2\leqq T2/(T1+T2)\leqq 0.8$ is important.

Also, it is appropriate that the thickness of the moire prevention layer be in the range of 1 μm to 10 μm, preferably 2 μm to 5 μm. When the layer thickness is less than 1 μm, expression of the prevention effect is poor, whereas when the layer thickness is more than 10 μm, residual potential accumulates, which is not desirable.

Metal oxides are dispersed along with a solvent and a binder resin by means of a ball mill, a sand mill, an attritor, etc. according to an ordinary procedure, with the addition of an agent, a solvent, an additive, a hardening accelerator and the like necessary for hardening (crosslinkage) if need be, and then formed on a base by means of blade coating, an immersion coating method, spray coating, beat coating, a nozzle coating method, etc. according to an ordinary procedure. After applied, the moire prevention layer is dried or hardened by drying, heating, or hardening with the use of light or the like.

Next, a photosensitive layer will be explained. A photosensitive layer is composed of the charge generating layer (35) which contains an organic charge generating material as a charge generating material, and the charge transporting layer (37) including a charge transporting material as a main component.

The charge generating layer (35) is a layer including an organic charge generating material as a charge generating material, as a main component. The charge generating layer (35) is formed, as an organic charge generating material is dispersed in a certain solvent, along with a binder resin if necessary, with the use of a ball mill, an attritor, a sand mill, a supersonic wave, etc., and this mixture is applied on a conductive support and dried.

Examples of the binder resin used in a charge generating layer if necessary include polyamide, polyurethane, epoxy resin, polyketone, polycarbonate, silicone resin, acrylic resin, polyvinylbutyral, polyvinyl formal, polyvinylketone, polystyrene, polysulfone, poly-N-vinylcarbazole, polyacrylamide, polyvinyl benzal, polyester, phenoxy resin, vinyl chloride-vinyl acetate copolymer, polyvinyl acetate, polyphenylene oxide, polyamide, polyvinylpyridine, cellulosic resin, casein, polyvinyl alcohol and polyvinylpyrrolidone. To 100 parts by weight of charge generating material, it is appropriate that the amount of binder resin be 0 part by weight to 500 parts by weight, preferably 10 parts by weight to 300 parts by weight.

Examples of the solvent used here include isopropanol, acetone, methyl ethyl ketone, cyclohexanone, tetrahydrofuran, dioxane, ethyl cellusolve, ethyl acetate, methyl acetate, dichloromethane, dichloroethane, monochlorobenzene, cyclohexane, toluene, xylene and ligroin. Examples of a coating method of a coating solution include an immersion coating method, spray coating, beat coating, nozzle coating, spinner coating and ring coating. It is appropriate that the film thickness of a charge generating layer be in the range of 0.01 μm to 5 μm, preferably in the range of 0.1 μm to 2 μm.

For a charge generating material, an organic charge generating material can be used.

For organic charge generating materials, conventional materials can be used, preferably disazo pigments or trisazo pigments and phthalocyanine series pigments. Examples thereof include phthalocyanine series pigments such as metal phthalocyanine and metal-free phthalocyanine; azlenium salt pigments; squaric acid methine pigments; azo pigments having carbazole skeletons; azo pigments having triphenylamine skeletons; azo pigments having diphenylamine skeletons; azo pigments having dibenzothiophene skeletons; azo pigements having fluorenone skeletons; azo pigments having oxadiazole skeletons; azo pigments having bisstilbene skeletons; azo pigments having distyryl oxadiazole skeletons; azo pigments having distyryl carbazole skeletons; perylene series pigments; anthraquinone series or polycyclic quinone series pigments; quinonimine series pigments; diphenylmethane and triphenylmethane series pigments; benzoquinone and naphthoquinone series pigments; cyanine and azomethine series pigments; indigoid series pigments; and bisbenzimidazole series pigments. These charge generating materials can be used independently or as mixtures each including two types or more.

Amongst them, the azo pigment represented by Structural Formula (1) below is effectively used. In particular, an asymmetric azo pigment, in which $Cp_1$ and $Cp_2$ are different from each other in an azo pigment, is great in carrier generating efficiency, and can therefore be effectively used as a charge generating material in the present invention.

Structural Formula (1)

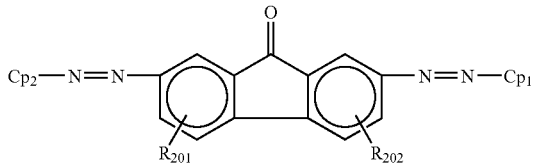

In Structural Formula (1), both $Cp_1$ and $Cp_2$ denote coupler residues; $R_{201}$ and $R_{202}$ each denote a hydrogen atom, a halogen atom, an alkyl group, an alkoxy group or a cyano group, and whether $R_{201}$ and $R_{202}$ are the same or different does not matter. $Cp_1$ and $Cp_2$ are represented by Structural Formula (2) below.

Structural Formula (2)

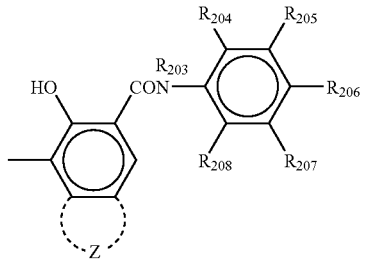

In Structural formula (2), $R_{203}$ denotes a hydrogen atom, an alkyl group such as a methyl group or ethyl group, or an aryl group such as a phenyl group. $R_{204}$, $R_{205}$, $R_{206}$, $R_{207}$ and $R_{208}$ each denote a hydrogen atom, a nitro group, a cyano group, a halogen atom such as fluorine, chlorine, bromine or iodine, an alkyl halide group such as a trifluoromethyl group, an alkyl group such as a methyl group or ethyl group, an alkoxy group such as a methoxy group or ethoxy group, a dialkylamino group, or a hydroxyl group; and Z denotes an atom group necessary to form a substituted/unsubstituted aromatic carbocycle or a substituted/unsubstituted aromatic heterocycle.

Also, titanyl phthalocyanine can be effectively used for a charge generating material in the present invention. In particular, a titanylphthalocyanine crystal that has a maximum diffraction peak of at least 27.2° of Bragg angle (2θ±0.2°), especially a titanylphthalocyanine crystal that has a maximum diffraction peak of at least 27.2°, has major peaks at 9.4°, 9.6° and 24.0°, has a minimum-angle diffraction peak at 7.3°, does not have a diffraction peak between the peaks at 7.3° and 9.4°, and does not have a diffraction peak at 26.3°, in an X-ray diffraction spectrum using a CuKα X-ray (1.542 Å), is great in carrier generating efficiency, and can therefore be effectively used as a charge generating material in the present invention.

As to an organic charge generating material contained in an electrophotographic photoconductor in the present invention, the effect can be expressed by reducing the particle size of a charge generating material as much as possible; it is desirable that the average particle size be 0.25 μm or less, more desirably 0.2 μm or less. A production method thereof is described below. A method for controlling the particle size of a charge generating material contained in a photosensitive layer is a method in which after a charge generating material is dispersed, coarse particles greater than 0.25 μm in size are removed.

Here, the average particle size denotes the volume average particle diameter, which can be determined by an ultracentrifugal automatic particle size distribution measuring apparatus CAPA-700 (produced by Horiba, Ltd.). On this occasion, the average particle size is calculated as a particle diameter (median diameter) equivalent to 50% of a cumulative distribution. However, there is a possibility that coarse particles existing in small amounts can not be detected by this method; accordingly, in order to calculate the average particle size in further detail, it is important to observe a charge generating material powder or a dispersion liquid thereof under an electron microscope, and thusly calculate the size thereof.

Next, a method in which after an organic charge generating material is dispersed, coarse particles are removed will be described.

The foregoing method is a method in which after preparing a dispersion liquid containing particles that have been made as fine as possible, the dispersion liquid is filtered with a certain filter. As for the preparation of the dispersion liquid, a typical method is used; a dispersion liquid is obtained, as an organic charge generating material is dispersed in a certain solvent, along with a binder resin if necessary, with the use of a ball mill, an attritor, a sand mill, a bead mill, a supersonic wave, etc. On this occasion, it is advisable to select a binder resin according to the electrostatic properties of a photoconductor or the like, and to select a solvent according to its wettability to a pigment, the dispersibility of a pigment, or the like.

This method is very effective in that it is even possible to remove coarse particles remaining in small amounts which are invisible to the naked eye (or which cannot be detected by means of particle diameter measurement), and also in that a particle size distribution is tightly controlled. Specifically, a dispersion liquid prepared in that manner is filtered with a filter of 5 μm or less in effective hole diameter, more preferably 3 μm or less, and a dispersion liquid is thus completed. According to this method as well, it is possible to prepare a dispersion liquid only including an organic charge generating material which is small in particle size (0.25 μm or less, preferably 0.2 μm or less), and by installing in an image forming apparatus a photoconductor utilizing this dispersion liquid, the effects of the present invention are made even more remarkable.

On this occasion, when the particle size of the dispersion liquid filtered is very large, or the particle size distribution is very wide, it is possible that loss caused by filtration may become great, or filtration may be made impossible because of clogging caused. Therefore, in a dispersion liquid before filtered, it is desirable that dispersion be continued until the average particle size attains 0.3 μm or less and the standard deviation thereof attains 0.2 μm or less. When the average particle size is 0.3 μm or more, loss caused by filtration becomes great, and when the standard deviation is 0.2 μm or more, there could be such a trouble that filtering time may lengthen greatly.

As to a charge generating material used in the present invention, intermolecular hydrogen bonding force, which is characteristic of a charge generating material showing a high-sensitive property, is very strong. Thus, interaction between particles in pigment particles dispersed is also very strong. As a result, there is a very strong possibility that charge generating material particles dispersed by a dispersing device or the like will flocculate again because of dilution or the like; by conducting filtration with a filter whose size is smaller than a particular size after dispersion as described above, it is possible to remove such a flocculation product. On this occasion, since a dispersion liquid is in a state of thixotropy, even particles which are smaller in size than the effective hole diameter of a filter used are removed. Alternatively, it is possible to change a liquid with structural viscosity into a state close to newtonian character by means of filtration. Thus, by removing coarse particles of a charge generating material, the effect of the present invention is improved remarkably.

A filter with which the dispersion liquid is filtered varies according to the size of coarse particles to be removed; according to a study by the present inventors, with respect to a photoconductor used in an electrophotographic apparatus which requires a resolution of 600 dpi or so, the existence of coarse particles of 3 μm or more in size, at least, has an impact on images. Therefore, a filter with an effective hole diameter of 5 μm or less should be used. It is more desirable that a filter with an effective hole diameter of 3 μm or less be used. As this effective hole diameter becomes smaller, there will be a greater effect on removal of coarse particles, but if the effective hole diameter is very small, necessary pigment particles themselves will be filtered out, and so there has to be an appropriate size. Moreover, if it is very small, there will be problems arising in which filtration takes a great deal of time, a filter is clogged, an enormous load is put when a liquid is sent using a pump or the like, and so forth. Here, it goes without saying that a material which is resistant to a solvent used in the dispersion liquid to be filtered is used for the filter.

The charge transporting layer (37), a layer including a charge transporting material as a main component, can be formed, as a charge transporting material and a binder resin are dissolved or dispersed in a certain solvent, and this mixture is applied on a charge generating layer and dried. Additionally, it is possible to add a plasticizer, a leveling agent, an antioxidant and the like if necessary.

Charge transporting materials can be divided into hole transporting materials and electron transport materials. Examples of hole transporting materials include poly-N-vinylcarbazole and derivatives thereof, poly-γ-carbazolylethylglutamate and derivatives thereof, pyrene-formaldehyde condensates and derivatives thereof, polyvinylpyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other conventional materials. Each of these charge transporting materials may be used alone or in combination with two or more.

Examples of electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, 1,3,7-trinitrodibenzothiophene-5,5-dioxide and benzoquinone derivatives.

Examples of binder resins include thermoplastic and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethylcellulose resin, polyvinyl butyral, polyvinyl formal, polyvinyltoluene, poly-N-vinylcarbazole, acrylic resin, silicone resin, epoxy resin, melamine resin, urethane resin, phenol resin and alkyd resin.

To 100 parts by weight of binder resin, it is appropriate that the amount of charge transporting material be 20 parts by weight to 300 parts by weight, preferably 40 parts by weight to 150 parts by weight. It is desirable that the thickness of a charge transporting layer be in the range of 5 μm to 100 μm or so.

For the solvent used here, tetrahydrofuran, dioxane, toluene, dichloromethane, monochlorobenzene, dichloroethane, cyclohexanone, methyl ethyl ketone, acetone or the like can be used. The use of a non-halogenated solvent is desirable, due to the intention of reducing damage to the environment and so forth. Specifically, cyclic ethers such as tetrahydrofuran, dioxolan and dioxane, aromatic series hydrocarbons such as toluene and xylene, and derivatives thereof can be favorably used.

In the present invention, a plasticizer and a leveling agent may be added to the charge transporting layer. For the plasticizer, a typical resinous plasticizer, such as dibutyl phthalate or dioctyl phthalate, can be used as it is, and it is appropriate that the amount thereof used be in the range of 0% by weight to 30% by weight or to the content of the binder resin. For the leveling agent, a silicone oil such as dimethyl silicone oil or methylphenyl silicone oil, a polymer having a perfluoroalkyl group for a side chain, or an oligomer can be used, and it is appropriate that the amount thereof used be in the range of 0% by weight to 1% by weight to the content of the binder resin.

The transit time of a photoconductor is, in general, determined by the carrier transporting ability of this charge transporting layer as described above. A control method of the transit time will be described.

The transit time depends upon the time during which photocarriers generated in a charge generating layer are injected into a charge transporting layer, cross the charge transporting layer and erase a surface charge. Within the foregoing time, the time during which carriers are injected and erase a surface charge can be ignored because it is sufficiently short in comparison with the time during which carriers cross the charge transporting layer. Therefore, the transit time roughly denotes the time during which carriers cross the charge transporting layer.

To control the transit time means to control the transfer velocity of carriers and the moving distance of the carriers. The former depends upon the composition, material, etc. of a charge transporting layer, and the latter depends upon the thickness of the charge transporting layer.

The composition of the charge transporting layer is determined by the type of a charge transporting material, the type of a binder resin, the charge transporting material density, and the presence/absence and type of additives. Amongst them, the type of a charge transporting material, the charge transporting material density, and the type of a binder resin greatly affect the composition of a charge transporting layer. As for the type of a charge transporting material, generally by using a material of great mobility for a charge transporting material, it is possible to shorten the transit time. As for the type of a binder resin, by using a binder resin of small polarity or a high-molecular charge transporting material, it is possible to shorten the transit time. As for the charge transporting material density, the higher the density is, the shorter the transit time can be made. As for the film thickness of a charge transporting layer, the smaller the film thickness is, the shorter the transit time can be made.

However, when the charge transporting layer is placed on a surface, it is hardly possible to design the charge transporting layer merely for shortening the transit time. For example, when the charge transporting material density is made high to a maximum degree, the transit time is shortened, to be sure, but abrasion resistance is extremely lowered, and the lifetime of the photoconductor is shortened. Also, when a charge transporting layer is made extremely thin, the transit time is shortened, but it is highly likely that side effects such as breakdown and background smear will be caused, and therefore a charge transporting layer cannot be easily made thin.

Therefore, a charge transporting layer is composed of the material, and the transit time is measured; optimization is achieved according to the relation between the transit time and the lifetime of a photoconductor.

Also, forming a protective layer on a surface layer, as the carrier transport velocity in a charge transporting layer is given top priority, is an effective means in the present invention. In this case, since it is possible to design the charge transporting layer only focusing attention on the carrier transfer velocity, with the abrasion resistance of the charge transporting layer ignored to some extent, the above-mentioned method can be employed.

As to an electrophotographic photoconductor of the present invention, a protective layer may be placed on a photosensitive layer, with the intention of protecting the photosensitive layer. In recent years, as computers have been used on a day-to-day basis, compactness of apparatuses, as well as high-speed output by printers, has been hoped for. Accordingly, by providing a protective layer and thusly improving durability, a photoconductor of the present invention, which is highly sensitive and free of abnormal defects, can be effectively used.

In this case, since the protective layer is placed as a photoconductor surface layer, lack of consideration of carrier transporting ability will affect the transit time. For this reason, layer structure and layer thickness are important to a protective layer. As to layer structure, after-mentioned two types can be effectively used. As to film thickness, it is important in whatever case not to make a protective layer thicker than necessary.

Effective protective layers used in the present invention are broadly divided into two types. One is a structure in which a filler is added to the inside of a binder resin. The other is a structure in which a crosslinkable binder is used.

First, the structure in which a filler is added to a protective layer will be explained.

Examples of materials used for protective layers include resins such as ABS resin, ACS resin, olefin-vinyl monomer copolymer, chlorinated polyether, allyl resin, phenol resin, polyacetal, polyamide, polyamide imide, polyacrylate, polyallyl sulfone, polybutylene, polybutylene terephthalate, polycarbonate, polyarylate, polyether sulfone, polyethylene, polyethylene terephthalate, polyimide, acrylic resin, polymethylpentene, polypropylene, polyphenylene oxide, polysulfone, polystyrene, AS resin, butadiene-styrene copolymer, polyurethane, polyvinyl chloride, polyvinylidene chloride and epoxy resin. Amongst them, polycarbonate and polyarylate can be most favorably used.

In addition, the following can be added to protective layers, with the intention of improving abrasion resistance: fluorine resins such as polytetrafluoroethylene; silicone resins; these resins having inorganic fillers such as titanium oxide, tin oxide, potassium titanate and silica, or organic fillers dispersed; and the like. Examples of filler materials used for protective layers of photoconductors are as follows: as organic filler materials, there are fluorine resin powders such as polytetrafluoroethylene, silicone resin powders, a-carbon powders, and the like; as inorganic filler materials, there are metal powders such as copper, tin, aluminum and indium, metal oxides such as silica, tin oxide, zinc oxide, titanium oxide, indium oxide, antimony oxide, bismuth oxide, antimony-doped tin oxide and tin-doped indium oxide, and inorganic materials such as potassium titanate. In particular, inorganic pigments and metal oxides are favorable, and silica, titanium oxide and alumina are effective.

The filler density in a protective layer varies according to the type of filler used or the electrophotographic process condition in which a photoconductor is used; however, it is desirable that the ratio of a filler in a total solid content on the top surface side of the protective layer be approximately 5% by weight or more, preferably 10% by weight or more and 50% by weight or less, more preferably 30% by weight or less. It is desirable that the volume average particle diameter of a filler used be in the range of 0.1 μm to 2 μm, more desirably 0.3 μm to 1 μm. In this case, when the average particle diameter is very small, abrasion resistance of the protective layer cannot be sufficiently exerted; in contrast, when it is very large, surface properties of a coating may be degraded, or a coat film itself cannot be formed.

The average particle diameter of a filler in the present invention denotes a volume average particle diameter, unless there is a specific mention to state otherwise; it is calculated by an ultracentrifugal automatic particle size distribution measuring apparatus CAPA-700 (produced by Horiba, Ltd.). Here, the average particle diameter of a filler is calculated as a particle diameter (median diameter) equivalent to 50% of a cumulative distribution. Also, it is important that the standard deviation of particles measured at the same time be 1 μm or less. When the standard deviation is greater than this value, the particle size distribution may be so wide that the effect of the present invention cannot be remarkably obtained.

Also, the pH of a filler used in the present invention greatly affects resolution and the dispersibility of the filler. One reason for that is thought to be that a filler, particularly a metal oxide, leaves hydrochloric acid, etc. when produced. When the residual amount of hydrochloric acid, etc. is large, occurrence of image blur is inevitable, and hydrochloric acid, etc. may affect the dispersibility of a filler depending upon the residual amount thereof.

Another reason for that is a difference in charging properties on the surface of a filler, particularly on the surface of a metal oxide. Normally, particles dispersed in a liquid are positively or negatively charged, and ions having the opposite charge gather to keep the particles electrically neutral; here, the dispersed state of the particles is stabilized as an electric double layer is formed. The potential (zeta potential) of a place in the liquid gradually lowers as measured away from the particles, and the potential of an electrically neutral region which is sufficiently away from the particles stands at zero. Therefore, stability is improved as an increase in the absolute value of the zeta potential heightens the repulsion of particles, and stability is lowered as the absolute value of the zeta potential nears zero. Meanwhile, the zeta potential greatly varies according to the pH value of a system; at a certain pH value, the potential stands at zero and an isoelectric point is created. Accordingly, a dispersion system can be stabilized by raising the absolute value of the zeta potential, away from an isoelectric point of a system as much as possible.

In a structure of the present invention, it has been confirmed that a filler whose pH at the isoelectric point is 5 or more is favorable in preventing image blur, and that the more basic a filler is, the more greater effect it tends to have on the preventing of image blur. As to a basic filler of a high pH at an isoelectric point, the zeta potential becomes even higher when a system is acid, and dispersibility and the stability of dispersibility are thus improved.

Here, as the pH value of a filler in the present invention, the pH value from a zeta potential to an isoelectric point is written. On this occasion, the zeta potential was measured by a laser zeta electrometer produced by Otsuka Electronics Co., Ltd.

Further, for fillers which prevent image blur from easily arising, fillers of high electrical insulation quality ($10^{10}\Omega\cdot$cm or more in resistivity) are favorable, particularly fillers whose pH is 5 or more and fillers whose dielectric constant is 5 or more. Also, not to mention the fact that fillers whose pH is 5 or more or fillers whose dielectric constant is 5 or more can be used independently, it is also possible to combine fillers whose ph is 5 or less and fillers whose ph is 5 or more as mixtures each including two types or more and to combine fillers whose dielectric constant is 5 or less and fillers whose dielectric constant is 5 or more as mixtures each including two types or more. Amongst these fillers, α-alumina that is highly insulative and highly thermostable and has a hexagonal close packing structure with high abrasion resistance is particularly effective in that image blur can be prevented and abrasion resistance can be improved.

The resistivity of a filler used in the present invention is defined as follows. Since the resistivity value of a powder such as a filler varies according to a filling percentage, it needs to be measured under certain conditions. In the present invention, the resistivity value of a filler was measured using a similar apparatus to the measuring apparatus disclosed in Japanese Patent Application Laid-Open (JP-A) No. 5-113688 (FIG. 1), and the measured value was used. In the measuring apparatus, the electrode area is 4.0 $cm^2$. Before measurement, a sample amount is adjusted such that the distance between electrodes is made 4 mm by applying an load of 4 kg to an electrode on one side. Measurement is carried out with the weight of an upper electrode (1 kg) being applied, and with the applied voltage being 100V. As to the range over $10^6\Omega\cdot$cm, measurement was carried out by a HIGH RESISTANCE METER (Yokogawa-Hewlett-Packard Ltd.); as to the range thereunder, measurement was carried out by a DIGITAL MULTI METER (Fluke Corporation). A resistivity value obtained as a result of this measurement is defined as a resistivity value in the present invention.

The dielectric constant of a filler was measured as follows. Such a cell as used in the measurement of resistivity was used, the capacitance was measured after a load was applied, and the dielectric constant was thusly calculated. For the measurement of the capacitance, a DIELECTRIC LOSS MEASURING APPARATUS (Ando Electric Co., Ltd.) was used.

Further, these fillers can be surface-treated by at least one type of surface-treating agent, and this is favorable in that further dispersibility of fillers is possible. Since reduction in the dispersibility of fillers not only causes rise in residual potential but also causes reduction in the transperency of coat films, generation of coating defects and reduction in abrasion resistance, a serious problem in which achievement of high durability or high image quality is hampered may be caused. For surface-treating agents, all conventionally-used surface-treating agents are acceptable; however, surface-treating agents which make it possible to retain the insulating properties of fillers are favorable. For example, the following are more favorable in that further dispersibility of fillers and prevention of image blurring are possible: titanate-based coupling agents, aluminum-based coupling agents, zircoaluminate-based coupling agents, higher fatty acids, etc. or mixtures of the foregoing and silane coupling agents, and $Al_2O_3$, $TiO_2$, $ZrO_2$, silicone, aluminum stearate, etc. or mixtures thereof. Although treatment by silane coupling agents increases effects of image blurring, it is possible that the effects may be curbed by mixing the surface-treating agents and silane coupling agents. The surface-treating amount varies according to the average primary particle diameter of the filler used; however, it is appropriate that the surface-treating amount be in the range of 3% by weight to 30% by weight, more preferably in the range of 5% by weight to 20% by weight. When the surface-treating amount is smaller than this, dispersibility of a filler cannot be effectively obtained, and when the surface-treating amount is far greater than this, a sharp rise in residual potential is caused. Each of these filler materials is used alone or in combination with two or more. The surface-treating amount of a filler is defined as the weight ratio of a surface-treating agent used to a filler amount, as described above.

These filler materials can be dispersed by using a certain dispersing device. Also, a filler used is dispersed to a primary particle level due to the transmittance of the protective layer, and a filler with fewer aggregates is therefore favorable.

Also, a charge transporting material is contained in a protective layer to reduce residual potential and improve responsiveness. For charge transporting materials, the materials mentioned in the explanation of a charge transporting layer, and conventional charge transporting materials can be used. When a low-molecular charge transporting material is used as a charge transporting material, a density gradient in the protective layer may be provided. Reducing the surface side of the protective layer in density to improve abrasion resistance is an effective means. Here, the density denotes the ratio of the weight of a low-molecular charge transporting material to the gross weight of all materials constituting a protective layer, and a density gradient denotes such a gradient that the density lowers on the surface side with respect to the weight ratio. Also, the use of a high-molecular charge transporting material is very advantageous in improving the durability of a photoconductor. According to a result of study by the present inventors, in the case of a protective layer with such structure, a filler dispersed in the protective layer does not affect the transit time much, and the transit time is determined by the carrier transport velocity at the portion composed of [binder resin+charge transporting material] constituting a binder matrix. Therefore, in this case also, it is reasonable to apply such ideas as described for a charge transporting layer.

In addition, it is possible to use a conventional high-molecular charge transporting material for a binder resin in the protective layer. As an effect which is created when this is used, improvement in abrasion resistance and high-speed charge transport can be achieved.

As a formation method of the protective layer, an ordinary coating method is employed. Additionally, it is appropriate that the thickness of the protective layer be in the range of 0.1 μm to 10 μm or so.

Next, as to a binder structure of the protective layer, a protective layer with crosslinked structure will be explained (hereinafter referred to as crosslinked type protective layer).

As for the formation of a crosslinked structure, a reactive monomer having a plurality of crosslinkable functional groups in one molecule is used, crosslinking reaction is brought about by using light or thermal energy, and a three-dimensional network is formed. This network functions as a binder resin and expresses high abrasion resistance.

For the reactive monomer, a monomer having charge transporting ability wholly or partially is used. By using such a monomer, a charge transport site is formed in a network, and functions required for a protective layer can be sufficiently expressed. For the monomer having charge transporting ability, a reactive monomer with triarylamine structure can be effectively used. Such structure makes it possible to secure a sufficient carrier transport velocity and shorten the transit time.

A protective layer having such a network is, on the one hand, high in abrasion resistance, but on the other hand great in volume contraction at the time of crosslinking reaction, thereby possibly causing a crack when made very thick. In such a case, a protective layer may be formed into a multi-layered structure in which a protective layer of a low-molecular dispersed polymer is used for an under layer (photosensitive layer side) and a protective layer having a crosslinked structure is formed as an upper layer (surface side).

Amongst crosslinked type protective layers, a protective layer with a specific structure mentioned below can be used in a particularly effective manner.

The specific crosslinked type protective layer is a protective layer formed by hardening at least a trifunctional or more radical polymerizable monomer having no charge transporting structure and a monofunctional radical polymerizable compound having a charge transporting structure. Due to a crosslinked structure formed by hardening a trifunctional or more radical polymerizable monomer, a three-dimensional network is developed, a surface layer which is very high in crosslink density, very hard and highly elastic can be obtained, and the surface layer is even and very smooth; thus, high abrasion resistance and scratch resistance can be achieved. As just described, it is important to increase the crosslink density of a photoconductor surface, in other words the number of crosslinking bonds per unit volume; however, since a large number of bonds are formed in an instant in hardening reaction, internal stress arises owing to volume contraction. Since this internal stress increases as the film thickness of a crosslinked type protective layer becomes greater, it is likely that cracks and film peeling will arise when all layers in a protective layer are hardened. Even when this phenomenon does not appear in a primary stage, it may become liable to arise with time, affected by hazards and thermal variations of charging, developing, transfer and cleaning as a protective layer is repeatedly used in an electrophotographic process.

Methods for solving this problem are oriented toward softening a cured resin layer, for example (1) introducing a high-molecular component into a crosslinked layer and a crosslinked structure, (2) using monofunctional and difunctional radical polymerizable monomers in large amounts and (3) using polyfunctional monomers which have pliable groups; however, in any of the methods, the crosslink density of a crosslinked layer lowers, and so a dramatic increase in abrasion resistance cannot be achieved. In contrast to this, as for the photoconductor of the present invention, a crosslinked type protective layer high in crosslink density, in which a three-dimensional network is developed on a charge transporting layer, is provided, preferably with its film thickness set in the range of 1 μm to 10 μm; thus, the cracks and film peeling are prevented from arising, and also very high abrasion resistance can be achieved. By adjusting the thickness of the crosslinked type protective layer to the range of 2 μm to 8 μm, the problem can be solved even more easily, and also it is possible to select a material with high crosslink density leading to further improvement in abrasion resistance.

A photoconductor of the present invention can prevent cracks and film peeling for the reasons that internal stress does not increase as the crosslinked type protective layer can be made thin, internal stress in the crosslinked type protective layer serving as a surface can be moderated as there is a photosensitive layer or charge transporting layer placed thereunder, and so forth. Accordingly, it is not necessary for the crosslinked type protective layer to contain a large amount of high-molecular material; and scratches and toner filming resulting from incompatibility with a hardened material produced by a reaction between a high-molecular material and a radical polymerizable component (radical polymerizable monomer and radical polymerizable compound having a charge transporting structure), brought about when the crosslinked type protective layer contains the high-molecular material, are unlikely to arise. Further, when a thick film equivalent to all layers in the protective layer is hardened by irradiation of light energy, light transmission to the inside is restricted due to absorption by a charge transporting structure, thereby possibly preventing hardening reaction from progressing sufficiently. Since the crosslinked type protective layer of the present invention is made to be a thin layer of preferably 10 μm or less, hardening reaction progresses evenly to the inside, and high abrasion resistance can be maintained on the inside as well as on the surface. Also, in forming a crosslinked type protective layer of the present invention, a monofunctional radical polymerizable compound having a charge transporting structure is contained in addition to the trifunctional radical polymerizable monomer, and this radical polymerizable compound is taken into a crosslinking bond when the trifunctional or more radical polymerizable monomer is hardened. In contrast to the foregoing, when a low-molecular charge transporting material with no functional groups is contained in a crosslinked surface layer, their incompatibility causes deposition of the low-molecular charge transporting material or white turbidity, and the mechanical strength of the crosslinked surface layer decreases. Meanwhile, when a difunctional or more charge transport compound is used as a main component, it is fixed in a crosslinked structure by a plurality of bonds, and the crosslink density increases further; however, since a charge transporting structure is very large in volume, distortion of a cured resin structure becomes very great, which causes internal stress in a crosslinked type protective layer to increase.

Further, the photoconductor of the present invention has excellent electrical properties, and thus the photoconductor is excellent in repetitive stability, thereby making it possible to produce a highly durable and highly stabilized photoconductor. This is attributable to the fact that as a component material of the crosslinked type protective layer, a radical polymerizable compound having a monofunctional charge transporting structure is used and radical polymerizable compound is fixed as pendants between the crosslinked bonds. A charge transporting material having no functional group causes deposition and white turbidity as described above, resulting in conspicuous degradation of electrical properties such as reduction in sensitivity and increase in residual potential in repetitive use. When a difunctional or more charge transporting compound is mainly used, the compound is fixed by a plurality of bonds in the crosslinked structure; thus, an intermediate structure (cation radical) cannot be stably maintained at the time of charge transport, and a decrease in sensitivity and a rise in residual potential due to charge trapping are liable to arise. These deteriorations in electrical properties lead to a decrease in image density, and images having narrowing of letters and characters, etc. Further, in a photoconductor of the present invention, designing allowing for high mobility with little charge trapping, which is for conventional photoconductors, can be applied to a charge transporting layer provided as an under layer of the crosslinked type protective layer, and electrical side effects caused by the crosslinked type protective layer can be reduced to a minimum level.

Further, in the crosslinked type protective layer formation according to the present invention, in particular, the abrasion resistance can be remarkably exerted, by making the crosslinked type protective layer insoluble in organic solvent. A crosslinked type protective layer of the present invention is formed by hardening a trifunctional or more radical polymerizable monomer having no charge transporting structure and a monofunctional radical polymerizable compound having a charge transporting structure, and the whole layer has a high crosslink density with a three-dimensional network developed; however, it is possible that the crosslink density may locally lower and the crosslinked type protective layer may be formed as an aggregate of minute hardened materials which are crosslinked highly densely, depending upon contained materials other than the components (for example, additives such as a monofunctional or difunctional monomer, a high-molecular binder, an antioxidant, a leveling agent and a plasticizer, and dissolved mixture components from an under layer) and hardening conditions. The crosslinked type protective layer is weak in bonding force between hardened materials and soluble in organic solvent and also makes it easier for local abrasion and desorption to the extent of minute hardened materials to arise while repeatedly used in an electrophotographic process. By making a crosslinked type protective layer insoluble in organic solvent as in the present invention, a high degree of crosslinkage is obtained as an original three-dimensional network is developed, and also hardened materials are made high in molecular weight as a chain reaction progresses in a wide range; therefore, a dramatic improvement in abrasion resistance can be achieved.

Next, constituent materials for the crosslinked type protective layer coating solution of the present invention will be explained.

A trifunctional or more radical polymerizable monomer having no charge transporting structure in the present invention does not, for example, have a hole transport structure such as triarylamine, hydrazone, pyrazoline, carbazole, etc. or an electron transport structure such as an electron-withdrawing aromatic ring having a condensed polycyclic quinone, diphenoquinone, cyano group, nitro group, etc., and also the radical polymerizable monomer denotes a monomer having three radical polymerizable functional groups or more. For these radical polymerizable functional groups, any groups are suitable as long as they have carbon-carbon double bonds and are capable of radical polymerization. Examples of these radical polymerizable functional groups include the 1-substituted ethylene functional group, the 1,1-substituted ethylene functional group and both shown below.

(1) Examples of the 1-substituted ethylene functional group include the functional group represented by the following Structural Formula 10.

$CH_2{=}CH{-}X_1{-}$ Structural Formula 10

(In Structural Formula 10, $X_1$ denotes a phenylene group that may have a substituent group, an arylene group such as a naphthylene group, an alkenylene group that may have a substituent group, a —CO— group, a —COO— group, a —CON($R_{10}$)— group ($R_{10}$ denotes hydrogen, an alkyl group such as a methyl group or ethyl group, an aralkyl group such as a benzyl group, naphthylmethyl group or phenethyl group, or an aryl group such as a phenyl group or naphthyl group), or an —S— group.)

Specific examples of these functional groups include a vinyl group, a styryl group, a 2-methyl-1,3-butadienyl group, a vinylcarbonyl group, an acryloyloxy group, an acryloylamide group and a vinyl thioether group.

(2) Examples of the 1,1-substituted ethylene functional group include the functional group represented by the following Structural Formula 11.

$CH_2{=}C(Y){-}X_2{-}$ Structural Formula 11

(In Structural Formula 11, Y denotes an alkyl group that may have a substituent group, an aralkyl group that may have a substituent group, an aryl group that may have a substituent group such as a phenyl group or naphthyl group, a halogen atom, a cyano group, a nitro group, an alkoxy group such as a methoxy group or ethoxy group, a —$COOR_{11}$ group ($R_{11}$ denotes a hydrogen atom, an alkyl group that may have a substituent group such as a methyl group or ethyl group, an aralkyl group that may have a substituent group such as a benzyl group or phenethyl group, or an aryl group that may have a substituent group such as a phenyl group or naphthyl group), or a —$CONR_{12}R_{13}$ group ($R_{12}$ and $R_{13}$ each denote a hydrogen atom, an alkyl group that may have a substituent group such as a methyl group or ethyl group, an aralkyl group that may have a substituent group such as a benzyl group, naphthylmethyl group or phenethyl group, or an aryl group that may have a substituent group such as a phenyl group or naphthyl group, and $R_{12}$ and $R_{13}$ may be the same or different from each other.); meanwhile, $X_2$ denotes the same substituent group, single bond or alkylene group as $X_1$ in Structural Formula 10 above. Here, note that at least either Y or $X_2$ denotes an oxycarbonyl group, a cyano group, an alkenylene group or an aromatic ring.) Specific examples of these functional groups include an α-acryloyloxy chloride group, a methacryloyloxy group, an α-cyanoethylene group, an α-cyanoacryloyloxy group, an α-cyano phenylene group and an methacryloyl amino group.

Examples of substituent groups replacing these substituent groups for $X_1$, $X_2$ and Y include a halogen atom, a nitro group, a cyano group, an alkyl group such as a methyl group or ethyl group, an alkoxy group such as a methoxy group or ethoxy group, an aryloxy group such as a phenoxy group, an aryl group such as a phenyl group or naphthyl group, and an aralkyl group such as a benzyl group or phenethyl group.

Amongst these radical polymerizable functional groups, an acryloyloxy group and a methacryloyloxy group, in particular, are useful, and a compound with three acryloyloxy groups or more can be obtained, for example, by using a compound with three or more hydroxyl groups in a molecule thereof and acrylic acid (salt), acrylic acid halide or acrylic acid ester, and bringing them into ester reaction or ester exchange reaction. Also, a compound with three or more methacryloyloxy groups can be obtained in a similar manner. Additionally, radical polymerizable functional groups in a monomer having three or more radical polymerizable functional groups may be the same or different from each other.

For specific trifunctional or more radical polymerizable monomers having no charge transporting structure, the following compounds are mentioned as examples; however, these compounds do not include all such radical polymerizable monomers.

Examples of the radical polymerizable monomers used in the present invention include trimethylolpropane triacrylate (TMPTA), trimethylolpropane trimethacrylate, trimethylolpropane alkylene-modified triacrylate, trimethylolpropane ethyleneoxy-modified (hereinafter EO-modified)triacrylate, trimethylolpropane propyleneoxy-modified (hereinafter PO-modified)triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified (hereinafter ECH-modified) triacrylate, glycerol EO-modified triacrylate, glycerol PO-modified triacrylate, tris (acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritolethoxy tetraacrylate, phosphoric acid EO-modified triacrylate, 2,2,5,5,-tetrahydroxymethylcyclopentanone tetraacrylate. These can be used independently, or two or more types amongst these can be used together.

As to a trifunctional or more radical polymerizable monomer having no charge transporting structure in the present invention, since intricate crosslinking bonds are formed in a crosslinked type protective layer, it is desirable that the proportion of the molecular weight to the number of functional groups in the monomer (molecular weight/the number of functional groups) be 250 or less. Also, when this proportion is 250 or greater, the crosslinked type protective layer is soft and tends to lower in abrasion resistance somewhat; therefore, as to monomers with modified groups such as EO, PO and caprolactone amongst the monomers and the like mentioned above as examples, it is not desirable to use monomers with extremely long modified groups independently. The content of the trifunctional or more radical polymerizable monomer having no charge transporting structure for a crosslinked type protective layer in the total weight of the crosslinked type protective layer is 20% by weight to 80% by weight, preferably 30% by weight to 70% by weight. When the monomer component is less than 20% by weight, the three-dimensional crosslinking bond density in the crosslinked type protective layer is small, and therefore a dramatic improvement in abrasion resistance tends to be difficult to achieve in comparison with related art in which a thermoplastic binder resin is used. When the monomer component is greater than 80% by weight, the contained amount of a charge transport compound decreases, and therefore deterioration in electrical properties tends to arise. Since electrical properties and abrasion resistance required vary depending upon the process used, and thus the film thickness of a crosslinked type protective layer in the present photoconductor varies, the monomer component cannot be unequivocally defined; however, in light of a balance between both electrical properties and abrasion resistance, it is most desirable that the monomer component be in the range of 30% by weight to 70% by weight.

A monofunctional radical polymerizable compound having a charge transporting structure used in a crosslinked type protective layer of the present invention has, for example, a hole transport structure such as triarylamine, hydrazone, pyrazoline, carbazole, etc. or an electron transport structure such as an electron-withdrawing aromatic ring having a condensed polycyclic quinone, diphenoquinone, cyano group, nitro group, etc., and also the radical polymerizable compound denotes a compound having one radical polymerizable functional group. Examples of this radical polymerizable functional group include any of the radical polymerizable monomers, and an acryloyloxy group and a methacryloyloxy group are particularly useful. As a charge transporting structure, a triarylamine structure is highly effective, and particularly when the compound represented by General Structural Formula (1) or (2) is used, electrical properties such as sensitivity and residual potential can be favorably sustained.

General Structural Formula (1)

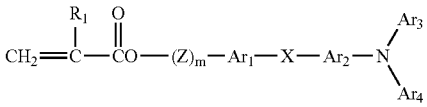

General Structural Formula (2)

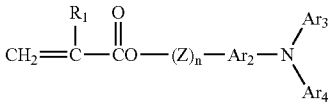

{In the general structural formulae, $R_1$ denotes a hydrogen atom, a halogen atom, an alkyl group that may have a substituent group, an aralkyl group that may have a substituent group, an aryl group that may have a substituent group, a cyano group, a nitro group, an alkoxy group, a —$COOR_7$ group ($R_7$ denotes a hydrogen atom, an alkyl group that may have a substituent group, an aralkyl group that may have a substituent group, or an aryl group that may have a substituent group), a carbonyl halide group, or a $CONR_8R_9$ group ($R_8$ and $R_9$ each denote a hydrogen atom, a halogen atom, an alkyl group that may have a substituent group, an aralkyl group that may have a substituent group, or an aryl group that may have a substituent group, and $R_8$ and $R_9$ may be the same or different from each other); $Ar_1$ and $Ar_2$ each denote a substituted/unsubstituted arylene group, and $Ar_1$ and $Ar_2$ may be the same or different from each other. $Ar_3$ and $Ar_4$ each denote a substituted/unsubstituted aryl group, and $Ar_3$ and $Ar_4$ may be the same or different from each other. X denotes a single bond, a substituted/unsubstituted alkylene group, a substituted/unsubstituted cycloalkylene group, a substituted/unsubstituted alkylene ether group, an oxygen atom, a sulfur atom or a vinylene group. Z denotes a substituted/unsubstituted alkylene group, a substituted/unsubstituted alkylene ether divalent group or an alkyleneoxycarbonyl divalent group. "m" and "n" respectively denote an integer of 0 to 3.}

Specific examples represented by General Structural Formulae (1) and (2) are shown below.

In General Structural Formulae (1) and (2), it is possible to mention that amongst substituent groups for $R_1$, an alkyl group can be a methyl group, ethyl group, propyl group, butyl group, etc.; an aryl group can be a phenyl group, naphthyl group, etc.; an aralkyl group can be a benzyl group, phenethyl group, naphthylmethyl group, etc.; and an alkoxy group can be a methoxy group, ethoxy group, propoxy group, etc. These groups may be replaced by a halogen atom, a nitro group, a cyano group, an alkyl group such as a methyl group or ethyl group, an alkoxy group such as a methoxy group or ethoxy group, an aryloxy group such as a phenoxy group, an aryl group such as a phenyl group or naphthyl group, and an aralkyl group such as a benzyl group or phenethyl group.

Amongst the substituent groups for $R_1$, a hydrogen atom and a methyl group are particularly favorable.

$Ar_3$ and $Ar_4$ respectively denote a substituted/unsubstituted aryl group; in the present invention, examples of the substituted/unsubstituted aryl group include condensed polycyclic hydrocarbon groups, non-condensed cyclic hydrocarbon groups and heterocyclic groups, and specific examples thereof include the following groups.

Examples of the condensed polycyclic hydrocarbon groups forming a ring and having 18 or less carbon atoms include a pentanyl group, an indenyl group, a naphthyl group, an azulenyl group, a heptalenyl group, a biphenylenyl group, an as-indacenyl group, an s-indacenyl group, a fluorenyl group, an acenaphthylenyl group, a pleiadenyl group, an acenaphthenyl group, a phenalenyl group, a phenanthryl group, an anthryl group, a fluoranthenyl group, an acephenanthrylenyl group, an aceanthrylenyl group, a triphenylel group, a pyrenyl group, a crycenyl group and a naphthacenyl group.

Examples of the non-condensed cyclic hydrocarbon groups include monovalent groups of monocyclic hydrocarbon compounds such as benzene, diphenyl ether, polyethylene diphenyl ether, diphenyl thioether and diphenyl sulfone; monovalent groups of non-condensed polycyclic hydrocarbon compounds such as biphenyl, polyphenyl, diphenylalkane, diphenylalkene, diphenylalkyne, triphenylmethane, distyrylbenzene, 1,1-diphenyl cycloalkane, polyphenylalkane and polyphenylalkene; and monovalent groups of cyclic assembly hydrocarbon compounds such as 9,9-diphenylfluorene.

Examples of the heterocyclic groups include monovalent groups of carbazole, dibenzofuran, dibenzothiophene, oxadiazole and thiadiazole.

The aryl groups denoted by $Ar_3$ and $Ar_4$ may respectively have such a substituent group as shown below.

(1) Halogen atom, cyano group, nitro group and the like.

(2) Alkyl group, preferably straight-chain/branched-chain alkyl group having $C_1$ to $C_{12}$, especially $C_1$ to $C_8$, more preferably $C_1$ to $C_4$; these alkyl groups may have a phenyl group substituted with a fluorine atom, a hydroxyl group, a cyano group, an alkoxy group having $C_1$ to $C_4$, a phenyl group or a halogen atom, and an alkyl group having $C_1$ to $C_4$ or an alkoxy group having $C_1$ to $C_4$. Specific examples thereof include methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group and 4-phenylbenzyl group.

(3) Alkoxy group (—$OR_2$); $R_2$ denotes the alkyl group defined in (2). Specific examples thereof include methoxy group, ethoxy group, n-propoxy group, i-propoxy group, t-butoxy group, n-butoxy group, s-butoxy group, i-butoxy group, 2-hydroxyethoxy group, benzyloxy group and trifluoromethoxy group.

(4) Aryloxy group; examples of the aryl group include phenyl group and naphthyl group. These groups may contain an alkoxy group having $C_1$ to $C_4$, an alkyl group having $C_1$ to $C_4$ or a halogen atom as a substituent group. Specific examples thereof include phenoxy group, 1-naphthyloxy group, 2-naphthyloxy group, 4-methoxyphenoxy group and 4-methylphenoxy group.

(5) Alkylmercapto group or arylmercapto group; examples thereof include methylthio group, ethylthio group, phenylthio group and p-methylphenylthio group.

Structural Formula 11

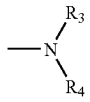

(6)

(In the structural formula, $R_3$ and $R_4$ each denote independently a hydrogen atom, and any of the alkyl groups or aryl groups defined in (2). Examples of the aryl group include phenyl group, biphenyl group and naphthyl group. These groups may contain an alkoxy group having $C_1$ to $C_4$, an alkyl group having $C_1$ to $C_4$ or a halogen atom as a substituent group. $R_3$ and $R_4$ may together form a ring.)

Specific examples thereof include amino group, diethylamino group, N-methyl-N-phenylamino group, N,N-diphenylamino group, N,N-di(tolyl)amino group, dibenzyl amino group, piperidino group, morpholino group and pyrrolidino group.

(7) Alkylenedioxy group, alkylenedithio group, etc. such as methylenedioxy group, methylenedithio group, etc.

(8) Substituted/unsubstituted styryl group, substitute d/unsubstituted β-phenylstyryl group, diphenylaminophenyl group, ditolylaminophenyl group and the like.

The arylene groups denoted by $Ar_1$ and $Ar_2$ are divalent groups derived from the aryl groups denoted by $Ar_3$ and $Ar_4$.

"X" in Structural Formulae 10 and 11 denotes a single bond, a substituted/unsubstituted alkylene group, a substituted/unsubstituted cycloalkylene group, a substituted/unsubstituted alkylene ether group, an oxgen atom, a sulfur atom or a vinylene group.

For the substituted/unsubstituted alkylene group, the following are suitable: straight-chain/branched-chain alkylene groups having $C_1$ to $C_{12}$, preferably $C_1$ to $C_8$, more preferably $C_1$ to $C_4$. These alkylene groups may have a phenyl group substituted with a fluorine atom, a hydroxyl group, a cyano group, an alkoxy group having $C_1$ to $C_4$, a phenyl group or a halogen atom, and an alkyl group having $C_1$ to $C_4$ or an alkoxy group having $C_1$ to $C_4$. Specific examples thereof include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methoxyethylene groups, benzylidene groups, phenylethylene groups, 4-chlorophenylethylene groups, 4-methylphenylethylene groups and 4-biphenylethylene groups.

The substituted/unsubstituted cycloalkylene group is a cyclic alkylene group having $C_5$ to $C_7$. These cyclic alkylene groups may have a fluorine atom, a hydroxyl group, an alkyl group having $C_1$ to $C_4$ and an alkoxy group having $C_1$ to $C_4$. Specific examples thereof include cyclohexylidene group, cyclohexylene group and 3,3-dimethylcyclohexylidene group.

For the substituted/unsubstituted alkylene ether group, the following are suitable: ethyleneoxy, propyleneoxy, ethyleneglycol, propylenglycol, diethyleneglycol, tetraethyleneglycol, and tripropyleneglycol. The alkylene ether groups and the alkylene groups may have a substituent group such as hydroxyl group, methyl group and ethyl group.

Vinylene group are represented by

Structural Formula 12

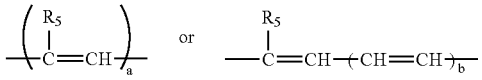

R5 denotes hydrogen, an alkyl group (any of the alkyl groups defined in (2)) and an aryl group (any of the aryl groups denoted by $Ar_3$ and $Ar_4$); "a" denotes an integer of 1 or 2; and "b" denotes an integer of 1 to 3.

"Z" in Structural Formulae 10 and 11 denotes a substituted/unsubstituted alkylene group, a substituted/unsubstituted alkylene ether divalent group or an alkyleneoxycarbonyl divalent group.

Examples of the substituted/unsubstituted alkylene group include one similar to the alkylene group denoted by X.

Examples of the substituted/unsubstituted alkylene ether divalent group include the alkylene ether divalent group denoted by X.

Examples of the alkyleneoxycarbonyl divalent group include a caprolactone divalent modified group.

Also, examples of a monofunctional radical polymerizable compound having a charge transporting structure in the present invention include a compound having the structure shown in General Structural Formula (3).

General Structural Formula (3)

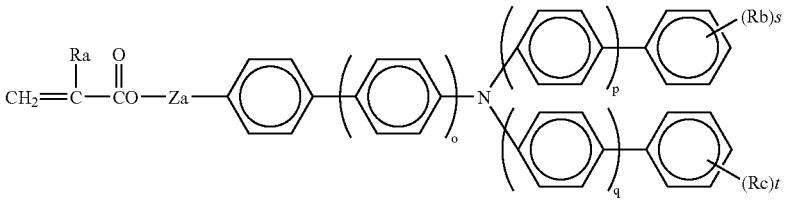

(In Formula (3), "o", "p" and "q" respectively denote an integer of 0 or 1; Ra denotes a hydrogen atom or a methyl group; Rb and Rc, which are substituent groups other than hydrogen atoms, denote alkyl groups of 1 to 6 in carbon number and may be different from each other in carbon number when their carbon numbers are 2 or more. "s" and "t" respectively denote an integer of 0 to 3. Za denotes a single bond, a methylene group or an ethylene group.)

General Structural Formula (3)

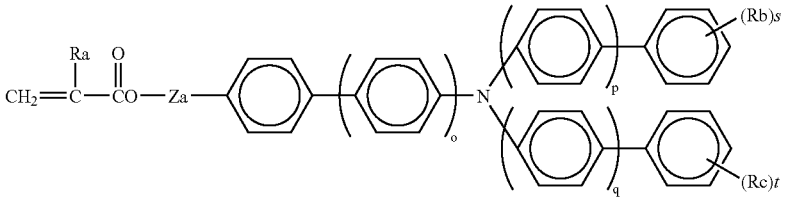

For the compound represented by the general structural formula, a compound in which the substituent groups of Rb and Rc are methyl groups or ethyl groups is particularly favorable.

As to the monofunctional radical polymerizable compounds having charge transporting structures represented by General Structural Formulae (1) to (3), particularly the one represented by General Structural Formula (3), used in the present invention, since the monofunctional radical polymerizable compound is polymerized with double bonds between carbon atoms being open at both sides, they do not have a terminate structure and they are incorporated into chain polymers; when in polymers formed by crosslinking polymerization between the monofunctional radical polymerizable compounds and trifunctional or more radical polymerizable monomers, the monofunctional radical polymerizable compound exists in high-molecular main chains and also in crosslinked chains between main chains (a crosslinked chain is classified into an intermolecular crosslinked chain formed between one high molecule and another, and an intramolecular crosslinked chain in which a site where there is a folded main chain and a monomer-derived site polymerized in a position away from the foregoing site in the main chain are crosslinked in one high molecule); whether the monofunctional radical polymerizable compound exists in main chains or in crosslinked chains, triarylamine structures, which hang down from chain parts, each have at least three aryl groups disposed in radial directions from a nitrogen atom; although bulky, it is not that the triarylamine structures are directly combined to the chain parts, but the triarylamine structures are hanging down from the chain parts via carbonyl groups or the like, and so the triarylamine structures are fixed in such a manner as to allow for flexible steric positioning; thus, since these triarylamine structures can be spatially positioned in such a manner as to be suitably adjacent to each other in polymers, there is little structural distortion in molecules; also, when used as surface layers of electrophotographic photoconductors, it is inferred that intramolecular structures which are relatively free of severance of charge transport paths can be employed.

Specific examples of monofunctional radical polymerizable compounds having charge transporting structures in the present invention will be shown below; however, it should be noted that the monofunctional radical polymerizable compounds are not confined to the following compounds.

No. 1

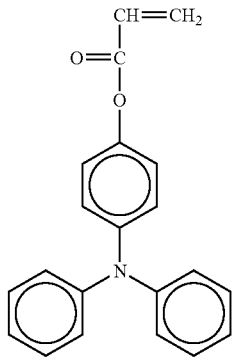

No. 2

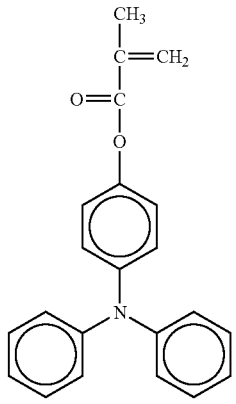

No. 3

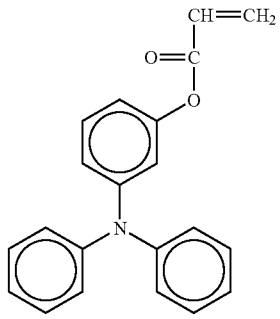

-continued
No. 4
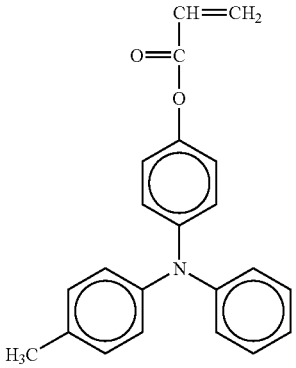
No. 5
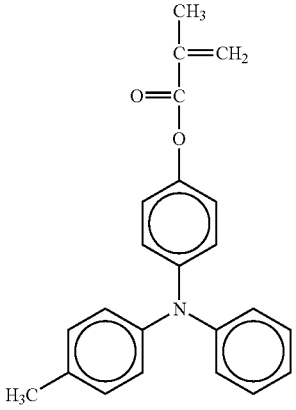
No. 6
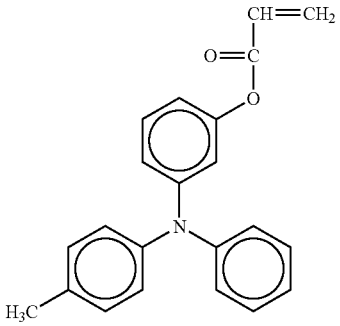
No. 7
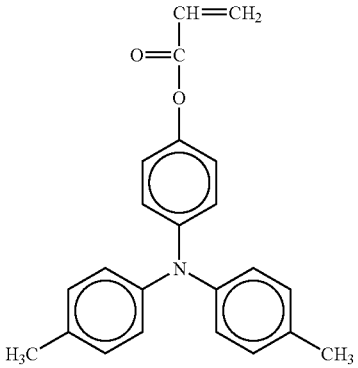
-continued
No. 8
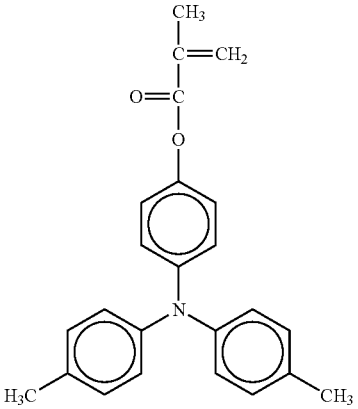
No. 9
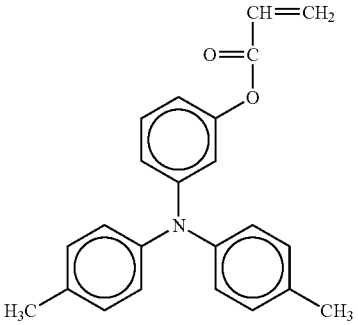
No. 10
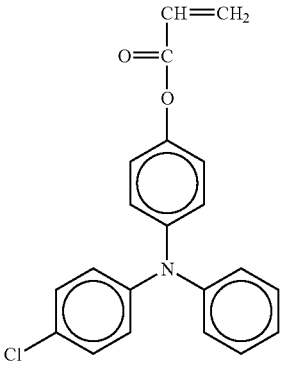
No. 11
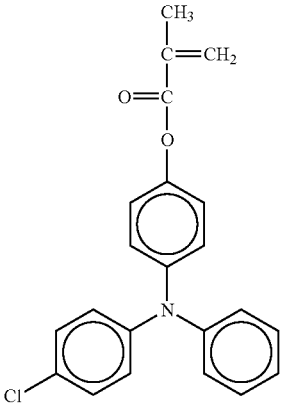

-continued
No. 12
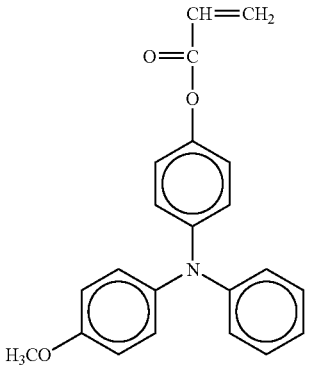
No. 13
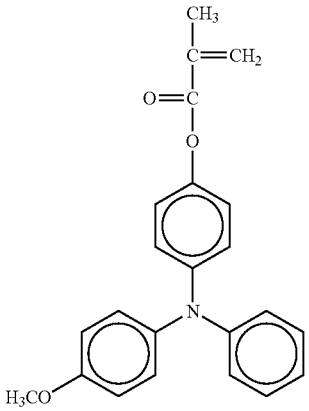
No. 14
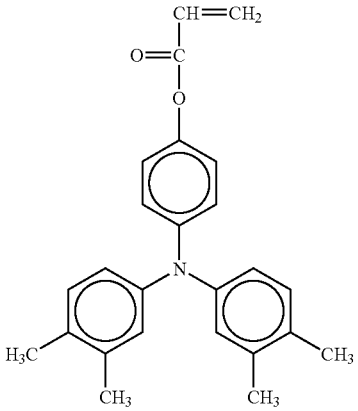
No. 15
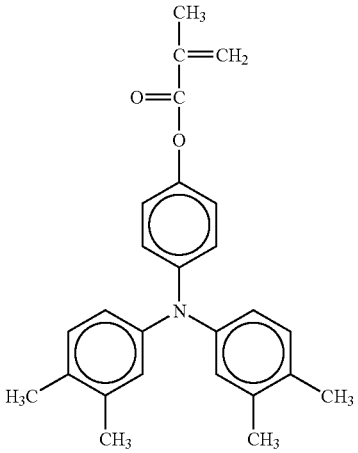
-continued
No. 16
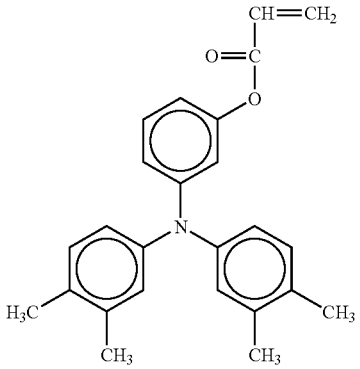
No. 17
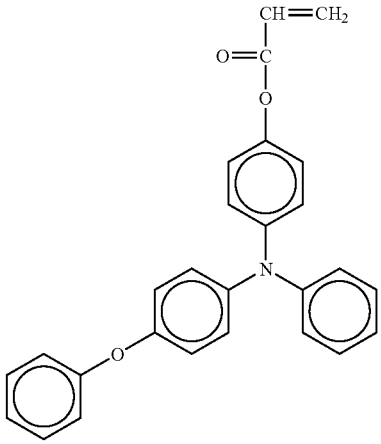
No. 18
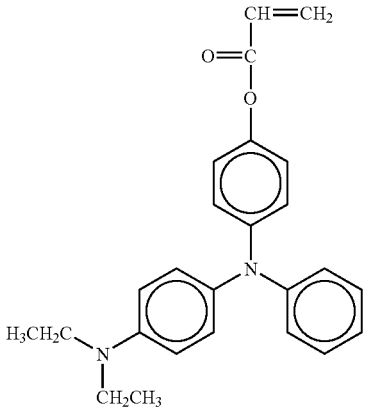

-continued
No. 19
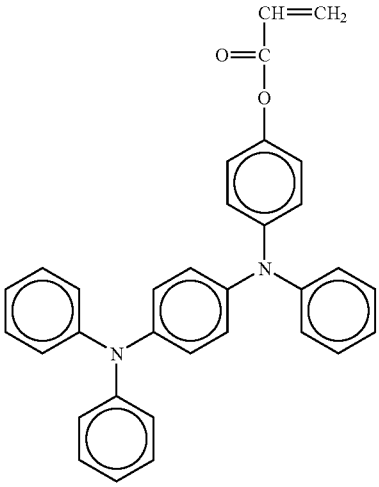
No. 20
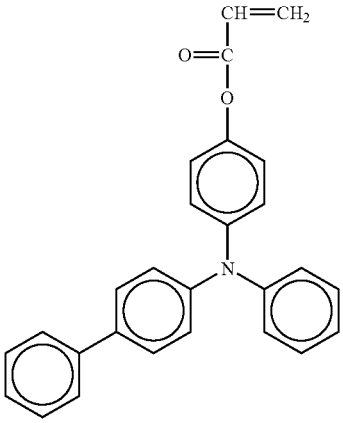
No. 21
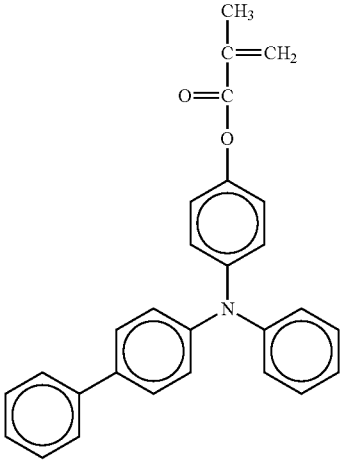
-continued
No. 22
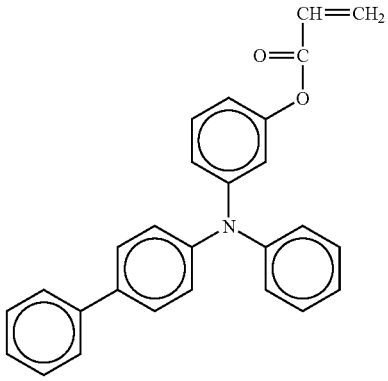
No. 23
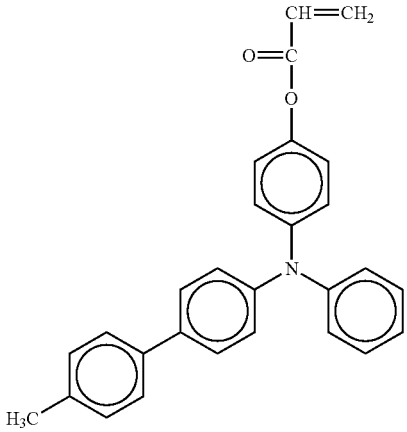
No. 24
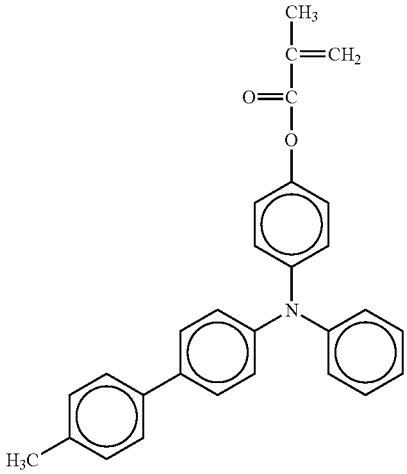

-continued
No. 25
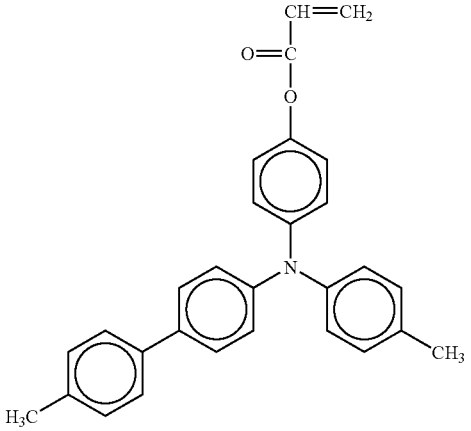
No. 26
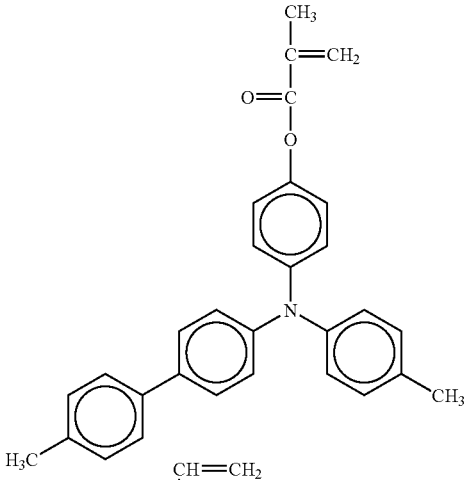
No. 27
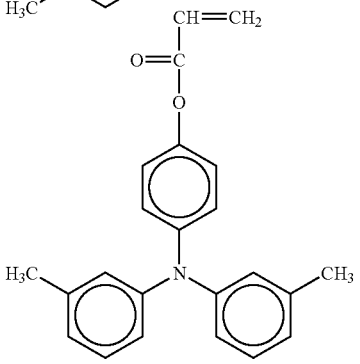
No. 28
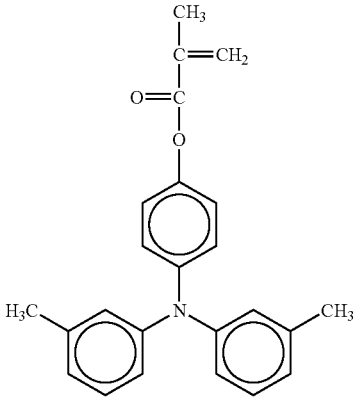
-continued
No. 29
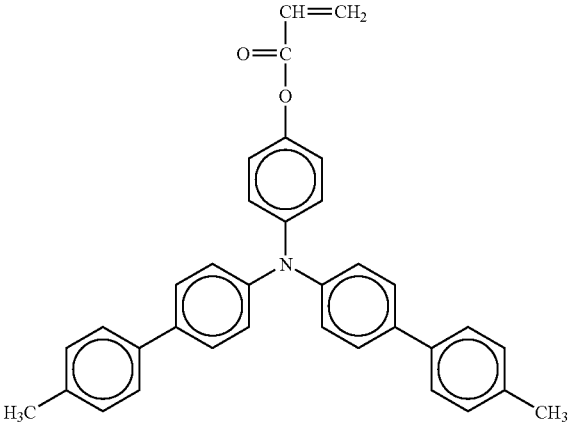
No. 30
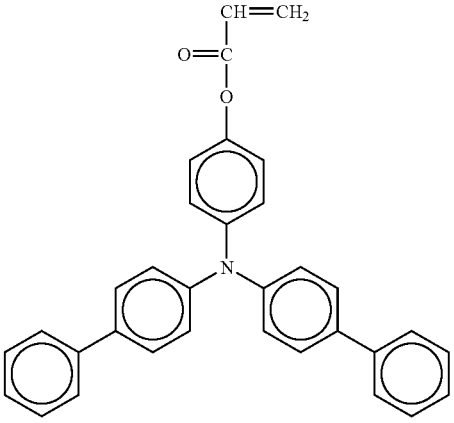
No. 31
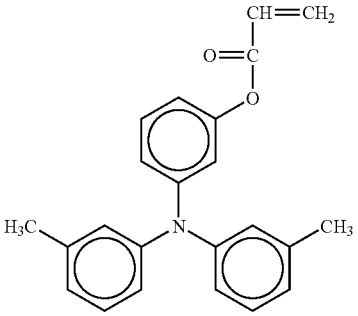
No. 32
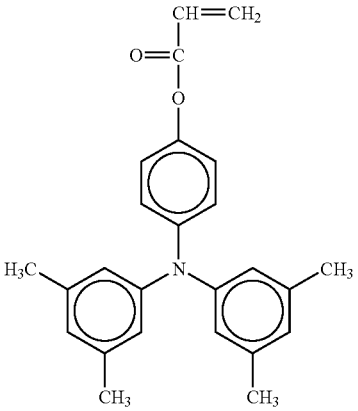

-continued
No. 33
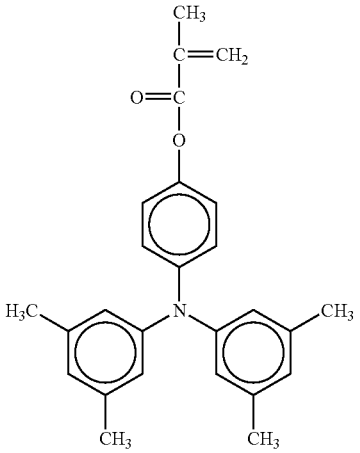
No. 34
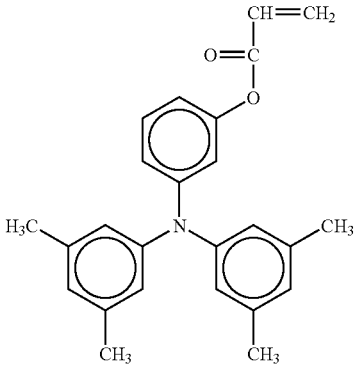
No. 35
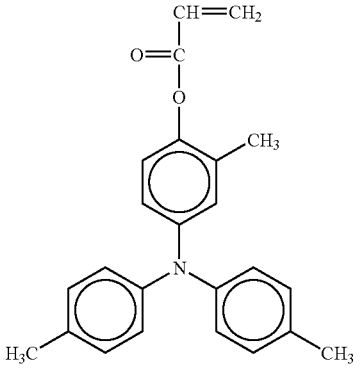
No. 36
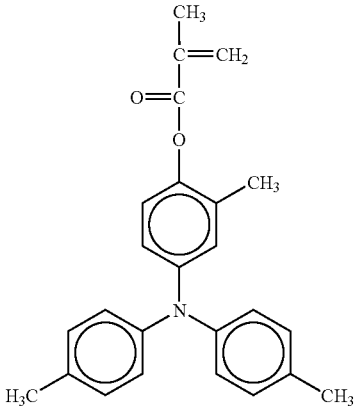
-continued
No. 37
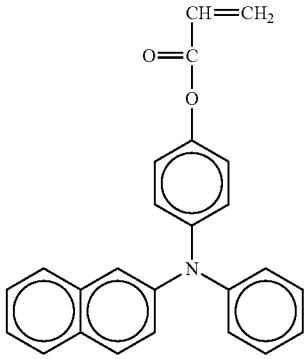
No. 38
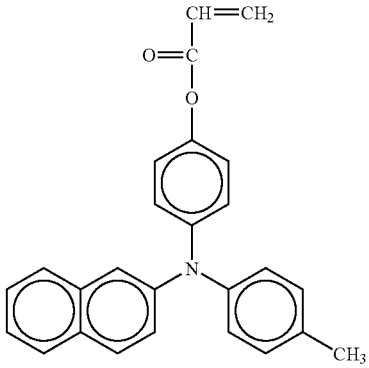
No. 39
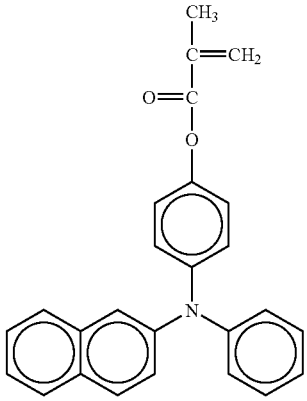
No. 40
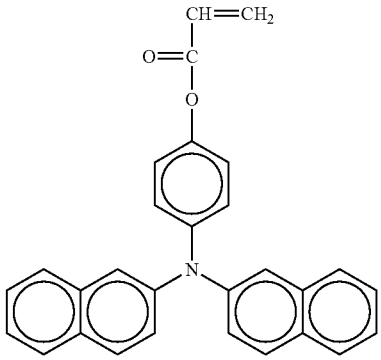

-continued
No. 41
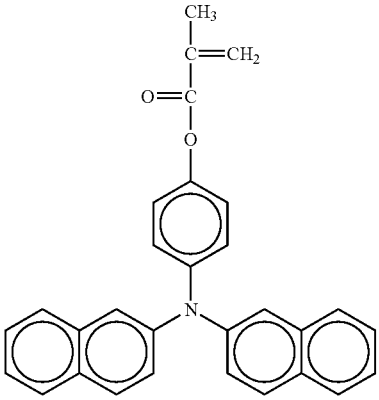
No. 42
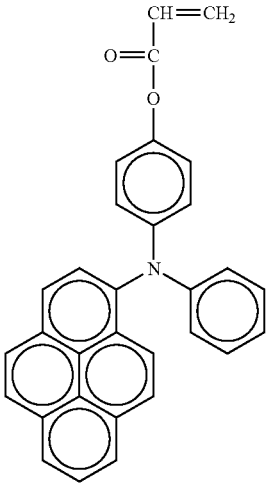
No. 43
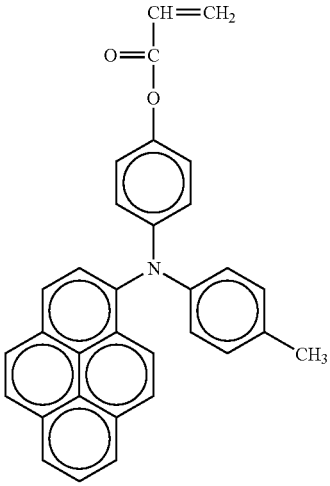
-continued
No. 44
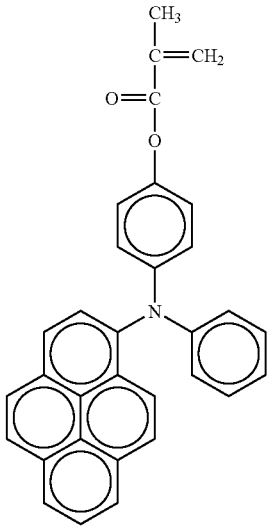
No. 45
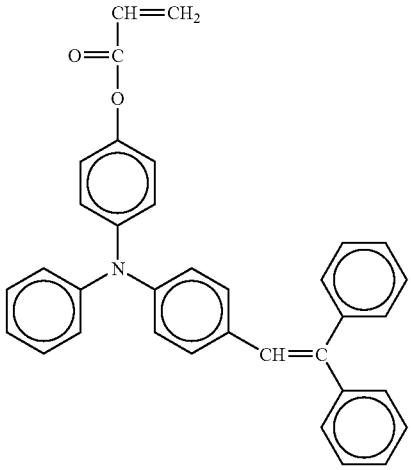
No. 46
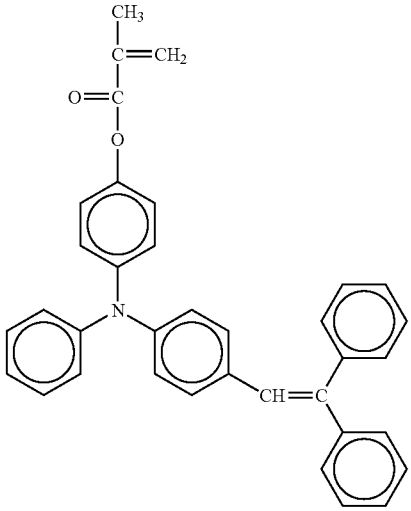

-continued
No. 47
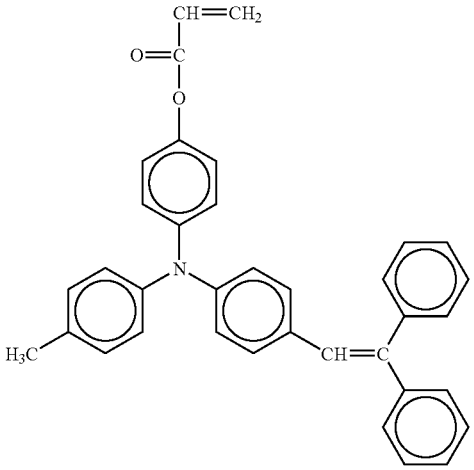
No. 48
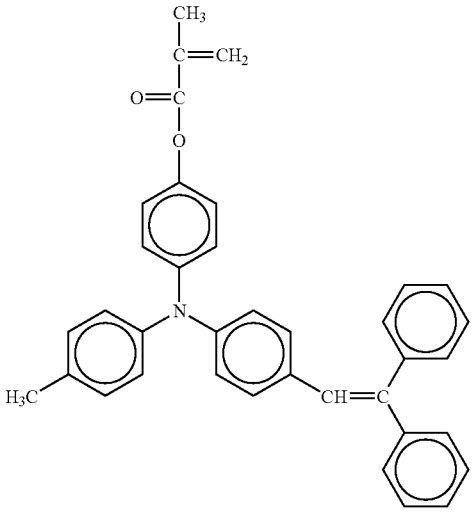
No. 49
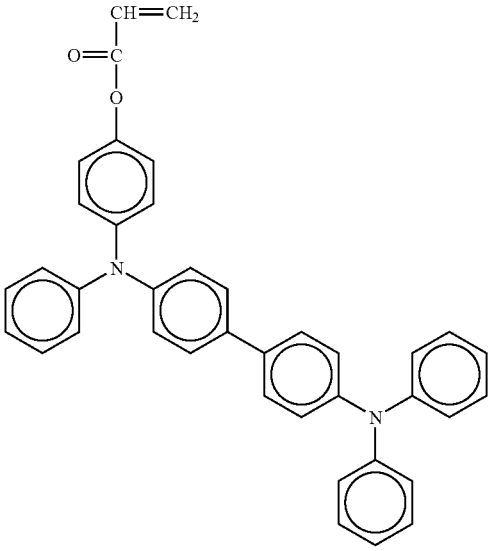
-continued
No. 50
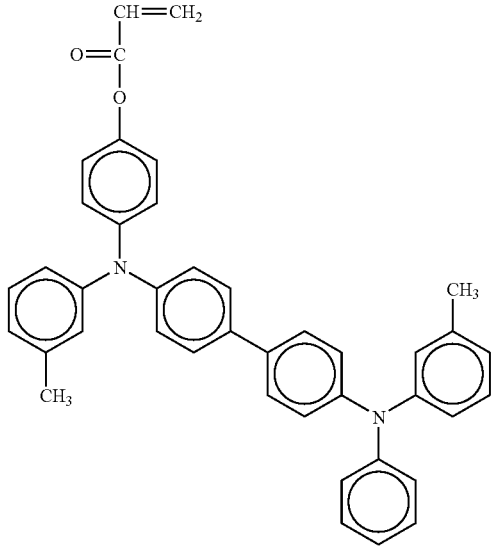
No. 51
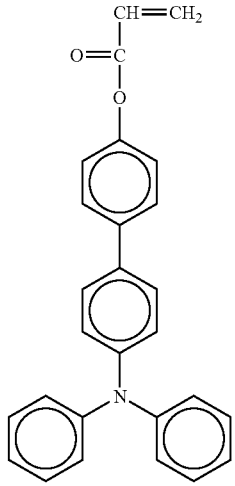
No. 52
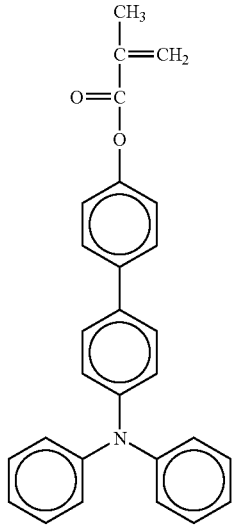

-continued
No. 53
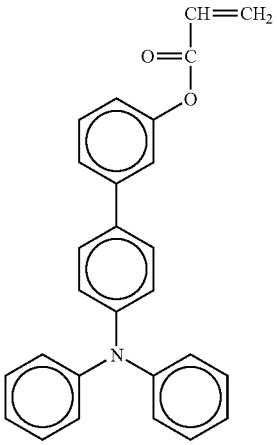
No. 54
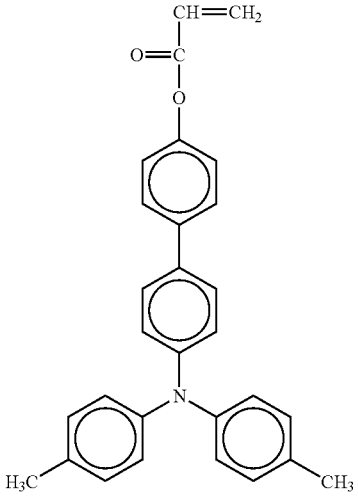
No. 55
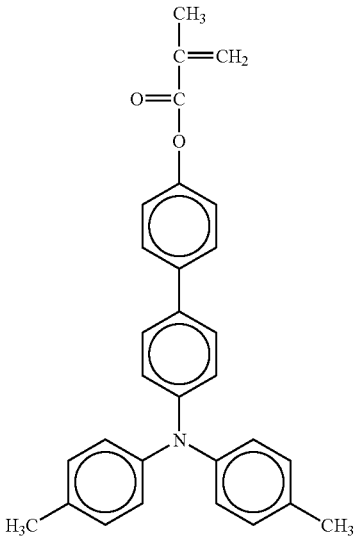
-continued
No. 56
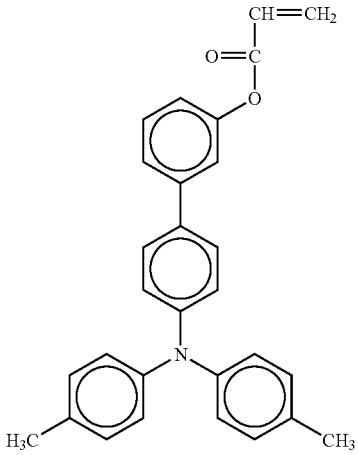
No. 57
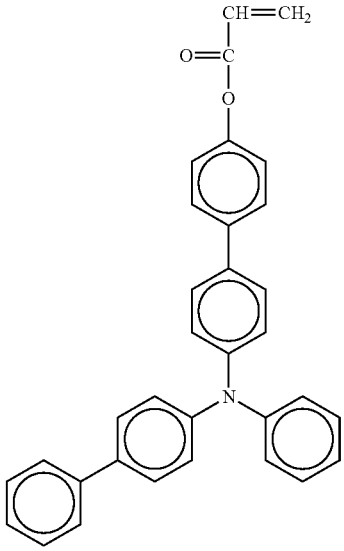
No. 58
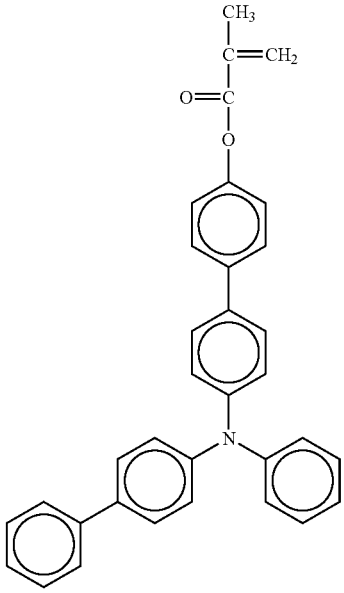

-continued
No. 59
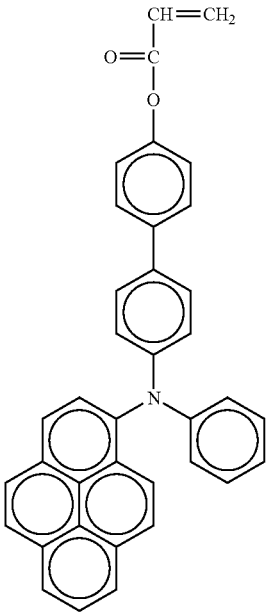
No. 60
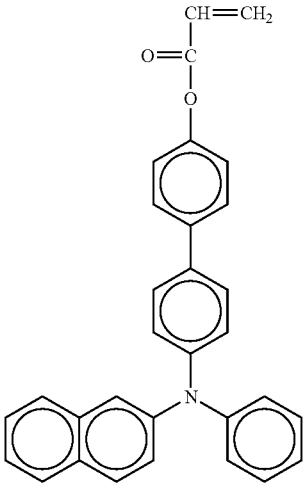
No. 61
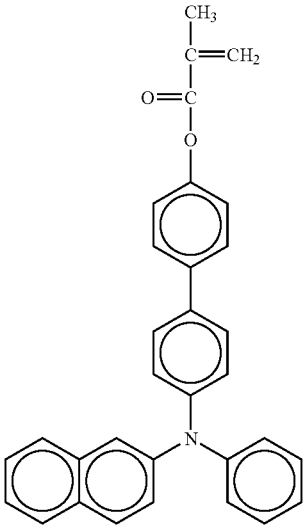
-continued
No. 62
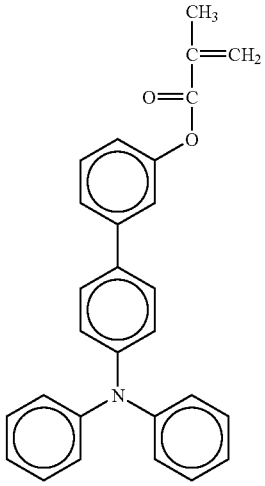
No. 63
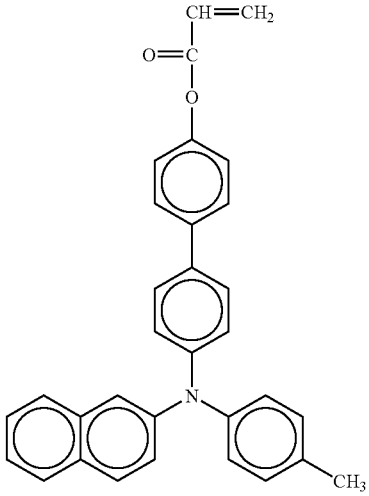
No. 64
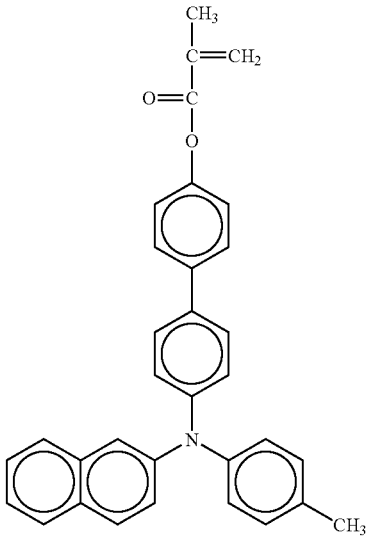

-continued
No. 65
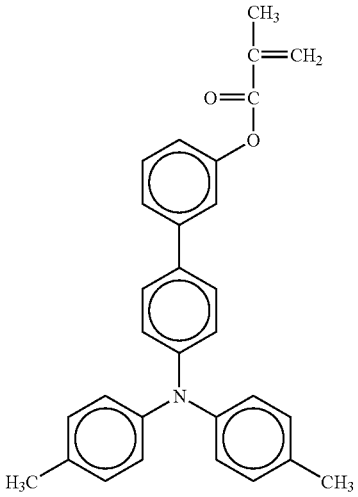
No. 66
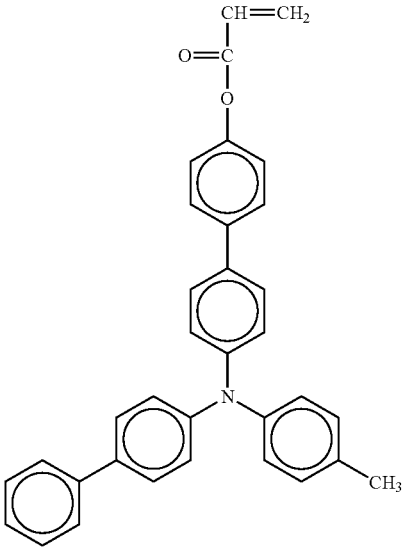
No. 67
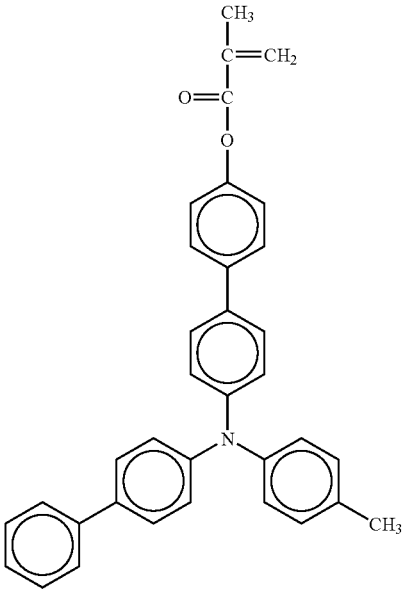
-continued
No. 68
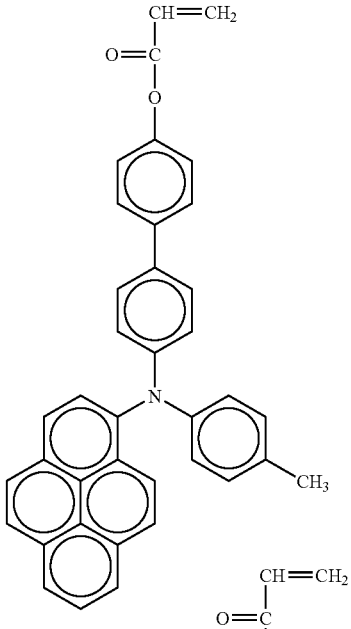
No. 69
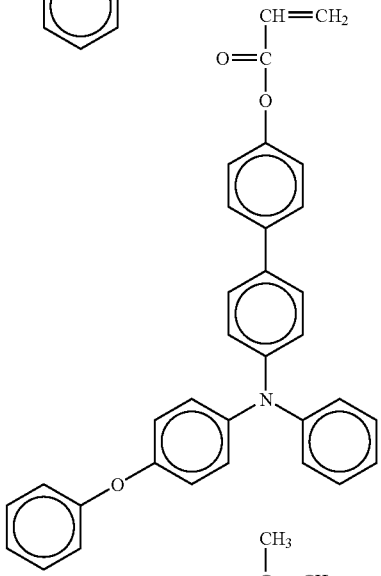
No. 70
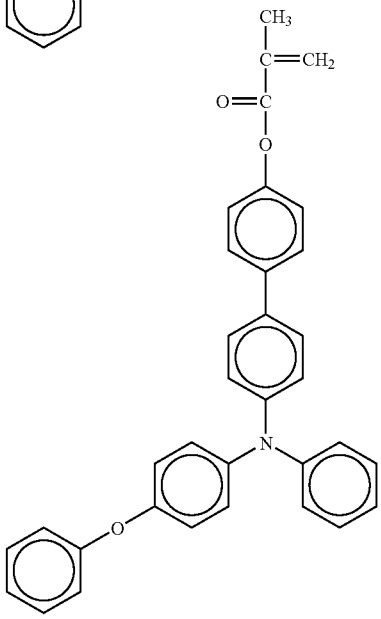

-continued
No. 71
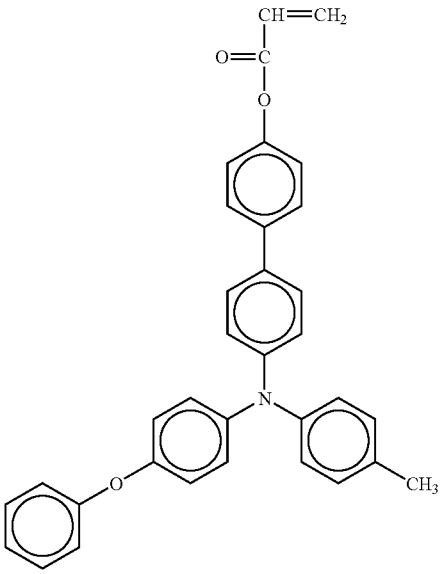
No. 72
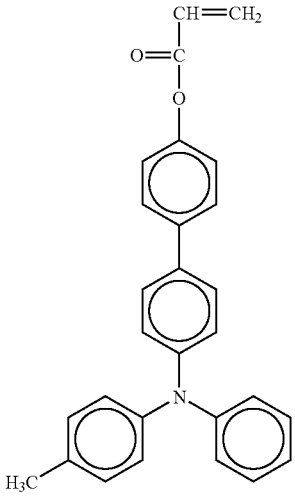
No. 73
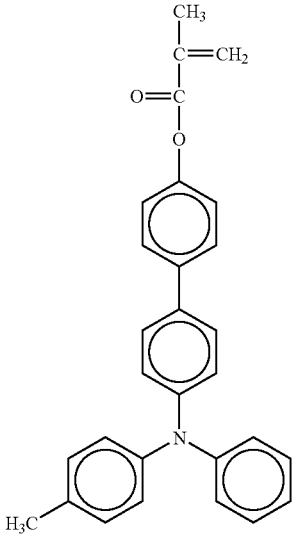
-continued
No. 74
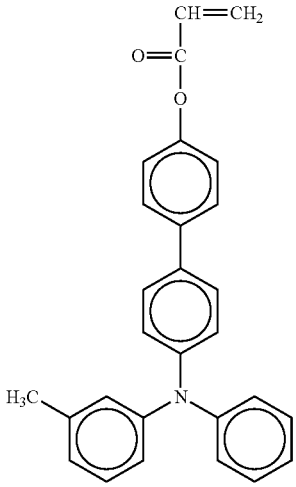
No. 75
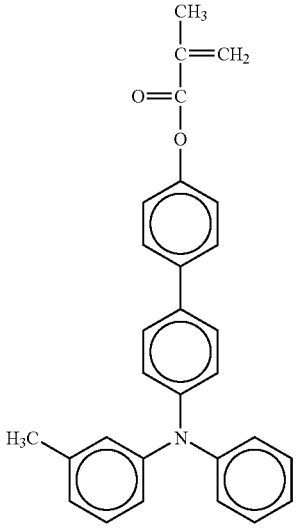
No. 76
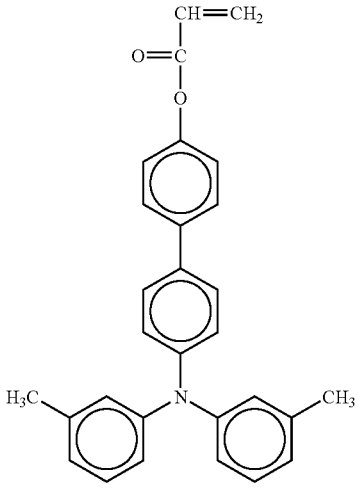

-continued
No. 77
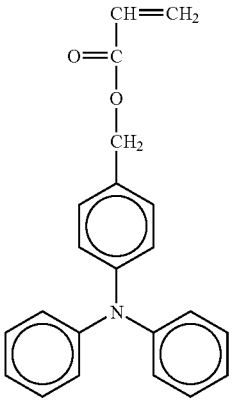
No. 78
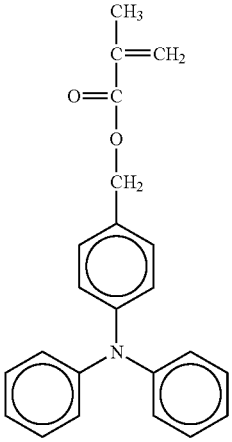
No. 79
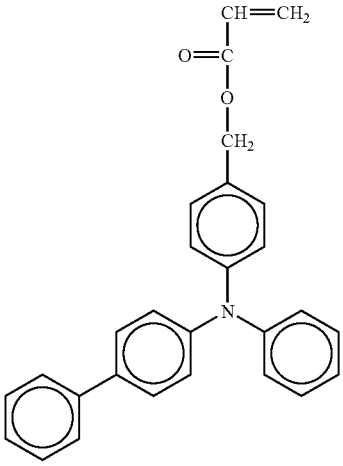
-continued
No. 80
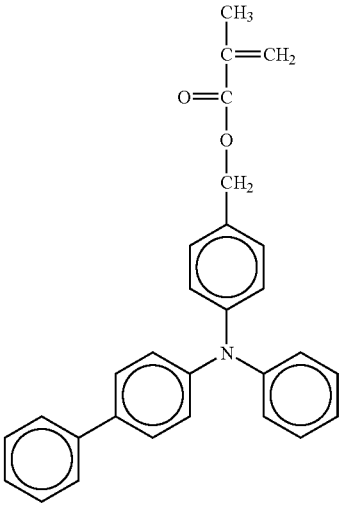
No. 81
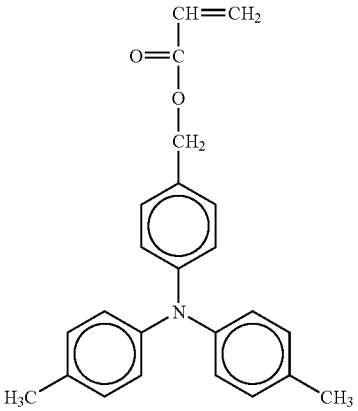
No. 82
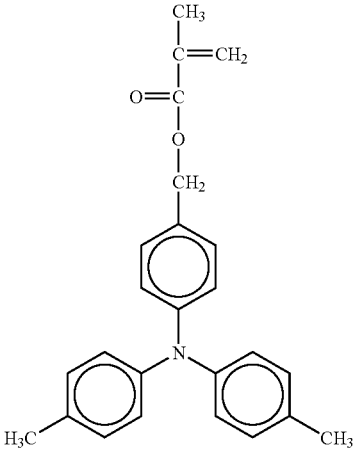

-continued
No. 83
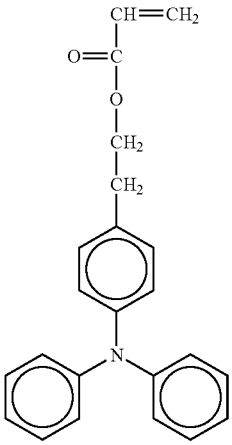
No. 84
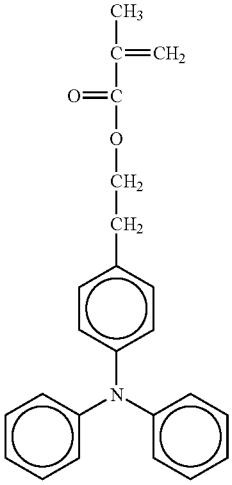
No. 85
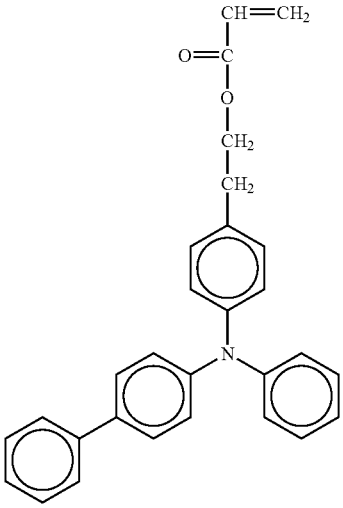
-continued
No. 86
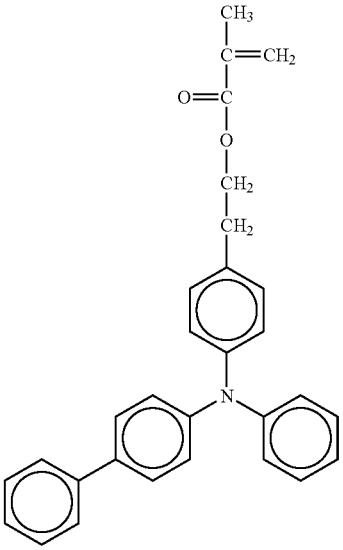
No. 87
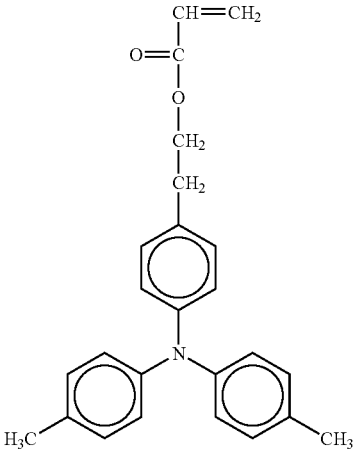
No. 88
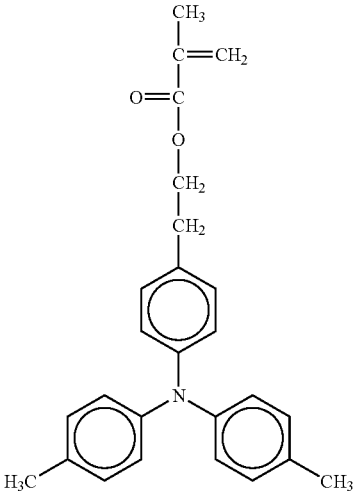

-continued
No. 89
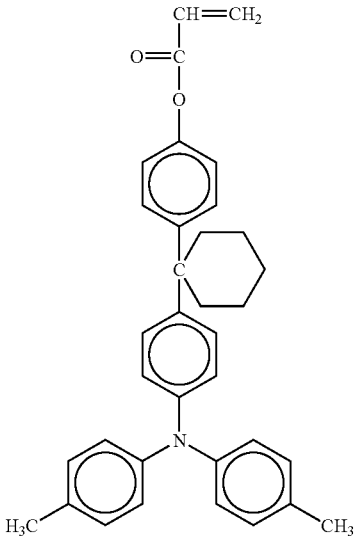
No. 90
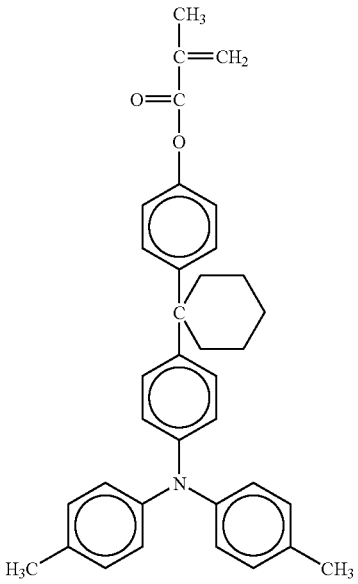
-continued
No. 91
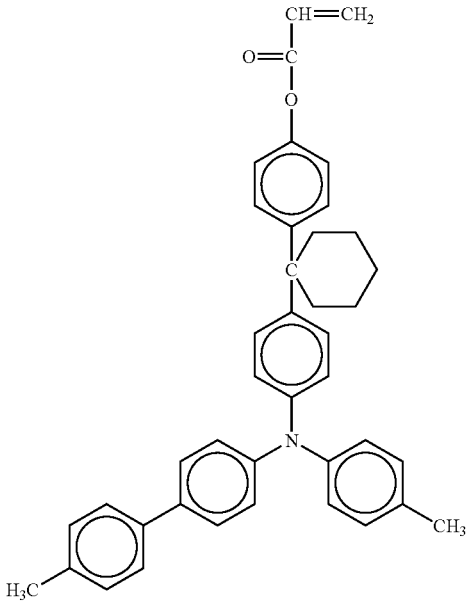
No. 92
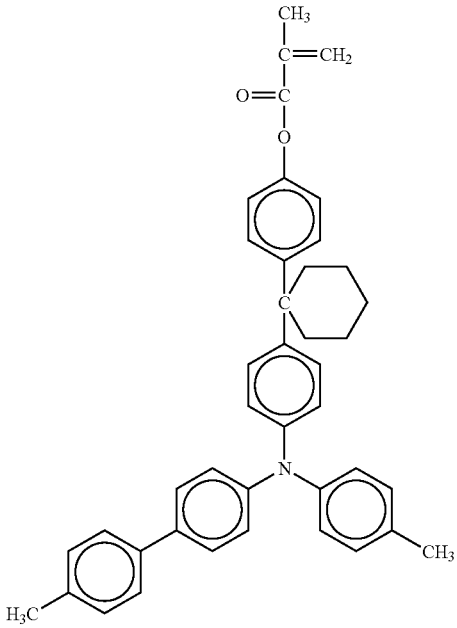

-continued
No. 93
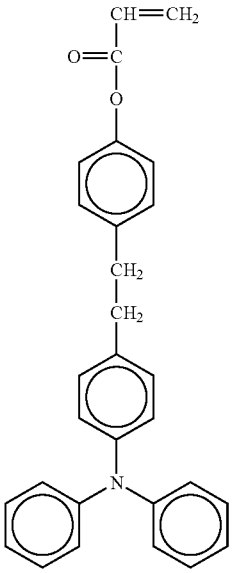
No. 94
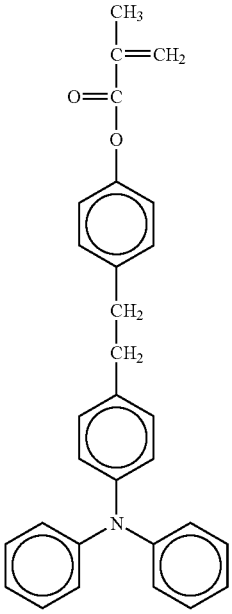
-continued
No. 95
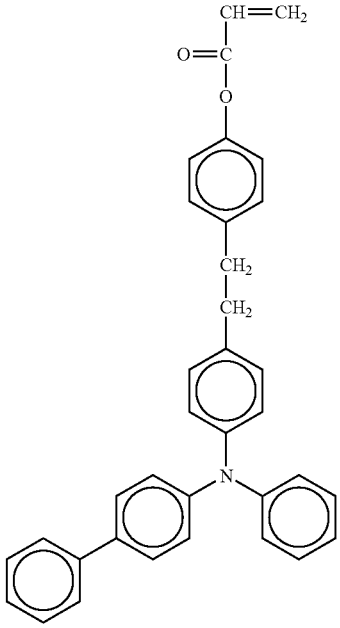
No. 96
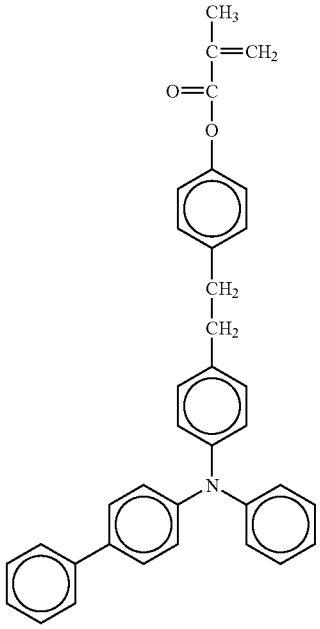

-continued
No. 97
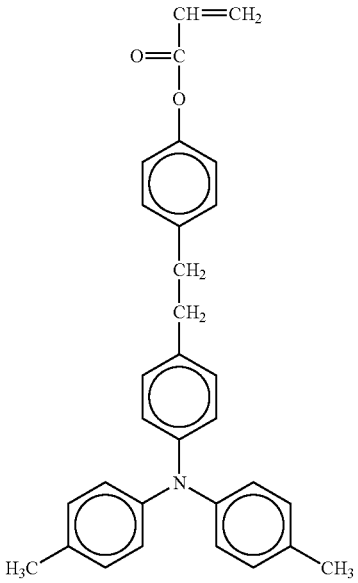
No. 98
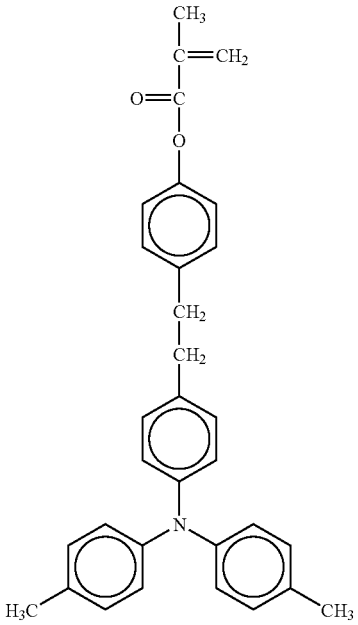
-continued
No. 99
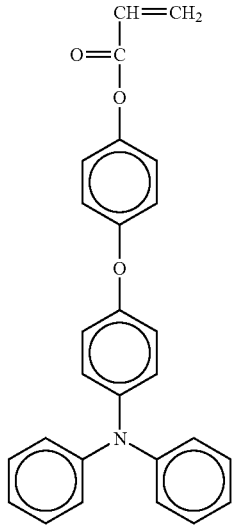
No. 100
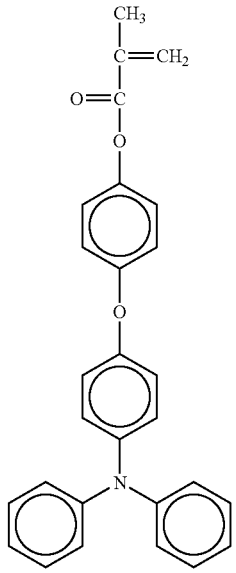

-continued
No. 101
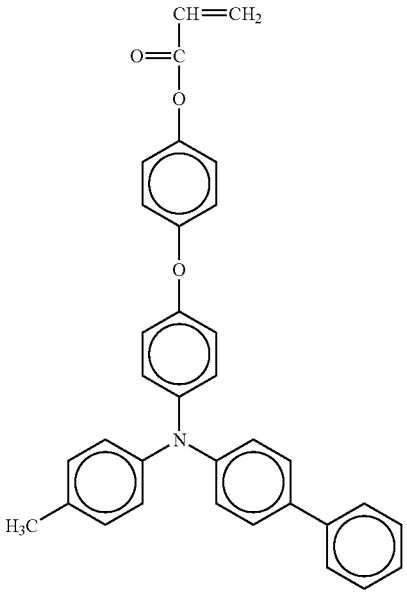
No. 102
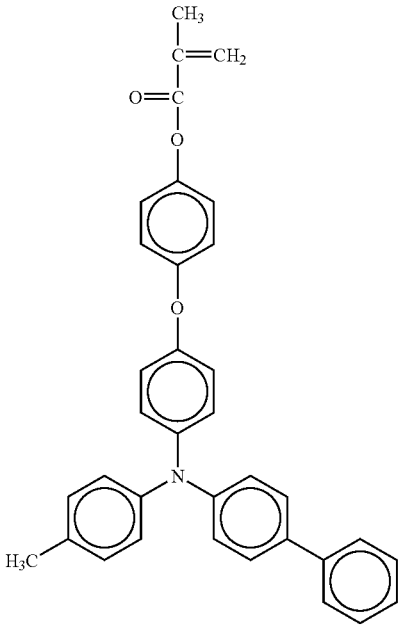
-continued
No. 103
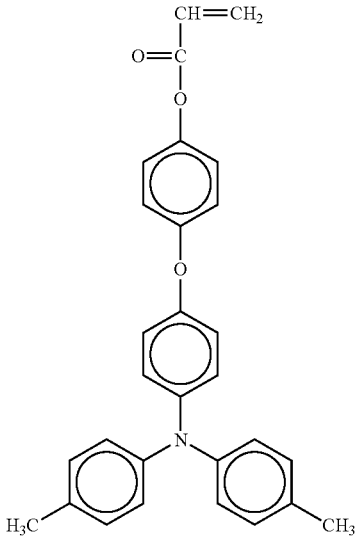
No. 104
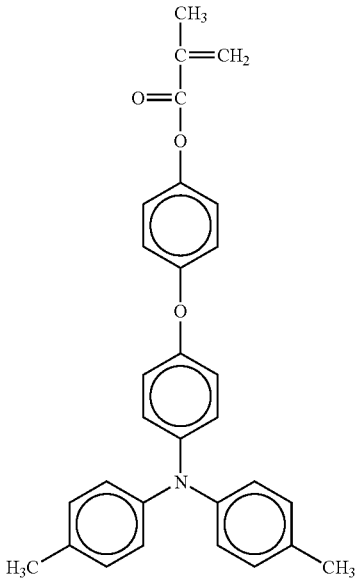

-continued
No. 105
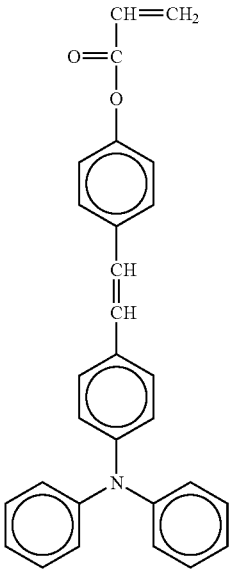
No. 106
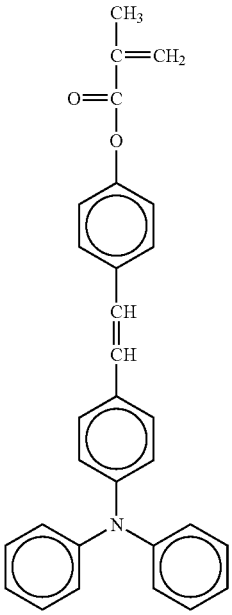
-continued
No. 107
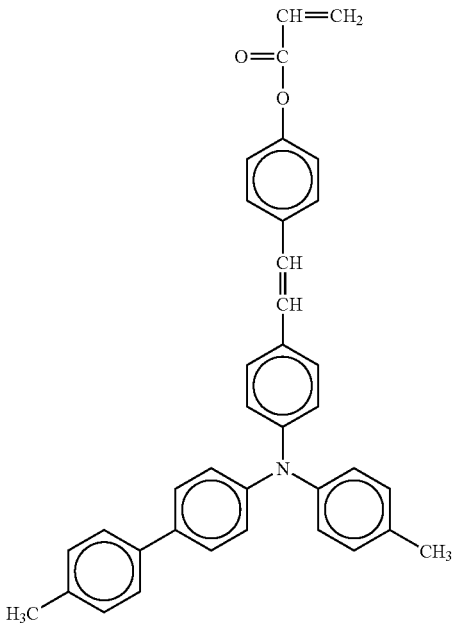
No. 108
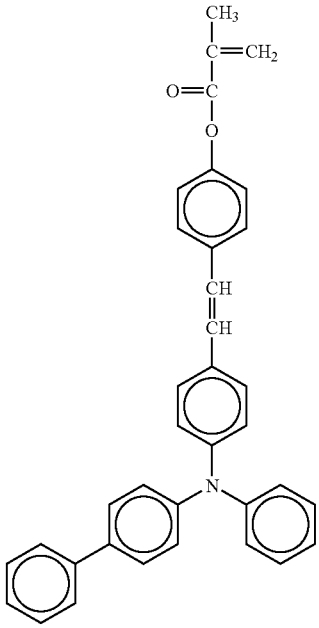

-continued
No. 109
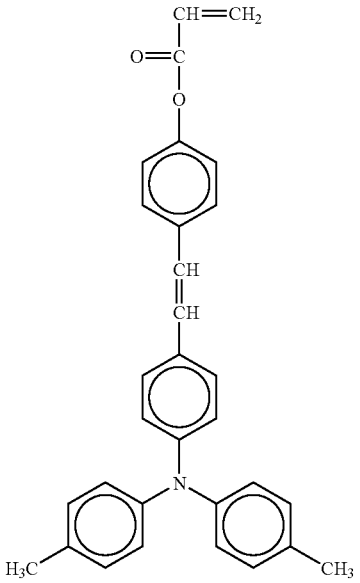
No. 110
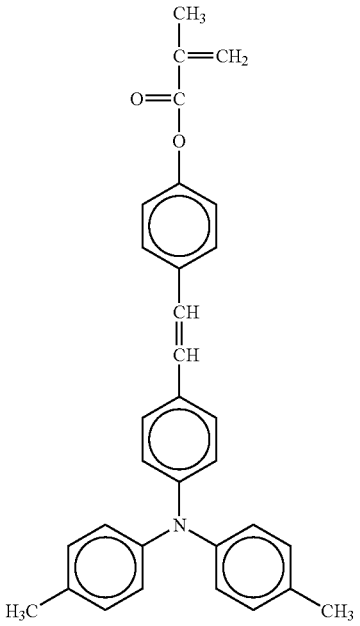
-continued
No. 111
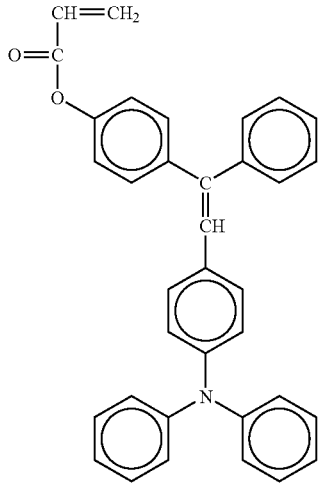
No. 112
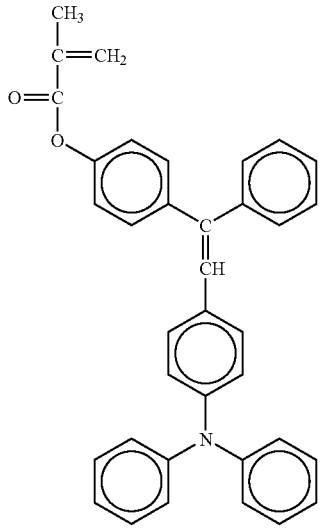
No. 113
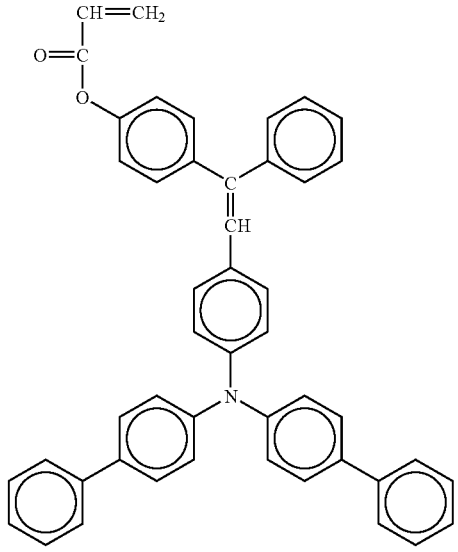

-continued
No. 114
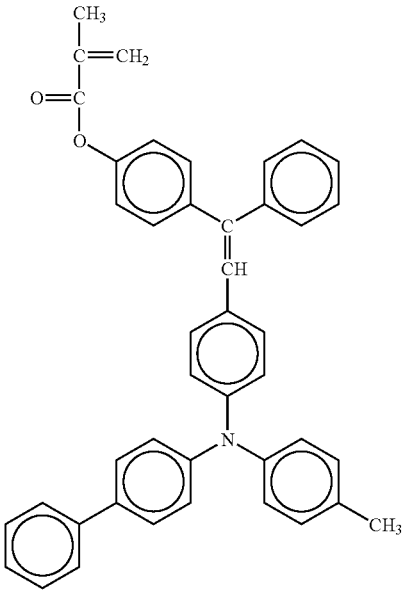
No. 115
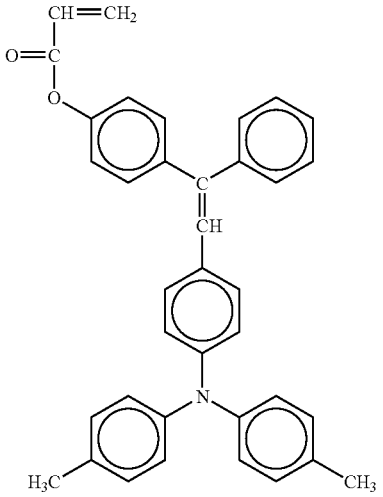
No. 116
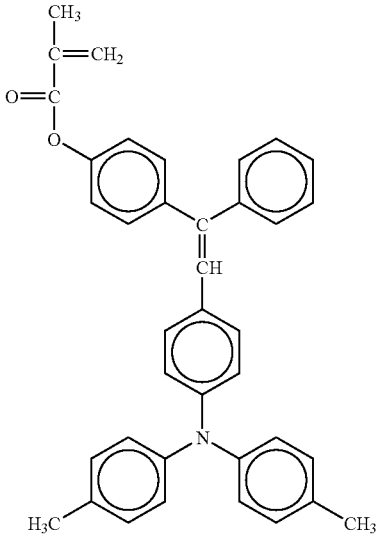
-continued
No. 117
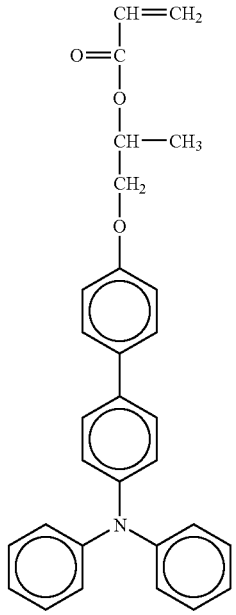
No. 118
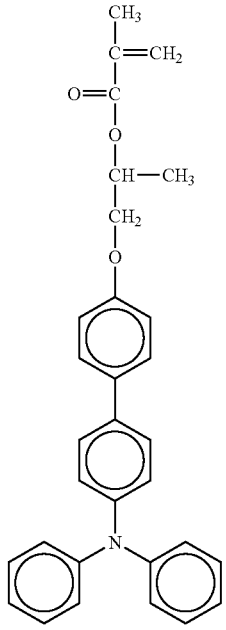

-continued
No. 119
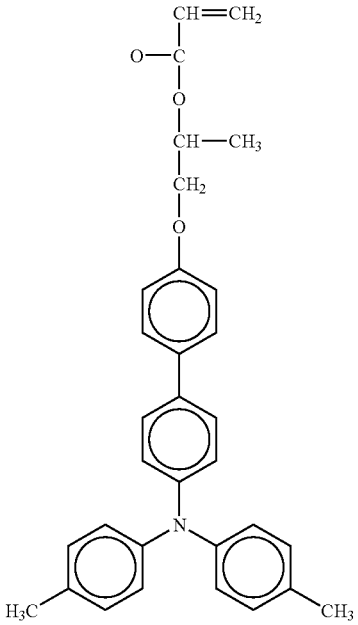
No. 120
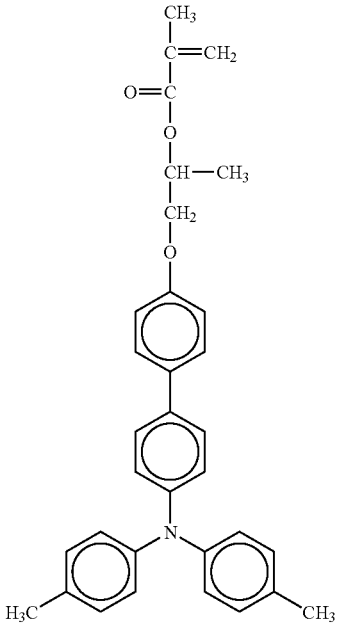
-continued
No. 121
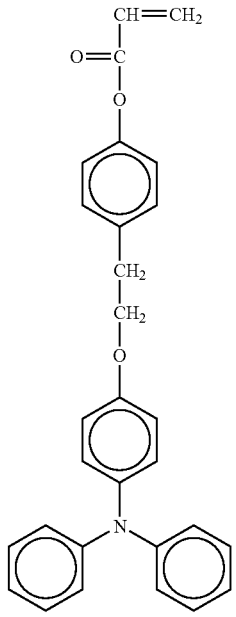
No. 122
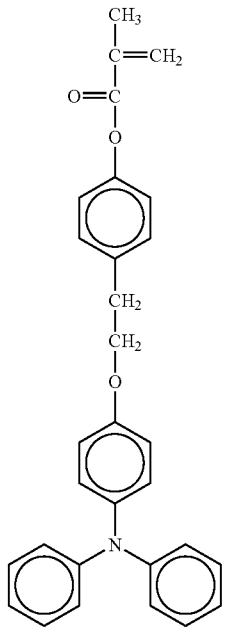

-continued
No. 123
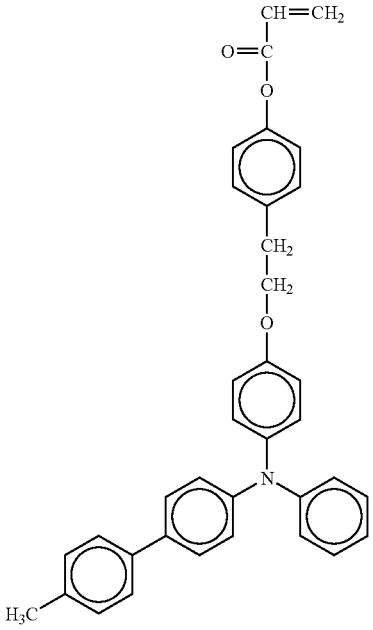
No. 124
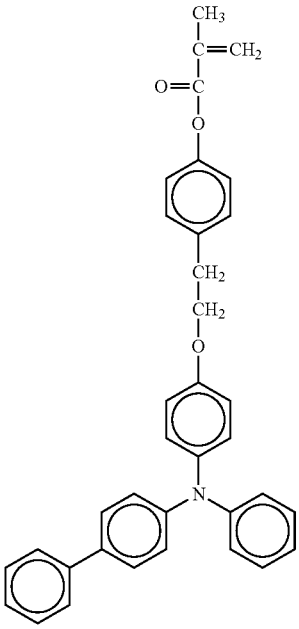
-continued
No. 125
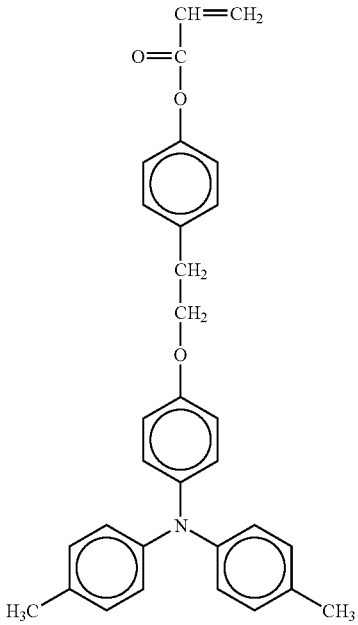
No. 126
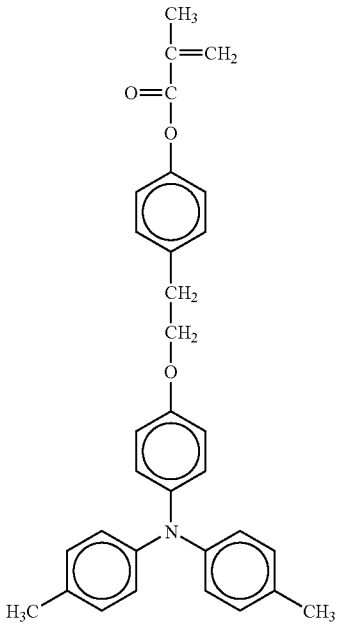

-continued
No. 127
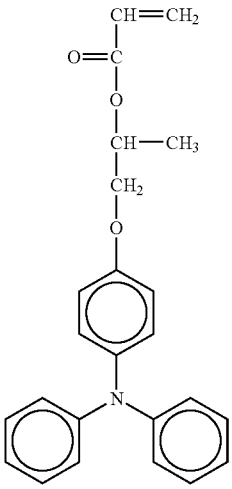
No. 128
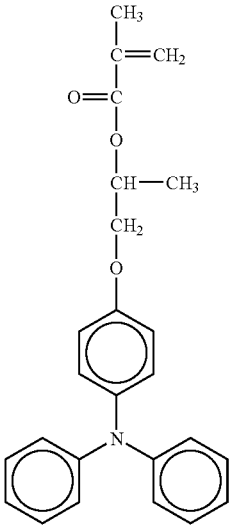
No. 129
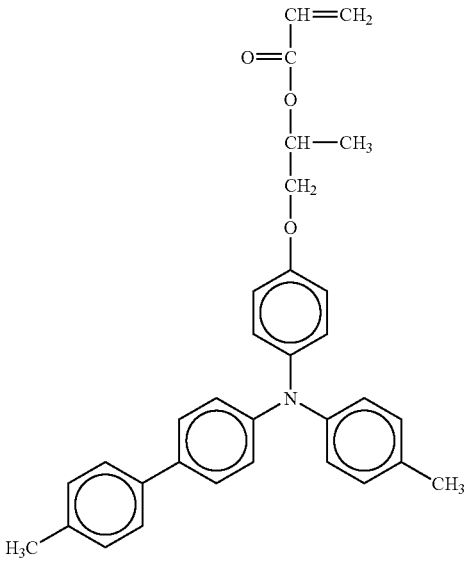
-continued
No. 130
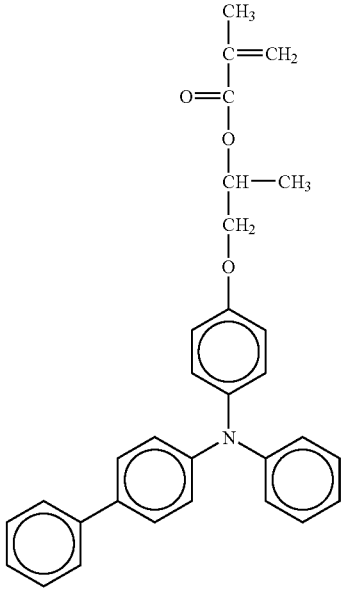
No. 131
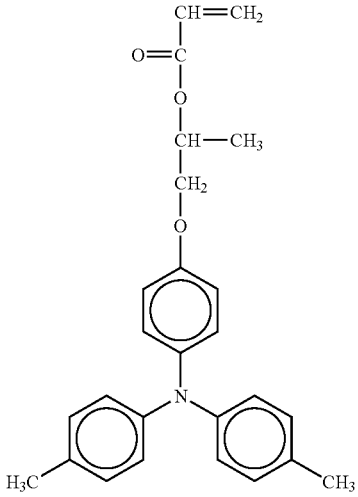
No. 132
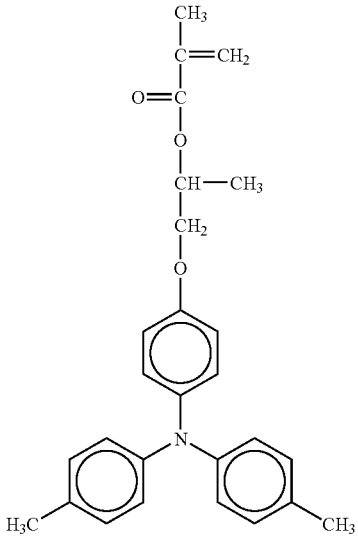

-continued
No. 133
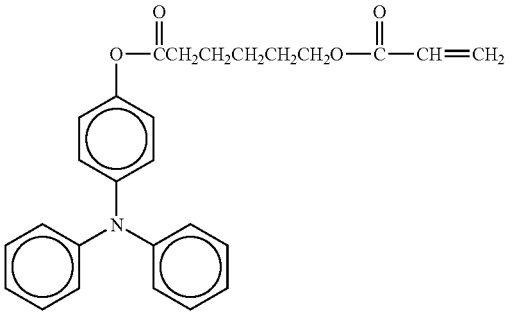
No. 134
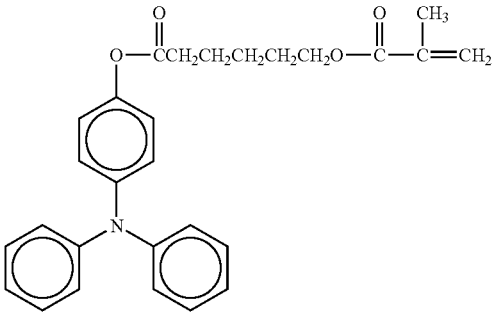
No. 135
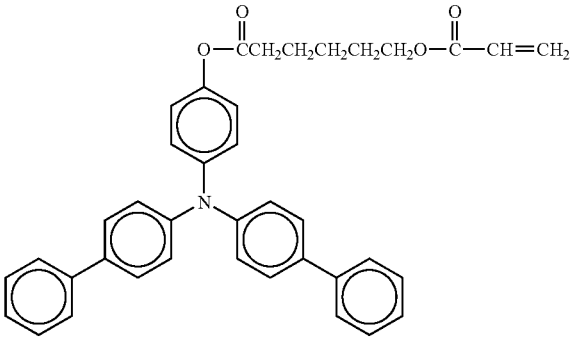
No. 136
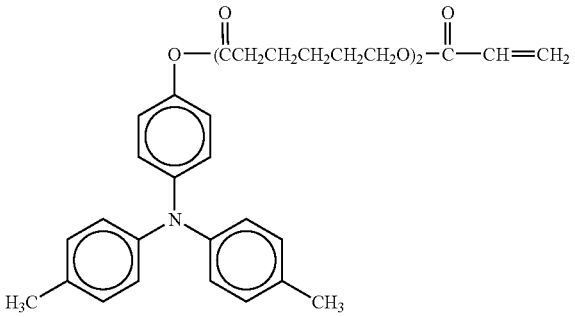
-continued
No. 137
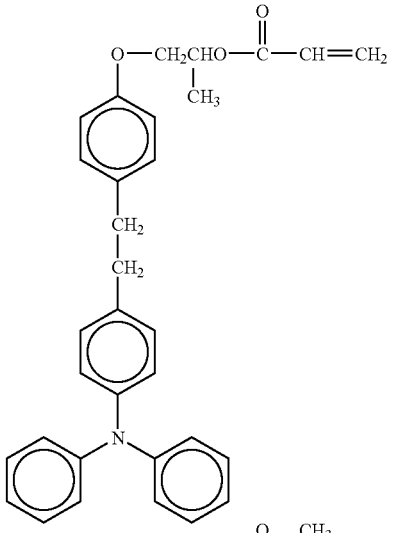
No. 138
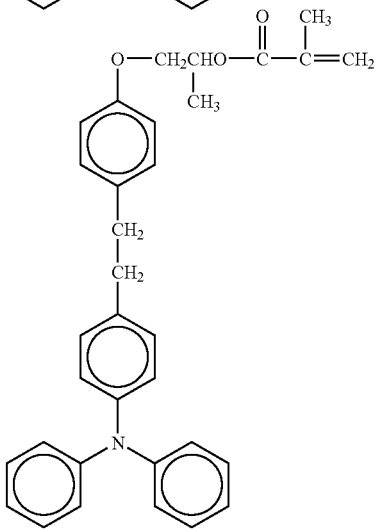
No. 139
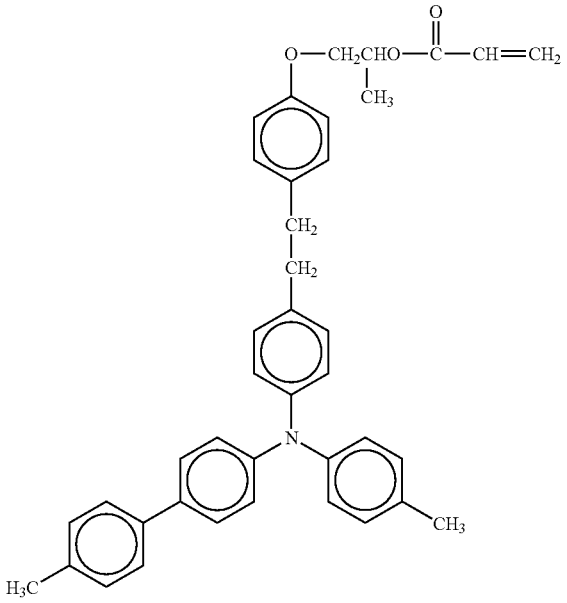

-continued
No. 140
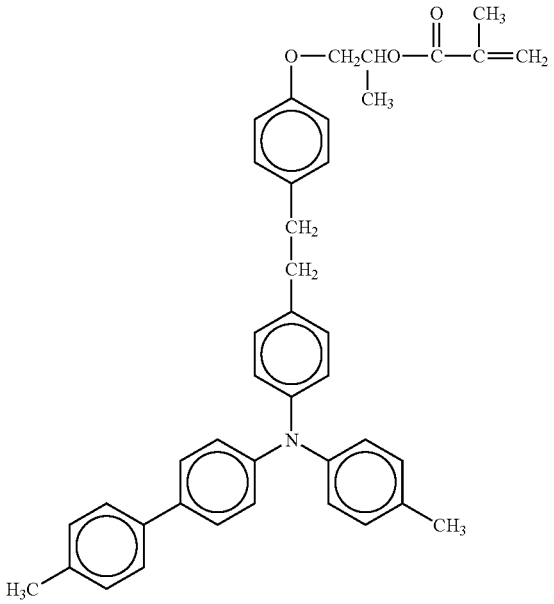
No. 141
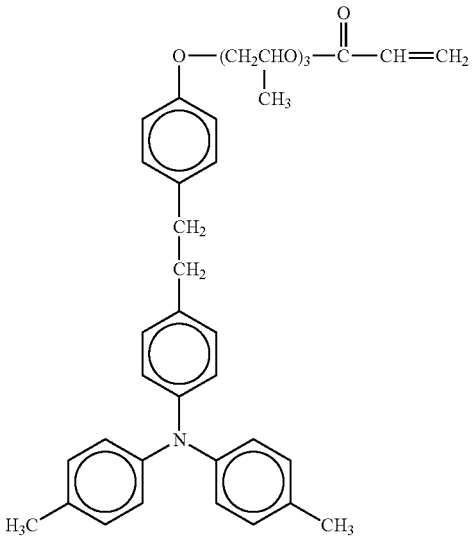
-continued
No. 142
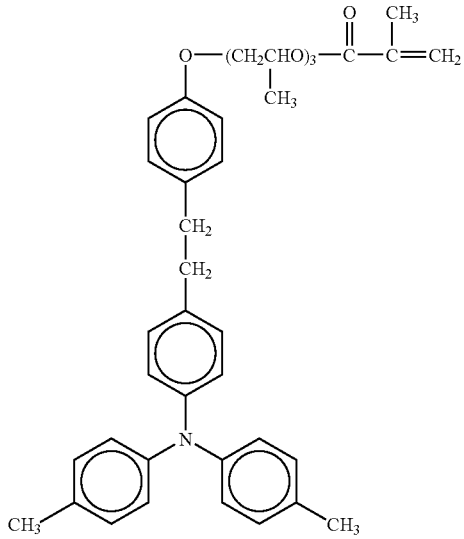
No. 143
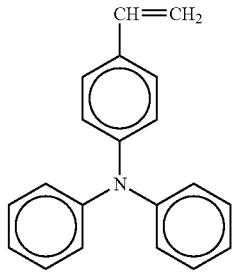
No. 144
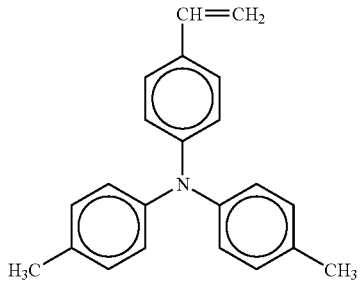
No. 145
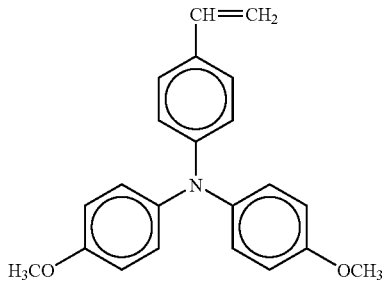

-continued
No. 146
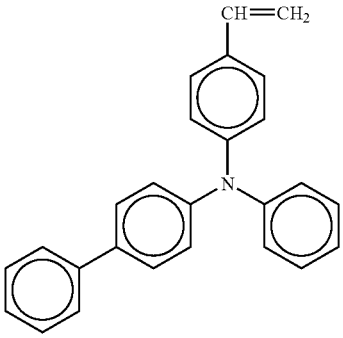
No. 147
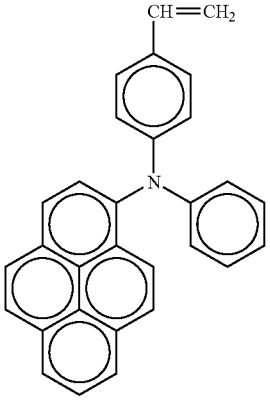
No. 148
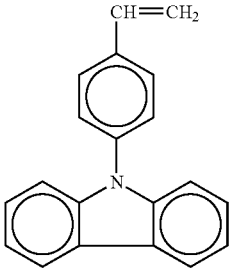
No. 149
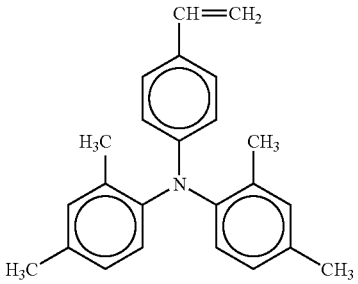
No. 150
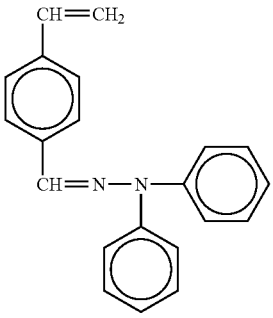
-continued
No. 151
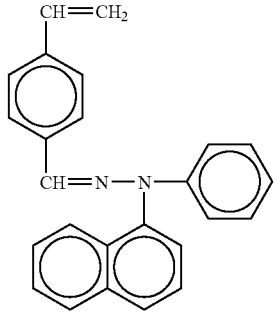
No. 152
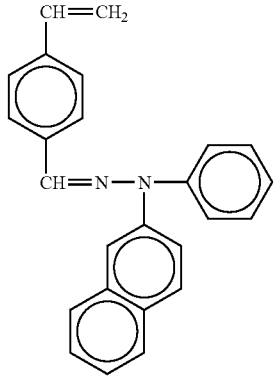
No. 153
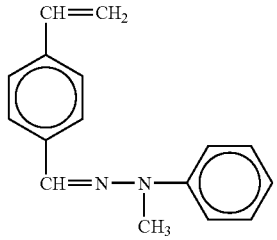
No. 154
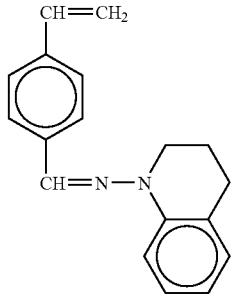
No. 155
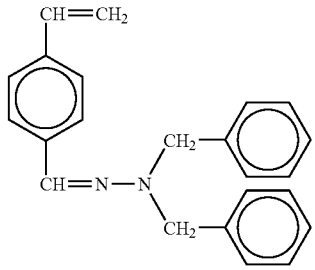

-continued

No. 156

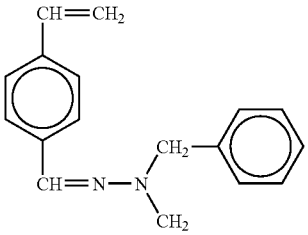

No. 157

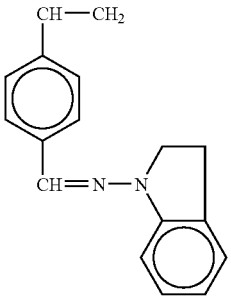

No. 158

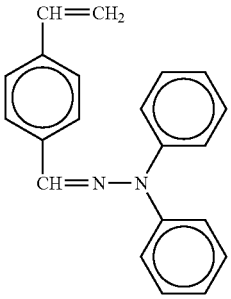

No. 159

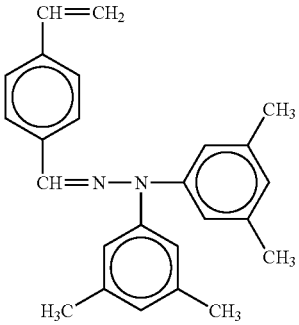

No. 160

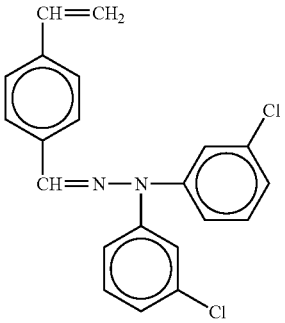

A monofunctional radical polymerizable compound having a charge transporting structure in the present invention plays an important role in adding to charge transporting performance of a crosslinked type protective layer, and the content of this monofunctional radical polymerizable compound in the crosslinked type protective layer is in the range of 20% by weight to 80% by weight, preferably in the range of 30% by weight to 70% by weight. When this monofunctional radical polymerizable compound contained is less than 20% by weight, charge transporting performance of a crosslinked type protective layer cannot be sufficiently retained, and deteriorations in electrical properties such as decrease in sensitivity and increase in residual potential tend to arise through repetitive use. When it is greater than 80% by weight, the contained amount of a trifunctional monomer having no charge transporting structure decreases, which causes the crosslinking bond density to decrease, and so high abrasion resistance tends to be difficult to perform. Since electrical properties and abrasion resistance required vary depending upon the process used, and thus the thickness of a crosslinked type protective layer in a photoconductor of the present invention varies, the amount of the monofunctional radical polymerizable compound cannot be unequivocally determined; however, in light of a balance between both electrical properties and abrasion resistance, it is most desirable that the monofunctional radical polymerizable compound contained be in the range of 30% by weight to 70% by weight.

A crosslinked type protective layer that is a component of an electrophotographic photoconductor of the present invention is formed by hardening at least a trifunctional or more radical polymerizable monomer having no charge transporting structure and a monofunctional radical polymerizable compound having a charge transporting structure; besides, monofunctional and difunctional radical polymerizable monomers, a functional monomer and a radical polymerizable oligomer can be additionally used for the purpose of adding functions, for example adjustment of viscosity at the time of coating, moderation of stress in the crosslinked type protective layer, reduction in surface energy and reduction in friction coefficient. For the radical polymerizable monomers and the radical polymerizable oligomer, conventional ones can be used.

Examples of monofunctional radical monomers include 2-ethylhexylacrylate, 2-hydroxyethylacrylate, 2-hydroxypropylacrylate, tetrahydrofurfrylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate and styrene monomer.

Examples of difunctional radical polymerizable monomers include 1,3-butane dioldiacrylate, 1,4-butanedioldiacrylate, 1,4-butane dioldimethacrylate, 1,6-hexanedioldiacrylate, 1,6-hexanedioldimethacrylate, diethyleneglycoldiacrylate, neopentylglycoldiacrylatebisphenol B-EO-modified diacrylate, bisphenol F-EO-modified diacrylate and neopentylglocoldiacrylate.

Examples of functional monmers include fluorinated monomers such as octafluoropentylacrylate, 2-perfluorooctylethylacrylate, 2-perfluorooctylethylmethacrylate and 2-perfluoroisononylethylacrylate; monomers having polysiloxane groups such as acryloylpolydimethylsiloxaneethyl, methacryloylpolydimethylsiloxaneethyl, acryloylpolydimethylsiloxanepropyl, acryloylpolydimethylsiloxanebutyl and diacryloylpolydimethylsiloxanediethyl, which are between 20 and 70 in siloxane repeating unit as described in Japanese Patent Application Publication (JP-B) Nos. 05-60503 and 06-45770.

Examples of radical polymerizable oligomers include epoxyacrylate oligomers, urethaneacrylate oligomers and polyesteracrylate oligomers.

It should be noted that when monofunctional and difunctional radical polymerizable monomers and radical polymerizable oligomers are contained in large amounts, the three-dimensional crosslinking bond density in a crosslinked type protective layer, in effect, decreases and a decrease in abrasion resistance is brought about. Thus, it is desirable that the contained amount of these monomers and oligomers be 50 parts by weight or less, more desirably 30 parts by weight or less, in relation to 100 parts by weight of trifunctional or more radical polymerizable monomers.

Also, a crosslinked type protective layer of the present invention is formed by hardening at least a trifunctional or more radical polymerizable monomer having no charge transporting structure and a monofunctional radical polymerizable compound having a charge transporting structure; if necessary, a polymerization initiator may be contained in a crosslinked type protective layer coating solution to make this hardening reaction progress efficiently.

Examples of thermal polymerization initiators include peroxide -based initiators such as 2,5-dimethylhexane-2,5-dihydropar oxide, dicumylparoxide, benzoylparoxide, t-butylcumylpar oxide, 2,5-dimethyl-2,5-di(par oxybenzoyl) hexyne-3, di-t-butylbelloxide, t-butylhydronaliumbell oxide, cumene hydronalium belloxide, lauroylpar oxide and 2,2-bis (4,4-di-t-butyl par clohexy)propane; and azo based initiators, such as azobisisobutylnitrile, azobiscyclohexanecarbonitrile, methyl azobisisobutyrate, azobisisobutylamidine hydrochloride and 4,4'-azobis-4-cyanovaleric acid.

Examples of photopolymerization initiators include acetophenone or ketal based photopolymerization initiators such as diethoxyacetophenone, 2,2-dimethoxy-, 2-diphenylethane-1-one, 1-hydroxy-cyclohexyl phenyl ketone, 4-(2-hydroxyethoxy)phenyl-(2-hydroxy-2-propyl)ketone, 2-benzyl-2-dimethylamino-1-(4-morpholino phenyl)butanone-1, 2-hydroxy-2-methyl-1-phenylpropane-1-one, 2-methyl-2-morpholino(4-methylthio phenyl)propan-1-one and 1-phenyl-1,2-propanedione-2-(o-carboethoxy)oxime; benzoin ether based photopolymerization initiators such as benzoin, benzoin methyl ether, benzoin ethyl ether, benzoin isobutyl ether and benzoin isopropyl ether; benzophenone based photopolymerization initiators such as benzophenone, 4-hydroxybenzophenone, methyl o-benzoylbenzoate, 2-benzoylnaphthalene, 4-benzoylbiphenyl, 4-benzoyl phenyl ether, acrylicized benzophenone and 1,4-benzoylbenzene; thio xanthone based photopolymerization initiators such as 2-isopropyl thioxanthone, 2-chloro thioxanthone, 2,4-dimethyl thioxanthone, 2,4-diethyl thioxanthone and 2,4-dichloro thioxanthone; and other photopolymerization initiators such as ethylanthraquinone, 2,4,6-trymethyl benzoic diphenyl phosphine acid, 4,6-trimethyl benzoic phenyl ethoxy phosphine oxide, bis(2,4,6-trimethyl benzoyl)phenylphosphine oxide, bis(2, 4-dimethoxybenzoyl)-2,4,4-trimethyl pentylphosphine oxide, methylphenyl glyoxylate ester, 9,10-phenanthrene, acridine compounds, triazine compound and imidazole compounds. Also, compounds having photopolymerization promoting effect may be used independently or together with the photopolymerization initiators. Examples thereof include triethanolamine, methyldiethanolamine, 4-dimethylamino ethyl benzoate, 4-dimethylamino isoamyl benzoate, ethyl benzoate(2-dimethylamino) and 4,4'-dimethylamino benzophenone.

Two or more types amongst these polymerization initiators may be mixed together. In relation to 100 parts by weight of a total contained material having radical polymerizability, the contained amount of a polymerization initiator is in the range of 0.5 parts by weight to 40 parts by weight, preferably in the range of 1 part by weight to 20 parts by weight.

Further, it is possible for a crosslinked type protective layer forming coating solution of the present invention to contain additives such as various types of plasticizers (for the purpose of moderating stress, improving adhesion, etc.), a leveling agent and a low-molecular charge transporting material without radical reactivity if necessary. Conventional ones can be used for these additives; for plasticizers, ones used in typical resins, such as dibutyl phthalate and dioctyl phthalate, can be utilized, and the amount of each plasticizer used is reduced to 20% by weight or less, preferably 10% by weight or less, in relation to a total solid content in the coating solution. For leveling agents, silicone oils such as dimethyl silicone oil and methylphenyl silicone oil, and polymers or oligomers having perfluoroalkyl groups for side chains can be used, and it is appropriate that the amount of each leveling agent used be 3% by weight or less in relation to a total solid content in the coating solution.

A crosslinked type protective layer of the present invention is formed, as a coating solution containing at least the trifunctional or more radical polymerizable monomer having no charge transporting structure and the monofunctional radical polymerizable compound having a charge transporting structure is applied onto the charge transporting layer and hardened. When the radical polymerizable monomer is a liquid, the coating solution can be applied, with another component dissolved in the radical polymerizable monomer; if necessary, a solvent is used to dilute the coating solution. Examples of a solvent used on this occasion include alcohols such as methanol, ethanol, propanol and butanol, ketones such as acetone, methyl ethyl ketone, methyl isobutyl ketone and cyclohexanone, esters such as ethyl acetate and butyl acetate, ethers such as tetrahydrofuran, dioxane and propyl ether, halogens such as dichloromethane, dichloroethane, trichloroethane and chlorobenzene, aromatics such as benzene, toluene and xylene; and cellosolves such as methylcellosolve, ethylcellosolve and cellosolve acetate. These solvents may be used alone or in combination with two or more. The dilution ratio of a coating solution by a solvent varies according to the solubility of a component, the coating method employed and the desired layer thickness, and can be arbitrarily decided. Coating can be carried out by means of an immersion coating method, spray coating, beat coating, ring coating or the like.

In the present invention, after the crosslinked type protective layer coating solution is applied, it is hardened with energy from outside given to it, and a crosslinked type protective layer is thus formed; examples of the external energy used on this occasion include heat, steam and radiant rays. As a method for applying thermal energy, the crosslinked type protective layer coating solution is heated from the coating surface side or the support side, using a gas such as air or nitrogen, steam, a thermal medium selected from various types, infrared rays or electromagnetic waves. It is desirable that the heating temperature be in the range of 100° C. to 170° C.; when it is less than 100° C., the reaction rate is low, and hardening reaction tends to be incomplete. When it stands at a high temperature greater than 170° C., hardening reaction progresses unevenly, and a great distortion, a large number of unreacted residues and unreactive termini arise in the crosslinked type protective layer. To make hardening reaction progress evenly, a method in which after heating takes place at a relatively low temperature of less than 100° C., heating takes place at 100° C. or more, and reaction is thus completed is also effective. For light energy, a UV irradiation light source such as a high-pressure mercury-vapor lamp or metal halide lamp having an emission wavelength in an ultraviolet region can be used mainly; also, a visible light source can be selected according to the absorption wavelength of a radical polymerizable contained material or a photopolymerization initiator. It is desirable that the amount of irradiating light be in the range of 50 mW/cm$^2$ to 1,000 mW/cm$^2$; when it is less than 50 mW/cm$^2$, hardening reaction takes more time. When it is 1,000 mW/cm$^2$ or greater, reaction progresses unevenly, causing local creases to arise on the crosslinked type protective layer surface, and also causing a large number of unreacted residues and unreactive termini to arise. Also, the abrupt crosslinkage makes internal stress greater, which is a cause of cracks and film peeling. Examples of radiant energy include a thing using electron rays. Amongst these types of energy, thermal energy and light energy are useful in that the reaction rate can be controlled with ease and an apparatus can be simplified.

It is desirable that the thickness of a crosslinked type protective layer of the present invention be 1 μm to 10 μm, more desirably 2 μm to 8 μm. When it is greater than 10 μm, cracks and film peeling are liable to arise as described above; when it is 8 μm or less, improvement in a margin makes it possible to increase the crosslink density, and further, to select a material which enhances abrasion resistance and set hardening conditions. Meanwhile, radical polymerization reaction is easily hindered by oxygen; specifically, on a surface contiguous to the air, crosslinkage is liable to stop progressing or become uneven, affected by a radical trap which is due to oxygen. This effect becomes conspicuous when the surface layer is less than 1 μm, and the crosslinked type protective layer of this thickness or smaller is liable to cause a decrease in abrasion resistance and uneven abrasion. Also, when the crosslinked type protective layer coating solution is applied, the components of the charge transporting layer, which is the under layer of the crosslinked type protective layer, are mixed therein, in particular, the mixed components spread throughout the crosslinked type protective layer, thereby hindering hardening reaction and decreasing the crosslink density. For these reasons, the crosslinked type protective layer used in the present invention has favorable abrasion resistance and scratch resistance when it is 1 μm or more in thickness; however, when the crosslinked type protective layer is locally peeled off as far as the charge transporting layer that is an under layer through repetitive use, abrasion at the locally peeled portions increases, and so the density of halftone images is liable to become uneven owing to variations in charging properties and sensitivity. Therefore, to achieve a long lifetime and high image quality, it is desirable that the film thickness of a crosslinked type protective layer be 2 μm or more.

A structure in which a charge blocking layer, a moire prevention layer, a photosensitive layer (charge generating layer and charge transporting layer) and a crosslinked type protective layer of an electrophotographic photoconductor of the present invention are formed in this order in a multilayered structure is characterized in that when the crosslinked type protective layer, which is a top surface, is insoluble in organic solvent, a dramatic improvement in abrasion resistance and scratch resistance can be achieved. As for a method of testing the solubility in the organic solvent, one droplet of an organic solvent which greatly dissolves high-molecular materials, such as tetrahydrofuran or dichloromethane, is applied onto the photoconductor surface layer, and a deformation of the photoconductor surface is observed under a stereomicroscope after the droplet has been naturally dried, thereby making it possible to measure the solubility. A highly soluble photoconductor experiences changes, including a phenomenon in which the central part of the liquid droplet becomes concave and its vicinity protrudes upward, a phenomenon in which the charge transporting material is deposited and white turbidity or loss of transparency is caused by the crystallization, and a phenomenon in which creases arise as a surface swells and later contracts. Conversely, not experiencing the phenomena, an insoluble photoconductor stays exactly the same as it was before a droplet has been applied.

In order to make the crosslinked type protective layer insoluble in organic solvent in the present invention, it is important to control the following: (1) adjustment of contents of composition components for the crosslinked type protective layer coating solution; (2) adjustment of the solid content concentration of a diluent solvent for the crosslinked type protective layer coating solution; (3) selection of a coating method for the crosslinked type protective layer; (4) control of hardening conditions for the crosslinked type protective layer; (5) achievement of low solubility of a charge transporting layer that is the under layer. However, it is not that the insolubility of the crosslinked type protective layer in organic solvent is achieved by one factor alone.

As to the composition components of the crosslinked type protective layer coating solution, when additives such as a binder resin having no radical polymerizable functional group, an antioxidant and a plasticizer are contained in large amounts besides the trifunctional or more radical polymerizable monomer having no charge transporting structure and the monofunctional radical polymerizable compound having a charge transporting structure, the crosslink density decreases and a phase separation between hardened materials created as a result of a reaction and the additive materials arises; thus, the crosslinked type protective layer coating solution tends to be soluble in organic solvent. Specifically, it is important that the total content of the additive materials be reduced to 20% by weight or less in relation to a total solid content in the coating solution. Also, in order to prevent the crosslink density from lowering, it is desirable that the total content of a difunctional radical polymerizable monomer, a reactive oligomer and a reactive polymer be 20% by weight or less to a trifunctional radical polymerizable monomer. Further, when a difunctional or more radical polymerizable compound having a charge transporting structure is contained in large amounts, the structural body that is large in volume is fixed in a crosslinked structure by a plurality of bonds, which causes distortion to arise easily, and the crosslinked type protective layer coating solution tends to be an aggregate of minute hardened materials. It is possible that the crosslinked type protective layer coating solution may become soluble in organic solvent as a result of this. Although it depends upon the compound structure, it is desirable that the content of a difunctional or more radical polymerizable compound having a charge transporting structure be 10% by weight or less to the monofunctional radical polymerizable compound having a charge transporting structure.

As to the diluent solvent for the crosslinked type protective layer coating solution, when a solvent low in evaporation rate is used, it is possible that a residual solvent may hamper hardening and may increase the mixed amount of the layer components, and therefore uneven hardening and a decrease in hardening density may be brought about. Thus, the crosslinked type protective layer coating solution tends to be soluble in organic solvent. Specifically, tetrahydrofuran, a mixed solvent of tetrahydrofuran and methanol, ethyl acetate, methyl ethyl ketone, ethylcellosolve or the like is useful; however, a diluent solvent is selected according to the coating method. As for the density of the solid content, when it is very low for a similar reason, the crosslinked type protective layer coating solution tends to be soluble in organic solvent. Due to restrictions on the layer thickness and the coating solution viscosity, there are limitations on a maximum density. Specifically, it is desirable that a diluting solvent be contained by the range of 10% by weight to 50% by weight. As a coating method for a crosslinked type protective layer, a method of reducing the content of a solvent when a coating film is formed and reducing the time during which to be contiguous with the solvent is suitable for a similar reason; specifically, a spray coating method, and a ring coating method whereby the amount of a coating solution is restricted are suitable. Also, use of a high-molecular charge transporting material as a charge transporting layer and formation of an intermediate layer insoluble in the coating solvent for the crosslinked type protective layer between a photosensitive layer (or the charge transporting layer) and the crosslinked type protective layer are effective means of preventing the mixed amount of the components of the under layer.

As for hardening conditions for the crosslinked type protective layer, when the energy of heating or light irradiation is low, hardening is not completed and solubility in organic solvent increases. Conversely, when the crosslinked type protective layer is hardened with very high energy, hardening reaction becomes uneven, the number of uncrosslinked parts and radical stoppage portions increases and the crosslinked type protective layer is liable to be an aggregate of minute hardened materials. For this reason, it is possible that the crosslinked type protective layer may be soluble in organic solvent. To make it insoluble in organic solvent, such thermal hardening conditions as 100° C. to 170° C. and 10 min to 3 hr are favorable, and such hardening conditions by means of UV light irradiation as 50 W/cm$^2$ to 1,000 mW/cm$^2$, 5 sec to 5 min and limitation of a temperature rise to 50° C. or less for preventing uneven hardening reaction are favorable.

A method for making a crosslinked type protective layer constituting the electrophotographic photoconductor of the present invention, insoluble in organic solvent is mentioned as follows. For example, when an acrylate monomer having three acryloyloxy groups and a triarylamine compound having one acryloyloxy group are used for the coating solution, the content ratio is in the range of 7:3 to 3:7, a polymerization initiator is added by 3% by weight to 20% by weight in relation to the total amount of these acrylate compounds, and a solvent is added to prepare the coating solution. For example, in a charge transporting layer that is an under layer of the crosslinked type protective layer, when a triarylamine-based donor is used for a charge transporting material, polycarbonate is used for the binder resin and the surface layer is formed by means of spray coating, it is desirable that a solvent for the coating solution be tetrahydrofuran, 2-butanone, ethyl acetate or the like, and the amount of it used is 3 times to 10 times the total amount of the acrylate compounds.

Subsequently, for example, by means of spraying or the like, the coating solution prepared is applied onto a photoconductor in which an intermediate layer, a charge generating layer and the charge transporting layer are formed in this order in a multi-layered structure on a support such as an aluminum cylinder. After that, the coating solution is dried naturally or dried at a relatively low temperature for a short period of time (25° C. to 80° C., 1 min to 10 min), and then hardened by UV irradiation or heating.

In the case of UV irradiation, a metal halide lamp or the like is used; it is desirable that the illuminance be in the range of 50 W/cm$^2$ to 1,000 mW/cm$^2$ and that the time be in the range of 5 sec to 5 min or so, and the drum temperature is controlled in such a manner as not to be greater than 50° C.

In the case of thermal hardening, it is desirable that the heating temperature be in the range of 100° C. to 170° C.; for example, when an air blasting type oven is used as a heating unit and the heating temperature is set at 150° C., the heating time will be in the range of 20 min to 3 hr.

After the hardening is finished, the coating solution is further heated at a temperature of 100° C. to 150° C. for 10 min to 30 min to reduce residual solvent, and a photoconductor of the present invention is thus obtained.

Also, besides the protective layer containing a filler and the crosslinked type protective layer, it is possible to use for a protective layer a conventional material such as a-C or a-SiC formed by a vacuum thin film forming method.

As described above, when a protective layer is formed on a photoconductor, charge eliminating light may not sufficiently reach a photosensitive layer and so charge elimination may not definitely function, unless an appropriate protective layer is selected. Also, since the protective layer absorbs charge eliminating light, the photosensitive layer may deteriorate and a rise in residual potential may be caused. Therefore, in any of the protective layers, it is desirable that the transmittance thereof be 30% or more, more desirably 50% or more, even more desirably 85% or more to a charge eliminating light used.

As described above, forming a protective layer on the surface of a photoconductor not only enhances the durability (abrasion resistance) of the photoconductor, but also produces a novel effect which monochrome image forming apparatuses do not have, when used in an after-mentioned tandem-type full-color image forming apparatus.

In the present invention, in an attempt to improve environment resistance, it is possible to add an antioxidant to respective layers of the protective layer, the charge transporting layer, the charge generating layer, the charge blocking layer, the moire prevention layer, etc., especially for the purpose of preventing a decrease in sensitivity and an increase in residual potential.

(Phenol Compounds)

2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2"-methylene-bis-(4-methyl-6-t-butylphenol), 2,2"-methylene-bis-(4-ethyl-6-t-butylphenol), 4,4"-thiobis-(3-methyl-6-t-butylphenol), 4,4"-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3",5"-di-t-butyl-4"-hydroxyphenyl)propionate]methane, and bis[3,3"-bis(4"-hydroxy-3"-t-butylphenyl)butylic acid]glycol ester, tocopherols and the like.

(P-phenylenediamines)

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine and the like.

(Hydroquinones)

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(Organic Sulfur Compounds)

lauryl-3,3'-thiodipropionate, "distearyl-3,3'-thiodipropionate, "ditetradecyl-3,3'-thiodipropionate and the like.

(Organic Phosphorus Compound)

triphenylphosphine, tri(nonylphenyl)phosphine, tri(dinonylphenyl)phosphine, tricresylphosphine, tri(2,4-dibutylphenoxy)phosphine and the like.

The compounds are known as antioxidants of rubbers, plastics, oils and fats, etc., and commercially-supplied antioxidants can be obtained with ease. The additive amount of antioxidants in the present invention is in the range of 0.01% by weight to 10% by weight to the gross weight of the layers to which the antioxidants are added.

In the case of full-color images, images of a variety of forms are input; conversely, images of fixed forms may also be input. For example, there are stamps of approval seen in Japanese documents and the like. Things like stamps of approval are normally positioned in the vicinity of ends of an image area, and colors used for them are limited. Image writing, developing and transfer are performed on a photoconductor in image forming elements on an average basis when images are always written in a random manner; conversely, when a large number of image formations are repeated in particular parts or particular image forming elements are exclusively used as described above, there will be lack of a balance with respect to the durability of the photoconductor. When a photoconductor which is (physically/chemically/mechanically) small in surficial durability is used under these conditions, lack of durability becomes conspicuous, leading to problems on images. Meanwhile, when a photoconductor is made highly durable, local variations of this type are small, thereby being unlikely to result in defects on images; therefore, the photoconductor is very effective in that high durability can be achieved and also output images can be made more stable.

EXAMPLES

Hereinafter, the present invention will be further described referring to specific Examples, however, the present invention is not limited to the following Examples. Note that the following unit term of "part" or "parts" respectively means "part by mass" or "parts by mass".

First, the method of synthesizing an azo pigment and a titanylphthalocyanine crystal will be described. The azo pigments used in the following Examples were prepared according to the method described in Japanese Patent Application Laid-Open (JP-A) No. 60-29109 and Japanese Patent (JP-B) No. 3026645. The titanylphthalocyanine crystal used in the following Examples was prepared according to the method described in Japanese Patent (JP-B) No. 2004-83859.

—Synthesis of Titanylphthalocyanine Crystal—

Synthesis Example A-1

A pigment was produced according to the Example 1 described in Japanese Patent Application Laid-Open (JP-A) No. 2004-83859.

Specifically, 292 g of 1,3-diiminoisoindline and 1,800 parts of sulfolane were mixed, and 20.4 g of titanium tetrabutoxide was delivered by drops into the mixture in a nitrogen gas stream. Upon completion of the dropping, the temperature of the mixture was gradually increased to 180° C. and then stirred and reacted for 5 hours while keeping the reaction temperature from 170° C. to 180° C. After completion of the reaction, the reactant was naturally cooled, and the precipitate was filtered and the filtrated precipitate was washed until the powder of the precipitate turned into blue by chloroform. Next, the powder was washed with methanol several times and further washed with 80° C. hot water several times and then dried to obtain a coarse titanylphthalocyanine. The coarse titanylphthalocyanine was dissolved in 20 times its volume of a sulfuric acid, and the titanylphthalocyanine solution was delivered by drops into 100 times its volume of ice water with stirring to obtain a precipitate of crystal. The precipitated crystal was filtered and then repeatedly washed with ion exchange water (pH: 7.0; relative conductivity: 1.0 μS/cm) until the wash solution became neutral (the pH value of the ion exchange water after washing was 6.8 and the relative conductivity was 2.6 μS/cm), thereby obtaining a titanylphthalocyanine pigment wet cake (water paste).

Figure 11:
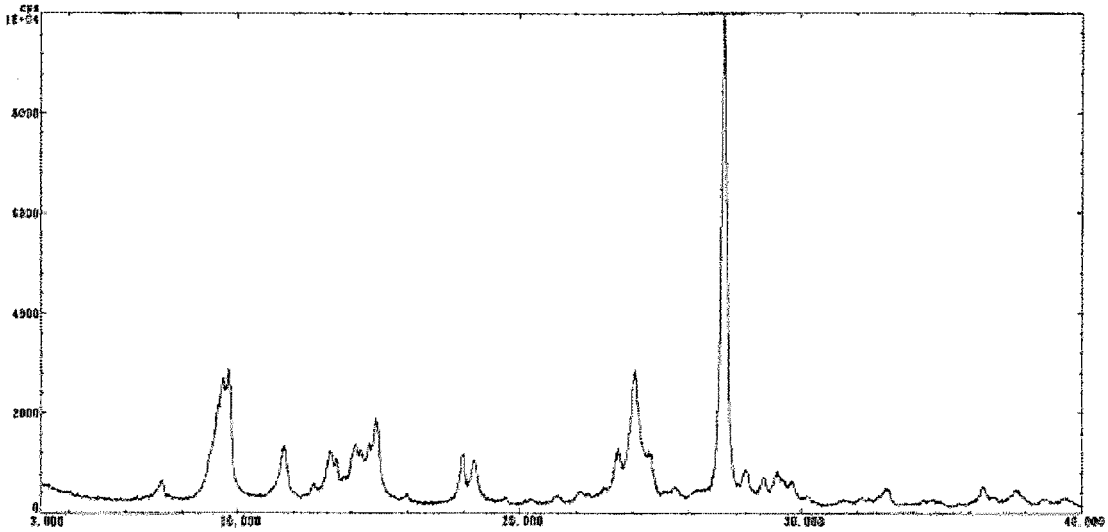
FIG. 11 is a diagram showing an XD spectrum of titanyl phthalocyanine synthesized in Synthetic Example A-1.

Forty grams of the obtained wet cake (water paste) was put in 200 g of tetrahydrofuran and the mixture was strongly stirred in a homomixer (MARKII f-Model, manufactured by KENIS, Ltd. at 2,000 rpm at room temperature. When the navy blue color of the paste turned into light blue (20 minutes later from the start of stirring), the stirring was stopped. Immediately after that, the mixture was filtered under reduced pressure. A crystal obtained in the filtration equipment was washed with tetrahydrofuran to thereby obtain a pigment wet cake. The pigment wet cake was dried at 70° C. under reduced pressure (5 mmHg) for two days to obtain 8.5 parts by mass of a titanylphthalocyanine crystal. This was termed as Pigment A-1. The solid content of the wet cake was 15% by mass. A crystal conversion solvent of 33 times the volume of the wet cake based on mass ratio was used. Note that no halogen-containing compound was used in raw materials of Synthesis Example A-1. The obtained titanylphthalocyanine powder was measured by an X-ray diffractometer under the following conditions, and it was found that a titanylphthalocyanine powder having a maximum peak at 27.2±0.2° of Bragg angle 2θ with respect to Cu—Kα line (wavelength: 1.542 angstrom), a peak at 7.3±0.2° of the minimum angle and further having primary peaks at 9.4±0.2°, 9.6±0.2°, 24.0±0.2° and having no peak in between the peak of 7.3° and the peak of 9.4°, further having no peak at 26.3° was obtained. FIG. 11 shows the measurement result.

Figure 12:
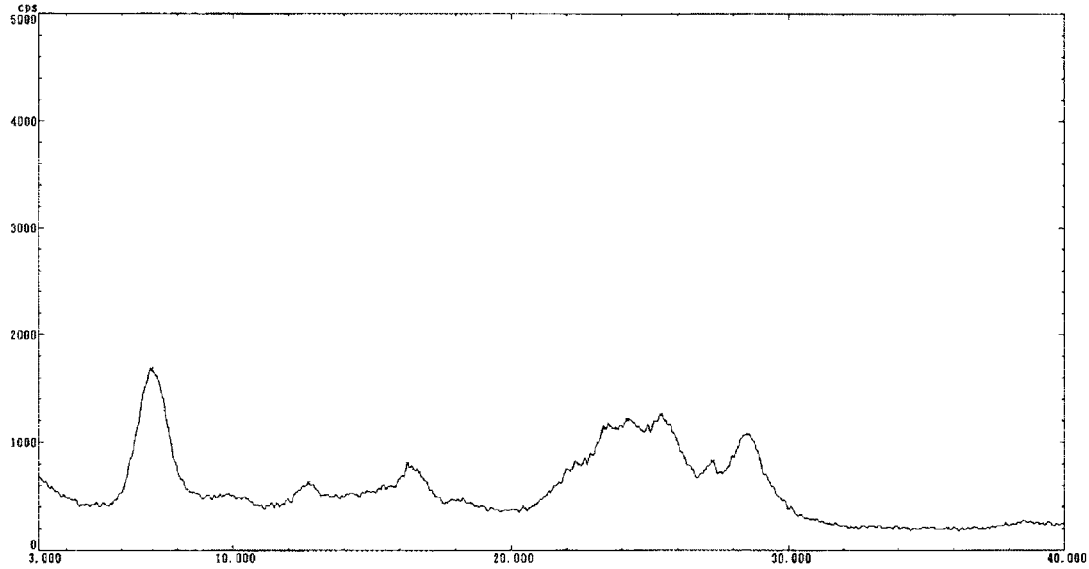
FIG. 12 is a diagram showing an XD spectrum of a dry powder of a water paste (wet cake).

Apart of the water paste obtained in Synthesis Example A-1 was dried at 80° C. under reduced pressure (5 mmHg) for 2 days to thereby obtain a low-crystalline titanylphthalocyanine powder. FIG. 12 shows an X-ray diffraction spectrum of the water paste dry powder.

<Measurement Conditions of X-ray Diffraction Spectrum>

X-ray tube: Cu

Power voltage: 50 kV

Power current: 30 mA

Scanning rate: 2°/min

Scanning range: 30 to 400

Time constant: 2 seconds

A part of the titanylphthalocyanine (water paste) before the crystal conversion prepared in Synthesis Example A-1 was diluted with ion exchange water so as to be about 1% by mass and the surface of the diluted suspension was skimmed with a copper skimmer subjected to a conductive treatment. Then, the titanylphthalocyanine was observed to determine the particle diameter with a transmission electron microscope (TEM, H-9000 NAR, manufactured by Hitachi, Ltd.) at 75,000-fold magnification. The average particle diameter was determined as follows.

The TEM image observed as above was printed on a film as a TEM photograph. From the projected titanylphthalocyanine particles, 30 particles having a needle-like shape were arbitrarily selected and the longest diameter of the respective particles was measured. The total measurement value of the longest diameters of the 30 particles was averaged out and the average value was regarded as the average particle diameter of the titanylphthalocyanine particles.

The average particle diameter of titanylphthalocyanine in the water paste (wet cake) in Synthesis Example A-1 determined by the above-noted method was 0.06 μm.

Further, the crystal-converted titanylphthalocyanine crystal immediately before the filtration in Synthesis Example A-1 was diluted with tetrahydrofuran so as to be about 1% by mass and the surface of the diluted suspension was observed in the same manner as described above. The average particle diameter determined by the same method as described above was shown in Table A-1. Note that in the titanylphthalocyanine crystal prepared in Synthesis Example A-1, all the crystal particles did not necessarily have the same shape, i.e., there were crystal particles having an approximately triangular or quadrangular shape, however, the crystal particles were similar in size. For this reason, the average particle diameter was calculated assuming the length of the longest diagonal line of the crystal particle was the longest diameter. As a result, the average particle diameter was 0.12 μm.

Dispersion Preparation Example A-1

The pigment A-1 prepared in Synthesis Example A-1 was dispersed in the following composition under the following conditions to prepare a dispersion as a charge-generating layer coating solution.

| | |
|---|---|
| Titanylphthalocyanine pigment (Pigment A-1) | 15 parts |
| Polyvinylbutyral (BX-1, manufactured by SEKISUI CHEMICAL CO., LTD.) | 10 parts |
| 2-butanone | 280 parts |

In a commercially available bead mill, the 2-butanone with the polyvinylbutyral dissolved therein and the titanylphthalocyanine pigment (Pigment A-1) were put and the components were dispersed using a PSZ ball having a diameter of 0.5 mm at a rotor speed of 1,200 rpm for 30 minutes to thereby prepare a dispersion. This was named as Dispersion A-1.

Dispersion Preparation Example A-2

The following composition was dispersed under the following conditions to prepare a dispersion as a charge generating coating solution.

| | |
|---|---|
| Azo pigment represented by the following structural formula | 5 parts |

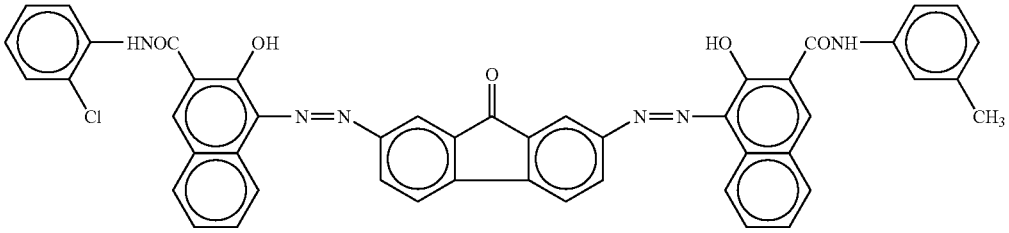

| | |
|---|---|
| Polyvinylbutyral (BX-1, manufactured by SEKISUI CHEMICAL CO., LTD.) | 2 parts |
| Cyclohexanone | 250 parts |
| 2-butanone | 100 parts |

In a bead mill, a solvent (2-butanone) with the polyvinylbutyral dissolved therein and the azo pigment were put and the components were dispersed using a PSZ ball having a diameter of 10 mm at a rotor speed of 85 rpm for 7 days to thereby prepare a dispersion. This was named as Dispersion A-2.

Dispersion Preparation Example A-3

A dispersion (Dispersion A-3) was prepared in the same manner as in Dispersion Preparation Example A-2, except that the azo pigment used in Dispersion Preparation Example A-2 was changed to a pigment represented by the following structural formula.

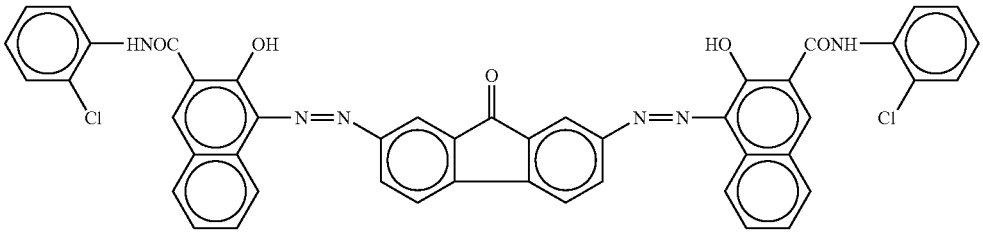

The particle size distribution of the pigment particle in the dispersion prepared as above was measured by a particle size distribution analyzer (CAPA-700, manufactured by HORIBA Instruments Inc.). Table A-1 shows the result.

TABLE A-1

| | Average particle diameter (μm) | Standard Deviation (μm) |
|---|---|---|
| Dispersion A1 | 0.19 | 0.13 |
| Dispersion A2 | 0.26 | 0.18 |
| Dispersion A3 | 0.27 | 0.17 |

Photoconductor Preparation Example A-1

Over the surface of an aluminum drum (JIS 1050) having an external diameter of 60 mm, an intermediate coating solution, a charge generating layer coating solution and a charge transporting coating solution each having the following composition were applied sequentially, the applied coating solutions were sequentially dried to form an intermediate layer having a thickness of 3.5 μm, a charge generating layer having a thickness of 0.5 μm and a charge transporting layer having a thickness of 17 μm, thereby preparing a multi-layered photoconductor (electrophotographic photoconductor 1a).

—Intermediate Layer Coating Solution—

| | |
|---|---|
| Surface-untreated rutile-type titanium oxide (CR-EL, manufactured by ISHIHARA INDUSTRY CO., LTD., average particle diameter: 0.25 μm) | 112 parts |
| Alkyd resin (BECKOLITE M6401-50-S (solid content: 50%), manufactured by Dainippon Ink and Chemicals, Inc.) | 33.6 parts |
| Melamine resin (SUPER BECKAMINE G 821-60 (solid content: 60%), manufactured by Dainippon Ink and Chemicals, Inc.) | 18.7 parts |
| 2-butanon | 115 parts |

—Charge Generating Layer Coating Solution—

The Dispersion A-2 prepared as above was used.

—Charge Transporting Layer Coating Solution—

| | |
|---|---|
| Polycarbonate (TS2050, manufactured by Teijin Chemicals, Ltd.) | 10 parts |
| Charge transporting material represented by the following structural formula | 8 parts |

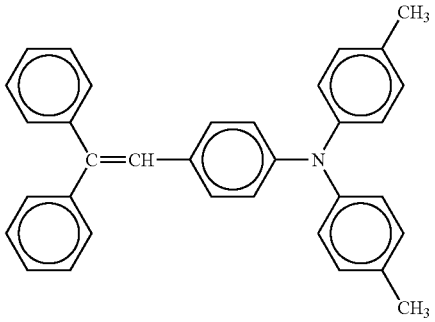

| | |
|---|---|
| Methylene chloride | 80 parts |

Photoconductor Preparation Example A-2

A photoconductor (photoconductor 2a) was prepared in the same manner as in Photoconductor Preparation Example A-1, except that the layer thickness of the charge transporting layer formed in Photoconductor Preparation Example A-1 was changed to 27 μm.

Photoconductor Preparation Example A-3

A photoconductor (photoconductor 3a) was prepared in the same manner as in Photoconductor Preparation Example A-1, except that the layer thickness of the charge transporting layer was changed to 37 μm.

Photoconductor Preparation Example A-4

A photoconductor (photoconductor 4a) was prepared in the same manner as in Photoconductor Preparation Example A-1, except that the layer thickness of the charge transporting layer was changed to 15 μm and a protective layer having the following composition and a thickness of 1 μm was formed on the charge transporting layer.

—Protective Layer Coating Solution—

| | |
|---|---|
| Polycarbonate (TS2050, manufactured by Teijin Chemicals, Ltd.) | 10 parts |
| Charge transporting material represented by the following structural formula | 10 parts |

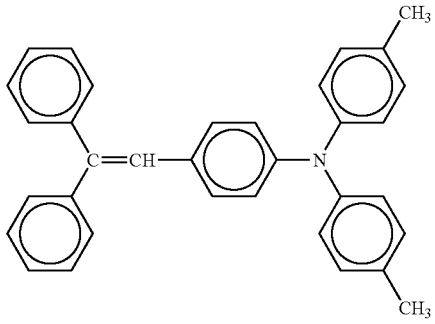

| | |
|---|---|
| α-alumina (relative resistivity: $2.5 \times 10^{12}\Omega \cdot$ cm, average primary particle diameter: 0.4 μm, refractive index: 1.28) | 2 parts |
| Resistivity reducing agent (BYK-P105, manufactured by BYK Chemie Co.) | 0.1 parts |
| Cyclohexanone | 160 parts |
| Tetrahydrofuran | 570 parts |

Photoconductor Preparation Example A-5

A photoconductor (photoconductor 5a) was prepared in the same manner as in Photoconductor Preparation Example A-4, except that the layer thickness of the protective layer was changed to 7 μm.

Photoconductor Preparation Example A-6

A photoconductor (photoconductor 6a) was prepared in the same manner as in Photoconductor Preparation Example A-1, except that the layer thickness of the charge transporting layer was changed to 15 μm and a protective layer having the following composition and a thickness of 1 μm was formed on the charge transporting layer.

—Protective Layer Coating Solution—

| | |
|---|---|
| Trifunctional or more radically polymerizable monomer having no charge transporting structure (trimethylolpropane triacrylate, KAYARAD TMPTA, manufactured by Nippon Kayaku Co., Ltd., molecular mass: 296, the number of functional groups: trifunctional, molecular mass/the number of functional groups = 99) | 10 parts |
| Radically polymerizable compound having a monofunctional charge transporting structure represented by the following structural formula | 10 parts |

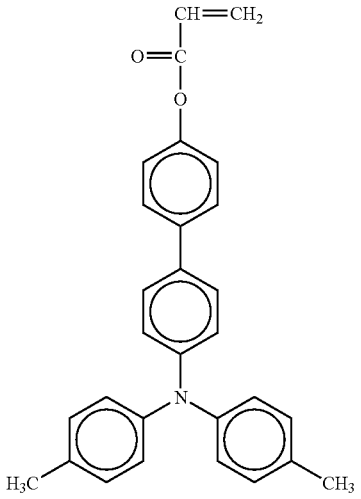

| | |
|---|---|
| Photopolymerization initiator (1-hydroxy-cyclohexyl-phenyl-ketone, IRGACURE 184, manufactured by Chiba Specialty Chemicals K.K.) | 1 part |
| Tetrahydrofuran | 100 parts |

The protective layer was formed as follows. The charge transporting layer surface was spray-coated with the protective layer coating solution, the applied protective layer coating solution was naturally dried for 20 minutes, and the coated layer was photo-irradiated under the conditions of metal halide lamp: 160 W/cm, irradiation intensity: 500 mW/cm$^2$ and irradiation time: 60 seconds.

Photoconductor Preparation Example A-7

A photoconductor (photoconductor 7a) was prepared in the same manner as in Photoconductor Preparation Example A-6, except that the layer thickness of the protective layer was changed to 8 μm.

Photoconductor Preparation Example A-8

A photoconductor (photoconductor 8a) was prepared in the same manner as in Photoconductor Preparation Example A-1, except that the intermediate layer formed in Photoconductor Preparation Example A-1 was changed so as to have a multi-layered structure composed of a charge blocking layer and a moire prevention layer, a charge blocking layer coating solution and a moire prevention layer coating solution each having the following composition were sequentially applied over the surface of an aluminum drum and the respectively applied coating solutions were dried to form a charge blocking layer having a thickness of 1.0 μm and a moire prevention layer having a thickness of 3.5 μm.

—Charge Blocking Layer Coating Solution—

| | |
|---|---|
| N-methoxymethylated nylon (FINE RESIN FR-101, manufactured by NAMARIICHI CO., LTD.) | 4 parts |
| Methanol | 70 parts |
| n-butanol | 30 parts |

—Moire Prevention Layer Coating Solution—

| | |
|---|---|
| Surface-untreated rutile-type titanium oxide (CR-EL, manufactured by ISHIHARA INDUSTRY CO., LTD., average particle diameter: 0.25 μm) | 126 parts |
| Alkyd resin (BECKOLITE M6401-50-S (solid content: 50%), manufactured by Dainippon Ink and Chemicals, Inc.) | 25.2 parts |
| Melamine resin (SUPER BECKAMINE G 821-60 (solid content: 60%), manufactured by Dainippon Ink and Chemicals, Inc.) | 14.0 parts |
| 2-butanone | 150 parts |

Photoconductor Preparation Example A-9

A photoconductor (photoconductor 9a) was prepared in the same manner as in Photoconductor Preparation Example A-1, except that the Dispersion A-3 was used instead of the charge generating coating solution used in Photoconductor Preparation Example A-1.

(Measurement of Transit Time Length)

The transit time of the prepared photoconductors 1a and 9a was determined as described below.

The potential at an exposed region of the respective photoconductors was determined under the following conditions using the equipment described in Japanese Patent Application Laid-Open (JP-A) No. 2000-275872 (shown in FIG. 1).

Linear velocity of photoconductor: 262 mm/sec

Resolution in the sub-scanning direction: 400 dpi

Static power in image surface: 0.3 mW (exposure dose: 0.4 μJ/cm$^2$)

Wavelength of writing light: 655 nm

Charge elimination device: activated

Charging condition: the charged amount of the photoconductor surface was controlled such that the surface potential before writing was set to −800V.

Figure 3:
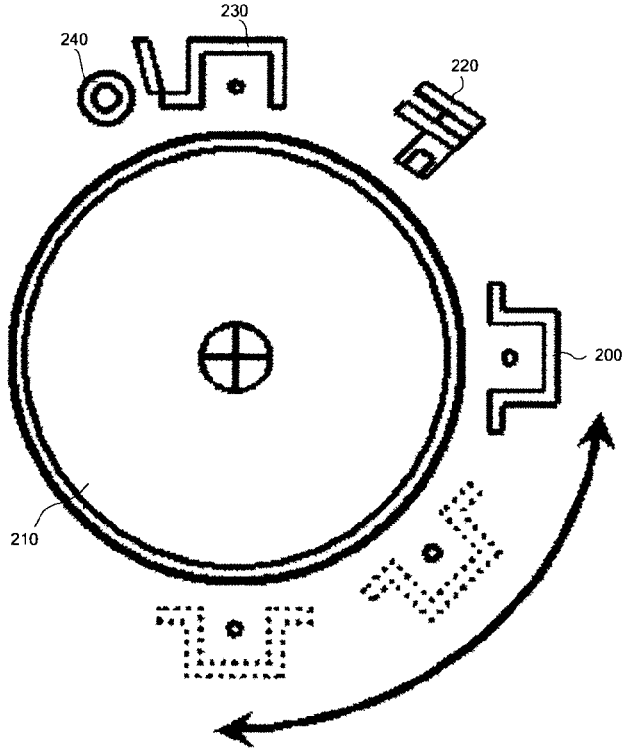
FIG. 3 is a conceptual diagram showing a method of evaluating a light decay property.

Under the above-mentioned conditions, a surface electrometer set to the developing position, as shown in FIG. 3, was re-positioned along the circumferential direction of the photoconductor, and charged amount was measured at 10 sites for 20 ms to 155 ms as the exposing-to-developing time length. In the Examples in the present invention, to obtain the following exposing-to-developing time lengths, the angle of the electrometer was set to the following degrees.

| | |
|---|---|
| "20 ms" | 10° |
| "25 ms" | 12.5° |
| "30 ms" | 15° |
| "35 ms" | 17.5° |
| "40 ms" | 20° |
| "50 ms" | 25° |
| "70 ms" | 35° |
| "90 ms" | 45° |
| "110 ms" | 55° |
| "130 ms" | 65° |
| "155 ms" | 77.5° |

Figure 4:
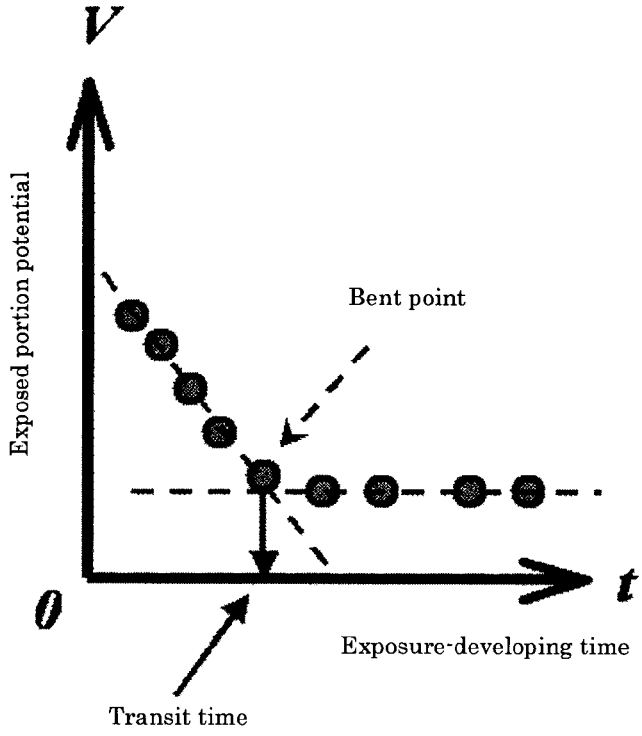
FIG. 4 is a diagram showing a method for calculating the transit time.

The thus obtained potential values in the exposed region of the respective photoconductors were individually plotted with respect to the exposing-to-developing time lengths as shown in FIG. 4 and the curve at the critical point (bend point) was determined to thereby determine the transit time of the respective photoconductors. Table A-2 shows the results.

TABLE A-2

| Photoconductor Preparation Example | Photoconductor No. | Transit time (ms) |
|---|---|---|
| A-1 | 1a | 43 |
| A-2 | 2a | 48 |
| A-3 | 3a | 57 |
| A-4 | 4a | 45 |
| A-5 | 5a | 62 |
| A-6 | 6a | 47 |
| A-7 | 7a | 67 |
| A-8 | 8a | 44 |
| A-9 | 9a | 44 |

Example A-1

The photoconductor "1a" prepared in Photoconductor Preparation Example A-1 was mounted in an image forming apparatus as shown in FIG. 9. A scorotoron charger (corona charge system) was used as a charging member to charge the photoconductor surface. An image was written at a resolution of 1,200 dpi using a semiconductor laser having a wavelength of 655 nm as the image exposing light source (four-channel LDAs in which four LDs are arranged in an array (1×4)—a semiconductor laser having a structure as described in Japanese Patent (JP-B) No. 3227226, although the arrangement differs from that of the semiconductor laser described therein, and an image is written by the use of a polygon mirror), the image was developed by two-component developing process using a toner having an average particle diameter of 6.8 μm. The developed image was transferred onto a transfer sheet using a primary transfer belt and a secondary transfer belt as transfer members, the photoconductor surface was cleaned by blade cleaning method and a charge remaining on the photoconductor surface was eliminated using an LED having a wavelength of 660 nm as the charge elimination light source.

Since the image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°, and the linear velocity of the photoconductor was 480 mm/sec, the LDs were arranged so that the time length the arbitrarily determined point on the photoconductor irradiated with the writing light reaching the center of the developing sleeve (exposing-to-developing time length) was 49 ms.

The process conditions were set so that the following conditions could be obtained at the initial operation.

Charge potential of photoconductor (potential of unexposed region): −800 V

Developing bias: −550V (negative/positive developing bias)

Surface potential of exposed region: −120 V (potential used in solid part of image)

<Evaluation Items>

(1) Measurement of Surface Potential

The potential at an exposed region in each of the prepared photoconductors was measured by the following method. Specifically, a surface potential meter was mounted to a position of the developing unit as shown in FIG. 9 and the photoconductor was negatively charged to −800 V. Thereafter, a solid part of image was written with the semiconductor laser, and the potential of the exposed region in the image-developed portion was measured. Table A-3 shows the result.

(2) Evaluation of Background Smear

A blank image print was output using the image forming apparatus to evaluate background smear under the conditions of 22° C. and a relative humidity of 50%. The level of background smear was evaluated based on the number of black points and the size of the black points occurred in the background of the output print. The state of background smear was ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table A-3 shows the evaluation results.

(3) Evaluation of Dot Reproductivity

Using the image forming apparatus, an isolated one-dot image was output to evaluate the dot reproductivity. The one-dot image print was observed by an optical microscope, and the definitude of the dot outline was ranked according to the following four grades. A photoconductor provided extremely favorable dot reproductivity was ranked A, a photoconductor provided favorable dot reproductivity was ranked B, a photoconductor provided slightly poor dot reproductivity was ranked C and a photoconductor provided extremely poor dot reproductivity was ranked D. Table A-3 shows the evaluation results.

After the evaluations (1) to (3) were carried out, 10,000 sheets of a chart with an image area of 6% (characters having an image area ratio equivalent to 6% to the entire area of the A4 sheet were averagely written) were printed out in succession under the above-noted process conditions. After outputting 10,000 sheets in succession, the evaluations (1) to (3) were carried out again.

Examples A-2 to A-6 and Comparative Examples A-1 to A-3

The electrophotographic photoconductors 2a to 9a prepared in Photoconductor Preparation Examples A-2 to A-9 were evaluated in the same conditions as in Example A-1. Table A-3 shows the evaluation results. Table A-3 also shows the electrophotographic photoconductor numbers used in Examples A-2 to A-6 and Comparative Examples A-1 to A-3.

TABLE A-3

| | Photoconductor No. | In initial stage: Surface potential (−V) | Background smear | Dot reproductivity | After printing 10,000 sheets: Surface potential (−V) | Background smear | Dot reproductivity |
|---|---|---|---|---|---|---|---|
| Ex. A-1 | 1a | 70 | B | A | 75 | B to C | A |
| Ex. A-2 | 2a | 75 | B to A | A | 80 | B | B |
| Compara. Ex. A-1 | 3b | 85 | C | C | 105 | C | C |
| Ex. A-3 | 4a | 70 | B to A | A | 75 | B to A | B to A |
| Compara. Ex. A-2 | 5a | 90 | C | C | 120 | C | C |
| Ex. A-4 | 6a | 75 | B to A | A | 80 | B to A | B to A |
| Compara. Ex. A-3 | 7a | 95 | C | C | 135 | C | C to D |
| Ex. A-5 | 8a | 70 | A | A | 75 | A | B to A |
| Ex. A-6 | 9a | 85 | B to A | A | 90 | B | D |

In Examples A-2 to A-6 and Comparative Examples A-1 to A-3, to obtain the above-noted exposing-to-developing time lengths, the angle of the electrometer was set to the following degrees.

| | |
|---|---|
| "20 ms" | 10° |
| "25 ms" | 12.5° |
| "30 ms" | 15° |
| "35 ms" | 17.5° |
| "40 ms" | 20° |
| "50 ms" | 25° |
| "70 ms" | 35° |
| "90 ms" | 45° |
| "110 ms" | 55° |
| "130 ms" | 65° |
| "155 ms" | 77.5° |

The results shown in Table A-3 verified that when the transit time length was shorter than the exposing-to-developing time length (Examples A-1 to A-6), the light decay property was favorably exhibited in the initial stage of the use of the photoconductors and even after repetitive use of the photoconductors. In contrast, when the transit time length was longer than the exposing-to-developing time length (Comparative Examples A-1 to A-3), a rise in surface potential was observed, and after repetitive use of the photoconductors, the phenomenon was conspicuous.

It was also found that the transit time length was shorter than the exposing-to-developing time length (Examples A-1 to A-6), the dot reproductivity was excellent, and even after repetitive use of the photoconductors, images having excellent dot image quality were formed. In contrast, it was found that when the transit time length was longer than the exposing-to-developing time length (Comparative Examples A-1 to A-3), the dot reproductivity was degraded after the repetitive use of the photoconductors.

Further, from the evaluation results using a blank image, the evaluation rank of background smear could be elevated and the improvement effect could be kept up even after repetitive use by making an intermediate layer have a multi-layered structure composed of a charge blocking layer and a moire prevention layer (Example A-5).

Furthermore, in a comparison between Example A-1 and Example A-6, the surface potential at the exposed region in the photoconductor 1a used in A-1 was lower than that of the photoconductor 9a used in Example A-6. This shows that the asymmetrical azo pigment used in the photoconductor 1a contributed to the high-photosensitivity.

Photoconductor Preparation Examples A-10 to A-17

Photoconductors were respectively prepared in the same manner as in Photoconductor Preparation Examples A-1 to A-8, except that the respective charge generating layer coating solutions used in Photoconductor Preparation Examples A-1 to A-8 were changed to Dispersion A-1 (the prepared photoconductors were named as photoconductors 10a to 17a in this order).

(Measurement of Transit Time Length)

The transit time length of the prepared photoconductors 10a to 17a was determined as described below.

The potential at an exposed region of the respective photoconductors was determined under the following conditions using the equipment described in Japanese Patent Application Laid-Open (JP-A) No. 2000-275872 (shown in FIG. 1).

Linear velocity of photoconductor: 262 mm/sec

Resolution in the sub-scanning direction: 400 dpi

Static power in image surface: 0.3 mW (exposure dose: 0.4 $\mu J/cm^2$)

Wavelength of writing light: 780 nm

Charge elimination device: activated

Charging condition: the charged amount of the photoconductor surface was controlled such that the surface potential before writing was set to −800V.

Under the above-mentioned conditions, a surface electrometer set to the developing position, as shown in FIG. 3, was re-positioned along the circumferential direction of the photoconductor, and charged amount was measured at 10 sites for 20 ms to 155 ms as the exposing-to-developing time length. In the Examples in the present invention, to obtain the following exposing-to-developing time lengths, the angle of the electrometer was set to the following degrees.

| | |
|---|---|
| "20 ms" | 10° |
| "25 ms" | 12.5° |
| "30 ms" | 15° |
| "35 ms" | 17.5° |
| "40 ms" | 20° |
| "50 ms" | 25° |
| "70 ms" | 35° |
| "90 ms" | 45° |
| "110 ms" | 55° |

-continued

| | |
|---|---|
| "130 ms" | 65° |
| "155 ms" | 77.5° |

The thus obtained potential values in the exposed region of the respective photoconductors were individually plotted with respect to the exposing-to-developing time lengths as shown in FIG. 4 and the curve at the critical point (bend point) was determined to thereby determine the transit time of the respective photoconductors. Table A-4 shows the results.

TABLE A-4

| Photoconductor Preparation Example | Photoconductor No. | Transit time (ms) |
|---|---|---|
| A-10 | 10a | 42 |
| A-11 | 11a | 50 |
| A-12 | 12a | 54 |
| A-13 | 13a | 46 |
| A-14 | 14a | 54 |
| A-15 | 15a | 48 |
| A-16 | 16a | 56 |
| A-17 | 17a | 44 |

Example A-7

The prepared electrophotographic photoconductor 10a was attached to a process cartridge and the process cartridge was placed in an image forming apparatus as shown in FIG. 9. The photoconductor was charged using a scorotoron charger (corona charge system) as a charging member. An image was written at a resolution of 2,400 dpi using a light source according to the surface-emitting laser array described in Japanese Patent Application Laid-Open (JP-A) No. 2004-287085 (light emitting points are dimensionally arrayed in 8×4; the number of laser beams: 32, wavelength: 780 nm) as an image exposure light source. The image was developed by two-component developing process using toners each having an average particle diameter of 6.2 μm (a yellow toner, a magenta toner, a cyan toner and a black toner were individually used for each station). The developed image was directly transferred onto a transfer sheet using a transfer belt as a transfer member, the photoconductor surface was cleaned by blade cleaning method and a charge remaining on the photoconductor surface was eliminated using an LED having a wavelength of 655 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

The process conditions were set so that the following conditions could be obtained at the initial operation.

Charge potential of photoconductor (potential of unexposed region): −800 V

Developing bias: −550V (negative/positive developing bias)

Surface potential of exposed region: −150 V

<Evaluation Items>

(1) Measurement of Surface Potential

The potential at an exposed region in each of the prepared photoconductors was measured by the following method. Specifically, a surface potential meter was mounted to a position of a developing unit of magenta station as shown in FIG. 9 and the photoconductor was negatively charged to −800 V. Thereafter, a solid part of image was written with the image exposure light source, and the potential of the exposed region in the image-developed portion was measured. Table A-5 shows the result.

(2) Evaluation of Image Density

After negatively charging each of the photoconductors to −800 V, 10,000 sheets in total of the image were printed out in succession using the image forming apparatus. An image printed out in the initial stage and an image printed out after outputting the 10,000 sheets were evaluated. The level of image density was ranked according to the following four grades. A photoconductor provided extremely favorable image density was ranked A, a photoconductor provided favorable image density was ranked B, a photoconductor provided slightly poor image density was ranked C and a photoconductor provided extremely poor image density was ranked D. Table A-5 shows the evaluation results.

(3) Evaluation of Residual Image

Figure 13:
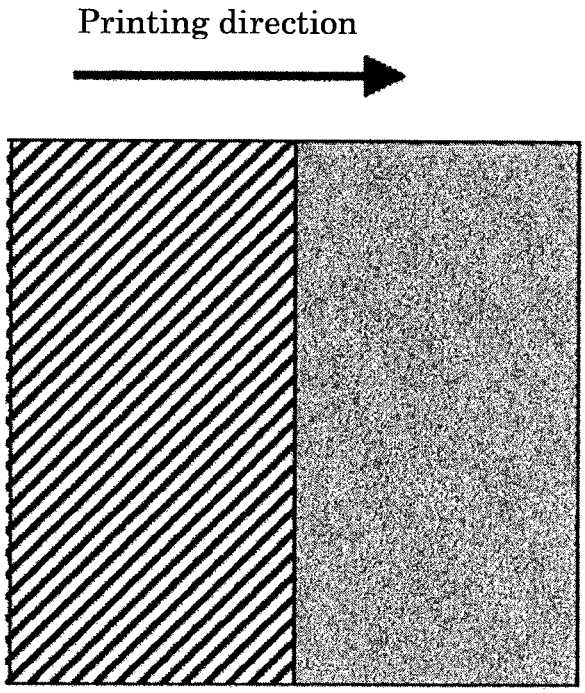
FIG. 13 is a test chart used in Examples A-7 and A-17.
Figure 14:
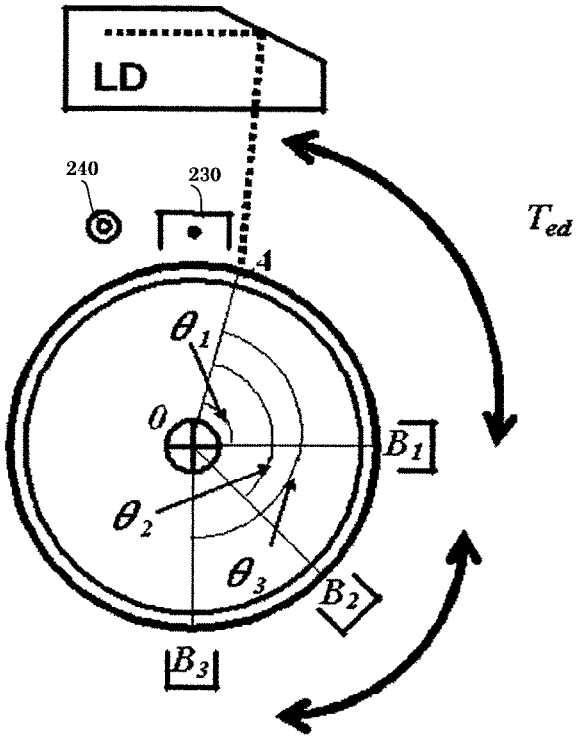
FIG. 14 is a diagram showing a photoconductor property evaluating apparatus of the present invention.
Figure 15:
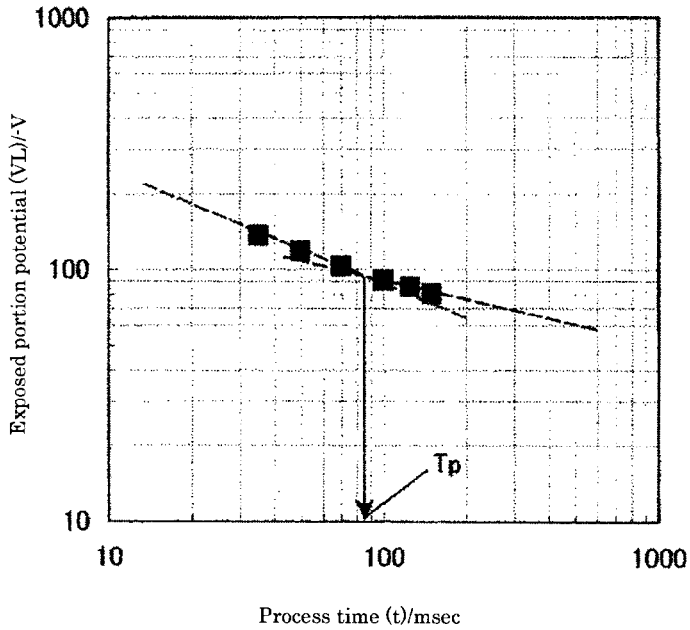
FIG. 15 is a diagram showing a specific example of the transit time.

An A4 size chart as shown in FIG. 13 (hatched image in the ⅖ (two fifth) part in the first part and a halftone image in the ⅗ (third fifth) part in the last part) was used, and the image was output in a mono-color mode (in black only). The level of a negative residual image in the halftone part (the hatched part is sometimes thickly output in the halftone part) was evaluated and ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table A-5 shows the evaluation results.

After the evaluations (1) to (3) were carried out, 10,000 sheets of a full-color chart with an image area of 6% (oblique lines having an image area ratio equivalent to 6% to the entire area of the A4 sheet were averagely written) were printed out in succession under the above-noted process conditions. After outputting 10,000 sheets in succession, the evaluations (1) to (3) were carried out again.

Examples A-8 to A-11 and Comparative Examples A-4 to A-6

Electrophotographic photoconductors 11a to 17a prepared as described above under the same conditions as in Example A-7 were evaluated. Table A-5 shows the result. Table A-5 also shows the electrophotographic photoconductor numbers used in Examples A-8 to A-11 and Comparative Examples A-4 to A-6.

TABLE A-5

| | Photoconductor No. | In initial stage | | | After printing 10,000 sheets | | |
|---|---|---|---|---|---|---|---|
| | | Surface potential (−V) | Image density | Residual image | Surface potential (−V) | Image density | Residual image |
| Ex. A-7 | 10a | 150 | A | A | 155 | B to A | A |
| Ex. A-8 | 11a | 155 | A | A | 160 | B | B |
| Compara. Ex. A-4 | 12a | 165 | C | C | 185 | C | C |
| Ex. A-9 | 13a | 150 | A | A | 155 | B to A | B to A |
| Compara. Ex. A-5 | 14a | 170 | C | C | 200 | C to D | C to D |
| Ex. A-10 | 15a | 155 | A | A | 160 | B to A | B to A |
| Compara. Ex. A-6 | 16a | 175 | C | C | 215 | C to D | C to D |
| Ex. A-11 | 17a | 150 | A | A | 155 | B | B |

The results shown in Table A-5 verified that when the transit time length was shorter than the exposing-to-developing time length (Examples A-7 to A-11), the light decay property was favorably exhibited in the initial stage of the use of the photoconductors and even after repetitive use of the photoconductors. In contrast, when the transit time length was longer than the exposing-to-developing time length (Comparative Examples A-4 to A-6), a rise in surface potential was observed, and after repetitive use of the photoconductors, the phenomenon was conspicuous.

It was also found that the transit time length was shorter than the exposing-to-developing time length (Examples A-7 to A-11), the image density was high, and even after repetitive use of the photoconductors, excellent color images could be formed. In contrast, it was found that when the transit time length was longer than the exposing-to-developing time length (Comparative Examples A-4 to A-6), the image density was lowered after the repetitive use of the photoconductors.

Further, when the transit time length was shorter than the exposing-to-developing time length (Examples A-7 to A-11), a favorable residual image level was obtained, and even after repetitive use of the photoconductors, excellent color images could be formed. In contrast, when the transit time length was longer than the exposing-to-developing time length (Comparative Examples A-4 to A-6), the residual image level was degraded after repetitive use of the photoconductors.

Photoconductor Preparation Examples A-18 to A-25

Photoconductors were prepared in the same manner as in Photoconductor Preparation Examples A-10 to A-17, except that the conductive support used in Photoconductor Preparation Examples A-10 to A-17 was changed to a nickel (Ni) belt having an external diameter of 168 mm (the prepared photoconductors were named as photoconductors 18a to 25a in this order).

(Measurement of Transit Time Length)

The transit time length of the prepared photoconductors 18a to 25a was determined as described below.

The potential at an exposed region of the respective photoconductors was determined under the following conditions using the equipment described in Japanese Patent Application Laid-Open (JP-A) No. 2000-275872 (shown in FIG. 1).

Linear velocity of photoconductor: 262 mm/sec

Resolution in the sub-scanning direction: 400 dpi

Static power in image surface: 0.3 mW (exposure dose: 0.4 $\mu J/cm^2$)

Wavelength of writing light: 780 nm

Charge elimination device: activated

Charging condition: the charged amount of the photoconductor surface was controlled such that the surface potential before writing was set to −800V.

Under the above-mentioned conditions, a surface electrometer set to the developing position, as shown in FIG. 3, was re-positioned along the circumferential direction of the photoconductor, and charged amount was measured at 10 sites for 20 ms to 155 ms as the exposing-to-developing time length. In the Examples in the present invention, to obtain the following exposing-to-developing time lengths, the angle of the electrometer was set to the following degrees.

| | |
|---|---|
| "20 ms" | 10° |
| "25 ms" | 12.5° |
| "30 ms" | 15° |
| "35 ms" | 17.5° |
| "40 ms" | 20° |
| "50 ms" | 25° |
| "70 ms" | 35° |
| "90 ms" | 45° |
| "110 ms" | 55° |
| "130 ms" | 65° |
| "155 ms" | 77.5° |

The thus obtained potential values in the exposed region of the respective photoconductors were individually plotted with respect to the exposing-to-developing time lengths as shown in FIG. 4 and the curve at the critical point (bend point) was determined to thereby determine the transit time of the respective photoconductors. Table A-6 shows the results.

TABLE A-6

| Photoconductor Preparation Example | Photoconductor No. | Transit time (ms) |
|---|---|---|
| A-18 | 18a | 45 |
| A-19 | 19a | 49 |
| A-20 | 20a | 57 |
| A-21 | 21a | 46 |
| A-22 | 22a | 54 |
| A-23 | 23a | 46 |
| A-24 | 24a | 57 |
| A-25 | 25a | 44 |

Example A-12

The thus prepared photoconductor A-18 was placed in an image forming apparatus as shown in FIG. 9. For the charging member, the scorotron charger was replaced by a charge roller which was closely situated in a distance of 50 μm from the photoconductor surface, and the photoconductor was charged. The surface of the charge roller was wound round with a gap-forming tape having a thickness of 50 μm such that only in image-non-formed surface areas at both ends of the photoconductor, the photoconductor surface could make contact with the charge roller. An image was written at a resolution of 1,200 dpi using a semiconductor laser having a wavelength of 780 nm as the image exposing light source (four-channel LDs in which four LDs are arranged in an array (1×4)—a semiconductor laser having a structure as described in Japanese Patent (JP-B) No. 3227226, although the arrangement differs from that of the semiconductor laser described therein, and an image is written by the use of a polygon mirror), the image was developed by two-component developing process using a toner having an average particle diameter of 6.8 μm. The developed image was transferred onto a transfer sheet using a primary transfer belt and a secondary transfer belt as transfer members, the photoconductor surface was cleaned by blade cleaning method and a charge remaining on the photoconductor surface was eliminated using an LED having a wavelength of 660 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

The process conditions were set so that the following conditions could be obtained at the initial operation.

Charge potential of photoconductor (potential of unexposed region): −800 V

Developing bias: −550V (negative/positive developing bias)

Surface potential of exposed region: −80 V (potential at solid part of image)

<Evaluation Items>

(1) Measurement of Surface Potential

The potential at an exposed region in each of the prepared photoconductors was measured by the following method. Specifically, a surface potential meter was mounted to a position of the developing unit as shown in FIG. 9 and the photoconductor was negatively charged to −800 V. Thereafter, a solid part of image was written with the semiconductor laser, and the potential of the exposed region in the image-developed portion was measured. Table A-7 shows the result.

(2) Evaluation of Background Smear

A blank image print was output using the image forming apparatus to evaluate background smear under the conditions of 22° C. and a relative humidity of 50%. The level of background smear was evaluated based on the number of black points and the size of the black points occurred in the background of the output print. The state of background smear was ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table A-7 shows the evaluation results.

(3) Evaluation of Dot-Reproductivity

Using the image forming apparatus, an isolated one-dot image was output to evaluate the dot reproductivity. The one-dot image print was observed by an optical microscope, and the definitude of the dot outline was ranked according to the following four grades. A photoconductor provided extremely favorable dot reproductivity was ranked A, a photoconductor provided favorable dot reproductivity was ranked B, a photoconductor provided slightly poor dot reproductivity was ranked C and a photoconductor provided extremely poor dot reproductivity was ranked D. Table A-7 shows the evaluation results.

After the evaluations (1) to (3) were carried out, 10,000 sheets of a chart with an image area of 6% (characters having an image area ratio equivalent to 6% to the entire area of the A4 sheet were averagely written) were printed out in succession under the above-noted process conditions. After outputting 10,000 sheets in succession, the evaluations (1) to (3) were carried out again.

Examples A-13 to A-16 and Comparative Examples A-7 to A-9

Electrophotographic photoconductors 19a to 25a prepared as described above under the same conditions as in Example A-12 were evaluated. Table A-7 shows the result. Table A-7 also shows the electrophotographic photoconductor numbers used in Examples A-13 to A-16 and Comparative Examples A-7 to A-9.

TABLE A-7

| | | In initial stage | | | After printing 10,000 sheets | | |
|---|---|---|---|---|---|---|---|
| | Photoconductor No. | Surface potential (−V) | Background smear | Dot reproductivity | Surface potential (−V) | Background smear | Dot reproductivity |
| Ex. A-12 | 18a | 120 | B | A | 120 | B to C | A |
| Ex. A-13 | 19a | 125 | B to A | A | 130 | B | B |
| Compara. Ex. A-7 | 20a | 135 | C | C | 155 | C | C |
| Ex. A-14 | 21a | 120 | B to A | A | 125 | B to A | B to A |
| Compara. Ex. A-8 | 22a | 140 | C | C | 170 | C | C |
| Ex. A-15 | 23a | 125 | B to A | A | 130 | B to A | B to A |
| Compara. Ex. A-9 | 24a | 145 | C | C | 185 | C | C to D |
| Ex. A-16 | 25a | 120 | A | A | 125 | A | B to A |

The results shown in Table A-7 verified that when the transit time length was shorter than the exposing-to-developing time length (Examples A-12 to A-16), the light decay property was favorably exhibited in the initial stage of the use of the photoconductors and even after repetitive use of the photoconductors. In contrast, when the transit time length was longer than the exposing-to-developing time length (Comparative Examples A-7 to A-9), a rise in surface potential was observed, and after repetitive use of the photoconductors, the phenomenon was conspicuous.

It was also found that the transit time length was shorter than the exposing-to-developing time length (Examples A-12 to A-16), the dot reproductivity was excellent, and even after repetitive use of the photoconductors, images having excellent dot image quality were formed. In contrast, it was found that when the transit time length was longer than the exposing-to-developing time length (Comparative Examples A-7 to A-9), the dot reproductivity was degraded after the repetitive use of the photoconductors.

Further, from the evaluation results using a blank image, the evaluation rank of background smear could be elevated and the improvement effect could be kept up even after repetitive use by making an intermediate layer have a multi-layered structure composed of a charge blocking layer and a moire prevention layer (Example A-16).

Example A-17

The prepared electrophotographic photoconductor 18a was attached to a process cartridge, and the process cartridge was placed in an image forming apparatus having a structure as shown in FIG. 10. For the charging member, a charge roller which was closely situated in a distance of 50 μm from the photoconductor surface, and the photoconductor was charged (in FIG. 10, a scorotoron charger was illustrated). The surface of the charge roller was wound round with a gap-forming tape having a thickness of 50 μm such that only in image-non-formed surface areas at both ends of the photoconductor, the photoconductor surface could make contact with the charge roller. An image was written at a resolution of 2,400 dpi using a light source according to the surface-emitting laser array described in Japanese Patent Application Laid-Open (JP-A) No. 2004-287085 (light emitting points are dimensionally arrayed in 8×4; the number of laser beams: 32, wavelength: 780 nm) as an image exposure light source. The image was developed by two-component developing process using toners each having an average particle diameter of 6.2 μm (a yellow toner, a magenta toner, a cyan toner and a black toner were individually used for each station). The developed image was transferred onto a transfer belt as a transfer member, the photoconductor surface was cleaned by blade cleaning method and a charge remaining on the photoconductor surface was eliminated using an LED having a wavelength of 655 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

The process conditions were set so that the following conditions could be obtained at the initial operation.

Charge potential of photoconductor (potential of unexposed region): −800 V

Developing bias: −550V (negative/positive developing bias)

Surface potential of exposed region: −150 V (potential at solid part of image)

<Evaluation Items>

(1) Measurement of Surface Potential

The potential at an exposed region in each of the prepared photoconductors was measured by the following method. Specifically, a surface potential meter was mounted to a position of a developing unit of magenta station as shown in FIG. 10 and the photoconductor was negatively charged to −800 V. Thereafter, a solid part of image was written with the image exposure light source, and the potential of the exposed region in the image-developed portion was measured. Table A-8 shows the result.

(2) Evaluation of Color Reproductivity

Using the image forming apparatus, 10,000 sheets of an ISO/JIS-SCID image N1 (portrait) were output, and the color reproductivity of the image print was visually checked and evaluated. The level of color reproductivity was ranked according to the following four grades. A photoconductor provided extremely favorable color reproductivity was ranked A, a photoconductor provided favorable color reproductivity was ranked B, a photoconductor provided slightly poor color reproductivity was ranked C and a photoconductor provided extremely poor color reproductivity was ranked D. Table A-8 shows the evaluation results.

(3) Evaluation of Residual Image

An A4 size chart as shown in FIG. 13 (hatched image in the ⅖ (two fifth) part in the first part and a halftone image in the ⅗ (third fifth) part in the last part) was used, and the image was output in a mono-color mode (in black only). The level of a negative residual image in the halftone part (the hatched part is sometimes thickly output in the halftone part) was evaluated and ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table A-8 shows the evaluation results.

After the evaluations (1) to (3) were carried out, 10,000 sheets of a full-color chart with an image area of 6% (oblique lines having an image area ratio equivalent to 6% to the entire area of the A4 sheet were averagely written) were printed out in succession under the above-noted process conditions. After outputting 10,000 sheets in succession, the evaluations (1) to (3) were carried out again.

Examples A-18 to A-21 and Comparative Examples A-10 to A-12

Electrophotographic photoconductors 19a to 25a prepared as described above under the same conditions as in Example A-17 were evaluated. Table A-8 shows the result. Table A-8 also shows the electrophotographic photoconductor numbers used in Examples A-18 to A-21 and Comparative Examples A-10 to A-12.

TABLE A-8

| | Photoconductor No. | In initial stage: Surface potential (−V) | Color reproductivity | Residual image | After printing 10,000 sheets: Surface potential (−V) | Color reproductivity | Residual image |
|---|---|---|---|---|---|---|---|
| Ex. A-17 | 18a | 150 | A | A | 155 | B to A | A |
| Ex. A-18 | 19a | 155 | A | A | 160 | B | B |
| Compara. Ex. A-10 | 20a | 165 | C | C | 185 | C | C |
| Ex. A-19 | 21a | 150 | A | A | 155 | B to A | B to A |
| Compara. Ex. A-11 | 22a | 170 | C | C | 200 | C to D | C to D |
| Ex. A-20 | 23a | 155 | A | A | 160 | B to A | B to A |
| Compara. Ex. A-12 | 24a | 175 | C | C | 215 | C to D | C to D |
| Ex. A-21 | 25a | 150 | A | A | 155 | B | B |

The results shown in Table A-8 verified that when the transit time length was shorter than the exposing-to-developing time length (Examples A-17 to A-21), the light decay property was favorably exhibited in the initial stage of the use of the photoconductors and even after repetitive use of the photoconductors. In contrast, when the transit time length was longer than the exposing-to-developing time length (Comparative Examples A-10 to A-12), a rise in surface potential was observed, and after repetitive use of the photoconductors, the phenomenon was conspicuous.

It was also found that the transit time length was shorter than the exposing-to-developing time length (Examples A-17 to A-21), the color reproductivity was excellent, and even after repetitive use of the photoconductors, images having excellent color image quality were formed. In contrast, it was found that when the transit time length was longer than the exposing-to-developing time length (Comparative Examples A-10 to A-12), the color reproductivity was degraded after the repetitive use of the photoconductors.

Further, when the transit time length was shorter than the exposing-to-developing time length (Examples A-17 to A-21), a favorable residual image level was obtained, and even after repetitive use of the photoconductors, excellent color images could be formed. In contrast, when the transit time length was longer than the exposing-to-developing time length (Comparative Examples A-10 to A-12), the residual image level was degraded after repetitive use of the photoconductors.

—Synthesis of Titanylphthalocyanine Crystal—

Synthesis Example B-1

A pigment was produced according to the Example 1 described in Japanese Patent Application Laid-Open (JP-A) No. 2004-83859.

Specifically, 292 g of 1,3-diiminoisoindline and 1,800 parts of sulfolane were mixed, and 20.4 g of titanium tetrabutoxide was delivered by drops into the mixture in a nitrogen gas stream. Upon completion of the dropping, the temperature of the mixture was gradually increased to 180° C. and then stirred and reacted for 5 hours while keeping the reaction temperature from 170° C. to 180° C. After completion of the reaction, the reactant was naturally cooled, and the precipitate was filtered and the filtrated precipitate was washed until the powder of the precipitate turned into blue by chloroform. Next, the powder was washed with methanol several times and further washed with 80° C. hot water several times and then dried to obtain a coarse titanylphthalocyanine. The coarse titanylphthalocyanine was dissolved in 20 times its volume of a sulfuric acid, and the titanylphthalocyanine solution was delivered by drops into 100 times its volume of ice water with stirring to obtain a precipitate of crystal. The precipitated crystal was filtered and then repeatedly washed with ion exchange water (pH: 7.0; relative conductivity: 1.0 μS/cm) until the wash solution became neutral (the pH value of the ion exchange water after washing was 6.8 and the relative conductivity was 2.6 μS/cm), thereby obtaining a titanylphthalocyanine pigment wet cake (water paste).

Figure 18:
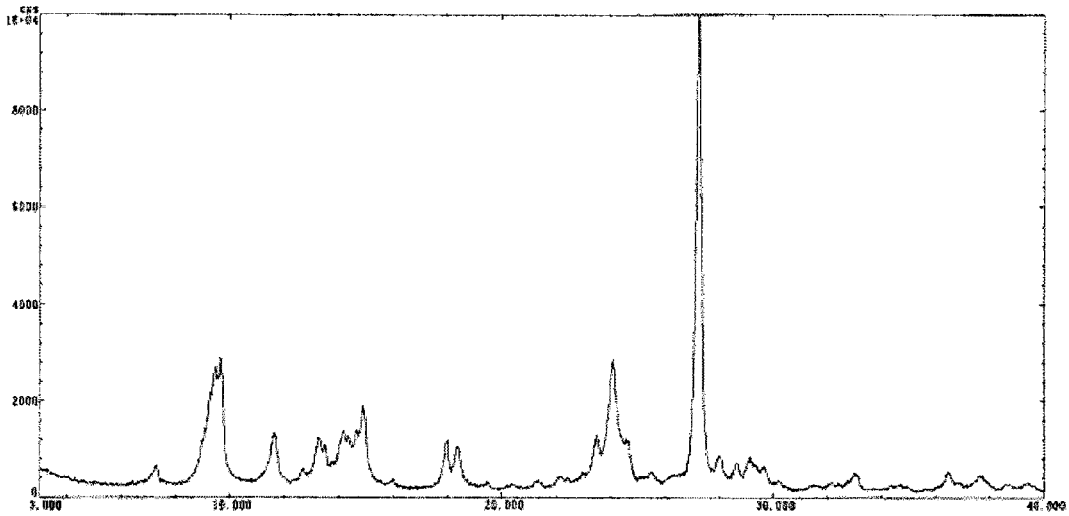
FIG. 18 is a diagram showing an XD spectrum of titanyl phthalocyanine synthesized in Synthetic Example B-1.

Forty grams of the obtained wet cake (water paste) was put in 200 g of tetrahydrofuran and the mixture was strongly stirred in a homomixer (MARKII f-Model, manufactured by KENIS, Ltd. at 2,000 rpm at room temperature. When the navy blue color of the paste turned into light blue (20 minutes later from the start of stirring), the stirring was stopped. Immediately after that, the mixture was filtered under reduced pressure. A crystal obtained in the filtration equipment was washed with tetrahydrofuran to thereby obtain a pigment wet cake. The pigment wet cake was dried at 70° C. under reduced pressure (5 mmHg) for two days to obtain 8.5 parts by mass of a titanylphthalocyanine crystal. This was termed as Pigment B-1. The solid content of the wet cake was 15% by mass. A crystal conversion solvent of 33 times the volume of the wet cake based on mass ratio was used. Note that no halogen-containing compound was used in raw materials of Synthesis Example B-1. The obtained titanylphthalocyanine powder was measured by an X-ray diffractometer under the following conditions, and it was found that a titanylphthalocyanine powder having a maximum peak at 27.2±0.2° of Bragg angle 2θ with respect to Cu—Kα line (wavelength: 1.542 angstrom), a peak at 7.3±0.2° of the minimum angle and further having primary peaks at 9.4±0.2°, 9.6±0.2°, 24.0±0.2° and having no peak in between the peak of 7.3° and the peak of 9.4°, further having no peak at 26.3° was obtained. FIG. 18 shows the measurement result.

Figure 19:
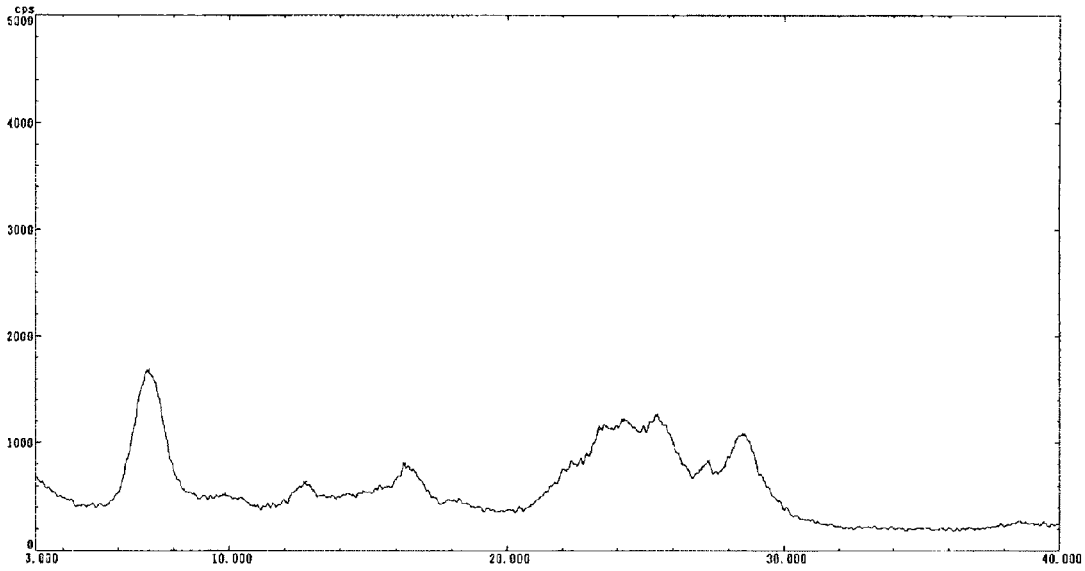
FIG. 19 is a diagram showing an XD spectrum of a dry powder of a water paste (wet cake).

A part of the water paste obtained in Synthesis Example B-1 was dried at 80° C. under reduced pressure (5 mmHg) for 2 days to thereby obtain a low-crystalline titanylphthalocyanine powder. FIG. 19 shows an X-ray diffraction spectrum of the water paste dry powder.

<Measurement Conditions of X-ray Diffraction Spectrum>
X-ray tube: Cu
Power voltage: 50 kV
Power current: 30 mA
Scanning rate: 2°/min
Scanning range: 3° to 40°
Time constant: 2 seconds A part of the titanylphthalocyanine (water paste) before the crystal conversion prepared in Synthesis Example B-1 was diluted with ion exchange water so as to be about 1% by mass and the surface of the diluted suspension was skimmed with a copper skimmer subjected to a conductive treatment. Then, the titanylphthalocyanine was observed to determine the particle diameter with a transmission electron microscope (TEM, H-9000 NAR, manufactured by Hitachi, Ltd.) at 75,000-fold magnification. The average particle diameter was determined as follows.

The TEM image observed as above was printed on a film as a TEM photograph. From the projected titanylphthalocyanine particles, 30 particles having a needle-like shape were arbitrarily selected and the longest diameter of the respective particles was measured. The total measurement value of the longest diameters of the 30 particles was averaged out and the average value was regarded as the average particle diameter of the titanylphthalocyanine particles. The average particle diameter of titanylphthalocyanine in the water paste (wet cake) in Synthesis Example B-1 determined by the above-noted method was 0.06 μm.

Further, the crystal-converted titanylphthalocyanine crystal immediately before the filtration in Synthesis Example B-1 was diluted with tetrahydrofuran so as to be about 1% by mass and the surface of the diluted suspension was observed in the same manner as described above. The average particle diameter determined by the same method as described above was shown in Table B-1. Note that in the titanylphthalocyanine crystal prepared in Synthesis Example B-1, all the crystal particles did not necessarily have the same shape, i.e., there were crystal particles having an approximately triangular or quadrangular shape, however, the crystal particles were similar in size. For this reason, the average particle diameter was calculated assuming the length of the longest diagonal line of the crystal particle was the longest diameter. As a result, the average particle diameter was 0.12 μm.

Dispersion Preparation Example B-1

The pigment B-1 prepared in Synthesis Example B-1 was dispersed in the following composition under the following conditions to prepare a dispersion as a charge-generating layer coating solution.

| | |
|---|---|
| Titanylphthalocyanine pigment (Pigment B-1) | 15 parts |
| Polyvinylbutyral (BX-1, manufactured by SEKISUI CHEMICAL CO., LTD.) | 10 parts |
| 2-butanone | 280 parts |

In a commercially available bead mill, the 2-butanone with the polyvinylbutyral dissolved therein and the titanylphthalocyanine pigment (Pigment B-1) were put and the components were dispersed using a PSZ ball having a diameter of 0.5 mm at a rotor speed of 1,200 rpm for 30 minutes to thereby prepare a dispersion. This was named as Dispersion B-1.

Dispersion Preparation Example B-2

The following composition was dispersed under the following conditions to prepare a dispersion as a charge generating coating solution.

| | |
|---|---|
| Azo pigment represented by the following structural formula | 5 parts |

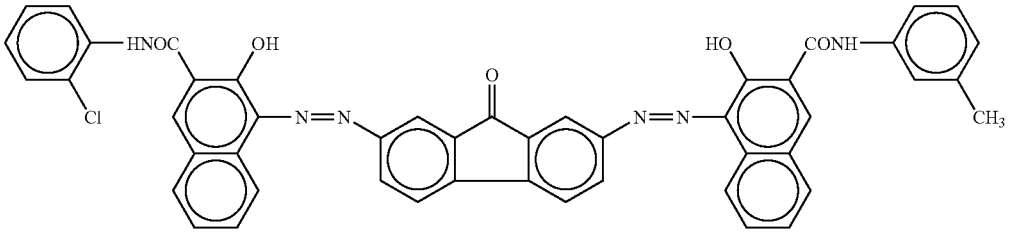

| | |
|---|---|
| Polyvinylbutyral (BX-1, manufactured by SEKISUI CHEMICAL CO., LTD.) | 2 parts |
| Cyclohexanone | 250 parts |
| 2-butanone | 100 parts |

In a bead mill, a solvent (2-butanone) with the polyvinylbutyral dissolved therein and the azo pigment were put and the components were dispersed using a PSZ ball having a diameter of 10 mm at a rotor speed of 85 rpm for 7 days to thereby prepare a dispersion. This was named as Dispersion B-2.

Dispersion Preparation Example B-3

A dispersion (Dispersion B-3) was prepared in the same manner as in Dispersion Preparation Example B-2, except that the azo pigment used in Dispersion Preparation Example B-2 was changed to a pigment represented by the following structural formula.

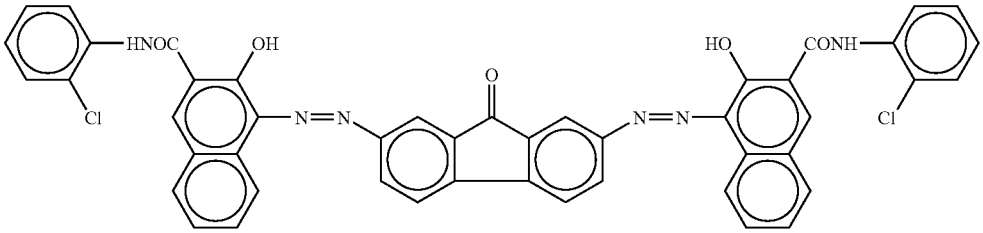

The particle size distribution of the pigment particle in the dispersion prepared as above was measured by a particle size distribution analyzer (CAPB-700, manufactured by HORIBA Instruments Inc.). Table B-1 shows the result.

TABLE B-1

| | Average particle diameter (μm) | Standard Deviation (μm) |
|---|---|---|
| Dispersion B1 | 0.19 | 0.13 |
| Dispersion B2 | 0.26 | 0.18 |
| Dispersion B3 | 0.27 | 0.17 |

Photoconductor Preparation Example B-1

Over the surface of an aluminum drum (JIS 1050) having an external diameter of 60 mm, an intermediate coating solution, a charge generating layer coating solution and a charge transporting coating solution each having the following composition were applied sequentially, the applied coating solutions were sequentially dried to form an intermediate layer having a thickness of 3.5 μm, a charge generating layer having a thickness of 0.5 μm and a charge transporting layer having a thickness of 17 μm, thereby preparing a multi-layered photoconductor (photoconductor 1b).

—Intermediate Layer Coating Solution—

| | |
|---|---|
| Surface-untreated rutile-type titanium oxide (CR-EL, manufactured by ISHIHARA INDUSTRY CO., LTD., average particle diameter: 0.25 μm) | 112 parts |
| Alkyd resin (BECKOLITE M6401-50-S (solid content: 50%), manufactured by Dainippon Ink and Chemicals, Inc.) | 33.6 parts |
| Melamine resin (SUPER BECKAMINE G 821-60 (solid content: 60%), manufactured by Dainippon Ink and Chemicals, Inc.) | 18.7 parts |
| 2-butanon | 115 parts |

—Charge Generating Layer Coating Solution—

The Dispersion B-2 prepared as above was used.

—Charge Transporting Layer Coating Solution—

| | |
|---|---|
| Polycarbonate (TS2050, manufactured by Teijin Chemicals, Ltd.) | 10 parts |
| Charge transporting material represented by the following structural formula | 8 parts |

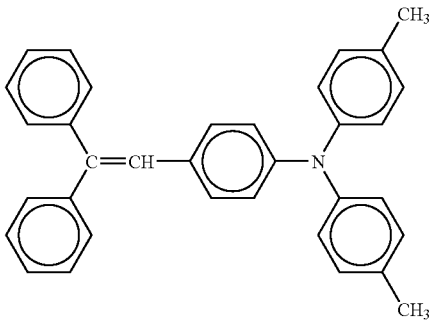

| | |
|---|---|
| Methylene chloride | 80 parts |

Photoconductor Preparation Example B-2

A photoconductor (photoconductor 2b) was prepared in the same manner as in Photoconductor Preparation Example B-1, except that the layer thickness of the charge transporting layer formed in Photoconductor Preparation Example B-1 was changed to 27 μm.

Photoconductor Preparation Example B-3

A photoconductor (photoconductor 3b) was prepared in the same manner as in Photoconductor Preparation Example B-1, except that the layer thickness of the charge transporting layer was changed to 37 μm.

Photoconductor Preparation Example B-4

A photoconductor (photoconductor 4b) was prepared in the same manner as in Photoconductor Preparation Example B-1, except that the layer thickness of the charge transporting layer was changed to 15 μm and a protective layer having the following composition and a thickness of 1 μm was formed on the charge transporting layer.

—Protective Layer Coating Solution—

| | |
|---|---|
| Polycarbonate (TS2050, manufactured by Teijin Chemicals, Ltd.) | 10 parts |
| Charge transporting material represented by the following structural formula | 10 parts |

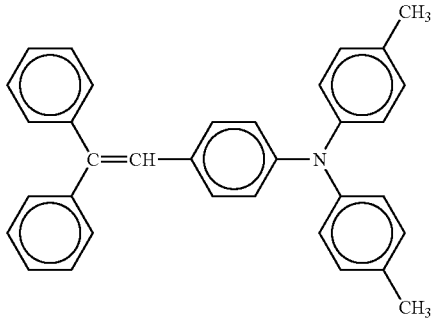

| | |
|---|---|
| α-alumina (relative resistivity: $2.5 \times 10^{12}\Omega \cdot$ cm, average primary particle diameter: 0.4 μm, refractive index: 1.28) | 2 parts |
| Resistivity reducing agent (BYK-P105, manufactured by BYK Chemie Co.) | 0.1 parts |
| Cyclohexanone | 160 parts |
| Tetrahydrofuran | 570 parts |

Photoconductor Preparation Example B-5

A photoconductor (photoconductor 6b) was prepared in the same manner as in Photoconductor Preparation Example B-4, except that the layer thickness of the protective layer was changed to 7 μm.

Photoconductor Preparation Example B-6

A photoconductor (photoconductor 6b) was prepared in the same manner as in Photoconductor Preparation Example B-1, except that the layer thickness of the charge transporting layer was changed to 15 μm and a protective layer having the following composition and a thickness of 1 μm was formed on the charge transporting layer.

—Protective Layer Coating Solution—

| | |
|---|---|
| Trifunctional or more radically polymerizable monomer having no charge transporting structure (trimethylolpropane triacrylate, KAYARAD TMPTA, manufactured by Nippon Kayaku Co., Ltd., molecular mass: 296, the number of functional groups: trifunctional, molecular mass/the number of functional groups = 99) | 10 parts |
| Radically polymerizable compound having a monofunctional charge transporting structure represented by the following structural formula | 10 parts |

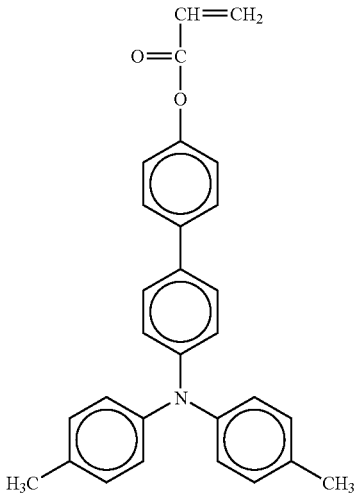

| | |
|---|---|
| Photopolymerization initiator (1-hydroxy-cyclohexyl-phenyl-ketone, IRGACURE 184, manufactured by Chiba Specialty Chemicals K.K.) | 1 part |
| Tetrahydrofuran | 100 parts |

The protective layer was formed as follows. The charge transporting layer surface was spray-coated with the protective layer coating solution, the applied protective layer coating solution was naturally dried for 20 minutes, and the coated layer was photo-irradiated under the conditions of metal halide lamp: 160 W/cm, irradiation intensity: 500 mW/cm$^2$ and irradiation time: 60 seconds.

Photoconductor Preparation Example B-7

A photoconductor (photoconductor 7b) was prepared in the same manner as in Photoconductor Preparation Example B-6, except that the layer thickness of the protective layer was changed to 8 μm.

Photoconductor Preparation Example B-8

A photoconductor (photoconductor 8b) was prepared in the same manner as in Photoconductor Preparation Example B-1, except that the intermediate layer formed in Photoconductor Preparation Example B-1 was changed so as to have a multi-layered structure composed of a charge blocking layer and a moire prevention layer, a charge blocking layer coating solution and a moire prevention layer coating solution each having the following composition were sequentially applied over the surface of an aluminum drum and the respectively applied coating solutions were dried to form a charge blocking layer having a thickness of 1.0 μm and a moire prevention layer having a thickness of 3.5 μm.

—Charge Blocking Layer Coating Solution—

| | |
|---|---|
| N-methoxymethylated nylon (FINE RESIN FR-101, manufactured by NAMARIICHI CO., LTD.) | 4 parts |
| Methanol | 70 parts |
| n-butanol | 30 parts |

—Moire Prevention Layer Coating Solution—

| | |
|---|---|
| Surface-untreated rutile-type titanium oxide (CR-EL, manufactured by ISHIHARA INDUSTRY CO., LTD., average particle diameter: 0.25 μm) | 126 parts |
| Alkyd resin (BECKOLITE M6401-50-S (solid content: 50%), manufactured by Dainippon Ink and Chemicals, Inc.) | 25.2 parts |
| Melamine resin (SUPER BECKAMINE G 821-60 (solid content: 60%), manufactured by Dainippon Ink and Chemicals, Inc.) | 14.0 parts |
| 2-butanone | 150 parts |

Photoconductor Preparation Example B-9

A photoconductor (photoconductor 9b) was prepared in the same manner as in Photoconductor Preparation Example B-1, except that the Dispersion B-3 was used instead of the charge generating coating solution used in Photoconductor Preparation Example B-1.

(Measurement of Transit Time Length)

The transit time of the prepared photoconductors 1b to 9b was determined as described below.

The potential at an exposed region of the respective photoconductors was determined under the following conditions using the equipment described in Japanese Patent Application Laid-Open (JP-A) No. 2000-275872 (shown in FIG. 1).

Linear velocity of photoconductor: 262 mm/sec

Resolution in the sub-scanning direction: 400 dpi

Static power in image surface: 0.3 mW (exposure dose: 0.4 μJ/cm$^2$)

Wavelength of writing light: 655 nm

Charge elimination device: activated

Charging condition: the charged amount of the photoconductor surface was controlled such that the surface potential before writing was set to −800V.

Under the above-mentioned conditions, a surface electrometer set to the developing position, as shown in FIG. 3, was re-positioned along the circumferential direction of the photoconductor, and charged amount was measured at 10 sites for 20 ms to 155 ms as the exposing-to-developing time length.

The thus obtained potential values in the exposed region of the respective photoconductors were individually plotted with respect to the exposing-to-developing time lengths as shown in FIG. 4 and the curve at the critical point (bend point) was determined to thereby determine the transit time of the respective photoconductors. Table B-2 shows the results.

TABLE B-2

| Photoconductor Preparation Example | Photoconductor No. | Transit time (ms) |
|---|---|---|
| B-1 | 1b | 44 |
| B-2 | 2b | 47 |
| B-3 | 3b | 58 |
| B-4 | 4b | 46 |
| B-5 | 5b | 61 |
| B-6 | 6b | 48 |

TABLE B-2-continued

| Photoconductor Preparation Example | Photoconductor No. | Transit time (ms) |
|---|---|---|
| B-7 | 7b | 68 |
| B-8 | 8b | 43 |
| B-9 | 9b | 44 |

Example B-1

The photoconductor 1b prepared as above was mounted (in a black image forming section) in a two-drum image forming apparatus as shown in FIG. 16. A scorotoron charger (corona charge system) was used as a charging member to charge the photoconductor surface. An image was written at a resolution of 1,200 dpi using a semiconductor laser having a wavelength of 655 nm as the image exposing light source (four-channel LDAs in which four LDs are arranged in an array (1×4)—a semiconductor laser having a structure as described in Japanese Patent (JP-B) No. 3227226, although the arrangement differs from that of the semiconductor laser described therein, and an image is written by the use of a polygon mirror), the image was developed by two-component developing process using a black toner having an average particle diameter of 6.8 μm. The developed image was directly transferred onto a transfer sheet in a transfer unit, the photoconductor surface was cleaned by blade cleaning method and a charge remaining on the photoconductor surface was eliminated using an LED having a wavelength of 660 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

Another photoconductor 1b which was different from the above-noted photoconductor 1b was mounted (in a color image forming section) in the image forming apparatus. A scorotoron charger (corona charge system) was used as a charging member to charge the photoconductor surface. An image was written at a resolution of 1,200 dpi using a semiconductor laser having a wavelength of 655 nm as the image exposing light source (four-channel LDAs in which four LDs are arranged in an array (1×4)—a semiconductor laser having a structure as described in Japanese Patent (JP-B) No. 3227226, although the arrangement differs from that of the semiconductor laser described therein, and an image is written by the use of a polygon mirror), the image was developed by two-component developing process using a color toner having an average particle diameter of 6.8 μm. The developed image was transferred onto a transfer sheet using a primary transfer belt and a secondary transfer belt as transfer members, the photoconductor surface was cleaned by blade cleaning method and a charge remaining on the photoconductor surface was eliminated using an LED having a wavelength of 660 nm as the charge elimination light source.

Since the image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°, and the linear velocity of the photoconductor was 480 mm/sec, the LDs were arranged so that the time length the arbitrarily determined point on the photoconductor irradiated with the writing light reaching the center of the developing sleeve (exposing-to-developing time length) was 49 ms.

The process conditions were set so that the following conditions could be obtained at the initial operation.

Charge potential of photoconductor (potential of unexposed region): −800 V

Developing bias: −550V (negative/positive developing bias) Surface potential of exposed region: −120 V (potential used in solid part of image)

<Evaluation Items (Monochrome)>

Photoconductor 1b was mounted to the black image forming section, and the following evaluations were carried out.

(4) Measurement of Surface Potential

The potential at an exposed region in the prepared photoconductor was measured by the following method. Specifically, a surface potential meter was mounted to a position of the developing unit in the black image forming section as shown in FIG. 16 and the photoconductor was negatively charged to −800 V. Thereafter, a solid part of image was written with the semiconductor laser, and the potential of the exposed region in the image-developed portion was measured. Table B-3-1 shows the result.

(5) Evaluation of Background Smear

A blank image print was output using the image forming apparatus to evaluate background smear under the conditions of 22° C. and a relative humidity of 50%. The level of background smear was evaluated based on the number of black points and the size of the black points occurred in the background of the output print. The state of background smear was ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-3-1 shows the evaluation results.

(6) Evaluation of Dot Reproductivity

Using the image forming apparatus, an isolated one-dot image was output to evaluate the dot reproductivity. The one-dot image print was observed by an optical microscope, and the definitude of the dot outline was ranked according to the following four grades. A photoconductor provided extremely favorable dot reproductivity was ranked A, a photoconductor provided favorable dot reproductivity was ranked B, a photoconductor provided slightly poor dot reproductivity was ranked C and a photoconductor provided extremely poor dot reproductivity was ranked D. Table B-3-1 shows the evaluation results.

After the evaluations (1) to (3) were carried out, 10,000 sheets of a chart with an image area of 6% (characters having an image area ratio equivalent to 6% to the entire area of the A4 sheet were averagely written) were printed out in succession under the above-noted process conditions. After outputting 10,000 sheets in succession, the evaluations (1) to (3) were carried out again.

<Evaluation Items (Full Color)>

Other photoconductors 1b which were different from the above-noted photoconductors 1b for evaluation in the black image forming section were respectively mounted in the black image forming section and the color image forming section, and the following evaluations were carried out.

(4) Measurement of Surface Potential

The potential at an exposed region in the prepared photoconductor was measured by the following method. Specifically, a surface potential meter was mounted to a position of the developing unit in the color image forming section as shown in FIG. 16 and the photoconductor was negatively charged to −800 V. Thereafter, a solid part of image was written with the semiconductor laser, and the potential of the exposed region in the image-developed portion was measured. Table B-3-2 shows the result.

(5) Evaluation of Image Density

After negatively charging each of the photoconductors to −800 V, 10,000 sheets in total of the image were printed out in succession using the image forming apparatus. An image printed out in the initial stage and an image printed out after outputting the 10,000 sheets were evaluated. The level of image density was ranked according to the following four grades. A photoconductor provided extremely favorable image density was ranked A, a photoconductor provided favorable image density was ranked B, a photoconductor provided slightly poor image density was ranked C and a photoconductor provided extremely poor image density was ranked D. Table B-3-2 shows the evaluation results.

(6) Evaluation of Residual Image

Figure 20:
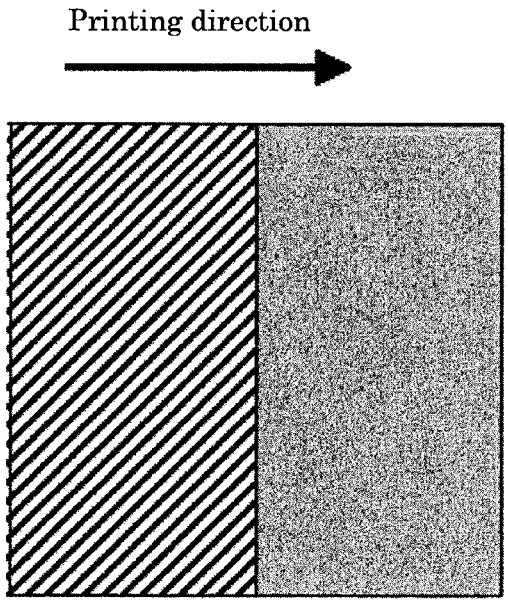
FIG. 20 is a test chart used in Examples B-1, B-7, B-12, B-17 and B-22.

An A4 size chart as shown in FIG. 20 (hatched image in the ⅖ (two fifth) part in the first part and a halftone image in the ⅗ (third fifth) part in the last part) was used, and the image was output in a mono-color mode (in black only). The level of a negative residual image in the halftone part (the hatched part is sometimes thickly output in the halftone part) was evaluated and ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-3-2 shows the evaluation results.

After the evaluations (4) to (6) were carried out, 10,000 sheets of a full-color chart with an image area of 6% (oblique lines having an image area ratio equivalent to 6% to the entire area of the A4 sheet were averagely written) were printed out in succession under the above-noted process conditions. After outputting 10,000 sheets in succession, the evaluations (4) to (6) were carried out again.

Examples B-2 to B-6 and Comparative Examples B-1 to B-3

Photoconductors 2b to 9b prepared as above in the same conditions as in Example B-1 were evaluated. Tables B-3-1 and B-3-2 show the evaluation results. Tables B-3-1 and B-3-2 also show the electrophotographic photoconductor numbers used in Examples B-2 to B-6 and Comparative Examples B-1 to B-3. Note that in the image forming apparatus in which the photoconductor 7b was mounted, the resolution was set to 600 dpi.

TABLE B-3-1

| | | In initial stage | | | After printing 10,000 sheets | | |
|---|---|---|---|---|---|---|---|
| | Photoconductor No. | Surface potential (−V) | Background smear | Dot reproductivity | Surface potential (−V) | Background smear | Dot reproductivity |
| Ex. B-1 | 1b | 65 | B | A | 70 | B to C | A |
| Ex. B-2 | 2b | 70 | B to A | A | 75 | B | B |
| Compara. Ex. B-1 | 3b | 80 | C | C | 100 | C | C |
| Ex. B-3 | 4b | 70 | B to A | A | 75 | B to A | B to A |
| Compara. Ex. B-2 | 5b | 95 | C | C | 125 | C | C |
| Ex. B-4 | 6b | 80 | B to A | A | 85 | B to A | B to A |
| Compara. Ex. B-3 | 7b | 95 | C | C | 135 | C | C to D |
| Ex. B-5 | 8b | 70 | A | A | 75 | A | B to A |
| Ex. B-6 | 9b | 80 | B to A | A | 85 | B | A |

TABLE B-3-2

| | | In initial stage | | | After printing 10,000 sheets | | |
|---|---|---|---|---|---|---|---|
| | Photoconductor No. | Surface potential (−V) | Image density | Residual image | Surface potential (−V) | Image density | Residual image |
| Ex. B-1 | 1b | 65 | A | A | 70 | B to A | A |
| Ex. B-2 | 2b | 70 | A | A | 75 | B | B |
| Compara. Ex. B-1 | 3b | 80 | C | C | 100 | C | C |
| Ex. B-3 | 4b | 70 | A | A | 75 | B to A | B to A |
| Compara. Ex. B-2 | 5b | 95 | C | C | 125 | C to D | C to D |
| Ex. B-4 | 6b | 80 | A | A | 85 | B to A | B to A |
| Compara. Ex. B-3 | 7b | 95 | C | C | 135 | C to D | C to D |
| Ex. B-5 | 8b | 70 | A | A | 75 | B | B |
| Ex. B-6 | 9b | 80 | A | A | 85 | B | B |

The results shown in Table B-3-1 verified that when the transit time length was shorter than the exposing-to-developing time length (Examples B-1 to B-6), the light decay property was favorably exhibited in the initial stage of the use of the photoconductors and even after repetitive use of the photoconductors. In contrast, when the transit time length was longer than the exposing-to-developing time length (Comparative Examples B-1 to B-3), a rise in surface potential was observed, and after repetitive use of the photoconductors, the phenomenon was conspicuous.

It was also found that the transit time length was shorter than the exposing-to-developing time length (Examples B-1 to B-6), the dot reproductivity was excellent, and even after repetitive use of the photoconductors, images having excellent dot image quality were formed. In contrast, it was found that when the transit time length was longer than the exposing-to-developing time length (Comparative Examples B-1 to B-3), the dot reproductivity was degraded after the repetitive use of the photoconductors.

Further, from the evaluation results using a blank image, the evaluation rank of background smear could be elevated and the improvement effect could be kept up even after repetitive use by making an intermediate layer have a multi-layered structure composed of a charge blocking layer and a moire prevention layer (Example B-5).

Furthermore, in a comparison between Example B-1 and Example B-6, the surface potential at the exposed region in the photoconductor 1b used in B-1 was lower than that of the photoconductor 9b used in Example B-6. This shows that the asymmetrical azo pigment used in the photoconductor 1b contributed to the high-photosensitivity.

The results shown in Table B-3-2 verified that when the transit time length was shorter than the exposing-to-developing time length (Examples B-1 to B-6), the light decay property was favorably exhibited in the initial stage of the use of the photoconductors and even after repetitive use of the photoconductors. In contrast, when the transit time length was longer than the exposing-to-developing time length (Comparative Examples B-1 to B-3), a rise in surface potential was observed, and after repetitive use of the photoconductors, the phenomenon was conspicuous.

It was also found that the transit time length was shorter than the exposing-to-developing time length (Examples B-1 to B-6), the image density was high, and even after repetitive use of the photoconductors, excellent full-color images could be formed. In contrast, it was found that when the transit time length was longer than the exposing-to-developing time length (Comparative Examples B-1 to B-3), the image density was lowered after the repetitive use of the photoconductors.

Further, when the transit time length was shorter than the exposing-to-developing time length (Examples B-1 to B-6), a favorable residual image level was obtained, and even after repetitive use of the photoconductors, excellent full-color images could be formed. In contrast, when the transit time length was longer than the exposing-to-developing time length (Comparative Examples B-1 to B-3), the residual image level was degraded after repetitive use of the photoconductors.

Photoconductor Preparation Examples B-10 to B-17

Photoconductors were respectively prepared in the same manner as in Photoconductor Preparation Examples B-1 to B-8, except that the respective charge generating layer coating solutions used in Photoconductor Preparation Examples B-1 to B-8 were changed to Dispersion B-1 (the prepared photoconductors were named as photoconductors 10b to 17b in this order).

(Measurement of Transit Time Length)

The transit time length of the prepared photoconductors 10b to 17b was determined as described below.

The potential at an exposed region of the respective photoconductors was determined under the following conditions using the equipment described in Japanese Patent Application Laid-Open (JP-A) No. 2000-275872 (shown in FIG. 1).

Linear velocity of photoconductor: 262 mm/sec

Resolution in the sub-scanning direction: 400 dpi

Static power in image surface: 0.3 mW (exposure dose: 0.4 $\mu J/cm^2$)

Wavelength of writing light: 780 nm

Charge elimination device: activated

Charging condition: the charged amount of the photoconductor surface was controlled such that the surface potential before writing was set to −800V.

Under the above-mentioned conditions, a surface electrometer set to the developing position, as shown in FIG. 3, was re-positioned along the circumferential direction of the photoconductor, and charged amount was measured at 10 sites for 20 ms to 155 ms as the exposing-to-developing time length.

The thus obtained potential values in the exposed region of the respective photoconductors were individually plotted with respect to the exposing-to-developing time lengths as shown in FIG. 4 and the curve at the critical point (bend point) was determined to thereby determine the transit time of the respective photoconductors. Table B-4 shows the results.

TABLE B-4

| Photoconductor Preparation Example | Photoconductor No. | Transit time (ms) |
|---|---|---|
| B-10 | 10b | 43 |
| B-11 | 11b | 47 |
| B-12 | 12b | 55 |
| B-13 | 13b | 45 |
| B-14 | 14b | 54 |
| B-15 | 15b | 47 |
| B-16 | 16b | 55 |
| B-17 | 17b | 43 |

Example B-7

The prepared electrophotographic photoconductor 10b was attached to a process cartridge and the process cartridge was placed (in a black image forming section) in an image forming apparatus as shown in FIG. 16. The photoconductor was charged using a scorotoron charger (corona charge system) as a charging member. An image was written at a resolution of 2,400 dpi using a light source according to the surface-emitting laser array described in Japanese Patent Application Laid-Open (JP-A) No. 2004-287085 (light emitting points are dimensionally arrayed in 8×4; the number of laser beams: 32, wavelength: 780 nm) as an image exposure light source. The image was developed by two-component developing process using a black toner having an average particle diameter of 6.2 μm. The developed image was directly transferred onto a transfer sheet in the transfer unit, the photoconductor surface was cleaned by blade cleaning method and a charge remaining on the photoconductor surface was eliminated using an LED having a wavelength of 655 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

Another photoconductor 10b which was different from the above-noted photoconductor 10b was attached to a process cartridge and the process cartridge was placed (in a color image forming section) in the image forming apparatus. The photoconductor was charged using a scorotoron charger (corona charge system) as a charging member. An image was written at a resolution of 2,400 dpi using a light source according to the surface-emitting laser array described in Japanese Patent Application Laid-Open (JP-A) No. 2004-287085 (light emitting points are dimensionally arrayed in 8×4; the number of laser beams: 32, wavelength: 780 nm) as an image exposure light source. The image was developed by two-component developing process using toners each having an average particle diameter of 6.2 μm (a yellow toner, a magenta toner, a cyan toner and a black toner were individually used for each station). The developed image was transferred onto a transfer sheet using a primary transfer belt and a secondary transfer belt as transfer members, the photoconductor surface was cleaned by blade cleaning method and a charge remaining on the photoconductor surface was eliminated using an LED having a wavelength of 655 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

The process conditions were set so that the following conditions could be obtained at the initial operation.

Charge potential of photoconductor (potential of unexposed region): −800 V

Developing bias: −550V (negative/positive developing bias)

Surface potential of exposed region: −150 V

<Evaluation Items (Monochrome)>

The photoconductor 10b was attached to a process cartridge the process cartridge was placed in the black image forming section, and the following evaluations were carried out.

<Evaluation Items (Monochrome)>

(1) Measurement of Surface Potential

The potential at an exposed region in the prepared photoconductor was measured by the following method. Specifically, a surface potential meter was mounted to a position of a developing unit of in the black image forming section as shown in FIG. 16 and the photoconductor was negatively charged to −800 V. Thereafter, a solid part of image was written with the image exposure light source, and the potential of the exposed region in the image-developed portion was measured. Table B-5-1 shows the result.

(2) Evaluation of Background Smear

A blank image print was output using the image forming apparatus to evaluate background smear under the conditions of 22° C. and a relative humidity of 50%. The level of background smear was evaluated based on the number of black points and the size of the black points occurred in the background of the output print. The state of background smear was ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-5-1 shows the evaluation results.

(3) Evaluation of Dot Reproductivity

Using the image forming apparatus, an isolated one-dot image was output to evaluate the dot reproductivity. The one-dot image print was observed by an optical microscope, and the definitude of the dot outline was ranked according to the following four grades. A photoconductor provided extremely favorable dot reproductivity was ranked A, a photoconductor provided favorable dot reproductivity was ranked B, a photoconductor provided slightly poor dot reproductivity was ranked C and a photoconductor provided extremely poor dot reproductivity was ranked D. Table B-5-1 shows the evaluation results.

After the evaluations (1) to (3) were carried out, 10,000 sheets of a chart with an image area of 6% (characters having an image area ratio equivalent to 6% to the entire area of the A4 sheet were averagely written) were printed out in succession under the above-noted process conditions. After outputting 10,000 sheets in succession, the evaluations (1) to (3) were carried out again.

<Evaluation Items (Full-Color)>

Other photoconductors 10b which were different from the above-noted photoconductors 10b were respectively mounted in the black image forming section and the color image forming section, and the following evaluations were carried out.

(4) Measurement of Surface Potential

The potential at an exposed region in the prepared photoconductor was measured by the following method. Specifically, a surface potential meter was mounted to a developed portion in the color image forming section as shown in FIG. 16 and the photoconductor was negatively charged to −800 V. Thereafter, a solid part of image was written with the semiconductor laser, and the potential of the exposed region in the image-developed portion was measured. Table B-5-2 shows the result.

(5) Evaluation of Image Density

After negatively charging each of the photoconductors to −800 V, 10,000 sheets in total of the image were printed out in succession using the image forming apparatus. An image printed out in the initial stage and an image printed out after outputting the 10,000 sheets were evaluated. The level of image density was ranked according to the following four grades. A photoconductor provided extremely favorable image density was ranked A, a photoconductor provided favorable image density was ranked B, a photoconductor provided slightly poor image density was ranked C and a photoconductor provided extremely poor image density was ranked D. Table B-5-2 shows the evaluation results.

(6) Evaluation of Residual Image

An A4 size chart as shown in FIG. 20 (hatched image in the ⅖ (two fifth) part in the first part and a halftone image in the 3/5 (third fifth) part in the last part) was used, and the image was output in a mono-color mode (in black only). The level of a negative residual image in the halftone part (the hatched part is sometimes thickly output in the halftone part) was evaluated and ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-5-2 shows the evaluation results.

After the evaluations (4) to (6) were carried out, 10,000 sheets of a full-color chart with an image area of 6% (oblique lines having an image area ratio equivalent to 6% to the entire area of the A4 sheet were averagely written) were printed out in succession under the above-noted process conditions. After outputting 10,000 sheets in succession, the evaluations (4) to (6) were carried out again.

Examples B-8 to B-11 and Comparative Examples B-4 to B-6

Photoconductors 11b to 17b prepared as described above under the same conditions as in Example B-7 were evaluated. Tables B-5-1 and B-5-2 show the result. Tables B-5-1 and B-5-2 also show the electrophotographic photoconductor numbers used in Examples B-8 to B-11 and Comparative Examples B-4 to B-6. Note that in the image forming apparatus in which the photoconductor 16b was mounted, the resolution was set to 600 dpi.

The results shown in Table B-5-1 verified that when the transit time length was shorter than the exposing-to-developing time length (Examples B-7 to B-11), the light decay property was favorably exhibited in the initial stage of the use of the photoconductors and even after repetitive use of the photoconductors. In contrast, when the transit time length was longer than the exposing-to-developing time length (Comparative Examples B-4 to B-6), a rise in surface potential was observed, and after repetitive use of the photoconductors, the phenomenon was conspicuous.

It was also found that the transit time length was shorter than the exposing-to-developing time length (Examples B-7 to B-11), the dot reproductivity was excellent, and even after repetitive use of the photoconductors, images having excellent dot image quality were formed. In contrast, it was found that when the transit time length was longer than the exposing-to-developing time length (Comparative Examples B-4 to B-6), the dot reproductivity was degraded after the repetitive use of the photoconductors.

Further, from the evaluation results using a blank image, the evaluation rank of background smear could be elevated and the improvement effect could be kept up even after repetitive use by making an intermediate layer have a multi-layered structure composed of a charge blocking layer and a moire prevention layer (Example B-1).

The results shown in Table B-5-2 verified that when the transit time length was shorter than the exposing-to-developing time length (Examples B-7 to B-11), the light decay property was favorably exhibited in the initial stage of the use

TABLE B-5-1

| | | In initial stage | | | After printing 10,000 sheets | | |
|---|---|---|---|---|---|---|---|
| | Photoconductor No. | Surface potential (−V) | Background smear | Dot reproductivity | Surface potential (−V) | Background smear | Dot reproductivity |
| Ex. B-7 | 10b | 145 | B | A | 150 | B to C | A |
| Ex. B-8 | 11b | 150 | B to A | A | 155 | B | B |
| Compara. Ex. B-4 | 12b | 160 | C | C | 180 | C | C |
| Ex. B-9 | 13b | 145 | B to A | A | 150 | B to A | B to A |
| Compara. Ex. B-5 | 14b | 165 | C | C | 195 | C | C |
| Ex. B-10 | 15b | 150 | B to A | A | 155 | B to A | B to A |
| Compara. Ex. B-6 | 16b | 170 | C | C | 210 | C | C to D |
| Ex. B-11 | 17b | 145 | A | A | 150 | A | B to A |

TABLE B-5-2

| | | In initial stage | | | After printing 10,000 sheets | | |
|---|---|---|---|---|---|---|---|
| | Photoconductor No. | Surface potential (−V) | Image density | Residual image | Surface potential (−V) | Image density | Residual image |
| Ex. B-7 | 10b | 145 | A | A | 150 | B to A | A |
| Ex. B-8 | 11b | 150 | A | A | 155 | B | B |
| Compara. Ex. B-4 | 12b | 160 | C | C | 180 | C | C |
| Ex. B-9 | 13b | 145 | A | A | 150 | B to A | B to A |
| Compara. Ex. B-5 | 14b | 165 | C | C | 195 | C to D | C to D |
| Ex. B-10 | 15b | 150 | A | A | 155 | B to A | B to A |
| Compara. Ex. B-6 | 16b | 170 | C | C | 210 | C to D | C to D |
| Ex. B-11 | 17b | 145 | A | A | 150 | B | B |

of the photoconductors and even after repetitive use of the photoconductors. In contrast, when the transit time length was longer than the exposing-to-developing time length (Comparative Examples B-4 to B-6), a rise in surface potential was observed, and after repetitive use of the photoconductors, the phenomenon was conspicuous.

It was also found that the transit time length was shorter than the exposing-to-developing time length (Examples B-7 to B-11), the image density was high, and even after repetitive use of the photoconductors, excellent full-color images could be formed. In contrast, it was found that when the transit time length was longer than the exposing-to-developing time length (Comparative Examples B-4 to B-6), the image density was lowered after the repetitive use of the photoconductors.

Further, when the transit time length was shorter than the exposing-to-developing time length (Examples B-7 to B-11), a favorable residual image level was obtained, and even after repetitive use of the photoconductors, excellent full-color images could be formed. In contrast, when the transit time length was longer than the exposing-to-developing time length (Comparative Examples B-4 to B-6), the residual image level was degraded after repetitive use of the photoconductors.

Example B-12

The thus prepared photoconductor 10b was placed in an image forming apparatus as shown in FIG. 17. For the charging member, a charge roller was closely situated in a distance of 50 μm from the photoconductor surface, and the photoconductor was charged. The surface of the charge roller was wound round with a gap-forming tape having a thickness of 50 μm such that only in image-non-formed surface areas at both ends of the photoconductor, the photoconductor surface could make contact with the charge roller. An image was written at a resolution of 1,200 dpi using a semiconductor laser having a wavelength of 780 nm as the image exposing light source (four-channel LDs in which four LDs are arranged in an array (1×4)—a semiconductor laser having a structure as described in Japanese Patent (JP-B) No. 3227226, although the arrangement differs from that of the semiconductor laser described therein, and an image is written by the use of a polygon mirror), the image was developed by two-component developing process using a black toner having an average particle diameter of 6.8 μm. The developed image was transferred onto a transfer sheet using a primary transfer belt and a secondary transfer belt as transfer members, the photoconductor surface was cleaned by blade cleaning method and a charge remaining on the photoconductor surface was eliminated using an LED having a wavelength of 660 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

Another photoconductor 10b which was different from the above-noted photoconductor 10b was mounted (in an image forming section S2) in the image forming apparatus. For the charging member, a charge roller was closely situated in a distance of 50 μm from the photoconductor surface, and the photoconductor was charged. The surface of the charge roller was wound round with a gap-forming tape having a thickness of 50 μm such that only in image-non-formed surface areas at both ends of the photoconductor, the photoconductor surface could make contact with the charge roller. An image was written at a resolution of 1,200 dpi using a semiconductor laser having a wavelength of 780 nm as the image exposing light source (four-channel LDs in which four LDs are arranged in an array (1×4)—a semiconductor laser having a structure as described in Japanese Patent (JP-B) No. 3227226, although the arrangement differs from that of the semiconductor laser described therein, and an image is written by the use of a polygon mirror), the image was developed by two-component developing process using a color toner having an average particle diameter of 6.8 μm. The developed image was transferred onto a transfer sheet using a primary transfer belt and a secondary transfer belt as transfer members, the photoconductor surface was cleaned by blade cleaning method and a charge remaining on the photoconductor surface was eliminated using an LED having a wavelength of 660 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

The process conditions were set so that the following conditions could be obtained at the initial operation.

Charge potential of photoconductor (potential of unexposed region): −800 V

Developing bias: −550V (negative/positive developing bias)

Surface potential of exposed region: −70 V (potential at solid part of image)

<Evaluation Items (Monochrome)>

Photoconductor 10b was mounted to the image forming section S1, and the following evaluations were carried out.

(1) Measurement of Surface Potential

The potential at an exposed region in the prepared photoconductor was measured by the following method. Specifically, a surface potential meter was mounted to a developed portion as shown in FIG. 17 and the photoconductor was negatively charged to −800 V. Thereafter, a solid part of image was written with the semiconductor laser, and the potential of the exposed region in the image-developed portion was measured. Table B-6-1 shows the result.

(2) Evaluation of Background Smear

A blank image print was output using the image forming apparatus to evaluate background smear under the conditions of 22° C. and a relative humidity of 50%. The level of background smear was evaluated based on the number of black points and the size of the black points occurred in the background of the output print. The state of background smear was ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-6-1 shows the evaluation results.

(3) Evaluation of Dot Reproductivity

Using the image forming apparatus, an isolated one-dot image was output to evaluate the dot reproductivity. The one-dot image print was observed by an optical microscope, and the definitude of the dot outline was ranked according to the following four grades. A photoconductor provided extremely favorable dot reproductivity was ranked A, a photoconductor provided favorable dot reproductivity was ranked B, a photoconductor provided slightly poor dot reproductivity was ranked C and a photoconductor provided extremely poor dot reproductivity was ranked D. Table B-6-1 shows the evaluation results.

After the evaluations (1) to (3) were carried out, 10,000 sheets of a chart with an image area of 6% (characters having an image area ratio equivalent to 6% to the entire area of the A4 sheet were averagely written) were printed out in succession under the above-noted process conditions. After outputting 10,000 sheets in succession, the evaluations (1) to (3) were carried out again.

<Evaluation Items (Full Color)>

Other photoconductors 10b which were different from the above-noted photoconductors 10b for evaluation in the image forming section S1 were respectively mounted in the image forming section S1 and an image forming section S2, and the following evaluations were carried out.

(4) Measurement of Surface Potential

The potential at an exposed region in the prepared photoconductor was measured by the following method. Specifically, a surface potential meter was mounted to a developed portion in the image forming section S2 as shown in FIG. 17 and the photoconductor was negatively charged to −800 V. Thereafter, a solid part of image was written with the semiconductor laser, and the potential of the exposed region in the image-developed portion was measured. Table B-6-2 shows the result.

(5) Evaluation of Image Density

After negatively charging each of the photoconductors to −800 V, 10,000 sheets in total of the image were printed out in succession using the image forming apparatus. An image printed out in the initial stage and an image printed out after outputting the 10,000 sheets were evaluated. The level of image density was ranked according to the following four grades. A photoconductor provided extremely favorable image density was ranked A, a photoconductor provided favorable image density was ranked B, a photoconductor provided slightly poor image density was ranked C and a photoconductor provided extremely poor image density was ranked D.

Table B-6-2 shows the evaluation results.

(6) Evaluation of Residual Image

An A4 size chart as shown in FIG. 20 (hatched image in the ⅖ (two fifth) part in the first part and a halftone image in the ⅗ (third fifth) part in the last part) was used, and the image was output in a mono-color mode (in black only). The level of a negative residual image in the halftone part (the hatched part is sometimes thickly output in the halftone part) was evaluated and ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-6-2 shows the evaluation results.

After the evaluations (4) to (6) were carried out, 10,000 sheets of a full-color chart with an image area of 6% (oblique lines having an image area ratio equivalent to 6% to the entire area of the A4 sheet were averagely written) were printed out in succession under the above-noted process conditions. After outputting 10,000 sheets in succession, the evaluations (4) to (6) were carried out again.

Examples B-13 to B-16 and Comparative Examples B-7 to B-9

Photoconductors 11b to 17b prepared as above under the same conditions as used in Example B-12 were evaluated. Tables B-6-1 and B-6-2 show the evaluation results. Tables B-6-1 and B-6-2 also show the electrophotographic photoconductor numbers used in Examples B-13 to B-16 and Comparative Examples B-7 to B-9. Note that in the image forming apparatus in which the photoconductor 16b was mounted, the resolution was set to 600 dpi.

TABLE B-6-1

| | | In initial stage | | | After printing 10,000 sheets | | |
|---|---|---|---|---|---|---|---|
| | Photoconductor No. | Surface potential (−V) | Background smear | Dot reproductivity | Surface potential (−V) | Background smear | Dot reproductivity |
| Ex. B-12 | 10b | 115 | B | A | 120 | B to C | A |
| Ex. B-13 | 11b | 120 | B to A | A | 125 | B | B |
| Compara. Ex. B-7 | 12b | 130 | C | C | 150 | C | C |
| Ex. B-14 | 13b | 115 | B to A | A | 120 | B to A | B to A |
| Compara. Ex. B-8 | 14b | 135 | C | C | 165 | C | C |
| Ex. B-15 | 15b | 120 | B to A | A | 125 | B to A | B to A |
| Compara. Ex. B-9 | 16b | 140 | C | C | 180 | C | C to D |
| Ex. B-16 | 17b | 115 | A | A | 120 | A | B to A |

TABLE B-6-2

| | Photoconductor No. | In initial stage: Surface potential (−V) | Image density | Residual image | After printing 10,000 sheets: Surface potential (−V) | Image density | Residual image |
|---|---|---|---|---|---|---|---|
| Ex. B-12 | 10b | 115 | A | A | 120 | B to A | A |
| Ex. B-13 | 11b | 120 | A | A | 125 | B | B |
| Compara. Ex. B-7 | 12b | 130 | C | C | 150 | C | C |
| Ex. B-14 | 13b | 115 | A | A | 120 | B to A | B to A |
| Compara. Ex. B-8 | 14b | 135 | C | C | 165 | C to D | C to D |
| Ex. B-15 | 15b | 120 | A | A | 125 | B to A | B to A |
| Compara. Ex. B-9 | 16b | 140 | C | C | 180 | C to D | C to D |
| Ex. B-16 | 17b | 115 | A | A | 120 | B | B |

The results shown in Table B-6-1 verified that when the transit time length was shorter than the exposing-to-developing time length (Examples B-12 to B-16), the light decay property was favorably exhibited in the initial stage of the use of the photoconductors and even after repetitive use of the photoconductors. In contrast, when the transit time length was longer than the exposing-to-developing time length (Comparative Examples B-7 to B-9), a rise in surface potential was observed, and after repetitive use of the photoconductors, the phenomenon was conspicuous.

It was also found that the transit time length was shorter than the exposing-to-developing time length (Examples B-12 to B-16), the dot reproductivity was excellent, and even after repetitive use of the photoconductors, images having excellent dot image quality were formed. In contrast, it was found that when the transit time length was longer than the exposing-to-developing time length (Comparative Examples B-7 to B-9), the dot reproductivity was degraded after the repetitive use of the photoconductors.

Further, from the evaluation results using a blank image, the evaluation rank of background smear could be elevated and the improvement effect could be kept up even after repetitive use by making an intermediate layer have a multi-layered structure composed of a charge blocking layer and a moire prevention layer (Example B-16).

Further, the results shown in Table B-6-2 verified that when the transit time length was shorter than the exposing-to-developing time length (Examples B-12 to B-16), the light decay property was favorably exhibited in the initial stage of the use of the photoconductors and even after repetitive use of the photoconductors. In contrast, when the transit time length was longer than the exposing-to-developing time length (Comparative Examples B-7 to B-9), a rise in surface potential was observed, and after repetitive use of the photoconductors, the phenomenon was conspicuous.

It was also found that the transit time length was shorter than the exposing-to-developing time length (Examples B-12 to B-16), the image density was high, and even after repetitive use of the photoconductors, excellent full-color images could be formed. In contrast, it was found that when the transit time length was longer than the exposing-to-developing time length (Comparative Examples B-7 to B-9), the image density was lowered after the repetitive use of the photoconductors.

Further, when the transit time length was shorter than the exposing-to-developing time length (Examples B-12 to B-16), a favorable residual image level was obtained, and even after repetitive use of the photoconductors, excellent full-color images could be formed. In contrast, when the transit time length was longer than the exposing-to-developing time length (Comparative Examples B-7 to B-9), the residual image level was degraded after repetitive use of the photoconductors.

Example B-17

The thus prepared photoconductor 10b was attached to a process cartridge and the process cartridge was placed (in an image forming section S1) in an image forming apparatus as shown in FIG. 17. For the charging member, a charge roller was closely situated in a distance of 50 μm from the photoconductor surface, and the photoconductor was charged. The surface of the charge roller was wound round with a gap-forming tape having a thickness of 50 μm such that only in image-non-formed surface areas at both ends of the photoconductor, the photoconductor surface could make contact with the charge roller. An image was written at a resolution of 2,400 dpi using a light source according to the surface-emitting laser array described in Japanese Patent Application Laid-Open (JP-A) No. 2004-287085 (light emitting points are dimensionally arrayed in 8×4; the number of laser beams: 32, wavelength: 780 nm) as an image exposure light source. The image was developed by two-component developing process using a black toner having an average particle diameter of 6.2 μm. The developed image was transferred onto a transfer sheet using a transfer belt as a transfer member, the photoconductor surface was cleaned by blade cleaning method and a charge remaining on the photoconductor surface was eliminated using an LED having a wavelength of 655 nm as the charge elimination light source and a charge remaining on the photoconductor surface was eliminated using an LED having a wavelength of 660 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

Another photoconductor 10b which was different from the above-noted photoconductor 10b was mounted (in an image forming section S2) in the image forming apparatus. For the charging member, a charge roller was closely situated in a distance of 50 μm from the photoconductor surface, and the photoconductor was charged. The surface of the charge roller was wound round with a gap-forming tape having a thickness of 50 μm such that only in image-non-formed surface areas at both ends of the photoconductor, the photoconductor surface could make contact with the charge roller. An image was written at a resolution of 2,400 dpi using a light source according to the surface-emitting laser array described in Japanese Patent Application Laid-Open (JP-A) No. 2004-287085 (light emitting points are dimensionally arrayed in 8×4; the number of laser beams: 32, wavelength: 780 nm) as an image exposure light source. The image was developed by two-component developing process using a color toner having an average particle diameter of 6.2 μm . The developed image was transferred onto a transfer sheet using a transfer belt as a transfer member, the photoconductor surface was cleaned by blade cleaning method and a charge remaining on the photoconductor surface was eliminated using an LED having a wavelength of 655 nm as the charge elimination light source and a charge remaining on the photoconductor surface was eliminated using an LED having a wavelength of 660 nm as the charge elimination light source.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

The process conditions were set so that the following conditions could be obtained at the initial operation.

Charge potential of photoconductor (potential of unexposed region): −800 V

Developing bias: −550V (negative/positive developing bias)

Surface potential of exposed region: −80 V (potential at solid part of image)

<Evaluation Items (Monochrome)>

Photoconductor 10b was attached to a process cartridge and the process cartridge was mounted to the image forming section S1, and the following evaluations were carried out.

(1) Measurement of Surface Potential

The potential at an exposed region in the prepared photoconductor was measured by the following method. Specifically, a surface potential meter was mounted to a developed portion in the image forming section S1 as shown in FIG. 17 and the photoconductor was negatively charged to −800 V. Thereafter, a solid part of image was written with the semiconductor laser, and the potential of the exposed region in the image-developed portion was measured. Table B-7-1 shows the result.

(2) Evaluation of Background Smear

A blank image print was output using the image forming apparatus to evaluate background smear under the conditions of 22° C. and a relative humidity of 50%. The level of background smear was evaluated based on the number of black points and the size of the black points occurred in the background of the output print. The state of background smear was ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-7-1 shows the evaluation results.

(3) Evaluation of Dot Reproductivity

Using the image forming apparatus, an isolated one-dot image was output to evaluate the dot reproductivity. The one-dot image print was observed by an optical microscope, and the definitude of the dot outline was ranked according to the following four grades. A photoconductor provided extremely favorable dot reproductivity was ranked A, a photoconductor provided favorable dot reproductivity was ranked B, a photoconductor provided slightly poor dot reproductivity was ranked C and a photoconductor provided extremely poor dot reproductivity was ranked D. Table B-7-1 shows the evaluation results.

After the evaluations (1) to (3) were carried out, 10,000 sheets of a chart with an image area of 6% (characters having an image area ratio equivalent to 6% to the entire area of the A4 sheet were averagely written) were printed out in succession under the above-noted process conditions. After outputting 10,000 sheets in succession, the evaluations (1) to (3) were carried out again.

<Evaluation Items (Full Color)>

Other photoconductors 10b which were different from the above-noted photoconductors 10b for evaluation in the image forming section S1 were respectively mounted in the image forming section S1 and an image forming section S2, and the following evaluations were carried out.

(4) Measurement of Surface Potential

The potential at an exposed region in the prepared photoconductor was measured by the following method. Specifically, a surface potential meter was mounted to a developed portion in the image forming section S2 as shown in FIG. 17 and the photoconductor was negatively charged to −800 V. Thereafter, a solid part of image was written with the semiconductor laser, and the potential of the exposed region in the image-developed portion was measured. Table B-7-2 shows the result.

(5) Evaluation of Color Reproductivity

Using the image forming apparatus, 10,000 sheets of an ISO/JIS-SCID image N1 (portrait) were output, and the color reproductivity of the image print was visually checked and evaluated. The level of color reproductivity was ranked according to the following four grades. A photoconductor provided extremely favorable color reproductivity was ranked A, a photoconductor provided favorable color reproductivity was ranked B, a photoconductor provided slightly poor color reproductivity was ranked C and a photoconductor provided extremely poor color reproductivity was ranked D. Table B-7-2 shows the evaluation results.

(6) Evaluation of Residual Image

An A4 size chart as shown in FIG. 20 (hatched image in the ⅖ (two fifth) part in the first part and a halftone image in the ⅗ (third fifth) part in the last part) was used, and the image was output in a mono-color mode. The level of a negative residual image in the halftone part (the hatched part is sometimes thickly output in the halftone part) was evaluated and ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-7-2 shows the evaluation results.

After the evaluations (4) to (6) were carried out, 10,000 sheets of a full-color chart with an image area of 6% (oblique lines having an image area ratio equivalent to 6% to the entire area of the A4 sheet were averagely written) were printed out in succession under the above-noted process conditions. After outputting 10,000 sheets in succession, the evaluations (4) to (6) were carried out again.

Examples B-18 to B-21 and Comparative Examples B-10 to B-12

Photoconductors 11b to 17b prepared as above under the same conditions as used in Example B-17 were evaluated. Tables B-7-1 and B-7-2 show the evaluation results. Tables B7-1 and B-7-2 also show the electrophotographic photoconductor numbers used in Examples B-18 to B-21 and Comparative Examples B-10 to B-12. Note that in the image forming apparatus in which the photoconductor 16b was mounted, the resolution was set to 600 dpi.

TABLE B-7-1

| | | In initial stage | | | After printing 10,000 sheets | | |
|---|---|---|---|---|---|---|---|
| | Photoconductor No. | Surface potential (−V) | Background smear | Dot reproductivity | Surface potential (−V) | Background smear | Dot reproductivity |
| Ex. B-17 | 10b | 145 | B | A | 150 | B to C | A |
| Ex. B-18 | 11b | 150 | B to A | A | 155 | B | B |
| Compara. Ex. B-10 | 12b | 160 | C | C | 180 | C | C |
| Ex. B-19 | 13b | 145 | B to A | A | 150 | B to A | B to A |
| Compara. Ex. B-11 | 14b | 165 | C | C | 195 | C | C |
| Ex. B-20 | 15b | 150 | B to A | A | 155 | B to A | B to A |
| Compara. Ex. B-12 | 16b | 170 | C | C | 210 | C | C to D |
| Ex. B-21 | 17b | 145 | A | A | 150 | A | B to A |

TABLE B-7-2

| | | In initial stage | | | After printing 10,000 sheets | | |
|---|---|---|---|---|---|---|---|
| | Photoconductor No. | Surface potential (−V) | Color reproductivity | Residual image | Surface potential (−V) | Color reproductivity | Residual image |
| Ex. B-17 | 10b | 145 | A | A | 150 | B to A | A |
| Ex. B-18 | 11b | 150 | A | A | 155 | B | B |
| Compara. Ex. B-10 | 12b | 160 | C | C | 180 | C | C |
| Ex. B-19 | 13b | 145 | A | A | 150 | B to A | B to A |
| Compara. Ex. B-11 | 14b | 165 | C | C | 195 | C to D | C to D |
| Ex. B-20 | 15b | 150 | A | A | 155 | B to A | B to A |
| Compara. Ex. B-12 | 16b | 170 | C | C | 210 | C to D | C to D |
| Ex. B-21 | 17b | 145 | A | A | 150 | B | B |

The results shown in Table B7-1 verified that when the transit time length was shorter than the exposing-to-developing time length (Examples B-17 to B-21), the light decay property was favorably exhibited in the initial stage of the use of the photoconductors and even after repetitive use of the photoconductors. In contrast, when the transit time length was longer than the exposing-to-developing time length (Comparative Examples B-10 to B-12), a rise in surface potential was observed, and after repetitive use of the photoconductors, the phenomenon was conspicuous.

It was also found that the transit time length was shorter than the exposing-to-developing time length (Examples B-17 to B-21), the dot reproductivity was excellent, and even after repetitive use of the photoconductors, images having excellent dot image quality were formed. In contrast, it was found that when the transit time length was longer than the exposing-to-developing time length (Comparative Examples B-10 to B-12), the dot reproductivity was degraded after the repetitive use of the photoconductors.

Further, from the evaluation results using a blank image, the evaluation rank of background smear could be elevated and the improvement effect could be kept up even after repetitive use by making an intermediate layer have a multi-layered structure composed of a charge blocking layer and a moire prevention layer Example B-21

Further, the results shown in Table B-7-2 verified that when the transit time length was shorter than the exposing-to-developing time length (Examples B-17 to B-21), the light decay property was favorably exhibited in the initial stage of the use of the photoconductors and even after repetitive use of the photoconductors. In contrast, when the transit time length was longer than the exposing-to-developing time length (Comparative Examples B-10 to B-12), a rise in surface potential was observed, and after repetitive use of the photoconductors, the phenomenon was conspicuous.

It was also found that the transit time length was shorter than the exposing-to-developing time length (Examples B-17 to B-21), the color reproductivity was excellent, and even after repetitive use of the photoconductors, excellent full-color images could be formed. In contrast, it was found that when the transit time length was longer than the exposing-to-developing time length (Comparative Examples B-10 to B-12), the color reproductivity was degraded after the repetitive use of the photoconductors.

Further, when the transit time length was shorter than the exposing-to-developing time length (Examples B-17 to B-21), a favorable residual image level was obtained, and even after repetitive use of the photoconductors, excellent full-color images could be formed. In contrast, when the transit time length was longer than the exposing-to-developing time length (Comparative Examples B-10 to B-12), the residual image level was degraded after repetitive use of the photoconductors.

Example B-22

Other photoconductor 1b which were different from the photoconductor 1b prepared as above were respectively mounted (in a black image forming section and a color image forming section) in a two-drum image forming apparatus as shown in FIG. 16.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

Still another photoconductor 1b which was different from the above-noted photoconductors 1b was mounted (in the color image forming section) in the same image forming apparatus.

The image exposure light source was placed such that an angle formed with a straight line drawn from the irradiating part (the center in which an image was written on the photoconductor) of the image exposure light source to the core of the photoconductor and another straight line drawn from the core of the developing sleeve to the core of the photoconductor was 45°. The photoconductor was activated at a linear velocity of 480 mm/sec, and thus the exposing-to-developing time length was 49 ms.

<Evaluation Items (Monochrome)>

Photoconductor 1b was mounted to the black image forming section, and the following evaluations were carried out.

(1) Measurement of Surface Potential

The potential at an exposed region in the prepared photoconductor was measured by the following method. Specifically, a surface potential meter was mounted to a developed portion in the black image forming section as shown in FIG. 16 and the photoconductor was negatively charged to −800 V. Thereafter, a solid part of image was written with the semiconductor laser, and the potential of the exposed region in the image-developed portion was measured. Table B-8-1 shows the result.

(2) Evaluation of Background Smear

A blank image print was output using the image forming apparatus to evaluate background smear under the conditions of 22° C. and a relative humidity of 50%. The level of background smear was evaluated based on the number of black points and the size of the black points occurred in the background of the output print. The state of background smear was ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-8-1 shows the evaluation results.

(3) Evaluation of Dot Reproductivity

Using the image forming apparatus, an isolated one-dot image was output to evaluate the dot reproductivity. The one-dot image print was observed by an optical microscope, and the definitude of the dot outline was ranked according to the following four grades. A photoconductor provided extremely favorable dot reproductivity was ranked A, a photoconductor provided favorable dot reproductivity was ranked B, a photoconductor provided slightly poor dot reproductivity was ranked C and a photoconductor provided extremely poor dot reproductivity was ranked D. Table B-8-1 shows the evaluation results.

After the evaluations (1) to (3) were carried out, 10,000 sheets of a chart with an image area of 6% (characters having an image area ratio equivalent to 6% to the entire area of the A4 sheet were averagely written) were printed out in succession under the above-noted process conditions. After outputting 10,000 sheets in succession, the evaluations (1) to (3) were carried out again.

<Evaluation Items (Full Color)>

Other photoconductors 1b which were different from the above-noted photoconductor 1b for evaluation in the black image forming section were respectively mounted in the black image forming section and the color image forming section, and the following evaluations were carried out.

(4) Measurement of Surface Potential

The potential at an exposed region in the prepared photoconductor was measured by the following method. Specifically, a surface potential meter was mounted to a developed portion in a color image forming section as shown in FIG. 16 and the photoconductor was negatively charged to −800 V. Thereafter, a solid part of image was written with the semiconductor laser, and the potential of the exposed region in the image-developed portion was measured. Table B-8-2 shows the result.

(5) Evaluation of Image Density

After negatively charging each of the photoconductors to −800 V, 10,000 sheets in total of the image were printed out in succession using the image forming apparatus. An image printed out in the initial stage and an image printed out after outputting the 10,000 sheets were evaluated. The level of image density was ranked according to the following four grades. A photoconductor provided extremely favorable image density was ranked A, a photoconductor provided favorable image density was ranked B, a photoconductor provided slightly poor image density was ranked C and a photoconductor provided extremely poor image density was ranked D. Table B-8-2 shows the evaluation results.

(6) Evaluation of Residual Image

An A4 size chart as shown in FIG. 20 (hatched image in the ⅖ (two fifth) part in the first part and a halftone image in the ⅗ (third fifth) part in the last part) was used, and the image was output in a mono-color mode (in black only). The level of a negative residual image in the halftone part (the hatched part is sometimes thickly output in the halftone part) was evaluated and ranked according to the following four grades. A photoconductor provided an extremely favorable result was ranked A, a photoconductor provided a favorable result was ranked B, a photoconductor provided a slightly poor result was ranked C and a photoconductor provided an extremely poor result was ranked D. Table B-8-2 shows the evaluation results.

After the evaluations (4) to (6) were carried out, 10,000 sheets of a full-color chart with an image area of 6% (oblique lines having an image area ratio equivalent to 6% to the entire area of the A4 sheet were averagely written) were printed out in succession under the above-noted process conditions. After outputting 10,000 sheets in succession, the evaluations (4) to (6) were carried out again.

Examples B-23 to B-24 and Comparative Examples B-13 to B-15

Photoconductors 2b, 3b, 9b, 10b and 11b prepared as above under the same conditions as used in Example B-22 were evaluated. Tables B-8-1 and B-8-2 show the evaluation results. Tables B-8-1 and B-8-2 also show the electrophotographic photoconductor numbers used in Examples B-23 to B-24 and Comparative Examples B-13 to B-15. Note that in the image forming apparatus in which the photoconductor 8b was mounted, the resolution was set to 600 dpi.

It was also found that the transit time length was shorter than the exposing-to-developing time length (Examples B-22 to B-24), the dot reproductivity was excellent, and even after repetitive use of the photoconductors, images having excellent dot image quality were formed. In contrast, it was found that when the transit time length was longer than the exposing-to-developing time length (Comparative Examples B-13 to B-15), the dot reproductivity was degraded after the repetitive use of the photoconductors.

Furthermore, in a comparison between Example B-22 and Example B-23, the surface potential at the exposed region in the photoconductor 1b used in B-22 was lower than that of the photoconductor 9b used in Example B-23. This shows that the asymmetrical azo pigment used in the photoconductor 1b contributed to the high-photosensitivity.

The results shown in Table B-8-2 verified that when the transit time length was shorter than the exposing-to-developing time length (Examples B-22 to B-24), the light decay property was favorably exhibited in the initial stage of the use of the photoconductors and even after repetitive use of the photoconductors. In contrast, when the transit time length

TABLE B-8-1

| | | In initial stage | | | After printing 10,000 sheets | | |
|---|---|---|---|---|---|---|---|
| | Photoconductor No. | Surface potential (−V) | Background smear | Dot reproductivity | Surface potential (−V) | Background smear | Dot reproductivity |
| Ex. B-22 | 1b | 70 | B | A | 75 | B to A | A |
| Compara. Ex. B-13 | 2b | 80 | C | C | 95 | C | C |
| Compara. Ex. B-14 | 3b | 95 | C | C | 120 | C | C to D |
| Ex. B-23 | 9b | 85 | B to A | A | 90 | B | A |
| Ex. B-24 | 10b | 65 | B | A | 70 | B to C | A |
| Compara. Ex. B-15 | 11b | 80 | C | C | 95 | C | C |

TABLE B-8-2

| | | In initial stage | | | After printing 10,000 sheets | | |
|---|---|---|---|---|---|---|---|
| | Photoconductor No. | Surface potential (−V) | Image density | Residual image | Surface potential (−V) | Image density | Residual image |
| Ex. B-22 | 1b | 70 | A | A | 75 | B to A | A |
| Compara. Ex. B-13 | 2b | 80 | C | C | 100 | C | C |
| Compara. Ex. B-14 | 3b | 90 | C | C | 115 | C to D | C to D |
| Ex. B-23 | 9b | 85 | A | A | 95 | B | B |
| Ex. B-24 | 10b | 65 | A | A | 70 | B to A | A |
| Compara. Ex. B-15 | 11b | 80 | C | C | 100 | C | C |

The results shown in Table B-8-1 verified that when the transit time length was shorter than the exposing-to-developing time length (Examples B-22 to B-24), the light decay property was favorably exhibited in the initial stage of the use of the photoconductors and even after repetitive use of the photoconductors. In contrast, when the transit time length was longer than the exposing-to-developing time length (Comparative Examples B-13 to B-15), a rise in surface potential was observed, and after repetitive use of the photoconductors, the phenomenon was conspicuous.

was longer than the exposing-to-developing time length (Comparative Examples B-13 to B-15), a rise in surface potential was observed, and after repetitive use of the photoconductors, the phenomenon was conspicuous.

It was also found that the transit time length was shorter than the exposing-to-developing time length (Examples B-22 to B-24), the image density was high, and even after repetitive use of the photoconductors, excellent full-color images could be formed. In contrast, it was found that when the transit time length was longer than the exposing-to-developing time length (Comparative Examples B-13 to B-15), the image density was lowered after the repetitive use of the photoconductors.

Further, when the transit time length was shorter than the exposing-to-developing time length (Examples B-22 to B-24), a favorable residual image level was obtained, and even after repetitive use of the photoconductors, excellent full-color images could be formed. In contrast, when the transit time length was longer than the exposing-to-developing time length (Comparative Examples B-13 to B-15), the residual image level was degraded after repetitive use of the photoconductors.

What is claimed is:

1. An image forming apparatus, comprising:

a photoconductor, a charging unit configured to charge the photoconductor to a desired potential, a writing unit configured to form a latent electrostatic image by exposing the surface of the photoconductor with a resolution of 1,200 dpi or more, a toner image forming unit configured to form a toner image by developing the latent electrostatic image using a toner, the toner image forming unit having a plurality of developing devices being placed so as to face the photoconductor and housing a plurality of color developers for each color, a transfer unit configured to transfer the toner image formed on the photoconductor onto a transfer material, and a fixing unit configured to fix the transferred toner image on the transfer material, wherein the time spent by an arbitrary point on the photoconductor in moving from a position in which to face the writing unit to a position in which to face the developing unit is shorter than 50 ms and longer than the transit time of the photoconductor.

2. An image forming apparatus, comprising:

a photoconductor, a plurality of charging units configured to charge the photoconductor to a desired potential, a plurality of writing units configured to form a latent electrostatic image by exposing the surface of the photoconductor with a resolution of 1,200 dpi or more, a toner image forming unit configured to form a toner image by developing the latent electrostatic image using a toner, the toner image forming unit comprising a plurality of developing devices being placed so as to face the photoconductor and housing a plurality of color developers for each color, a transfer unit configured to transfer the toner image formed on the photoconductor onto a transfer material, and a fixing unit configured to fix the transferred toner image on the transfer material, wherein the time spent by arbitrary points on the photoconductor in moving from respective positions in which to face the plurality of writing units to respective positions in which to face the corresponding plurality of developing units is shorter than 50 ms and longer than the transit time of the photoconductor.

3. The image forming apparatus according to claim 1, wherein a multi-beam exposing system is employed in which the writing unit is configured to form the latent electrostatic image by simultaneously exposing a plurality of exposed regions using a plurality of beam bundles.

4. The image forming apparatus according to claim 3, wherein a light source employed in the multi-beam exposing system is composed of three or more surface-emitting laser arrays.

5. The image forming apparatus according to claim 4, wherein the light source employed in the multi-beam exposing system is composed of three or more surface-emitting laser arrays, and surface-emitting lasers are disposed in a two-dimensional manner.

6. The image forming apparatus according to claim 1, wherein the photoconductor has a photosensitive layer containing an azo pigment represented by the following Structural Formula (1), Structural Formula (1)

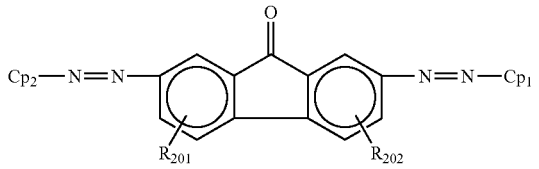

where $Cp_1$ and $Cp_2$ respectively denote a coupler residue; $R_{201}$ and $R_{202}$ respectively denote any one of a hydrogen atom, a halogen atom, an alkyl group, an alkoxy group and a cyano group, and $R_{201}$ and $R_{202}$ may be the same or different from each other; $Cp_1$ and $Cp_2$ are respectively represented by the following Structural Formula (2), Structural Formula (2)

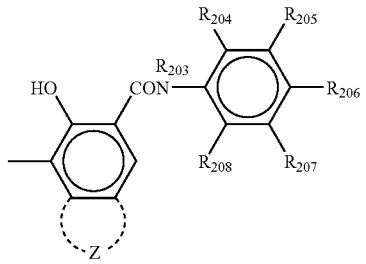

where $R_{203}$ denotes any one of a hydrogen atom, an alkyl group and an aryl group; $R_{204}$, $R_{205}$, $R_{206}$, $R_{207}$ and $R_{208}$ respectively denote any one of a hydrogen atom, a nitro group, a cyano group, a halogen atom, an alkyl halide group, an alkyl group, an alkoxy group, a dialkylamino group and a hydroxyl group; and Z denotes an atom group necessary to form a carbocyclic aromatic group that may have a substituent group or a heterocyclic aromatic group that may have a substituent group.

7. The image forming apparatus according to claim 6, wherein $Cp_1$ and $Cp_2$ in the azo pigment are different from each other.

8. The image forming apparatus according to claim 1, wherein the photoconductor has a photosensitive layer containing a titanylphthalocyanine crystal that has a maximum diffraction peak of at least 27.2° of Bragg angle (2θ±0.2°), has major peaks at 9.4°, 9.6° and 24.0°, has a minimum-angle diffraction peak at 7.3°, does not have a diffraction peak between the peaks at 7.3° and 9.4°, and does not have a diffraction peak at 26.3°, in an X-ray diffraction spectrum using a CuKα X-ray (1.542 Å).

9. The image forming apparatus according to claim 1, wherein the photoconductor has a protective layer on the photosensitive layer.

10. The image forming apparatus according to claim 9, wherein the protective layer comprises at least any one of an inorganic pigment and a metal oxide having a specific resistance of $10^{10}\Omega\cdot$cm or more.

11. The image forming apparatus according to claim 9, wherein the protective layer is formed by hardening at least a trifunctional or more radical polymerizable monomer having no charge transporting structure and a monofunctional radical polymerizable compound having a charge transporting structure.

12. The image forming apparatus according to claim 1, provided with a process cartridge which is detachably mountable to the image forming apparatus main body, wherein the process cartridge comprises the photoconductor and one or more units selected from the charging unit, the writing unit, the developing unit, the transfer unit, a cleaning unit and a charge-eliminating unit, and the photoconductor and the one or more units are integrated into one unit.

13. An image forming apparatus, comprising:

a color image forming section configured to form a color toner image on a first photoconductor by a plurality of color image developing units and transfer the color toner image onto a recording material in a first transfer portion, a black image forming section configured to form a black toner image on a second photoconductor by a black image developing unit and transfer the black toner image onto the recording material in a second transfer portion, and a fixing unit configured to fix the transferred color toner image and the transferred black toner image on the recording material, wherein the color image forming section comprises the first photoconductor, a first writing unit having a resolution of 1,200 dpi or more and the plurality of color image developing units, the black image forming section comprises the second photoconductor, a second writing unit having a resolution of 1,200 dpi or more and the black image developing unit, and the time spent by arbitrary points on the first and second photoconductors in moving from respective positions in which to face the corresponding writing units to respective positions in which to face the corresponding developing units is shorter than 50 ms and longer than the transit time of the first and second photoconductors, respectively.

* * * * *